US012285065B2

(12) United States Patent
Weitz et al.

(10) Patent No.: US 12,285,065 B2
(45) Date of Patent: Apr. 29, 2025

(54) HIGH TENSILE STRENGTH FABRIC SEAMS, WELDABLE FABRIC TABS AND THE PREPARATION OF REDUCED WEIGHT INFLATABLES

(71) Applicant: Kennon Products, Inc., Sheridan, WY (US)

(72) Inventors: Mark Weitz, Sheridan, WY (US); Justin Wood, Sheridan, WY (US); Zachary Grey, Sheridan, WY (US); Brock Sweckard, Sheridan, WY (US); Thomas Bushnell, Sheridan, WY (US); Dakotah Gali, Sheridan, WY (US)

(73) Assignee: Kennon Products, Inc., Sheridan, WY (US)

( * ) Notice: Subject to any disclaimer, the term of this patent is extended or adjusted under 35 U.S.C. 154(b) by 226 days.

(21) Appl. No.: 17/926,884

(22) PCT Filed: May 26, 2021

(86) PCT No.: PCT/US2021/034263

§ 371 (c)(1),
(2) Date: Dec. 5, 2022

(87) PCT Pub. No.: WO2022/039814

PCT Pub. Date: Feb. 24, 2022

(65) Prior Publication Data

US 2023/0248096 A1 Aug. 10, 2023

Related U.S. Application Data

(60) Provisional application No. 63/030,036, filed on May 26, 2020.

(51) Int. Cl.
*A41D 27/24* (2006.01)

(52) U.S. Cl.
CPC ..... *A41D 27/245* (2013.01); *Y10T 428/197* (2015.01)

(58) Field of Classification Search
None
See application file for complete search history.

(56) References Cited

U.S. PATENT DOCUMENTS 6,893,704 B1 5/2005 van der Loo
7,993,715 B2 8/2011 Geva et al.
(Continued)

FOREIGN PATENT DOCUMENTS

EP 0708163 A2 * 4/1996

OTHER PUBLICATIONS

Portanova, M. A., "Standard Methods for Unnotched Tension Testing of Textile Coupons," *NASA Contractor Report 198264* (1995) (electronic reference).

(Continued)

*Primary Examiner* — Alexander S Thomas
(74) *Attorney, Agent, or Firm* — Arnold & Porter Kaye Scholer LLP

(57) ABSTRACT

The present disclosure provides high tensile strength FCL seams, as well as methods for forming high tensile strength FCL seams by laser welding. The present disclosure also provides weldable FCL tabs for the reinforcement of both linear and curved sections of seams, as well as methods for reinforcing linear and curved sections of seams with weldable FCL tabs.

19 Claims, 56 Drawing Sheets

(56) References Cited

U.S. PATENT DOCUMENTS

| | | | |
|---|---|---|---|
| 8,158,228 | B2 | 4/2012 | Wienke et al. |
| 9,702,664 | B2 | 7/2017 | Marissen et al. |
| 10,137,638 | B2 | 11/2018 | Erickson et al. |
| 2006/0113027 | A1 | 6/2006 | Hethcock et al. |
| 2013/0220195 | A1 | 8/2013 | Sjostedt |
| 2016/0031164 | A1 | 2/2016 | Downs et al. |
| 2017/0067204 | A1 | 3/2017 | Duggal et al. |
| 2017/0082406 | A1 | 3/2017 | Marissen et al. |
| 2018/0022060 | A1 | 1/2018 | Downs et al. |

OTHER PUBLICATIONS

Hilton et al., "Laser Welding of Fabrics Using Infrared Absorbing Dyes," presented at the International Conference on Joining of Advanced and Specialty Materials III, ASM 2000, Oct. 9-12, 2000, St. Louis, MO (electronic reference).

International Search Report dated Apr. 4, 2022 issued in Int'l Appln. PCT/US2021/034263.

* cited by examiner

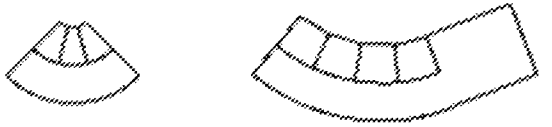
Fig. 13A
Fig. 13B
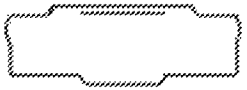
Fig. 13C
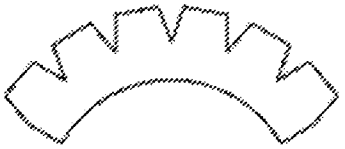
Fig. 13D
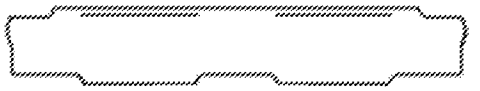
Fig. 13E
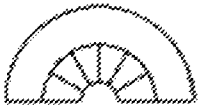
Fig. 13F
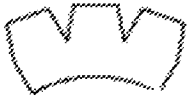
Fig. 13G

HIGH TENSILE STRENGTH FABRIC SEAMS, WELDABLE FABRIC TABS AND THE PREPARATION OF REDUCED WEIGHT INFLATABLES

CROSS REFERENCE TO RELATED APPLICATION

This application is a U.S. national phase application under 35 U.S.C. § 371 of International Application No. PCT/US2021/034263, filed May 26, 2021, wherein International Application No. PCT/US2021/034263 claims the benefit of U.S. Provisional Patent Application No. 63/030,036, filed May 26, 2020, the contents of each of which are herein incorporated by reference in their entireties.

GOVERNMENT RIGHTS

This invention was made with government support under SBIR contract N68335-14-C-0151 awarded by the United States Naval Air Systems Command (NAVAIR). The government has certain rights in the invention.

FIELD OF THE INVENTION

The present disclosure relates to high tensile strength FCL seams and weldable FCL tabs for the reinforcement of sections of seams. The present disclosure also relates to the development of new methods for forming and reinforcing high tensile strength FCL seams and their use in reduced footprint life preservers.

BACKGROUND OF THE INVENTION

The discovery of a new generation of ultra-light/ultra-thin textiles known as flexible composite laminates (FCLs, trade name Dyneema®) represents a major technological advancement in the textiles industry. A composite laminate contains discrete layers of fibrous composite materials, where the fiber layers are stacked on top of one another and bonded together. The structure of a typical FCL is illustrated in FIG. 1. In a composite laminate material, the individual fiber layers are embedded and held together within a polymeric matrix or elastic resin. Composite laminates may be rigid or flexible. Flexible composite laminates (FCLs) are of particular interest to the textile industry due to their ultra-light/ultra-thin profile and bendable nature.

Many FCLs contain thermoplastic polyethylene. In particular, Ultra-High Molecular Weight Polyethylene (UHMWPE) polymeric materials are commonly used, where the polyethylene fiber monolayers are stacked and suspended in place within a matrix. The UHMWPE polymers themselves are composed of very long polyethylene chains, all aligned in the same direction, where a network of strong intermolecular interactions link successive layers together. Typically the fiber monolayers are cross-plied, where the unidirectionally-oriented UHMWPE fibers within one layer are oriented perpendicular to any adjacent monolayer. The vast, interconnected inter- and intra-molecular bonding network that results affords FCLs their very high impact and tensile strengths. Trade names for UHMWPE fibers include Dyneema®, Spectra®, and Dynex®. See, for example, U.S. Pat. No. 6,893,704 B1; U.S. Pat. No. 7,993,715 B2; U.S. Pat. No. 8,158,228 B2; U.S. Pat. No. 9,702,664, and US 2018/0022060 A1. For methods to test the tensile strengths of composite textiles, see, for example, Portanova, M. A., "Standard Methods for Unnotched Tension Testing of Textile Coupons," NASA Contractor Report 198264 (1995).

The high tensile strengths of FCLs, such as Dyneema®, could find application in the production of emergency inflatables (e.g., life preservers, life rafts, parachutes) having ultra-strong, airtight seams that are resistant to rupture. The low overall weight profile of such emergency inflatable structures would be of further benefit. However, standard seaming methods known in the art, including sewing and taping, are insufficient for the seaming of FCLs directed to more demanding applications due to the light weight and thin physical profile of these materials. Similarly, the welding of FCL materials, accomplished by the melting and joining of FCL polymer coatings, is problematic for several reasons. First, both the base fiber material and its outer polymer coating are both very thin, leading to weakened seams due to insufficient thickness. Second, the degradation temperatures of the core polyethylene fibers tend to be close to those of standard FCL thermoplastic coatings, typically leading to burned seams during the welding process.

Traditionally, textiles can be seamed by sewing, taping, and/or fusing the polymer coatings of the textiles together by melting. All of these methods have been practiced for many years, taking many forms, where it is typical to select a specific method based on the composition of the materials to be seamed together as well as the application of the final seamed product.

Multiple layers of FCLs can be sewn and/or taped together to create seams. For some applications, sewing or taping is sufficient. However, other more rigorous applications require the fusing or welding of FCLs. The ability to fuse together FCL materials is dependent on the nature of the material itself. Also important is that the FCL pieces to be joined in place be held stationary while the energy is delivered in order to allow the melted material to melt, mingle, and re-solidify. In metal welding, this is generally accomplished by way of clamping, where the energy/heat may be delivered by any number of means, including by electric arc, oxy-acetylene, etc. Similarly, in thermoplastics, the laminate materials must be held together without movement while energy is delivered to melt and re-solidify their polymeric coatings. It may also be beneficial to force the molten materials together in order to enhance commingling.

Traditionally, heat is applied directly via heated platens, heated irons, heated rods, hot air, etc. Heat may also be delivered indirectly, by delivering radio wave energy (RF), microwave energy, ultrasonic vibration energy, laser energy, or induction heating. Indirect heating methods rely on the molecular structures of the textiles themselves to absorb the applied energy and create heat.

Historically, the welding of FCLs, such as Dyneema®, has proven to be a challenging problem as the base fiber material as well as its outer polymer coating(s) are very thin. Adding to this difficulty is the fact that, in comparison to traditional coated/woven materials, the melt/degradation temperature of core FCL fibers are typically much closer to that of the surrounding thermoplastic coating(s). For seaming accomplished by the melting together of textile coatings, or "welding", it is critical that the core fibers of the textiles do not become damaged by heat or pressure or any other processing element, as these will generally cause one or more areas of weakness in the final seamed product.

Others have been able to fuse Dyneema® materials together by the use of radio-frequency (RF) welding. See U.S. Pat. No. 10,137,638 B2. However, the success of RF welding relies on one or more additive layers being placed between any two Dyneema® fabric layers, where each additive layer is derived from polyester or a polyamide. The applied radio-frequency energy causes each additive layer to vibrate, and this vibrational movement is transferred to adjacent Dyneema® layers, causing sufficient disruption of the matrices so as to induce interlayer cross-bonding. That the success of the RF welding process is reliant on the inclusion of radiofrequency-absorbing additive layers limits the versatility of this process. Indeed, the additive layers add unnecessary weight and thickness to the resultant seams without improving seam strength. Moreover, RF welding requires application of the RF energy through tooling referred to as "electrodes" or "sealing dies." For welding thin materials of larger pieces together, low tolerance machined toolings are required. Not only is low tolerance machining expensive, but if the toolings distort or degrade, the quality and consistency of the resulting welds may be compromised.

New emergency inflatables (e.g., life preservers, life rafts) having ultra-strong, airtight seams would find application in a variety of industrial settings. To access ultra-strong emergency inflatables, new methods for fusing (welding) an FCL material to another FCL material or to itself which are both precise and reliable are needed. New, efficient methods for the reinforcing of FCL-derived seams and an ability weld together various dissimilar materials are also desirable from the standpoint of developing new emergency inflatables. It is understood in the art that such materials and methods for producing new emergency inflatables, a highly demanding application for FCLs, would find utility in other, less demanding applications as well.

One of skill in the art will also appreciate that the specific choice of thermoplastic coasting(s) will be dependent upon the application at hand. In many applications, reducing the overall weight of the product is critical. Examples of such applications include life vests, slides, parachutes, etc.

In contrast to metal and plastic welding where the materials are essentially homogeneous, FCLs comprise multiple distinct materials that largely intermingle. Thermoplastics exhibit substantial variations in their abilities to absorb laser energy. Similar to metals, the variability exhibited by thermoplastics is dependent upon the molecular structure of the thermoplastic coating(s) of the FCL, while the composition of the FCL fiber layers and plastic matrix may also impact laser absorptivity.

Standard seaming methods have proved to be insufficient for the seaming of FCLs given the light weights, thin physical profiles, and high tensile strengths of these materials. Accordingly, the identification of new, FCL-specific seaming technologies are desired. To date, no method for fusing two or more FCLs without the simultaneous incorporation of additive layers between FCL layers has been reported.

SUMMARY OF THE INVENTION

In an aspect, the present disclosure provides for, and includes, a seam having a length of at least one inch comprising a weld formed between a first base flexible composite laminate (FCL) and a second base FCL, each base FCL comprising a plurality of stacked, unidirectionally oriented Ultra-High Molecular Weight Polyethylene (UHMWPE) fibers in cross-plied monolayers embedded in a plastic matrix, where each FCL is coated on at least one face with a meltable layer, and where the weld comprises a homogeneous, fused monolayer formed from the meltable layers from each of said first and second coated FCLs.

In an aspect, the present disclosure provides for, and includes, a reinforced seam joining two flexible composite laminates (FCLs), the reinforced seam comprising three welds between a first FCL, a second FCL, a reinforcement FCL, and arranged to form intraseam space comprising (i) a continuous first weld comprising a homogeneous, fused monolayer formed from a meltable layer of the reinforcement FCL and a meltable layer of the first FCL, (ii) a continuous second weld comprising a homogeneous, fused monolayer formed from the meltable layer of the reinforcement FCL and a meltable layer of the second FCL, and (iii) a continuous third weld arranged equidistant or nearly equidistant from the first and second welds and comprising a homogeneous, fused monolayer formed from the meltable layers of the first and second FCLs, the welds and FCLs arranged to form intraseam space, where the second meltable layer is located on the inner face of the first FCL, the third meltable layer is located on the inner face of the second FCL, and the first meltable layer is located on the outer face of the reinforcement FCL, the reinforcement FCL being folded along a midline, and each of the FCLs comprises a plurality of stacked, unidirectionally oriented Ultra-High Molecular Weight Polyethylene (UHMWPE) fibers arranged in cross-plied monolayers and embedded in a plastic matrix.

In an aspect, the present disclosure provides for, and includes, a reinforced curved seam joining two FCLs, the reinforced seam comprising three welds between a first FCL, a second FCL, a reinforcement FCL, and arranged to form intraseam space comprising (i) a continuous first weld comprising a homogeneous, fused monolayer formed from a first meltable layer of the reinforcement FCL and a meltable layer of the first FCL, (ii) a continuous second weld comprising a homogeneous, fused monolayer formed from first and second meltable layers of the reinforcement FCL and a meltable layer of the second FCL, and (iii) a continuous third weld arranged equidistant or nearly equidistant from the first and second welds and comprising a homogeneous, fused monolayer formed from the meltable layers of the first and second FCLs, the welds and FCLs arranged to form intraseam space, where the first FCL has a curved edge and the meltable layer on its inner face, the second FCL has a curved edge and the meltable layer on its inner face; the reinforcement FCL comprises (a) a folded third FCL comprising a curved edge and three or more folded tabs, the folded tabs being formed from two or more cuts oriented perpendicular to the curved edge and extending to a midline, the tabs being folded along the midline to provide an exposed face having the second meltable layer, and (b) a folded fourth FCL comprising a curved edge and three or more folded tabs, the folded tabs being formed from two or more cuts oriented perpendicular to the curved edge and extending to a midline to provide an exposed face having the first meltable layer and an inner face having the second meltable layer, where the second meltable layer of the third FCL is joined to the second meltable layer of the fourth FCL by providing a heat means to a surface; each of the FCLs comprises a plurality of stacked, unidirectionally oriented Ultra-High Molecular Weight Polyethylene (UHMWPE) fibers arranged in cross-plied monolayers and embedded in a plastic matrix; all curved edges are aligned and juxtaposed; and the number of cuts are configured so that each inner edge of the folded tabs is oriented within 88 and 90 degrees relative to the curved edge so as to maintain no more than a 6 millimeter (mm) distance between the mid-point of the section of the midline comprising the fold of each of the folded tabs and the corresponding arc representing the true curvature of the midline.

In an aspect, the present disclosure provides for, and includes, a reinforced curved seam joining two FCLs, the reinforced seam comprising (i) three welds between a first FCL, a second FCL, a reinforcement FCL, and arranged to form intraseam space comprising (i) a continuous first weld comprising a homogeneous, fused monolayer formed from a first meltable layer of the reinforcement FCL and a meltable layer of the first FCL, (ii) a continuous second weld comprising a homogeneous, fused monolayer formed from first and second meltable layers of the reinforcement FCL and a meltable layer of the second FCL, and (iii) a continuous third weld arranged equidistant or nearly equidistant from the first and second welds and comprising a homogeneous, fused monolayer formed from the meltable layers of the first and second FCLs, the welds and FCLs arranged to form intraseam space, where the first FCL has a curved edge and the meltable layer on its inner face; the second FCL has a curved edge and the meltable layer on its inner face; the reinforcement FCL comprises (a) a folded third FCL comprising two or more notched gaps oriented perpendicular to a curved edge and extending from the curved edge to a midline to form three or more tabs, the third FCL being folded along the midline to provide an exposed face having the second meltable layer, and (b) a folded fourth FCL comprising two or more notched gaps oriented perpendicular to a curved edge and extending from the curved edge to a midline to form three or more tabs, the fourth FCL being folded along midline to provide an exposed face having the first meltable layer, and an inner face having the second meltable layer, where the second meltable layer of the third FCL is joined to the second meltable layer of the fourth FCL by providing a heat means to a surface; each of the FCLs comprises a plurality of stacked, unidirectionally oriented Ultra-High Molecular Weight Polyethylene (UHMWPE) fibers arranged in cross-plied monolayers and embedded in a plastic matrix; all curved edges are aligned and juxtaposed, and the notched gaps are configured so that each inner edge of the folded tabs is oriented within 88 and 90 degrees relative to the curved edge so as to maintain no more than a 6 millimeter (mm) distance between the mid-point of the section of the midline comprising the fold of each of the folded tabs and the corresponding arc representing the true curvature of the midline.

In an aspect, the present disclosure provides for, and includes, a seamed, inflatable body comprising two or more FCLs and having one or more linear-shaped seam areas in need of reinforcement, where the one or more linear-shaped seam areas in need of reinforcement are laser-welded to one or more reinforcement FCLs.

In an aspect, the present disclosure provides for, and includes, a seamed, inflatable body comprising two or more FCLs and having one or more concave seam areas in need of reinforcement, where the one or more concave seam areas in need of reinforcement are laser-welded to one or more reinforcement FCLs.

In an aspect, the present disclosure provides for, and includes, a seamed, inflatable body comprising two or more FCLs and having one or more convex seam areas in need of reinforcement, where the one or more convex seam areas in need of reinforcement are laser-welded to one or more reinforcement FCLs.

In an aspect, the present disclosure provides for, and includes, a seamed, inflatable body having one or more seam areas in need of reinforcement, where the shape of the one or more seam areas in need of reinforcement is selected from the group consisting of a linear area, a concave area, and a convex area, where any one or more linear areas in need of reinforcement is laser-welded to one or more reinforcement FCLs, any one or more concave areas in need of reinforcement is laser-welded to one or more reinforcement FCLs, and any one or more convex areas in need of reinforcement is laser-welded to one or more reinforcement FCLs.

In an aspect, the present disclosure provides for, and includes a seamed, inflatable body having one or more seam areas in need of reinforcement, where any one or more seam areas in need of reinforcement is laser-welded to one or more reinforcement FCLs, and where the end of a first seam area in need of reinforcement is linked to an end of a second seam area in need of reinforcement, thereby forming a continuous reinforced seam area.

In an aspect, the present disclosure provides for, and includes, a method of forming a seam, where the method comprises the steps of (i) providing a first FCL comprising a meltable layer on at least on face and a second FCL comprising a meltable layer on at least one face, the first and second FCLs configured to have similar or matching edges; (ii) overlaying the first and second FCLs so that said meltable layers are juxtaposed, and so that said similar or matching edges are aligned; (iii) directing a laser beam having a wavelength between 900 nm and 1100 nm, a power of between 20 and 40 watts per 15 square millimeters, and a beam width of about 7 mm at a weld location, and simultaneously applying a pressure of between 100 and 1,000 kilopascals (kPa) at the weld location, where the weld location comprises an absorption modifier; (iv) moving the laser beam along the aligned edges at a speed of between 0.65 and 7.5 centimeters/second (cm/sec) and a dwell time of between 5 and 180 seconds while maintaining the pressure; and (v) melting the meltable layers to produce a homogeneous, fused monolayer.

In an aspect, the present disclosure provides for, and includes, a method of forming a reinforced seam joining two FCLs, where the method comprises the steps of (i) providing a first FCL having a meltable layer on its inner face, a second FCL having a meltable layer on its inner face, and a reinforcement FCL folded along a midline and having a meltable layer on its exposed face, where the first and second FCLs are configured to have similar or matching edges; (ii) inserting the reinforcement FCL between the first FCL and the second FCL, so that said meltable layer of the reinforcement FCL is juxtaposed with the meltable layers of the first and second FCLs, and so that the similar or matching edges are aligned; (iii) directing a laser beam at first, second, and third weld locations, the laser having a wavelength between 900 nm and 1100 nm, a power of between 20 and 40 watts per 15 square millimeters, and a beam width of about 7 mm, and simultaneously applying a pressure of between 100 and 1,000 kilopascals (kPa), where the weld locations comprise an absorption modifier; (iv) moving the laser beam along the aligned edges at a speed of between 0.65 and 7.5 centimeters/second (cm/sec) and a dwell time of between 5 and 180 seconds; (v) melting the meltable layers at each of the three weld locations; and (vi) cooling to form a reinforced seam comprising first, second, and third continuous welds at the first, second, and third weld locations, where the first weld fuses the meltable layer of the first FCL and the meltable layer of the reinforcement FCL, where the second weld fuses the meltable layer of the second FCL and the meltable layer of the reinforcement FCL, where the third weld fuses meltable layers of the first and second FCLs, and where the first and second welds are arranged equidistant or nearly equidistant from the third weld.

In an aspect, the present disclosure provides for, and includes, a method of forming a reinforced curved seam joining two FCLs, the method comprising the steps of (i) providing a first FCL having a curved edge and a meltable layer on its inner face, a second FCL having a curved edge and a meltable layer on its inner face, a folded third FCL having a curved edge and three or more folded tabs, the folded tabs being formed from two or more cuts oriented perpendicular to the curved edge and extending to a midline, the tabs being folded along said midline to provide an exposed face having a first meltable layer, and a folded fourth FCL having a curved edge and three or more folded tabs, the folded tabs being formed from two or more cuts oriented perpendicular to the curved edge and extending to a midline, the tabs being folded along the midline to provide an exposed face having a second meltable layer, and an inner face having the first meltable layer, (ii) inserting the folded third FCL into the folded fourth FCL, so that the first meltable layer of the folded third FCL is juxtaposed with the first meltable layer of the folded fourth FCL, (iii) joining the folded third FCL to the folded fourth FCL by applying a heat means to a surface, thereby forming a reinforcement FCL, (iv) aligning the first FCL relative to the second FCL along their curved edges, (v) inserting the reinforcement FCL between the aligned first and second FCLs so as to align and juxtapose all four of the curved edges, juxtapose the second meltable layer with each of the meltable layers of the first and second FCLs, and juxtapose the second meltable layer with the meltable layer of the second FCL, (vi) directing a laser beam at first, second, and third weld locations, the laser having a wavelength between 900 nm and 1100 nm, a power of between 20 and 40 watts per 15 square millimeters, and a beam width of about 7 mm, and simultaneously applying a pressure of between 100 and 1,000 kilopascals (kPa), where the weld locations comprise an absorption modifier, (vii) moving the laser beam along the aligned curved edges at a speed of between 0.65 and 7.5 centimeters/second (cm/sec), and for a time of between 5 and 180 seconds, (viii) melting the meltable layers at each of the three weld locations, and (ix) cooling to form a reinforced curved seam comprising first, second, and third continuous welds at the first, second, and third weld locations, where the first weld fuses the second meltable layer and the meltable layer of the first FCL, where the second weld fuses the first and second meltable layers with the meltable layer of the second FCL, where the third weld fuses the meltable layers of the first and second FCLs, and where the first and second welds are arranged equidistant or nearly equidistant from the third weld.

In an aspect, the present disclosure provides for, and includes, a method of forming a reinforced curved seam joining two FCLs, the method comprising the steps of (i) providing a first FCL having a curved edge and a meltable layer on its inner face, a second FCL having a curved edge and a meltable polymer coating on its inner face, a folded third FCL having a curved edge and two or more notched gaps oriented perpendicular to the curved edge and extending from the curved edge to a midline to form three or more tabs, the third FCL being folded along the midline to provide an exposed face having a first meltable layer, and a folded fourth FCL having a curved edge and two or more notched gaps oriented perpendicular to the curved edge and extending from the curved edge to a midline to form three or more tabs, the fourth FCL being folded along the midline to provide an exposed face having a second meltable layer, and an inner face having the first meltable layer, (ii) inserting the folded third FCL into the folded fourth FCL, so that the first meltable layer of the folded third FCL is juxtaposed with the first meltable layer of the folded fourth FCL, (iii) joining the folded third FCL to the folded fourth FCL by applying a heat means to a surface, thereby forming a reinforcement FCL, (iv) aligning the first FCL relative to the second FCL along their curved edges, (v) inserting the reinforcement FCL between the aligned first and second FCLs so as to align and juxtapose all four of the curved edges, juxtapose the second meltable layer with each of the meltable layers of the first and second FCLs, and juxtapose the first meltable layer with the meltable layer of the second FCL, (vi) directing a laser beam at first, second, and third weld locations, the laser having a wavelength between 900 nm and 1100 nm, a power of between 20 and 40 watts per 15 square millimeters, and a beam width of about 7 mm, and simultaneously applying a pressure of between 100 and 1,000 kilopascals (kPa), where the weld locations comprise an absorption modifier, (vii) moving the laser beam along the aligned curved edges at a speed of between 0.65 and 7.5 centimeters/second (cm/sec), and for a time of between 5 and 180 seconds, (viii) melting the meltable layers at each of the three weld locations, and (ix) cooling to form a reinforced curved seam comprising first, second, and third continuous welds at the first, second, and third weld locations, where the first weld fuses the second meltable layer and the meltable layer of the first FCL, where the second weld fuses the first and second meltable layers with the meltable layer of the second FCL, where the third weld fuses the meltable layers of the first and second FCLs, and where the first and second welds are arranged equidistant or nearly equidistant from the third weld.

In an aspect, the present disclosure provides for, and includes, a method of making a reinforcement FCL, where the method comprises the steps of (i) providing a first FCL having a curved edge and a first meltable layer on one face, (ii) providing a second FCL having curved edge, the first meltable layer on one face, and a second meltable layer on the other face, (iii) cutting two or more cuts in the first FCL perpendicular to its curved edge and extending to a midline to form three or more tabs, (iv) cutting two or more cuts in the second FCL perpendicular to its curved edge and extending to a midline to form three or more tabs, (v) folding each of the tabs of the first FCL along the midline to form a folded first FCL, (vi) folding each of the tabs of the second FCL along the midline to form a folded second FCL, (vii) inserting the folded first FCL into the folded second FCL so that their curved edges are aligned and juxtaposed and providing an intraseam space, and (viii) heat-fusing the first meltable layer of the first FCL to the first meltable layer of the second FCL by applying a heat means to a surface.

In an aspect, the present disclosure provides for, and includes, a method of making a reinforcement FCL, where the method comprises the steps of (i) providing a first FCL having a curved edge and a first meltable layer on one face, (ii) providing a second FCL having curved edge, the first meltable layer on one face, and a second meltable layer on the other face, (iii) notching the first FCL perpendicular to its curved edge and extending from the curved edge to a midline to prepare two or more notched gaps and three or more tabs, (iv) notching the second FCL perpendicular to its curved edge and extending from the curved edge to a midline to prepare two or more notched gaps and three or more tabs, (v) folding each of the tabs of the first notched FCL along the midline to form a folded first FCL, (vi) folding each of the tabs of the second notched FCL along the midline to form a folded second FCL, (vii) inserting the folded first FCL into the folded second FCL so that their curved edges are aligned and juxtaposed, and (viii) heat-fusing the first meltable layer of the first FCL to the first meltable layer of the second FCL by applying a heat means to a surface.

In an aspect, the present disclosure provides for, and includes, a method of preparing a reinforced seam for an inflatable body along an linear seam formed from two or more FCLs, the method comprising the steps of (i) providing an inflatable body in need of a linear seam, and (ii) laser-welding one or more reinforcement FCLs along the linear seam to form a reinforced linear seam.

In an aspect, the present disclosure provides for, and includes, a method of preparing a reinforced seam for an inflatable body along a concave curved seam formed from two or more FCLs, the method comprising the steps of (i) providing an inflatable body in need of a seam along a concave curve, and (ii) laser-welding one or more reinforcement FCLs to the concave curve to form a reinforced concave curved seam.

In an aspect, the present disclosure provides for, and includes, a method of preparing a reinforced seam for an inflatable body along a convex curved seam formed from two or more FCLs, the method comprising the steps of (i) providing an inflatable body in need of a seam along a convex curve, and (ii) laser-welding one or more reinforcement FCLs to the convex curve to form a reinforced convex curved seam.

In an aspect, the present disclosure provides for, and includes, a method of preparing a reinforced seam for an inflatable body, the method comprising the steps of (i) providing an inflatable body in need of a seam along one or more areas, the one or more areas selected from the group consisting of a linear area, a concave curved area, and a convex curved area, (ii) laser-welding one or more reinforcement FCLs along the one or more linear areas, (iii) laser-welding one or more reinforcement FCLs along the one or more concave curved areas, and (iv) laser-welding one or more reinforcement FCLs along the one or more convex curved areas.

In an aspect, the present disclosure provides for, and includes, a method of forming a seam, where the method comprises the steps of (i) providing a first FCL comprising a meltable layer on at least on face and a second FCL comprising a meltable layer on at least one face, the first and second FCLs configured to have similar or matching edges; (ii) overlaying the first and second FCLs so that said meltable layers are juxtaposed, and so that said similar or matching edges are aligned; (iii) directing a laser beam having a wavelength between 900 nm and 1100 nm, a power of between 85 and 95 watts per 15 square millimeters, and a beam width of about 3 mm at a weld location, and simultaneously applying a pressure of between 100 and 1,000 kilopascals (kPa) at the weld location, where the weld location comprises an absorption modifier; (iv) moving the laser beam along the aligned edges at a speed of between 35 and 45 centimeters/second (cm/sec) and a dwell time of between 5 and 180 seconds while maintaining the pressure, and (v) melting the meltable layers to produce a homogeneous, fused monolayer.

In an aspect, the present disclosure provides for, and includes, a method of forming a reinforced seam joining two FCLs, where the method comprises the steps of (i) providing a first FCL having a meltable layer on its inner face, a second FCL having a meltable layer on its inner face, and a reinforcement FCL folded along a midline and having a meltable layer on its exposed face, where the first and second FCLs are configured to have similar or matching edges; (ii) inserting the reinforcement FCL between the first FCL and the second FCL, so that said meltable layer of the reinforcement FCL is juxtaposed with the meltable layers of the first and second FCLs, and so that the similar or matching edges are aligned; (iii) directing a laser beam at first, second, and third weld locations, the laser having a wavelength between 900 nm and 1100 nm, a power of between 85 and 95 watts per 15 square millimeters, and a beam width of about 3 mm, and simultaneously applying a pressure of between 100 and 1,000 kilopascals (kPa), where the weld locations comprise an absorption modifier; (iv) moving the laser beam along the aligned edges at a speed of between 35 and 45 centimeters/second (cm/sec) and a dwell time of between 5 and 180 seconds; (v) melting the meltable layers at each of the three weld locations; and (vi) cooling to form a reinforced seam comprising first, second, and third continuous welds at the first, second, and third weld locations, where the first weld fuses the meltable layer of the first FCL and the meltable layer of the reinforcement FCL, where the second weld fuses the meltable layer of the second FCL and the meltable layer of the reinforcement FCL, where the third weld fuses meltable layers of the first and second FCLs, and where the first and second welds are arranged equidistant or nearly equidistant from the third weld.

In an aspect, the present disclosure provides for, and includes, a method of forming a reinforced curved seam joining two FCLs, the method comprising the steps of (i) providing a first FCL having a curved edge and a meltable layer on its inner face, a second FCL having a curved edge and a meltable layer on its inner face, a folded third FCL having a curved edge and three or more folded tabs, the folded tabs being formed from two or more cuts oriented perpendicular to the curved edge and extending to a midline, the tabs being folded along said midline to provide an exposed face having a first meltable layer, and a folded fourth FCL having a curved edge and three or more folded tabs, the folded tabs being formed from two or more cuts oriented perpendicular to the curved edge and extending to a midline, the tabs being folded along the midline to provide an exposed face having a second meltable layer, and an inner face having the first meltable layer, (ii) inserting the folded third FCL into the folded fourth FCL, so that the first meltable layer of the folded third FCL is juxtaposed with the first meltable layer of the folded fourth FCL, (iii) joining the folded third FCL to the folded fourth FCL by applying a heat means to a surface, thereby forming a reinforcement FCL, (iv) aligning the first FCL relative to the second FCL along their curved edges, (v) inserting the reinforcement FCL between the aligned first and second FCLs so as to align and juxtapose all four of the curved edges, juxtapose the second meltable layer with each of the meltable layers of the first and second FCLs, and juxtapose the second meltable layer with the meltable layer of the second FCL, (vi) directing a laser beam at first, second, and third weld locations, the laser having a wavelength between 900 nm and 1100 nm, a power of between 85 and 95 watts per 15 square millimeters, and a beam width of about 3 mm, and simultaneously applying a pressure of between 100 and 1,000 kilopascals (kPa), where the weld locations comprise an absorption modifier, (vii) moving the laser beam along the aligned curved edges at a speed of between 35 and 45 centimeters/second (cm/sec), and for a time of between 5 and 180 seconds, (viii) melting the meltable layers at each of the three weld locations, and (ix) cooling to form a reinforced curved seam comprising first, second, and third continuous welds at the first, second, and third weld locations, where the first weld fuses the second meltable layer and the meltable layer of the first FCL, where the second weld fuses the first and second meltable layers with the meltable layer of the second FCL, where the third weld fuses the meltable layers of the first and second FCLs, and where the first and second welds are arranged equidistant or nearly equidistant from the third weld.

In an aspect, the present disclosure provides for, and includes, a method of forming a reinforced curved seam joining two FCLs, the method comprising the steps of (i) providing a first FCL having a curved edge and a meltable layer on its inner face, a second FCL having a curved edge and a meltable layer on its inner face, a folded third FCL having a curved edge and two or more notched gaps oriented perpendicular to the curved edge and extending from the curved edge to a midline to form three or more tabs, the third FCL being folded along the midline to provide an exposed face having a first meltable layer, and a folded fourth FCL having a curved edge and two or more notched gaps oriented perpendicular to the curved edge and extending from the curved edge to a midline to form three or more tabs (918), the fourth FCL being folded along the midline to provide an exposed face having a second meltable layer, and an inner face having the first meltable layer, (ii) inserting the folded third FCL into the folded fourth FCL, so that the first meltable layer of the folded third FCL is juxtaposed with the first meltable layer of the folded fourth FCL, (iii) joining the folded third FCL to the folded fourth FCL by applying a heat means to a surface, thereby forming a reinforcement FCL, (iv) aligning the first FCL relative to the second FCL along their curved edges, (v) inserting the reinforcement FCL between the aligned first and second FCLs so as to align and juxtapose all four of the curved edges, juxtapose the second meltable layer with each of the meltable layers of the first and second FCLs, and juxtapose the first meltable layer with the meltable layer of the second FCL, (vi) directing a laser beam at first, second, and third weld locations, the laser having a wavelength between 900 nm and 1100 nm, a power of between 85 and 95 watts per 15 square millimeters, and a beam width of about 3 mm, and simultaneously applying a pressure of between 100 and 1,000 kilopascals (kPa), where the weld locations comprise an absorption modifier, (vii) moving the laser beam along the aligned curved edges at a speed of between 35 and 45 centimeters/second (cm/sec), and for a time of between 5 and 180 seconds, (viii) melting the meltable layers at each of the three weld locations, and (ix) cooling to form a reinforced curved seam comprising first, second, and third continuous welds at the first, second, and third weld locations, where the first weld fuses the second meltable layer and the meltable layer of the first FCL, where the second weld fuses the first and second meltable layers with the meltable layer of the second FCL, where the third weld fuses the meltable layers of the first and second FCLs, and where the first and second welds are arranged equidistant or nearly equidistant from the third weld.

BRIEF DESCRIPTION OF THE DRAWINGS

The present disclosure is disclosed with reference to the accompanying drawings, where:

FIG. 2 presents illustrations of two stacked FCLs suitable for welding according to aspects of the present disclosure.

FIG. 3A presents is a cross section of a seam resulting from the stacked configuration of FIG. 2A, in accordance of an aspect of the present disclosure. FIG. 3B is a cross section of a seam resulting from the stacked configuration of FIG. 2B, in accordance of an aspect of the present disclosure.

Two common types of seams are fin seams and overlap seams. FIG. 4A presents and illustration of a "fin" or "prayer" seam. FIG. 4B presents an "overlap" seam. Fin seams fail by pealing. Overlap seams fail by shearing. FIG. 4A depicts a side view of a simple fin seam (53) formed from two FCLs (51, 52). As shown, the direction of stress (55) experienced by seam (53) as the two seamed FCLs (51, 52) are pulled apart is perpendicular to the plane of the fin seam (53). FIG. 4B depicts a side view of an overlap seam (63) formed from two FCLs (61, 62). As shown, the direction of stress (65) experienced by seam (63) as the two seamed FCLs (61, 62) are pulled apart is parallel to the plane of the overlap seam (63).

FIG. 5A presents coated FCL (420) having a thin layer of a meltable layer (405) applied. In FIG. 5B, a second FCL (410) is arranged on top of FCL (420) and illuminated with a laser at a wavelength between 900 nm and 1100 nm through a transparent wheel (185). The transparent wheel (185) applies a pressure of between 100 and 1,000 kilopascals (kPa) on the stacked FCLs against a backing layer of silicone rubber (501). The backing layer allows for the even application of pressure from the transparent wheel (185) during welding. FIG. 5C shows the welded FCLs having a fused homogeneous layer (435) formed from the meltable layers. FIG. 5D side view of the seamed structure of FIG. 5C where non-seamed areas of FCL have been separated apart as would occur in a closed body that has been inflated, in an aspect accordance with the present disclosure.

FIG. 6A is a view of two FCLs showing each IR absorbing layer in a stacked configuration where the applied power is too high and the absorption (10%) is too low resulting in burning of the silicone backing layer. FIG. 6B is the same configuration of FIG. 6A, but where the interface layer has an absorptivity (80%) that is too high, resulting in a burned interface layer and damage to the adjacent cross-plied monolayers. FIG. 6C is the same configuration with an absorptivity (80%) but where the laser power is reduced (30%) and the wavelength, pressure, and dwell time are optimized resulting in fusion of the meltable polymer layers to form a fused layer and a strong weld. The adjacent cross-plied monolayers are not damaged. FIG. 6D is the same configuration with a lower power (30%) and lower absorptivity (30%) resulting in incomplete melting and a weak weld. FIG. 6E is the same configuration of FIG. 6D, but where moderate power (40%) is applied, and interface layer has a moderate inherent absorptivity (45%), resulting in a strong weld.

FIG. 7A presents a four layered configuration where welds are produced at two interfaces. FIG. 7B presents a view of a four layered configuration where welds are produced at three interfaces.

FIG. 8A is a top view of an unfolded reinforcement FCL, in accordance with the present disclosure. FIG. 8B is a top view of a folded reinforcement FCL. FIG. 8C presents a side view of the folded reinforcement tab identifying the meltable polymer layer and absorption modifier.

FIG. 9A is a side view of a folded reinforcement FCL, as previously shown in FIG. 8C, placed on base FCL (760). FIG. 9B shows a second base FCL (770) arranged on top with the edges of the two aligned and the Tensor tab placed at a distance and providing an intra-seam space (715). FIG. 9C presents an illustration of the welded seam including a fin seam (735) between the two base FCLs and reinforcement seams (731) and (733) between the Tensor tab and base FCLs. FIG. 9D presents the welded seam in an inflated form in accordance with the present disclosure.

FIG. 10A is a top view of arced FCLs (810) and (820), each having three cuts that are perpendicular to curved edges (809) or (819) and extending to the midline to create four tabs (807) and (816) on each FCL. FIG. 10B illustrates the folding of the tabs at the midline (811) and (821). FIG. 10C is a perspective view of the assembly of the two cut and folded FCLs (810) and (820) to prepare a reinforcement FCL, where folded FCL (820) has been inserted into folded FCL (810). FIG. 10D presents the two halves of the assembled reinforcement FCL joined by heat fusion. FIG. 10E illustrates the physical relationship between the foldable midline (811) or (821) and the true curvature of the foldable midline (873) or (883) for FCLs (810) and (820).

FIG. 11A is a top view of arced FCLs (910) and (920) having three notched gaps (978) and (979) that are perpendicular to curved edges (909) and (919) and extending to the midline to create four tabs (907) and (916) on each FCL. FIG. 11B illustrates the folding of the tabs at the midline (911). FIG. 11C is a perspective view of the assembly of the two notched and folded FCLs (910) and (920) to prepare a reinforcement FCL, where folded FCL (920) has been inserted into folded FCL (910). FIG. 11D presents the two halves of the assembled reinforcement FCL joined by heat fusion. FIG. 11E illustrates the physical relationship between the foldable midline (911) or (921) and the true curvature of the foldable midline (973) or (983) for FCLs (910) and (920).

FIG. 12A illustrates the stacking of the Flexus tab onto a first base FCL (860).

FIGS. 13A, 13B, 13C, 13D, 13E, 13F, and 13G present examples of Flexus reinforcement tabs according to aspects of the present disclosure.

DETAILED DESCRIPTION

Figure 1:
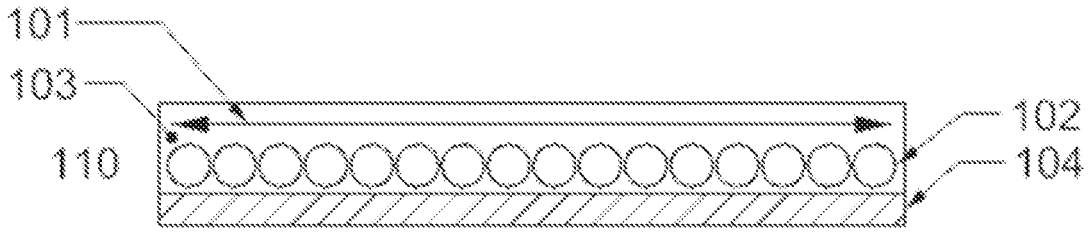
FIG. 1 is a diagram of a flexible composite laminate (FCL) presenting a two cross-plied monolayers of unidirectionally oriented high strength fibers (101) and (102) embedded in a plastic matrix (103). Also shown is a meltable layer (104) that is applied to one side of the FCL during manufacture but may include a coating on both sides. FCLs have a minimum of two cross-plied monolayers and while the number of layers is not limited, commercial FCLs typically have between 2 and 6.

The present disclosure provides for, and includes, seams and method of forming seams between two coated flexible composite laminates (FCLs) referred to as base FCLs. The present disclosure further provides for methods and structures for preparing reinforced seams between base FCLs. Seamed base FCLs can be used for the preparation of a wide variety of products including clothing, tents, shelters, and importantly inflatables. The seams of the present disclosure comprise welds that comprise a homogeneous, fused monolayers formed from meltable polymer layers or coatings on each base FCL. Seams can be prepared using infrared (IR) absorbing meltable layers or through the application of minor amounts of infrared absorbing materials (absorption modifiers). Not to be limited by theory, it is thought that the strength of the seams and welds is due to the integration of the meltable layers with the FCL during manufacture and their homogeneous fusion using the disclosed methods. The inclusion of minor amounts of IR absorbing materials either within the meltable layer or applied to the meltable polymer surface are not intended or expected to contribute or subtract from the overall strength of the bond. The seams are an advance over the art in that they do not require the addition of other structural materials, add no weight to the product, and are suitable for the production of light weight, non-porous materials. A further advantage is the ability to create welds at multiple locations at depth in a stack of FCLs. The seams of the present disclosure are strong seams that exhibit a strength that is close to that of the base textile itself. "Acceptable strength" can be determined by standard tensile test methods, or can be determined by other means suited for the specific final product in which the joined textiles are incorporated. For example, a preferred strength test for an inflatable structure is a burst pressure test. For a reinforced object, the measurement of pull strength in multiple directions is preferred. Strength tests for garments may include determining the garment's abrasion or water resistance, or testing the strength of the garment's attachment to other articles, if the application at hand so requires. The seams of the present application approach the strength of the materials themselves and do not introduce added materials and weight.

In an aspect, the present disclosure provides for, and includes, a seam having a length of at least one inch comprising a weld formed between a first coated base FCL and a second coated base FCL, each coated base FCL comprising a plurality of stacked, unidirectionally oriented fibers in cross-plied monolayers embedded in a plastic matrix, where each base FCL is coated on at least one face with a meltable layer, and where the weld comprises a homogeneous, fused monolayer formed from the meltable layers from each of said first and second coated base FCLs. The unidirectionally oriented fibers of the FCL include polyethylene fibers selected from the group consisting of UHMWPE, High Density Polyethylene (HDPE) fibers, Medium-Density Polyethylene (MDPE) fibers, Low-Density Polyethylene (LDPE) fibers, Very Low-Density Polyethylene (VLDPE) fibers, and Cross-Linked Polyethylene (PEX) fibers. In an aspect, the unidirectionally oriented fibers in cross-plied monolayers (101) are Ultra-High Molecular Weight Polyethylene (UHMWPE) fibers.

As provided, the seam comprises a weld formed between a first coated base FCL and a second coated base FCL. Each coated base FCL comprises an ultra-light/ultra-thin textile known as a flexible composite laminate (FCL) and includes materials available under the trade name Dyneema®. FCLs are extremely lightweight and very thin. In aspects, the FCLs can be as thin as $10\times10^{-6}$ meters (micrometers, μM, or microns). FCLs derived their high strength from the stacked, unidirectionally oriented fibers in cross-plied monolayers. In aspects, the fibers are UHMWPE fibers. UHMWPE fibers are a subset of thermoplastic polyethylene and comprises extremely long chains with a typical molecular mass of between $3.5\times10^6$ to $7.5\times10^6$ Daltons. UHMWPE fibers are extremely strong having yield strengths as high as 2.4 GPa (2.4 $kN/mm^2$ or 350,000 psi) and density as low as 0.97 $g/cm^3$. UHMWPE fibers are low stretch, high strength and low weight. To maintain these desirable properties and maintain the strength of FCLs containing, them, the UHMWPE fibers need to remain undamaged when joining FCLs. The seams of the present disclosure are prepared using methods that avoid damage to the UHMWPE fibers and result in high strength, light weight seamed FCLs.

As used herein, the term "fiber" refers to a thread or filament. As used herein the term "FCL" refers to a textile comprising multiple stacked layers of fibers. The fibers comprising a single layer of an FCL, referred to herein as a monolayer, may have a specific relative orientation. In an aspect of the present disclosure, the fibers within a single monolayer have a unidirectional orientation.

Figure 2A:
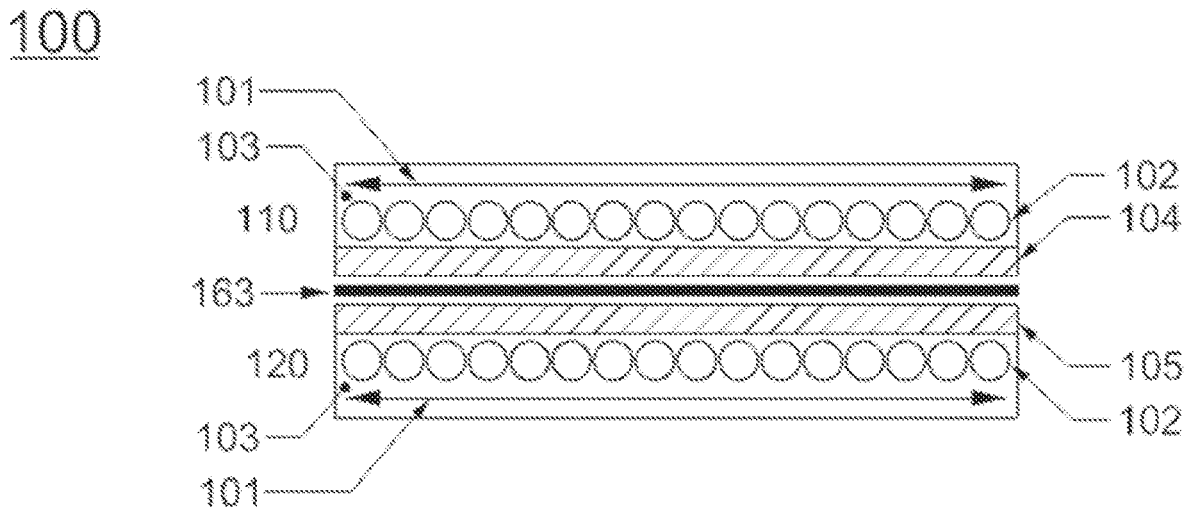
FIG. 2A is a side view of two coated FCLs in a stacked configuration, where the adjacent cross-plied monolayers are oriented parallel relative to one another, in accordance with the present disclosure.
Figure 2B:
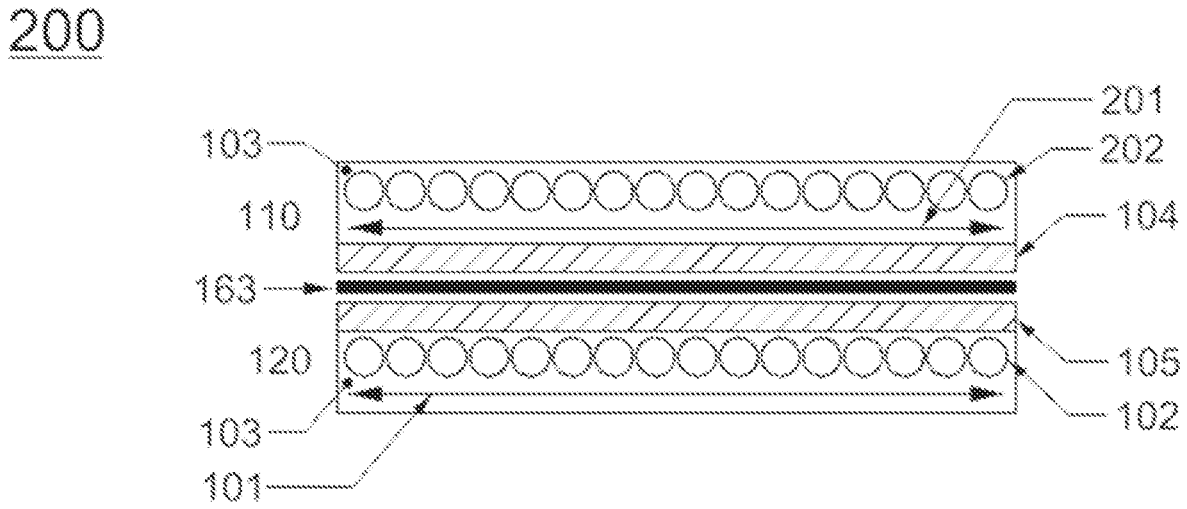
FIG. 2B is a side view of two coated FCLs in a stacked configuration, where the adjacent cross-plied monolayers are oriented perpendicular relative to one another, in accordance with the present disclosure.
Figure 3A:
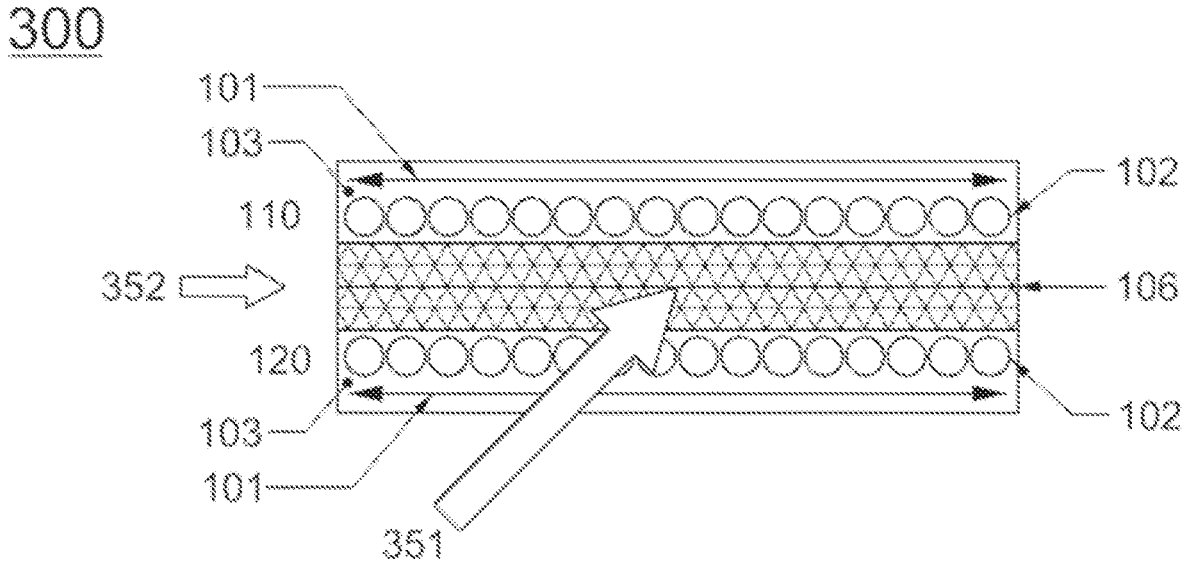
FIGS. 3A and 3B presents illustrations of welded FCLs according to aspects of the present disclosure.

FCLs as used herein are illustrated in FIG. 1, which presents an FCL having two cross-plied monolayers of unidirectionally oriented high strength fibers (101) and (102) embedded in plastic matrix (103) and having a meltable layer (104) over monolayer (102). Example configurations of stacked FCLs prior to welding in FIG. 2. FIG. 2A depicts a side view of two FCLs (110, 120) in a stacked configuration, where each FCL comprises two stacked, unidirectionally oriented UHMWPE fiber cross-plied monolayers (101, 102) embedded within a plastic matrix (103). While shown here as a two-layered FCL, the present disclosure further includes and provides for additional cross-plied monolayers of unidirectionally oriented UHMWPE fibers embedded in matrix (103). Each FCL to be joined in a seam of the present disclosure further comprise a meltable layer (104, 105) that are melted and fused using the methods of the present disclosure to prepare a homogeneous, fused monolayer weld region (106) as illustrated in FIG. 3A. As used herein, the layers (102) of each FCL (110) or (120) immediately under the meltable layer (104) or (105) are identified as "adjacent cross-plied monolayers." Notably, the adjacent cross-plied monolayers in FIG. 2A have the fibers oriented in parallel. As will be described below, the orientation of the adjacent cross-plied monolayers affects the tensile and burst strength of seamed FCLs. FIG. 2B presents the same two layered FCLs (110) and (120), however the adjacent cross-plied monolayers are oriented perpendicularly. As discussed in detail below, the adjacent cross-plied monolayers (101, 102) adjacent to the meltable layer (104, 105) before welding or the fused monolayer weld region (106) after welding are undamaged. By welding the two FCLs without damaging the underlying fibers, the high strength of the materials is retained. The ability to weld the materials together without adding tapes or materials allows for the production of lighter weight products.

As used herein, each of the terms "adjacent" and "juxtaposed" refers to objects that are in nearby or in close physical proximity to one another. In an aspect of the present disclosure, any two adjacent stacked unidirectionally oriented monolayers comprising an FCL are oriented orthogonal to one another, also referred to as "cross-plied." As used herein, the term "orthogonal" is defined as having a perpendicular relative orientation or direction. In an aspect, all stacked monolayers comprising an FCL are cross-plied, so that any chosen monolayer is oriented orthogonal to any adjacent monolayer.

As used herein, the term "flexible composite laminate (FCL)" refers to a composite FCL material comprising cross-plied layers of high-strength fibers embedded in a flexible matrix. FCLs are available commercially having either one or both sides coated with a meltable layer. Two or more FCLs may be welded together juxtaposing the FCLs so that the two meltable layers are in contact, directing an IR laser to the weld site while the area is under pressure of between 100 and 1,000 kilopascals (kPa) for sufficient time to melt and fuse the two meltable layers and fuse them to form a seam. In an aspect, an FCL may be coated on both faces with the same meltable polymer layer. In an aspect, an FCL may be coated on each face with a different meltable polymer layer. In an aspect, an FCL may be coated on a single face with a meltable polymer layer. To provide for welding and seam formation, at least one side of each FCL to be welded must be coated with a meltable layer that has a melting point that is at least 1° C. below the melting points of the FCL fibers and FCL matrix, and preferably at least 5° C. below the melting points of the FCL fibers and FCL matrix.

An FCL may be comprised of a variety of fiber types. In an aspect of the present disclosure, the fibers comprise polyethylene (PE). In an aspect, the PE fibers may be Ultra-High Molecular Weight Polyethylene (UHMWPE) fibers. In an aspect, the UHMPE fibers may be Dyneema®, Spectra®, or Dynex®. In an aspect, the PE fibers may be High Density Polyethylene (HDPE) fibers. In an aspect, the PE fibers may be Medium-Density Polyethylene (MDPE) fibers. In an aspect, the PE fibers may be Low-Density Polyethylene (LDPE) fibers. In an aspect, the PE fibers may be Linear Low-Density Polyethylene (LLDPE) fibers. In an aspect, the PE fibers may be Very Low-Density Polyethylene (VLDPE) fibers. In an aspect, the PE fibers may Cross-Linked Polyethylene (PEX) fibers. In an aspect, the PE fibers may be a polyethylene co-polymer. In an aspect, the PE fibers may be a chemically-modified polyethylene.

As used herein, the term "heterogeneous" refers to a mixtures of one or more substances having two or more phases (e.g., solid, liquid, or gas), and the term "homogeneous" refers to a mixture of more than one more substances having a single phase.

The present disclosure identifies the relative orientation of the unidirectionally oriented UHMWPE fibers in said cross-plied monolayers (101) and (102) adjacent to said fused monolayer (106) as an important consideration in preparing high strength seams. Unexpectedly, and as demonstrated below in Example 4, seams having fibers in adjacent cross-plied monolayers in a parallel configuration results in greater strength of the seam. By aligning the fibers in adjacent cross-plied monolayers in parallel, or close to parallel, the tensile strength of the seam can be increased by 5 to 15%.

As used herein, "adjacent cross-plied monolayers" refers to the monolayers immediately adjacent to the meltable layer in each FCL to be joined. When the two FCLs are joined using the methods of the present disclosure, the adjacent cross-plied monolayers are separated by the homogeneous fused monolayer (106). The relative angular orientation of any two adjacent fiber monolayers in an FCL or FCL affects the strength of the weld and seam.

As used herein, the term "oblique angle" refers to an angle that is not a right angle. As used herein, the term "perpendicular" refers to a right angle of 90 degrees. As used herein, the term "parallel" refers to an angle of zero degrees for the fibers in the adjacent cross-plied monolayers.

Figure 3B:
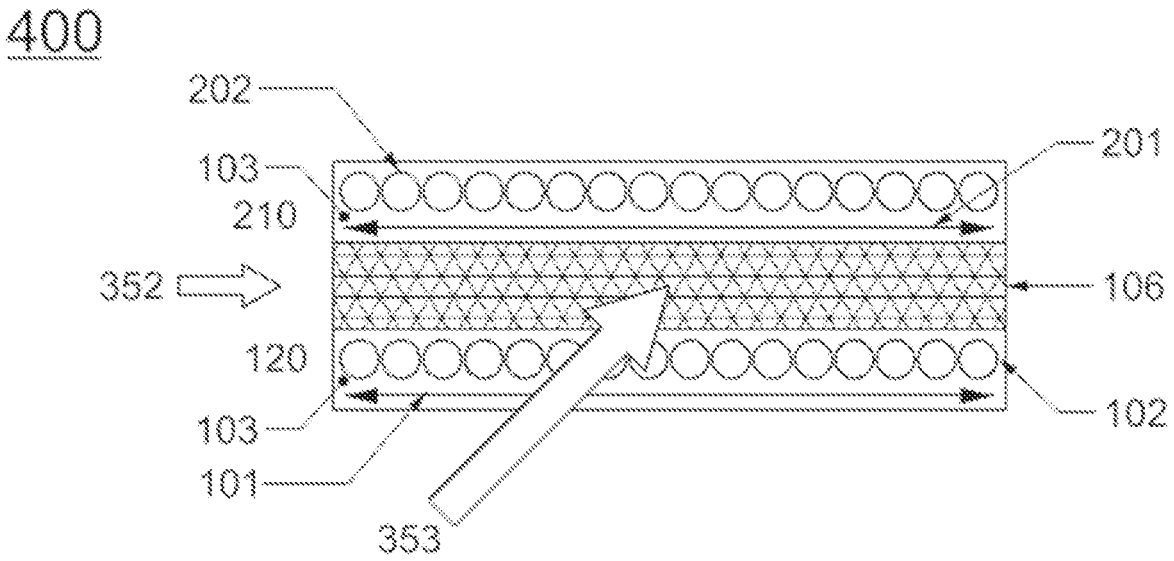

Two example seams of stacked and welded FCLs are illustrated in FIGS. 3A and 3B. FIG. 3A shows a side view of a sample seam (300) resulting from welding the stacked configuration of FIG. 2A, where the each of the innermost cross-plied monolayers (102) located adjacent to homogeneous, fused monolayer weld region (106) are oriented in the same direction as a seam having direction (351), and oriented orthogonal to a seam having direction (352).

FIG. 3B presents a side view illustration of a seam (400) resulting from welding a stacked configuration according to FIG. 2B, where the innermost cross-plied monolayer (102) located adjacent to homogeneous, fused monolayer weld region (106) is oriented in the same direction as a seam having direction (353), or oriented orthogonal to a seam having direction (354). Similarly, innermost cross-plied monolayer (201) located adjacent to homogeneous, fused monolayer weld region (106) is oriented orthogonal to a seam having direction (353), or oriented in the same direction as a seam having direction (354).

Figure 5A:
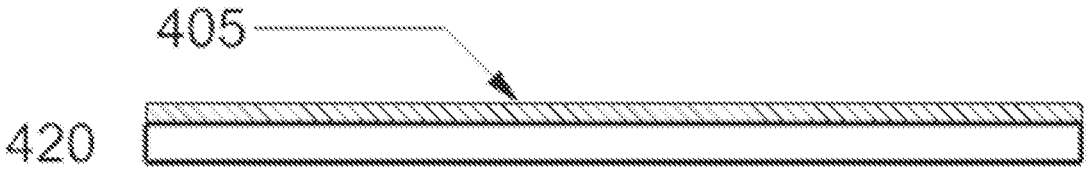
FIGS. 5A, 5B, 5C, and 5D present a side view illustration of the structures and steps to prepare a fin seam in an aspect of the present disclosure.
Figure 5B:
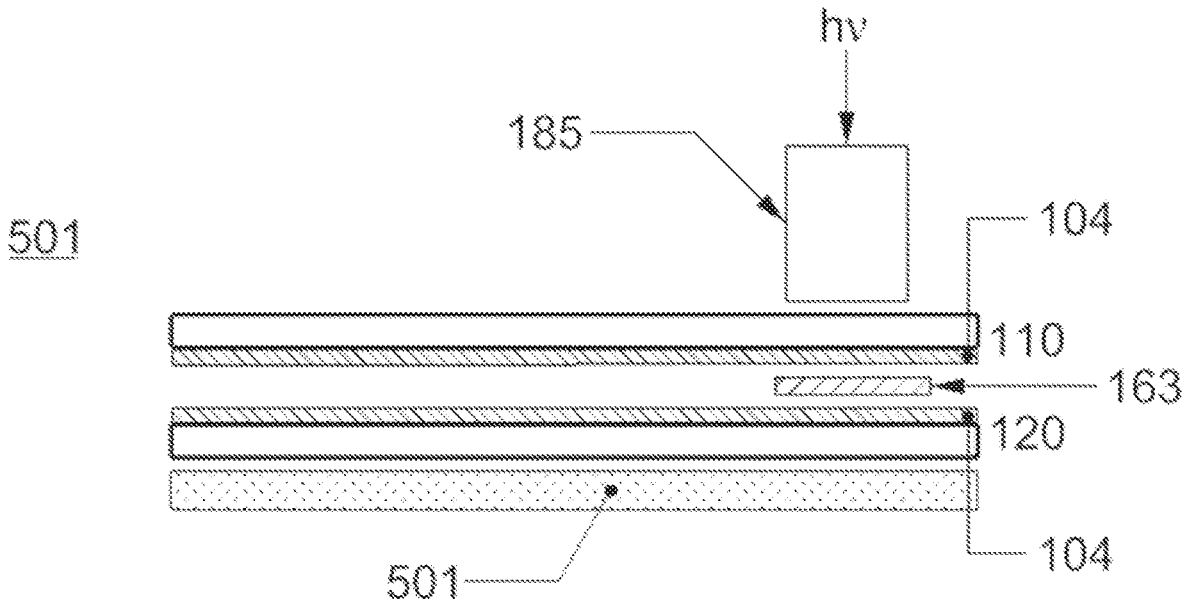
Figure 5C:
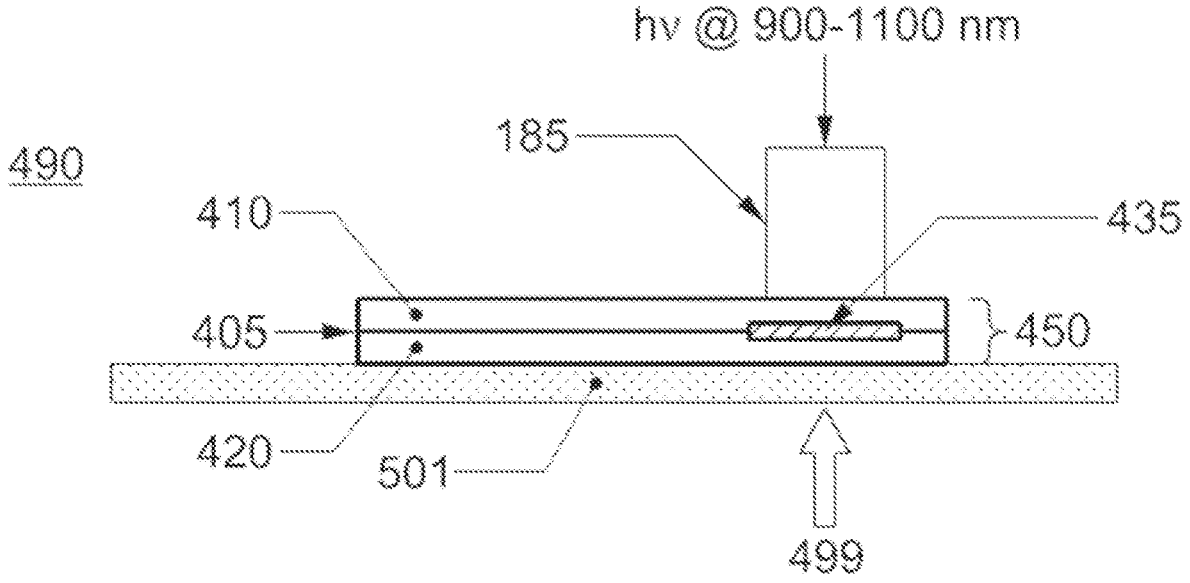
Figure 5D:
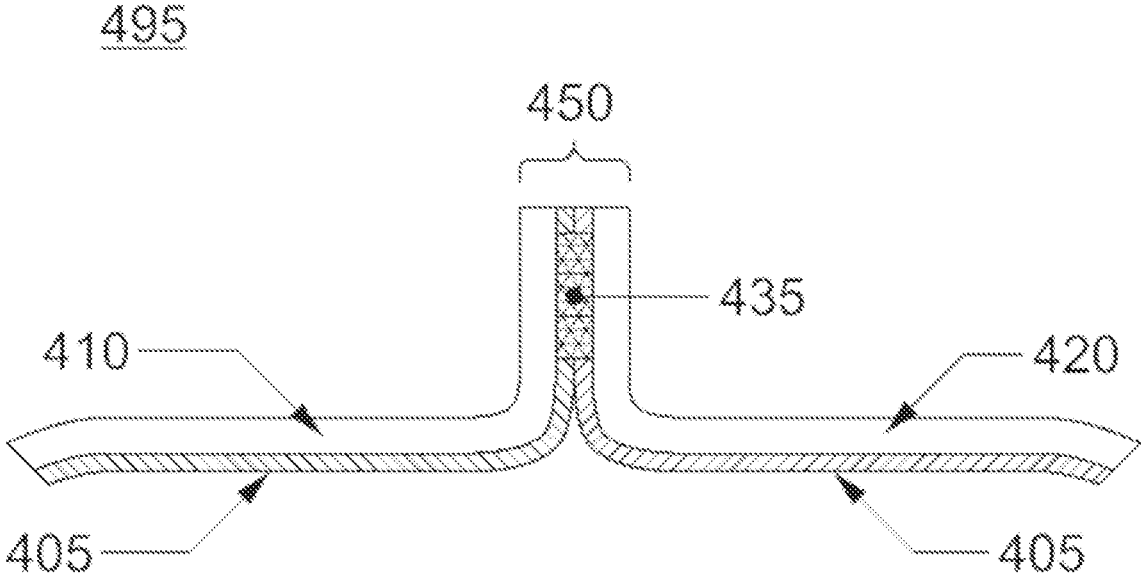

FIG. 5A-D present the general steps involved in the formation of an example fin seam (450). First, as shown in FIG. 5A, an absorption modifier (163) is applied to an area that is desired to be welded on top of a meltable layer (405) located on the inner face of a first FCL (420). Next, as shown in FIG. 5B, the inner face of a second FCL (410), also having a meltable layer (405) on its inner face, is stacked on top of the inner face of the first FCL (420). FIG. 5C illustrates the welding process where energy is directed to the weld location through a transparent wheel (185) that applies a pressure at the weld location (499) for a suitable time, resulting in the melting and fusion of the meltable layers (405). Upon cooling, the meltable layers (405) are fused to form a weld comprising a homogeneous fused layer (106) as shown in FIG. 5C. Moving the welding apparatus along the edge of the materials creates seam (450) comprising weld (435). FIG. 5D presents a cross section view of the seam when the seam is present in an inflated product.

Figure 6A:
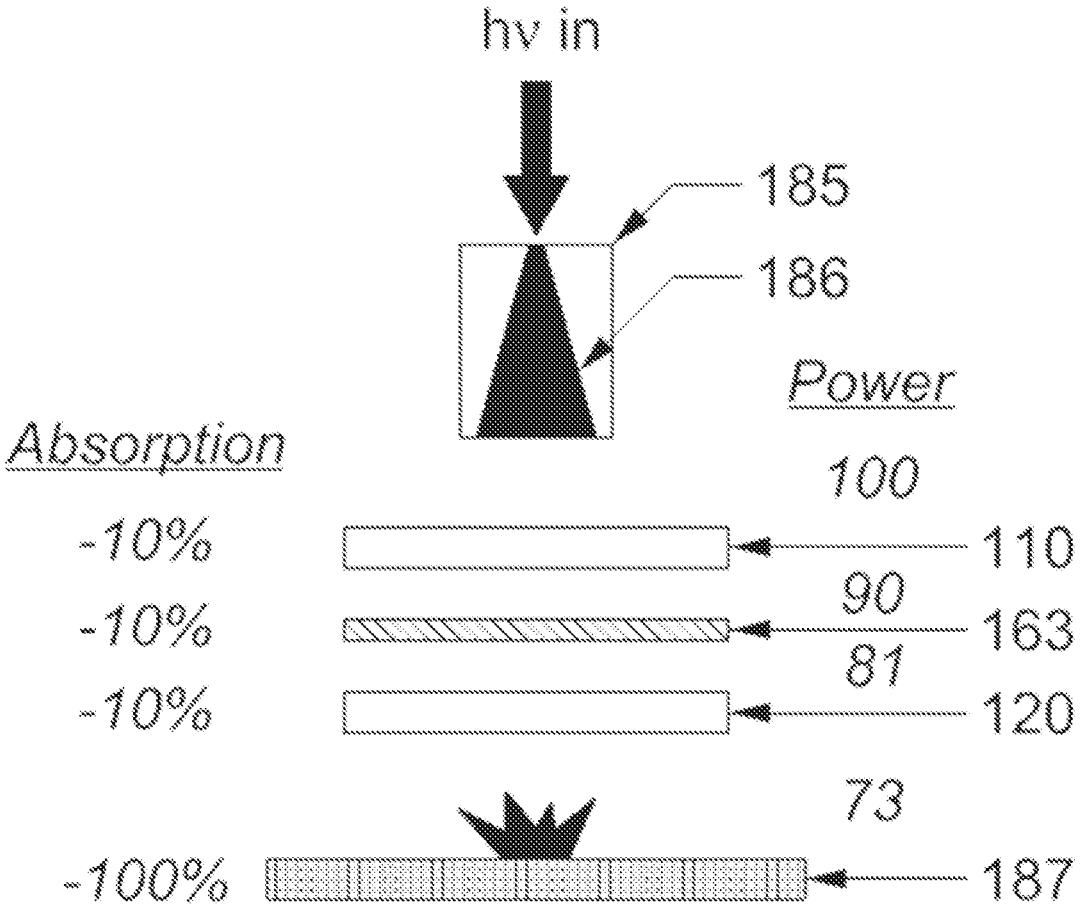
FIGS. 6A, 6B, 6C, 6D, and 6E present illustrations of welding processes illustrating stacked laser welding in aspects according to the present specification.
Figure 6B:
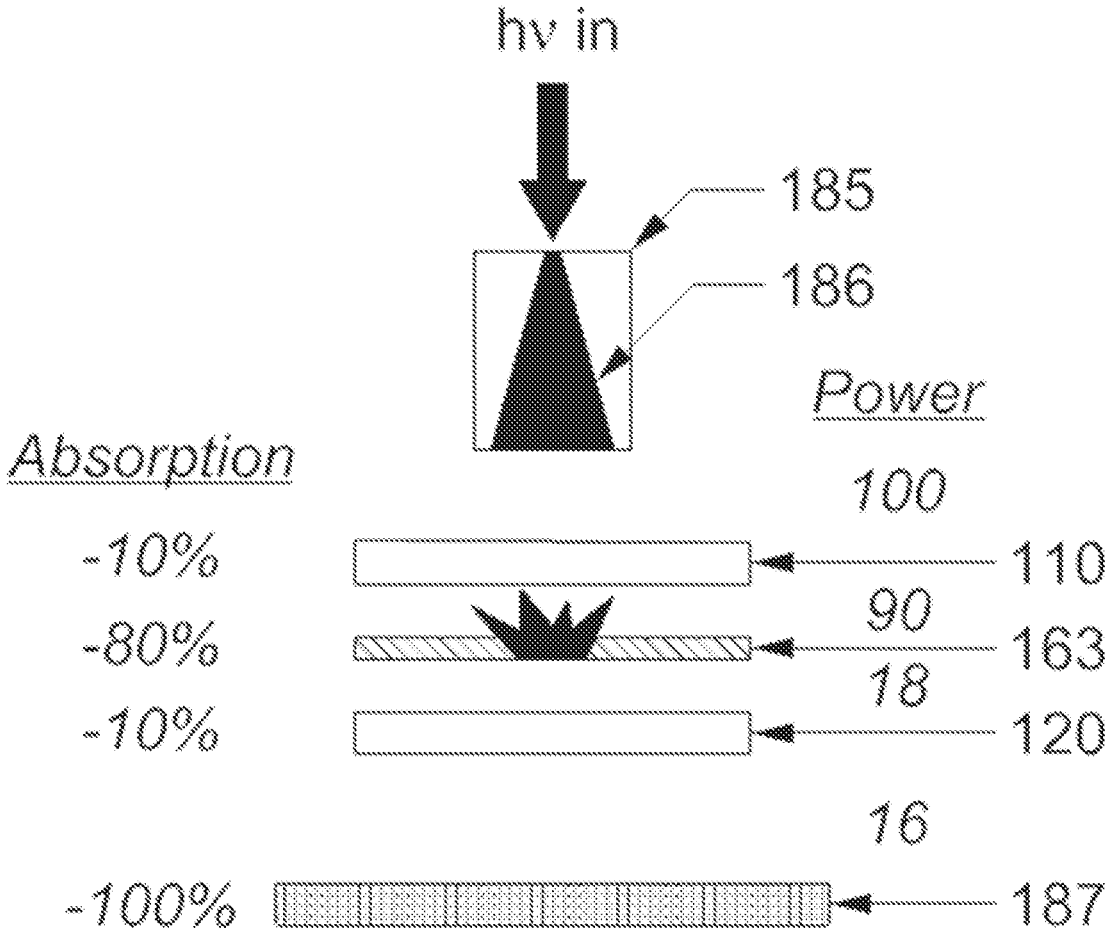
Figure 6C:
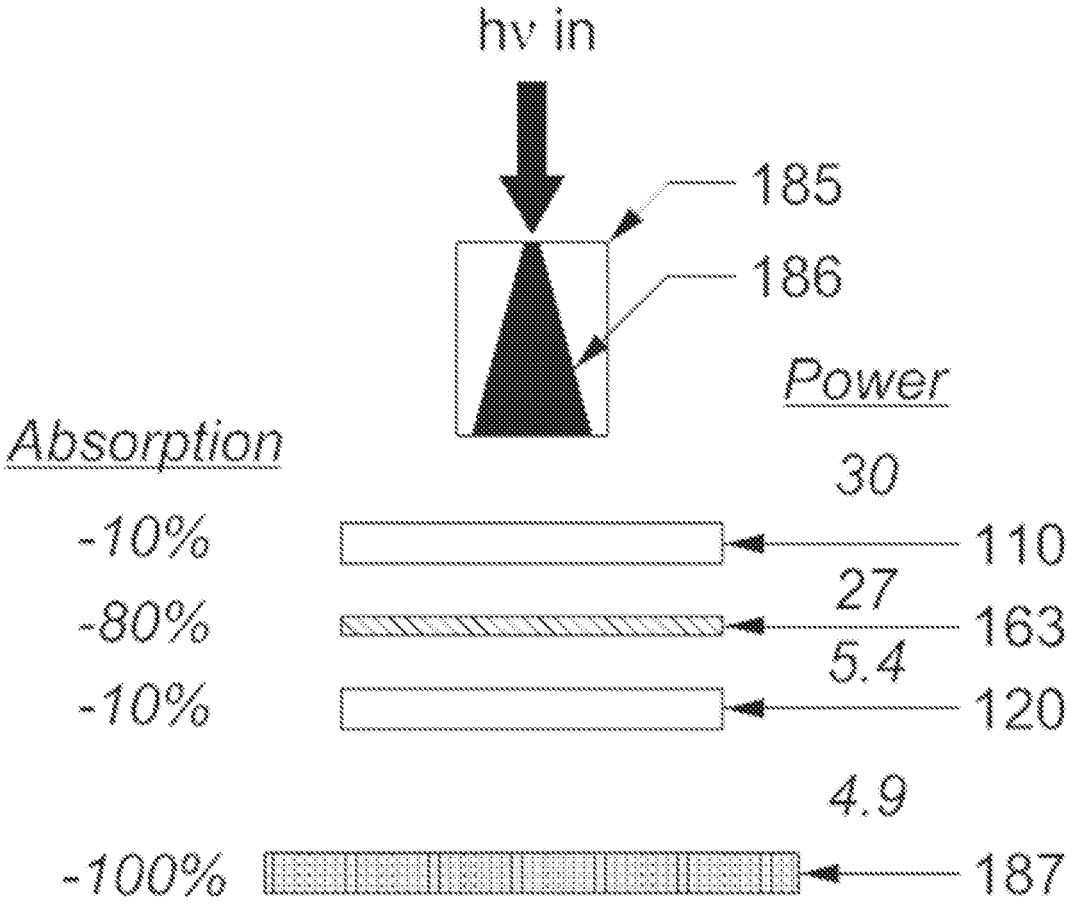
Figure 6D:
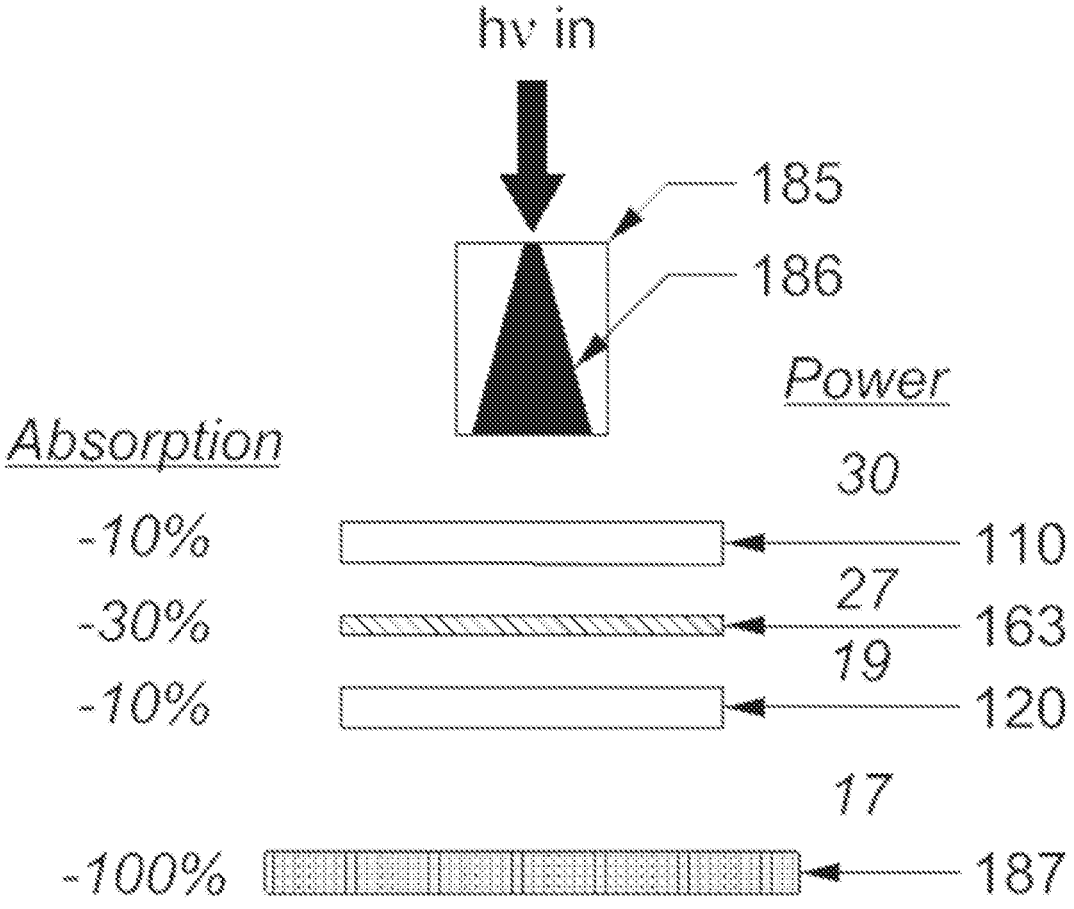
Figure 6E:
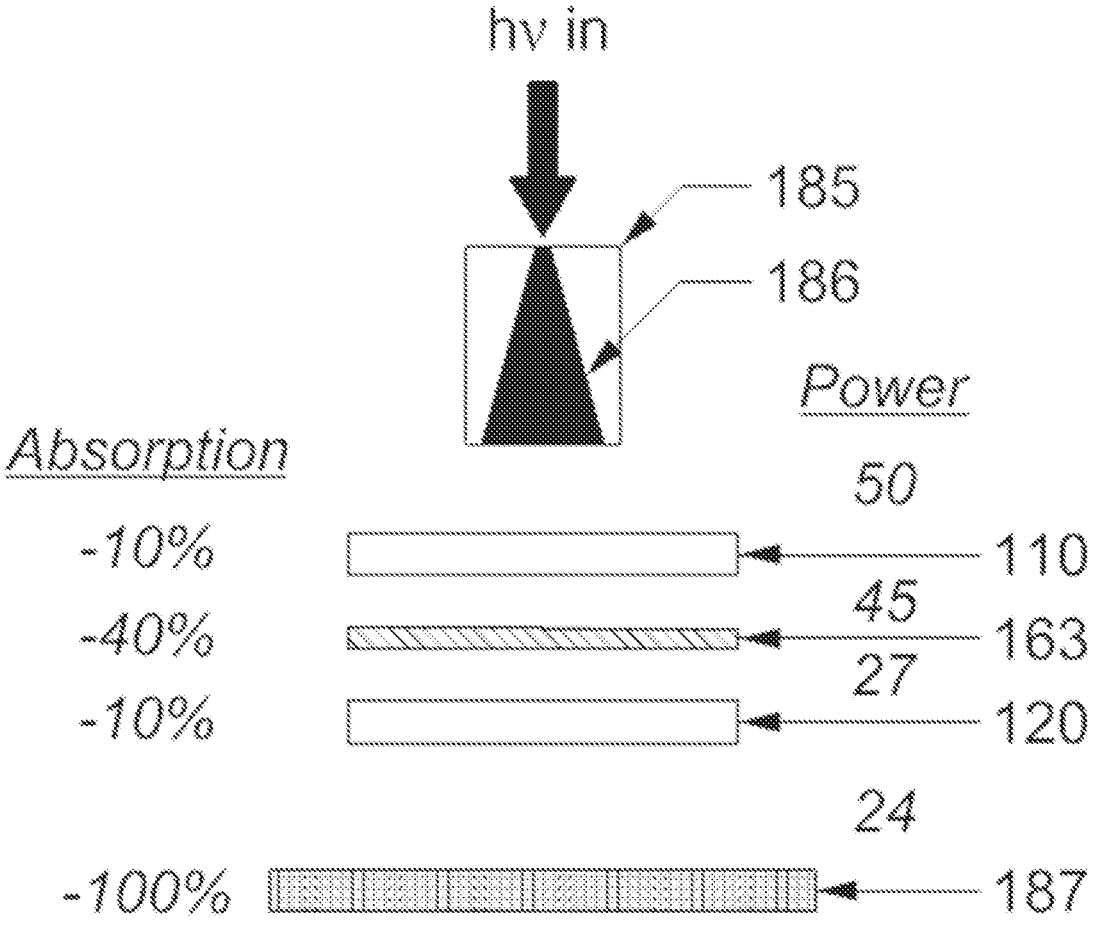

FIGS. 6A-6E illustrates how the variation of the laser power and FCL absorption parameters affect the strength of the weld. FIG. 6A depicts a side view of the example seamed structure of FIG. 5D, showing the different IR absorbing components. As shown, both base FCLs absorb 10% of the applied IR laser energy, the absorption modifier (163) absorbs 10%, and the remainder is absorbed by the base layer resulting in melting of the base layer, but insufficient melting of the meltable layer to create a weld. FIG. 6B presents a similar configuration where the absorption modifier absorbs 80% of the incident IR energy resulting in the melting of the meltable polymer layers, melting of the components of the FCL, and the formation of a weak weld. FIG. 6C presents the same configuration as shown in FIG. 6B where the laser power is reduced to 30% and results in the melting and fusion of the meltable layers, fusion, and formation of a strong weld. FIG. 6D employs the same lower power as FIG. 6C but with an absorption modifier that absorbs only 30% of the applied IR light. The combination of FIG. 6D results in incomplete melting of the meltable layers and formation of a weak bond. FIG. 6E presents another configuration with a power level at 50%, an absorption modifier set to 40% to create a strong bond. Notably, while the FCL layers each absorb IR energy the fibers and matrix are not heated with enough power to melt. Accordingly, while FCL absorption (if present) must be accommodated in adjusting the absorption modifier and energy power to create a strong weld, the low levels of absorption by the FCL layers are insufficient to damage and weaken the overall seam. Importantly, the ability to adjust the absorption of IR energy at each layer allows for the welding of multiple layers in a single operation, and also the ability to weld a stacked combination of materials at specific, discrete layers and locations.

Figure 7A:
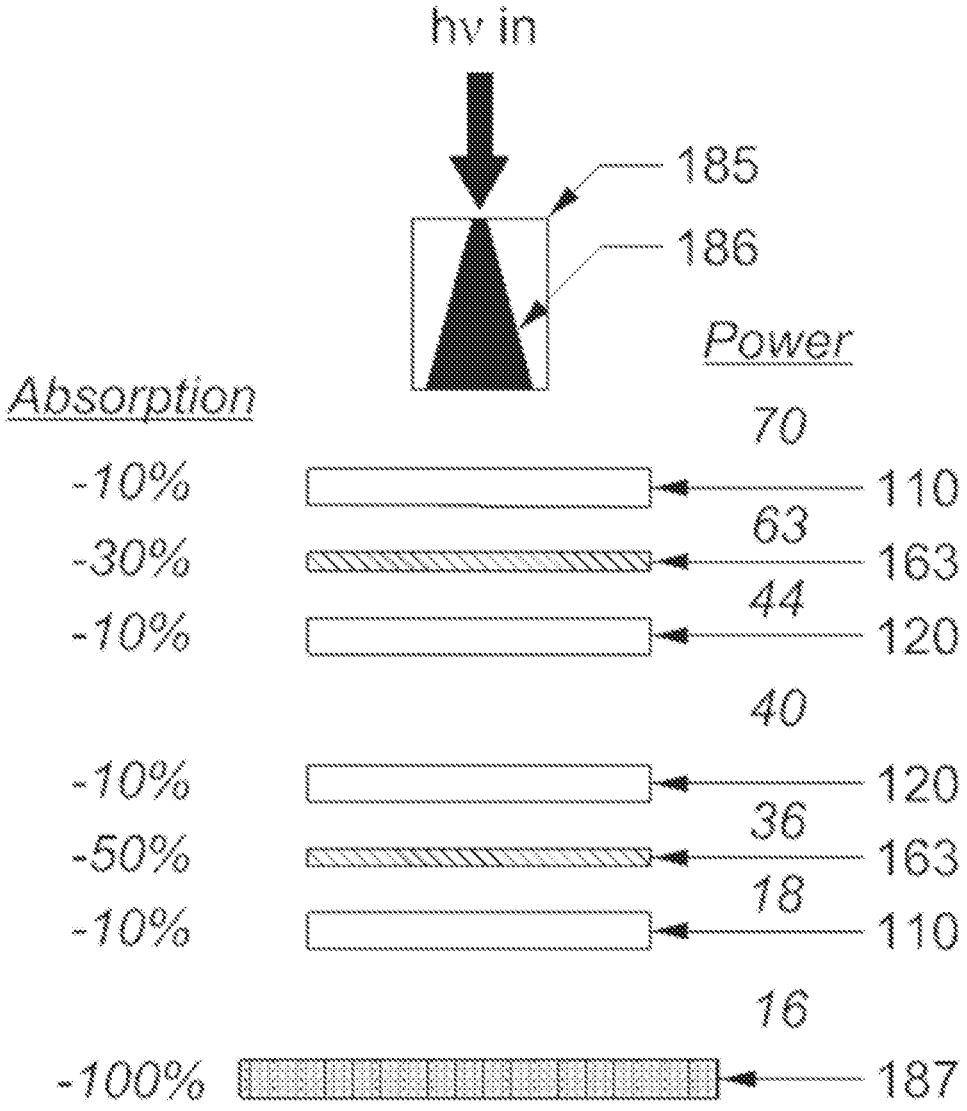
FIGS. 7A and 7B present illustrations of multilayer deep welding of FCL materials according to aspects of the present disclosure.
Figure 7B:
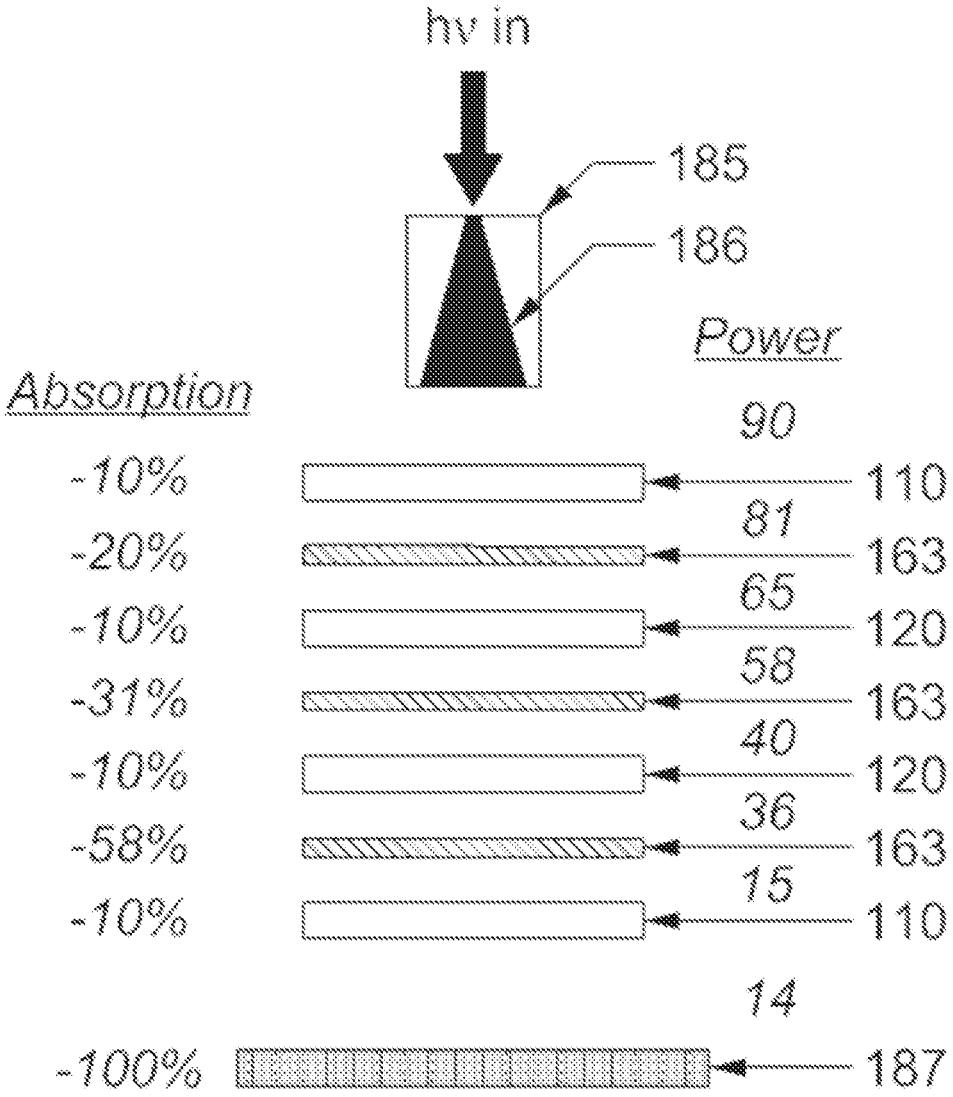

Turning to FIGS. 7A and 7B, the ability to weld simultaneously in a stacked configuration is illustrated. FIG. 7A depicts an exploded view of four FCLs (110, 120, 120, 110) in a stacked configuration providing the absorption of each separate component. The inherent percent absorptivity of each component layer is provided in the left-hand column, and the residual power to which each component layer is exposed is provided in the right-hand column. As shown, two welds are created. FIG. 7B depicts an exploded view of four FCLs (110, 120, 120, 110) in a stacked configuration. Application of the laser at 90% power joins together and creates three fused interface layers. Proper choices of applied laser power and inherent absorptivities of all components results in a strong, intact triple weld in a single pass of the laser/wheel apparatus.

In aspects, seams between the first coated base FCL and a second coated base FCL comprising fibers in adjacent cross-plied monolayers that are perpendicular to each other as illustrated in FIG. 2A. Further included and provided for, are fibers in adjacent cross-plied monolayers that are nearly perpendicular and have an oblique angle of no less than 75 degrees. That is, the fibers are only off perpendicular by a maximum of 15 degrees. In some aspect, the fibers in adjacent cross-plied monolayers are arranged at an angle of no less than 85 degrees. In certain aspects, the fibers in adjacent cross-plied monolayers vary within 75 to 90 degrees. In other aspects, the fibers in adjacent cross-plied monolayers vary within 85 to 90 degrees. In an aspect, the relative orientation of adjacent unidirectionally oriented fibers in two cross-plied monolayers has an oblique angle of no less than 75 degrees. In another aspect, the relative orientation of adjacent unidirectionally oriented fibers in two cross-plied monolayers has an oblique angle of no less than 85 degrees. In an aspect, the relative orientation of adjacent unidirectionally oriented fibers in two cross-plied monolayers is perpendicular. The unidirectionally oriented fibers of the FCL include polyethylene fibers selected from the group consisting of UHMWPE, High Density Polyethylene (HDPE) fibers, Medium-Density Polyethylene (MDPE) fibers, Low-Density Polyethylene (LDPE) fibers, Very Low-Density Polyethylene (VLDPE) fibers, and Cross-Linked Polyethylene (PEX) fibers. In an aspect, the unidirectionally oriented fibers in cross-plied monolayers (101) are Ultra-High Molecular Weight Polyethylene (UHMWPE) fibers.

The present disclosure provides for, and includes, seams between a first coated base FCL and a second coated base FCL comprising fibers in adjacent cross-plied monolayers, where the relative orientation of the fibers in the adjacent cross-plied monolayers have an oblique angle that is between 75 degrees and 85 degrees. In an aspect, the relative orientation of fibers in adjacent cross-plied monolayers have an oblique angle that is between 80 degrees and 85 degrees. In an aspect, the relative orientation of adjacent unidirectionally oriented fibers in two cross-plied monolayers has an angle that is between 75 degrees and perpendicular. In an aspect, the relative orientation of adjacent unidirectionally oriented fibers in two cross-plied monolayers has an angle that is between 80 degrees and perpendicular. In an aspect, the relative orientation of adjacent unidirectionally oriented fibers in two cross-plied monolayers has an angle that is between 85 degrees and perpendicular. The unidirectionally oriented fibers of the FCL include polyethylene fibers selected from the group consisting of UHMWPE, High Density Polyethylene (HDPE) fibers, Medium-Density Polyethylene (MDPE) fibers, Low-Density Polyethylene (LDPE) fibers, Very Low-Density Polyethylene (VLDPE) fibers, and Cross-Linked Polyethylene (PEX) fibers. In an aspect, the unidirectionally oriented fibers in cross-plied monolayers (101) are Ultra-High Molecular Weight Polyethylene (UHMWPE) fibers.

The present disclosure provides for, and includes, unidirectionally oriented fibers in adjacent cross-plied monolayers that are parallel or having an oblique angle of no more than 15 degrees. In an aspect, the relative orientation of adjacent unidirectionally oriented fibers in two cross-plied monolayers has an oblique angle of no more than 5 degrees. In an aspect, the relative orientation of adjacent unidirectionally oriented fibers in two cross-plied monolayers is parallel. In an aspect, the relative orientation of adjacent unidirectionally oriented fibers in two cross-plied monolayers has an oblique angle that is between 5 degrees and 15 degrees. In an aspect, the relative orientation of adjacent unidirectionally oriented fibers in two cross-plied monolayers has an oblique angle that is between 5 degrees and 10 degrees. In an aspect, the relative orientation of adjacent unidirectionally oriented fibers in two cross-plied monolayers has an angle that is between parallel and 15 degrees. In an aspect, the relative orientation of adjacent unidirectionally oriented fibers in two cross-plied monolayers has an angle that is between parallel and 10 degrees. In an aspect, the relative orientation of adjacent unidirectionally oriented fibers in two cross-plied monolayers has an angle that is between parallel and 5 degrees. The unidirectionally oriented fibers of the FCL include polyethylene fibers selected from the group consisting of UHMWPE, High Density Polyethylene (HDPE) fibers, Medium-Density Polyethylene (MDPE) fibers, Low-Density Polyethylene (LDPE) fibers, Very Low-Density Polyethylene (VLDPE) fibers, and Cross-Linked Polyethylene (PEX) fibers. In an aspect, the unidirectionally oriented fibers in cross-plied monolayers (101) are Ultra-High Molecular Weight Polyethylene (UHMWPE) fibers.

As used herein, the term "weld" refers to an area where two coated FCLs have been joined or fused together by the application of heat produced by laser light absorption while under pressure. By varying the wavelength, intensity, and absorption modifier (163), different powers are achieved to carefully control the melting of meltable layer (104, 105) while remaining below the melting point of the unidirectionally oriented fibers of layers (101) and (102) and the plastic matrix (103). This careful control allows for welds that are limited to form a fused monolayer weld region (106) while leaving the fibers layers (101) and (102) and the plastic matrix (103) intact and undamaged. Heterogeneity of the welds results in significant losses in tensile strength and renders the weld unsuitable for inflatables and other high strength requiring applications.

The present disclosure provides for, and includes, welds formed by the melting and fusion under pressure of the meltable layer. Suitable meltable layers are selected based on their relative melting temperature compared to the components of the base FCLs. In aspects, the meltable layers are selected to have a melting temperature that is at least 5° C. below the melting temperature of the fibers in the cross-plied monolayers and the embedding plastic matrix. In other aspects, the meltable layer has a melting temperature that is at least 1° C. below the melting temperature of the fibers in the cross-plied monolayers and the embedding plastic matrix. In another aspect, the meltable layer has a melting temperature that is at least 2° C. below the melting temperature of the fibers in the cross-plied monolayers and the embedding plastic matrix. In another aspect, the meltable layer has a melting temperature that is at least 3° C. below the melting temperature of the fibers in the cross-plied monolayers and the embedding plastic matrix. In another aspect, the meltable layer has a melting temperature that is at least 4° C. below the melting temperature of the fibers in the cross-plied monolayers and the embedding plastic matrix. In another aspect, the meltable layer has a melting temperature that is at least 5° C. below the melting temperature of the fibers in the cross-plied monolayers and the embedding plastic matrix. The present disclosure provides for, and includes, meltable layers selected from the group consisting of thermoplastic polyurethane (TPU), thermoplastic polyvinyl chloride (PVC), polyester (PE), nylon, and Mylar®.

The meltable layers of the present disclosure are applied to the FCL as a thin layer. In aspects, the meltable layer is applied during the manufacture of the FCL to ensure strong bonding. The present disclosure provides for meltable layers that are between 10 um and 50 um. In aspects, the meltable layers are applied at a thickness that is no more than 25% of the total thickness of the FCL. Thin meltable layers are preferred in applications are an important considerations. The meltable layers do not contribute significantly to the overall strength the material (that is due to the monolayers of oriented fibers) but do contribute to the strengths of the welds.

As used herein, a "continuous weld" refers to a homogeneous welded joint lacking any weakened, non-fused regions. Conversely, as used herein a "discontinuous weld" refers to welded joint that is non-homogeneous, or comprises one or more regions of incomplete fusion, or both. Discontinuous welds results in significant losses in tensile strength and renders the weld unsuitable for inflatables and other high strength requiring applications. Further, discontinuous welds result in gas leaks and gas permeability.

As used herein, the term "seam" refers to a region along which two FCLs are joined together by a weld of the present disclosure. In an aspect, the joining of two FCLs to form a seam is accomplished by welding using the methods of the present disclosure. The laser welding methods of the present disclosure are distinguishable from welding using radiofrequency ("RF") welding as RF welds result in the incorporation of the RF sorbent that increases the weight of the resulting product. RF welding further produces welds and seams that have lower tensile strength. In an aspect, a seam may be linear, curved, or a combination thereof. As used herein, welds are non-reinforced. Seams for inflatable applications can be reinforced as provided herein. Seams according to the present disclosure can be formed between different FCLs (e.g., different numbers of layers 102 in different matrices 103) as long as they share a common meltable layer.

Fiber Orientation

As illustrated in FIG. 2A, each of the two FCLs (110, 120) is coated on its inner face with a meltable layer (104, 105), and separated by an optional thin coating of an absorption modifier (163). The absorption modifier (163) is necessary in aspects where the meltable layer is transparent to light having a wavelength of between 900 nm and 1400 nm. In this configuration, the two innermost fiber layers (102) of the two FCLs (110, 120) are oriented parallel relative to one another to obtain maximal strength.

FIG. 2B shows a side view of two FCLs (210, 120) in an alternative stacked configuration (200), where the first FCL (210) comprises two stacked, unidirectionally oriented UHMWPE fiber cross-plied monolayers (201, 202) embedded within a plastic matrix (103), and the second FCL (120) comprises two stacked, unidirectionally oriented UHMWPE fiber cross-plied monolayers (101, 102) embedded within a plastic matrix (103). Each of the two FCLs (210, 120) is coated on its inner face with a meltable layer (104, 105), and separated by an optional absorption modifier (163). In this configuration, the two innermost fiber layers (201, 102) of the two FCLs (210, 120) are oriented perpendicular relative to one another.

The seams of the present disclosure comprise a weld that is a homogeneous, fused monolayer formed from a meltable layer applied to the surface of FCLs during manufacturing. The weld is formed from a meltable coating present on each surface of the FCL. In an aspect, the weld is formed by the melting of the polymer coatings that absorb light between 900 nm and 1100 nm. That is, the absorption modifier (163) is integrated into the meltable layer. In other aspects, the meltable layers do not contain an absorption modifier (163) and welding requires that it be applied to the surface of either FCL, or both FCLs. This configuration is advantageous as it allows the amount of absorption, and thus heating, to be more carefully controlled. More importantly, by arranging the absorption modifiers and FCLs in a stack, single pass welding can be performed as illustrated in FIGS. 7A and 7B. As shown in FIG. 7A, a stack of four FCL layers having multiple polymer coatings can be simultaneously welded at two locations at different depths using a single pass of the laser. As shown in FIG. 7B, a stack of four FCL layers having multiple polymer coatings can be simultaneously welded at three locations at different depths using a single pass of the laser.

The present disclosure provides for, and includes, welds and seams where the fibers of the first and second coated FCLs (110) and (120) in the adjacent cross-plied monolayers are undamaged. By avoiding damage, the strength of the FCL materials is maintained and the strength of the weld and seam is maximized. The unidirectionally oriented fibers of the FCL include polyethylene fibers selected from the group consisting of UHMWPE, High Density Polyethylene (HDPE) fibers, Medium-Density Polyethylene (MDPE) fibers, Low-Density Polyethylene (LDPE) fibers, Very Low-Density Polyethylene (VLDPE) fibers, and Cross-Linked Polyethylene (PEX) fibers. In an aspect, the unidirectionally oriented fibers in cross-plied monolayers (101) are Ultra-High Molecular Weight Polyethylene (UHMWPE) fibers.

When referring to a seam or weld, the term "damage" refers to undesirable physical changes to the underlying fibers which weaken the seam. The physical changes corresponding to fiber damage may be visibly observable. In an aspect, the physical changes corresponding to damaged fibers include, but are not limited to, discoloration, rippling, bubbling, deformation, and tearing. In an aspect, damage may arise from overheating during the welding process. In an aspect, damage may arise from an external force or forces applied to the weld or seam during or after the welding process. In other aspects, the physical changes corresponding to fiber damage need to be observed microscopically.

The present disclosure provides for, and includes, seams between a first and second coated FCL that has less than 10% damaged fibers per square centimeter ($cm^2$) as determined by scanning electron microscopy.

As used herein, the term "scanning-electron microscopy (SEM)" refers to an imaging technique that focuses a high energy beam of electrons over a surface to create a magnified image that is from 200× to 91,000× of the actual size. In an aspect, the quality of fibers comprising a weld or seam is evaluated by SEM. In an aspect, any observable damage to fibers comprising a weld or seam is revealed by SEM. In a related aspect, observable damage to fibers comprising a weld or seam is quantified by analyzing a section of the weld or seam having an area of about 0.5 $cm^2$ by SEM. In another related aspect, observable damage to fibers comprising a weld or seam is quantified by analyzing a section of the weld or seam having an area of about 1 $cm^2$ by SEM. In another related aspect, observable damage to fibers comprising a weld or seam is quantified by analyzing a section of the weld or seam having an area of about 2 $cm^2$ by SEM. In another related aspect, observable damage to fibers comprising a weld or seam is quantified by analyzing a section of the weld or seam having an area of about 3 $cm^2$ by SEM. In another related aspect, observable damage to fibers comprising a weld or seam is quantified by analyzing a section of the weld or seam having an area of about 5 $cm^2$ by SEM. In a related aspect, observable damage to fibers comprising a weld or seam is quantified by analyzing a section of the weld or seam having an area of at least 0.5 $cm^2$ by SEM. In another related aspect, observable damage to fibers comprising a weld or seam is quantified by analyzing a section of the weld or seam having an area of at least 1 $cm^2$ by SEM. In another related aspect, observable damage to fibers comprising a weld or seam is quantified by analyzing a section of the weld or seam having an area of at least 2 $cm^2$ by SEM. In another related aspect, observable damage to fibers comprising a weld or seam is quantified by analyzing a section of the weld or seam having an area of at least 3 $cm^2$ by SEM. In another related aspect, observable damage to fibers comprising a weld or seam is quantified by analyzing a section of the weld or seam having an area of at least 5 $cm^2$ by SEM.

The present disclosure provides for, and includes, undamaged welds and seams where the damage is measured as an average of an area of between 0.5 $cm^2$ and 5 $cm^2$ measured over an area of between 10 $cm^2$ to 30 $cm^2$. In an aspect, an undamaged weld area of at least 1 $cm^2$ is an average determined from an area of at least 10 $cm^2$. In another aspect, an undamaged seam comprises an area of at least 0.5 $cm^2$ is an average determined from an area of at least 20 $cm^2$. In an aspect, damage to an area of at least 1 $cm^2$ is an average determined from an area of at least 20 $cm^2$.

In an aspect, the amount of a unit area of a seam or weld that is revealed by SEM to be free of damage may be expressed as a percent area free from damage over the entirety of the measured region. In a further aspect, free from damage corresponds to no observable discoloration, rippling, bubbling, deformation, and tearing of fibers as revealed by SEM. In another further aspect, damage corresponding to discoloration, rippling, bubbling, deformation, and tearing of fibers results from overheating.

In aspects of the present disclosure, the damage observed in a unit area of a seam or weld as revealed by SEM may be expressed as a percent damage over the entirety unit area. In a further aspect, damage corresponds to observable evidence of discoloration, rippling, bubbling, deformation, and tearing of fibers as revealed by SEM. In another further aspect, damage results from overheating.

The present disclosure provides for, and includes, for seams between a first and second coated FCL that has less than 10/damaged fibers per square centimeter ($cm^2$) as determined by scanning electron microscopy. In an aspect, the fibers of two coated FCLs comprising a seam in an area of at least 1 $cm^2$ show no damage from overheating as revealed by SEM. In an aspect, the fibers of two coated FCLs comprising a seam in an area of at least 1 $cm^2$ show from 1 to 2% damage as revealed by SEM. In an aspect, the fibers of two coated FCLs comprising a seam in an area of at least 1 $cm^2$ show about 5% damage as revealed by SEM. In an aspect, the fibers of two coated FCLs comprising a seam in an area of at least 1 $cm^2$ show about 10% damage from overheating as revealed by SEM.

The present disclosure provides for, and includes, seams wherein the fibers and plastic matrix of the joined FCLs are 90% free of discoloration, rippling, bubbling, deformation, and tearing. The absence of discoloration, rippling, bubbling, deformation, and tearing provides a visual indication of the success of the welding process and the strength of the seam. In an aspect, about 95% of a weld or seam in an area of at least 1 $cm^2$ is free of discoloration, rippling, bubbling, deformation, and tearing. In an aspect, a weld or seam in an area of at least 1 $cm^2$ is free of discoloration, rippling, bubbling, deformation, and tearing. In determining the presence of discoloration, rippling, bubbling, deformation, and tearing, a minimum of 10 cm of a seam is evaluated.

Physical damage to a seam or weld may also be observed as areas of weld discontinuity, as revealed by SEM. In particular, discontinuous weld lines oriented perpendicular to the direction of the seam are indicative of weld discontinuity. In aspects of the present disclosure, weld discontinuity is quantified by analyzing a section of the weld or seam having a length of between 10 and 20 cm by SEM. In aspects of the present disclosure, weld discontinuity is quantified by analyzing a section of the weld or seam having a length of between 10 and 20 cm by eye. In an aspect, a seam or weld shows no visible discontinuous weld lines oriented perpendicular to the direction of the seam when sampled along a length of at least 10 cm. In an aspect, a seam or weld shows no visible discontinuous weld lines oriented perpendicular to the direction of the seam when sampled along a length of at least 20 cm.

The present disclosure provides for, and includes, seams wherein the fibers of the joined FCLs have less than 5% by weight of melt recrystallized fibers. As used herein, the term "melt recrystallization" refers to fibers that have partially melted during the welding process and have then re-bonded upon cooling. Melt recrystallization of an area of a weld or seam can be determined by analyzing the area by differential scanning calorimetry (DSC). Melt-recrystallized fibers in a sample correspond to an observed endothermic peak in a DSC trace of the sample employing a temperature gradient of 10° C./min, and percentage of melt-recrystallized fibers present in the sample corresponds to the relative magnitude of the endothermic peak.

The present disclosure provides for, and includes, seams wherein less than 5% by weight of the fibers in the adjacent cross-plied monolayers are recrystallized. In aspects of the present disclosure, melt-recrystallization is measured by DSC with a temperature gradient of 10° C./min and the sample area is at least 10 $cm^2$. In an aspect, less than 2% by weight of the fibers comprising a seam are melt recrystallized as determined by the testing of a sample of the seam by differential scanning calorimetry with a temperature gradient of 10° C./min. In another aspect, less than 1% by weight of the fibers comprising a seam are melt recrystallized as determined by the testing of a sample of the seam by differential scanning calorimetry with a temperature gradient of 10° C./min. In yet another aspect, no melt recrystallized fibers are detected upon the testing of a sample of the seam sample by differential scanning calorimetry with a temperature gradient of 10° C./min.

Figure 4A:
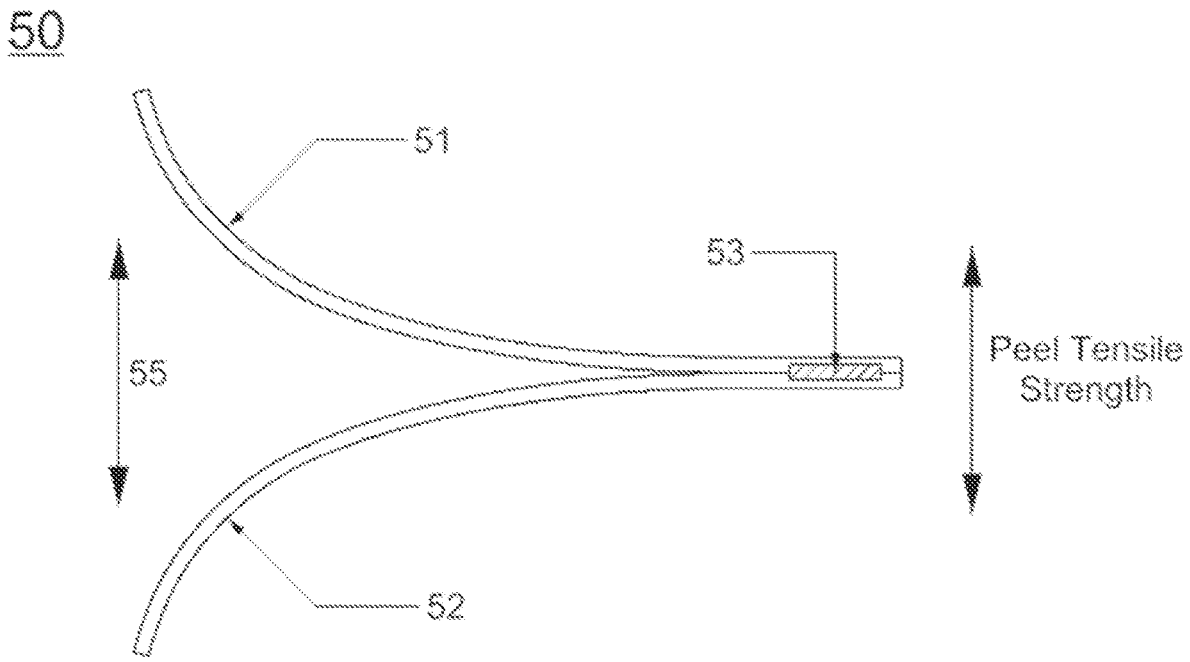
FIGS. 4A and 4B illustrate the seam types between base FCLs.
Figure 4B:
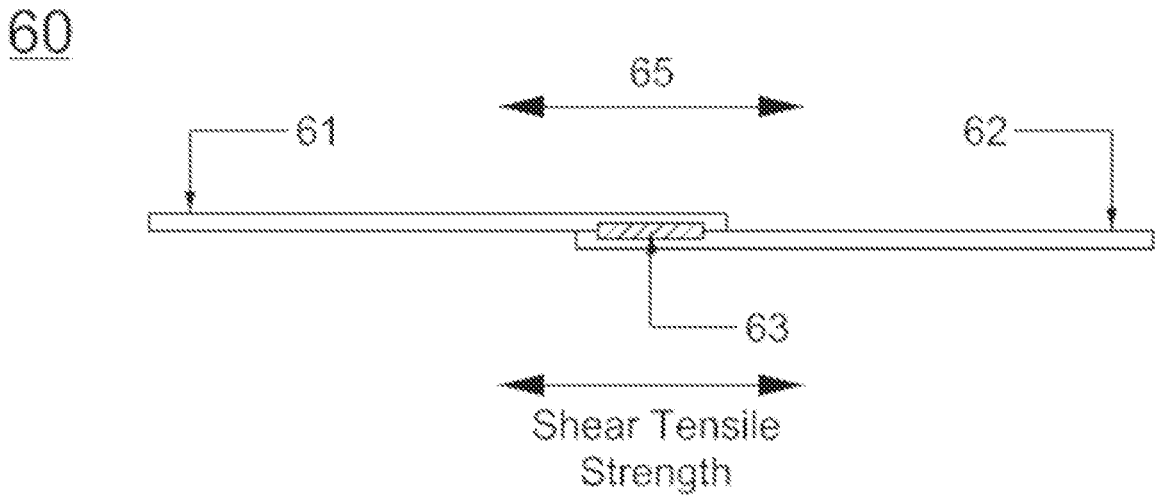
Figure 12A:
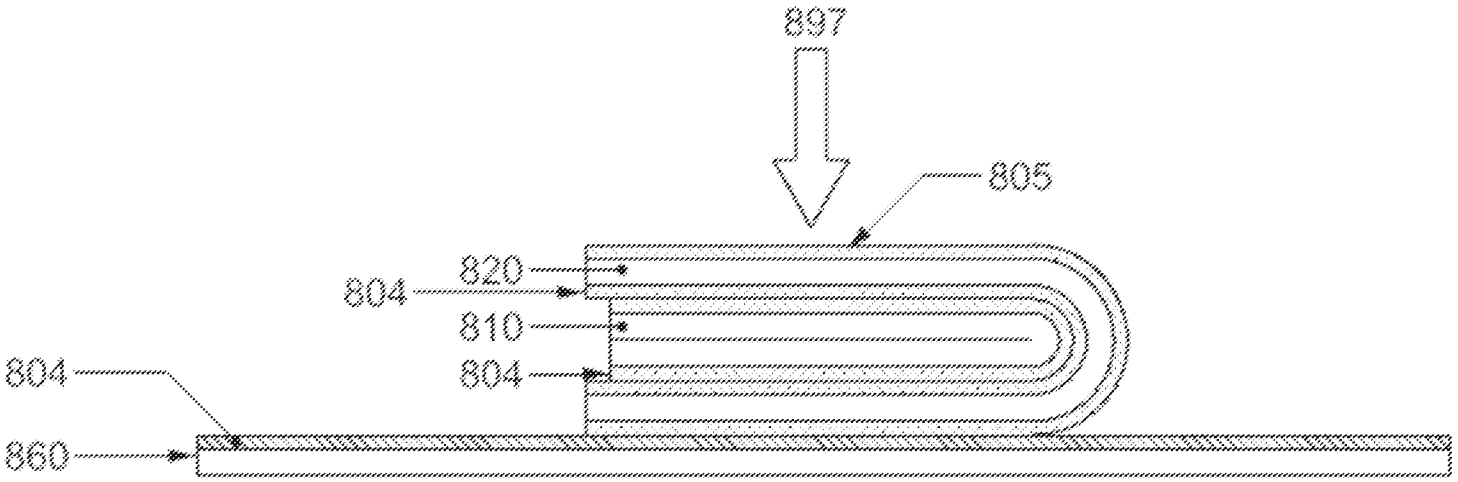
FIG. 12A presents an illustration of the assembly and welding of the curved reinforced tab of FIGS. 10D and 11D.
Figure 12B:
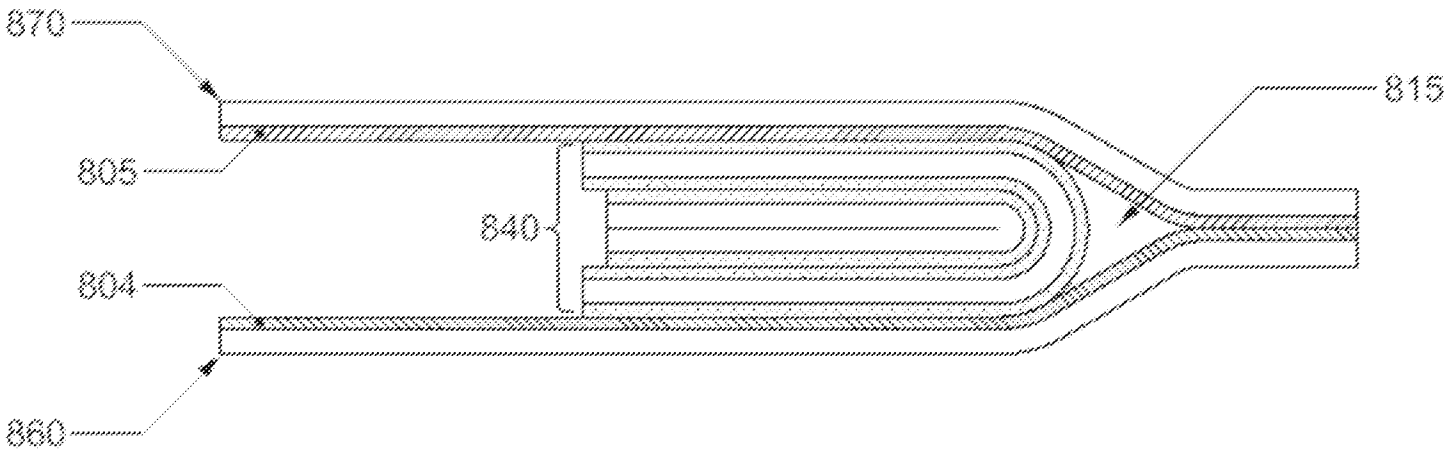
FIG. 12B illustrates the stacking of a second base FCL (870) arranged on top with the edges of the two aligned and the Flexus tab placed at a distance and providing an intra-seam space (815).
Figure 12C:
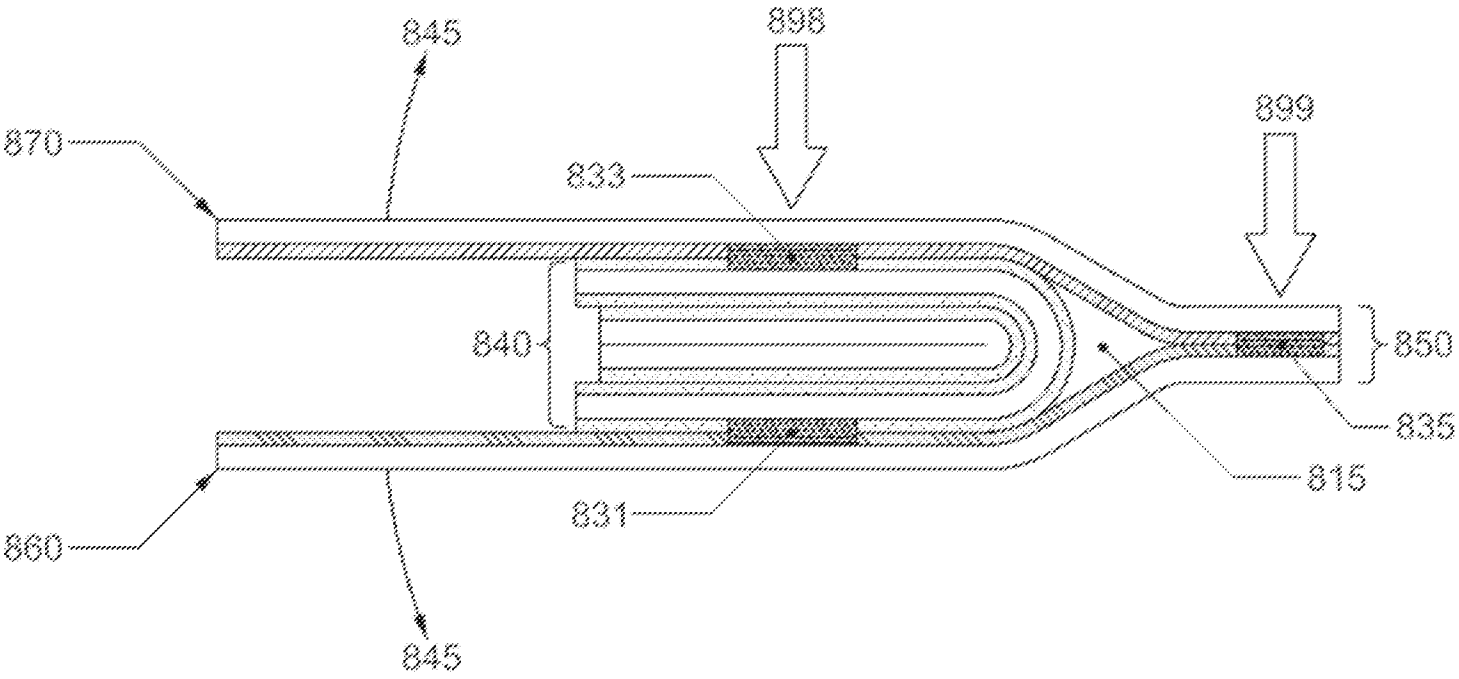
FIG. 12C presents an illustration of the welded seam including a fin seam (835) between the two base FCLs and reinforcement seams (831) and (833) between the Flexus tab and base FCLs.
Figure 12D:
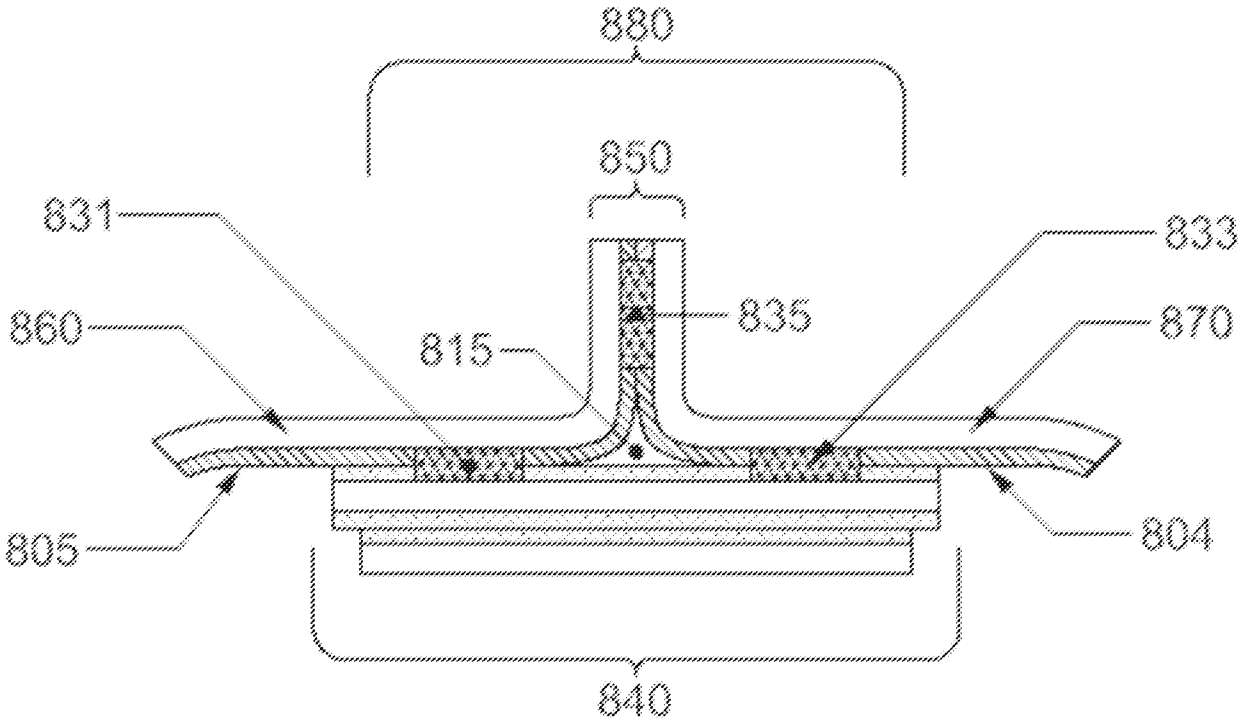
FIG. 12D presents the welded seam of FIG. 12C in an inflated form in accordance with the present disclosure.

The present disclosure provides for, and includes, for seams between FCLs that are highly resistant to ripping or tearing when tested and have high tensile strength when tested using methods known to those of skill in the art. As used herein, the term "tensile strength" of a seam or a reinforced seam, also referred to as the ultimate tensile strength, refers to the maximum amount of pulling force that the seamed FCL can withstand before failure or breakage. Tensile strength is typically measured in Newtons per 5 centimeters (N/5 cm), or in pounds per square inch ($lb/in^2$). As used herein, a tensile strength measurement measures either the shear tensile strength or the peel tensile strength of a seam. As used herein, "peel tensile strength" refers to the tensile strength of a fin seam measured perpendicular to the direction of the cross section of the seam as shown in FIG. 4A. As used herein, "shear tensile strength" is measured parallel to the direction of the cross section of the seam as shown in FIG. 4B. Reinforced seams as shown in FIG. 9D and FIG. 12D comprise two overlap seams and one peel seam.

As used herein, the term "average tensile strength" refers to a mean tensile strength value calculated from at least three of tensile strength measurements of seams prepared using identical conditions (e.g., laser power, absorption modifier and amount, pressure, and dwell time, base FCLs and meltable layers) As used herein, an average tensile strength measurement measures either the average shear tensile strength or the average peel tensile strength of a seam, or both for a reinforced seam. As used herein, the term "coupon" refers to a segment or section of a seam or reinforced seam for which a tensile strength or average tensile strength is determined. As used herein, coupons have overall dimensions of 2.54 cm×12.7 cm and are bisected by a seam comprising a weld having a width of about 1 cm. Coupons may comprise either a peal seam or a fin seam. In aspects, a coupon comprises a reinforced seam as shown in FIG. 9D and FIG. 12D.

The present disclosure provides for, and includes, seams between a first and second base coated fabrics (110) and (120) comprising a homogeneous, fused monolayer (106) formed from meltable layers (104) and (105) from each of the first and second coated fabrics (110) and (120) that are characterized by high tensile strength. In aspects, the seams have a tensile strength that is at least 10% of the tensile strength of the base FCLs. For seams having base FCLs of differing structure and tensile strength, the seams of the present disclosure have seams that are at least 10% of the tensile strength of the weakest base FCL. Using the methods of the present disclosure, reinforced seams are prepared that have tensile strengths that exceed the tensile strength of the underlying FCLs. As will be understood by persons of skill in the art, seams of the present disclosure depend on the width of the weld. Wider welds provide for greater tensile strength, particularly for shear seams. In contrast, fiber damage such as melting and recrystallization, burning, and FCL discoloration, rippling, bubbling, and deformation all result in significantly weaker welds and seams.

In aspects of the present disclosure, fin seams have an average peel tensile strength that is at least 10% of the base tensile strength of the weaker of two coated FCLs comprising the seam when tested on a coupon with a 1 cm width. In aspects, the fin seams have at least 15% of the base tensile strength of the weaker of two coated FCLs comprising the seam. In further aspects, the fin seam has a peel tensile strength that is at least 20% of the base tensile strength of the weaker of two coated FCLs comprising the seam. The methods and welds further provide fin seams having at least 25% of the base tensile strength of the weaker of two coated base FCLs comprising the seam. In aspects, fin seams of the present disclosure have an average peel tensile strength of between 10% and 25% of the base tensile strength of the weaker of two coated base FCLs comprising the seam. Also provided for, and included, are fin seams that are between 10% and 50% of the base tensile strength of the weaker of two coated base FCLs comprising the seam. In aspects, a fin seam has an average peel tensile strength that is between 70% and 75%, between 75% and 80%, between 80% and 85%, between 85% and 90%, between 90% and 95%, between 70% and 80%, between 75% and 85%, between 80% and 90%, or between 70% and 95% the base tensile strength of the weaker of two FCLs comprising the seam.

In aspects of the present disclosure, overlap seams have at least an average shear tensile strength that is at least 10% of the base tensile strength of the weaker of two coated FCLs comprising the seam when tested on a coupon with a 1 cm width. In aspects, the overlap seams have at least 15% of the base tensile strength of the weaker of two coated FCLs comprising the seam. In further aspects, the overlap seam has a shear tensile strength that is at least 20% of the base tensile strength of the weaker of two coated FCLs comprising the seam. The methods and welds further provide overlap seams having at least 25% of the base tensile strength of the weaker of two coated base FCLs comprising the seam. In aspects, overlap seams of the present disclosure have an average shear tensile strength of between 10% and 25% of the base tensile strength of the weaker of two coated base FCLs comprising the seam. Also provided for, and included, are overlap seams that are between 10% and 50% of the base tensile strength of the weaker of two coated base FCLs comprising the seam. In aspects, an overlap seam has an average shear tensile strength that is between 70% and 75%, between 75% and 80%, between 80% and 85%, between 85% and 90%, between 90% and 95%, between 70% and 80%, between 75% and 85%, between 80% and 90%, or between 70% and 95% the base tensile strength of the weaker of two FCLs comprising the seam.

The present disclosure provides for, and includes, reinforced seams that have high tensile strengths including tensile strengths equal to or greater than the tensile strength of the underling base FCLs. When used in inflatable products, for example, reinforced seams that are stronger than the underlying FCLs exhibit "catastrophic failures", where failure occurs in a broad area of the body, and not along a seam or a specific location. Strong, lightweight reinforced seams that are stronger than the underlying materials are highly desirable. In aspects, reinforced seams of the present disclosure have average tensile strengths that are at least 70% of the base tensile strength of the weaker of two FCLs comprising the reinforced seam. As noted, reinforced seams comprise both fin and overlap seams. Accordingly, when measuring a reinforced seam of the present disclosure, the average tensile strength includes both peel and shear components. In some aspects, the average tensile strength is between 70% and 100%. Notably, while the reinforced seams of the present disclosure may have tensile strengths greater than 100%, the underlying FCLs limit the measurement. In such aspects, the FCLs fail before the reinforced seam leaving the actual reinforced seam tensile strength indeterminate. In aspects, the average tensile strength of a reinforced seam (e.g., both Tensor- and Flexus-reinforced seams) that is at least 75% of the base tensile strength of the weaker of two FCLs comprising the reinforced seam. In a further aspect, the average tensile strength of a reinforced seam (e.g., both Tensor- and Flexus-reinforced seams) that is at least 80% of the base tensile strength of the weaker of two FCLs comprising the reinforced seam. In further aspects, the average tensile strength of a reinforced seam (e.g., both Tensor- and Flexus-reinforced seams) that is at least 85% of the base tensile strength of the weaker of two FCLs comprising the reinforced seam. Other aspects provide for reinforced seams having an average tensile strength that is at least 90% of the base tensile strength of the weaker of two FCLs comprising the reinforced seam. In aspects, the average tensile strength of a reinforced seam (e.g., both Tensor- and Flexus-reinforced seams) that is at least 95% of the base tensile strength of the weaker of two FCLs comprising the reinforced seam.

The seams of the present disclosure include seams joining a variety of FCLs. Each FCL of the present disclosure comprises a plurality of stacked, unidirectionally oriented fibers in cross-plied monolayers (101) and (102) embedded in a plastic matrix (103), wherein each coated FCL is coated on at least one face with a meltable layer (104) or (105). The unidirectionally oriented fibers of the FCL include polyethylene fibers selected from the group consisting of UHMWPE, High Density Polyethylene (HDPE) fibers, Medium-Density Polyethylene (MDPE) fibers, Low-Density Polyethylene (LDPE) fibers, Very Low-Density Polyethylene (VLDPE) fibers, and Cross-Linked Polyethylene (PEX) fibers. In an aspect, the unidirectionally oriented fibers in cross-plied monolayers (101) are Ultra-High Molecular Weight Polyethylene (UHMWPE) fibers.

As used herein, the term "stacked" refers to successive fiber monolayers being placed or arranged one on top of the next to form a ordered stacking configuration. In aspects according to the present disclosure, an FCL comprises a plurality of stacked, unidirectionally oriented fibers in cross-plied monolayers embedded in a plastic matrix. In further aspects, each of the plurality of stacked, unidirectionally oriented cross-plied monolayers has a thickness that is less than 10 μM (microns), less than 20 μM, less than 30 M, less than 40 μM, less than 50 M, less than 60 μM, less than 70 μM, less than 80 μM, less than 90 μM, less than 100 μM, less than 110 M, or less than 120 μM. In other further aspects, each of the plurality of stacked, unidirectionally oriented cross-plied monolayers has a thickness that is about 10 μM (microns), about 20 μM, about 30 μM, about 40 μM, about 50 μM, about 60 μM, about 70 μM, about 80 μM, about 90 M, about 100 μM, about 110 μM, or about 120 μM. In other further aspects, each of the plurality of stacked, unidirectionally oriented cross-plied monolayers has a thickness that is between 10 μM and 40 μM, between 40 μM and 80 μM, between 80 μM and 120 μM, between 30 μM and 50 μM, between 40 μM and 60 μM, or between 10 μM and 120 μM. The unidirectionally oriented fibers of the FCL include polyethylene fibers selected from the group consisting of UHMWPE, High Density Polyethylene (HDPE) fibers, Medium-Density Polyethylene (MDPE) fibers, Low-Density Polyethylene (LDPE) fibers, Very Low-Density Polyethylene (VLDPE) fibers, and Cross-Linked Polyethylene (PEX) fibers. In an aspect, the unidirectionally oriented fibers in cross-plied monolayers (101) are Ultra-High Molecular Weight Polyethylene (UHMWPE) fibers.

In aspects according to the present disclosure, an FCL comprises a plurality of stacked, unidirectionally oriented Ultra-High Molecular Weight Polyethylene (UHMWPE) fibers in cross-plied monolayers embedded in a plastic matrix. In an aspect, an FCL of the present disclosure has an outer layer of weldable urethane, a fiber orientation of 0/90 UHMWPE fibers, and a weight of 109 g/m$^2$ (article code CT5HW23, commercially available from DSM). In an aspect, an FCL of the present disclosure has a first outer layer of weldable urethane, a second outer layer of polyester film, and a fiber orientation of 0/90 UHMWPE fibers, and a weight of 80 g/m$^2$ (article code CT5HK.18, commercially available from DSM). In further aspects, each of the plurality of stacked, unidirectionally oriented cross-plied monolayers has a thickness that is less than 10 μM (microns), less than 20 M, less than 30 μM, less than 40 μM, less than 50 μM, less than 60 μM, less than 70 μM, less than 80 μM, less than 90 μM, less than 100 μM, less than 110 μM, or less than 120 μM. In other further aspects, each of the plurality of stacked, unidirectionally oriented cross-plied monolayers has a thickness that is about 10 μM (microns), about 20 μM, about 30 μM, about 40 μM, about 50 μM, about 60 μM, about 70 μM, about 80 μM, about 90 μM, about 100 μM, about 110 μM, or about 120 μM. In other further aspects, each of the plurality of stacked, unidirectionally oriented cross-plied monolayers has a thickness that is between 10 μM and 40 μM, between 40 μM and 80 μM, between 80 μM and 120 μM, between 30 μM and 50 μM, between 40 μM and 60 μM, or between 10 μM and 120 μM.

The FCLs of the present disclosure are coated on at least one or both of its faces with a meltable layer (104, 105) that has a melting temperature that is below the melting temperature of the fibers of cross-plied monolayers (101, 102) and the plastic matrix (103). In some aspects, an FCL may be coated on both faces with the same polymer coating. In some other aspects, an FCL may be coated on each face with a different polymer coating where only the side to be welded requires a meltable polymer. In an aspect, an FCL may be coated on a single face with a polymer coating. In applications that require weight minimization, the FCLs are coated on a single side with a meltable layer. As used herein, the term "meltable layer" refers to an outer layer of polymeric material covering a face of the flexible composite laminate. In practice, the meltable layer is incorporated into the FCL during the manufacturing process and is integrally bonded to the underlying plastic matrix. Not to be limited by theory, it is this integration of the meltable layer that provides for the high tensile strength when bonding as part of a homogeneous fused layer. Suitable meltable layers for use in the present methods and for the preparation of seams are meltable layers that have a melting temperature that is at least 5° C. below the melting temperature of both the fibers in cross-plied monolayers (101) and (102) and the embedding plastic matrix (103). The present disclosure provides for, and includes, meltable layers have a melting temperature of 110° C. or less, 120° C. or less, 130° C. or less, 135° C. or less, 140° C. or less, or 145° C. or less. In some aspects, the meltable layers of the present disclosure have a melting temperature of about 120° C., about 130° C., about 135° C., about 140° C., or about 145° C. In aspects, the meltable layers have melting temperatures of between 120° C. and 130° C., between 130° C. and 140° C., between 135° C. and 145° C., between 130° C. and 145° C., and between 120° C. and 145° C. In the FCLs of the present disclosure, the meltable layer is selected to have a melting point that is 2° C. below the melting point of the plastic matrix (103) and fibers. In other aspects, the meltable layer is selected to have a melting point that is 3° C. below the melting point of the fibers and plastic matrix. In yet other aspects, the meltable layer is selected to have a melting point that is 5° C. below the melting point of the fibers and plastic matrix. Also provided for, and included in the methods and seams of the present disclosure are meltable layers that between 3° C. and 10° C. below the melting points of the fibers in monolayers (101) and (102) and the plastic matrix (103). The present disclosure provides for, and includes, meltable layers selected from the group consisting of epichlorohydrin, thermoplastic polyurethane (TPU), thermoplastic polyvinyl chloride (PVC), polyester (PE), polyvinyl fluoride (PVF), ethylene chlorotrifluoroethylene (ECTFE), ethylene tetrafluoroethylene (ETFE), expanded polytetrafluoroethylene (EPTFE), polyurethane (PU), K.18, WOV6, WOV32c, nylon, and Mylar®.

The present disclosure provides for, and includes, FCLs having meltable layers that are at least 10 μm thick. Also provided for and included are FCLs having meltable layers that are no more than 100 μm thick. In aspects of the present disclosure, the FCLs have meltable layers that are no more than 25% of the thickness of the sum of the plurality of stacked, unidirectionally oriented fibers in cross-plied monolayers (101) and (102) embedded in a plastic matrix (103).

The present disclosure provides for, and includes, gas impermeable seams and FCLs. As provided herein, by selecting a suitable gas impermeable meltable polymer, welds will maintain a gas impermeable seam. Previous approaches to incorporate FCL materials into waterproof products such as tents and jackets required the addition of a support material, sewing, and subsequent application of a sealant. Notably, such sealants can be removed by wear and need to be re-applied. The seams of the present disclosure avoid the need for sealing and allows the preparation of tents and jackets that do not require any sewing while retaining the high strength of the FCL materials. Suitable gas impermeable meltable polymers include thermoplastic polyurethane (TPU), thermoplastic polyvinyl chloride (PVC), and polyester (PE).

The present disclosure provides for, and includes, FCLs having a plurality of stacked, unidirectionally oriented fibers embedded into a plastic matrix that are welded together using the present methods to prepare a seam. As used herein, the term "matrix" refers to a plastic material into which multiple stacked layers of fibers are embedded to form a flexible composite laminate. In some aspects, the plastic matrix is a thermoset, a thermoplastic, or a combination thereof. As used herein, the term "thermoset" refers to a polymer that us irreversibly hardened from a soft solid or viscous liquid prepolymer or resin by application of heat, radiation, pressure, chemical catalysis, or a mixture thereof. As used herein, the term "thermoplastic" refers to a material or resin that takes a liquid form upon heating, but hardens when cooled. In an aspect, a plastic matrix may be an epoxy matrix. As used herein, the term "elastomer" refers to a polymer capable of resuming its normal shape following stretching, contraction, or other distortion. In an aspect, a plastic matrix may be an elastomer. In a further aspect, the elastomer has a tensile modulus that is less than 41 MPa (Megapascals) at 25° C.

The present disclosure provides for, and includes, seams comprising welds that are homogeneous, fused monolayers (106) formed from the meltable layers (104, 105) of each FCL. The welds are formed by heating the meltable layers with a laser at a wavelength of between 900 nm and 1100 nm under a pressure of between 100 and 1,000 kilopascals for a dwell time sufficient to melt the meltable layer. Cooling of the weld results in a homogeneous, fused monolayer (106) formed from said meltable layers (104) and (105) from each of said first and second coated fabrics (110) and (120).

The present disclosure provides for, and includes, FCLs that incorporate a variety of unidirectionally oriented fiber types. In an aspect of the present disclosure, the fibers comprise polyethylene (PE). In an aspect, the PE fibers are Ultra-High Molecular Weight Polyethylene (UHMWPE) fibers. In an aspect, the UHMPE fibers may be Dyneema®, Spectra®, or Dynex®. In an aspect, the PE fibers may be High Density Polyethylene (HDPE) fibers. In an aspect, the PE fibers may be Medium-Density Polyethylene (MDPE) fibers. In an aspect, the PE fibers may be Low-Density Polyethylene (LDPE) fibers. In an aspect, the PE fibers may be Linear Low-Density Polyethylene (LLDPE) fibers. In an aspect, the PE fibers may be Very Low-Density Polyethylene (VLDPE) fibers. In an aspect, the PE fibers may Cross-Linked Polyethylene Fibers (PEX). In an aspect, the PE fibers may be a polyethylene co-polymer. In an aspect, the PE fibers may be a chemically-modified polyethylene.

Suitable FCLs for use in the methods of the present disclosure to prepare high strength seams include component fibers having varying densities depending on the application. For applications requiring high strength such as inflatables and parachutes, higher fiber densities are desirable. At the same time, higher densities result in higher weights and careful balancing of the strength vs. weight is incorporated into the FCL selection process. In aspects, the FCL has a density of less than 3.0 g/cm$^3$. In an aspect, the FCL has an overall density of less than 2.0 g/cm$^3$. In another aspect, the FCL has an overall density of less than 1.5 g/cm$^3$. In an aspect, the FCL has an overall density of less than 1.0 g/cm$^3$. In other aspects, the FCL has an overall density of less than 0.95 g/cm$^3$. In yet another aspect, the FCLs have an overall density of less than 0.90 g/cm$^3$. In an aspect, the FCL has an overall density of 0.97 g/cm$^3$. In general, the first and second FCLs have the same overall density but are not so limited.

The present disclosure provides for, and includes, FCLs for use as base FCLs that have weights of between 15 g/m$^2$ and 200 g/m$^2$. The present disclosure provides for, and includes, FCLs for use as base FCLs that have weights of about 110 g/m$^2$. For applications requiring high strength such as inflatables and parachutes, low weights are desirable. At the same time, a careful balancing of strength vs. weight is incorporated into the FCL selection process. In aspects, the FCL has a weight of less than 50 grams/meter$^2$. In an aspect, the FCL has a weight of less than 40 grams/meter$^2$. In another aspect, the FCL has weight of less than 30 grams/meter$^2$. In an aspect, the FCL has a weight of less than 20 grams/meter$^2$. In other aspects, the FCL has weight at least 15 grams/meter$^2$. In general, the first and second FCLs are selected to have the same overall fiber density but are not so limited.

The welding and fusing of thermoplastic-based textiles is controlled by varying, either separately or in tandem, parameters selected from the group consisting of (i) the power of the IR laser (e.g., the wavelength and intensity of the laser), (ii) the pressure at the weld site, (iii) the amount and extinction coefficient of the absorbance modifier (e.g., the amount of heat applied at the weld site), and (iv) the time period in which the power, heat, and pressure are applied, also known as the "dwell time." The susceptibility of the FCL to damage can be correlated to the overall melting temperature of the fibers in the matrix, and, importantly, can also be correlated to the differences between the fiber and matrix melting temperatures and the melting temperature of the meltable layer. In aspects, the temperature difference is at least 5° C.

While the melting temperatures of the materials in standard textiles are significantly higher than the melting temperatures of meltable layers, the melting temperatures of the materials in FCLs are often within a few degrees of those of meltable polymer coatings. As a result, there is only a narrow temperature range within which an FCL's meltable layer will melt while the integrity of the FCL's components is maintained. This narrow temperature window further limits the methods that can be used to join the FCL materials while creating a strong bond. Radio frequency welding does not provide for sufficient control of heating and further requires the addition of specialized RF absorbents that are incorporated into the weld and seam adding weight while generating a weaker bond. Similarly, applying heated elements does not provide the precision needed to limit melting to the meltable layer. For heated elements, lower temperatures are impracticable as it greatly increases the time needed to create a bond. The temperature window necessitates a very precise delivery of heat to the melt zone, so as to only melt the polymer coating but not to melt or otherwise damage the core FCL fibers (as the polymer coating has the lowest melting point in the entire seam ensemble). The highly desired properties of high tensile strength combined with light weight has heretofore limited the ability to directly join FCL materials. The methods of the present disclosure overcome these problems through (1) the precise delivery of laser energy limited to the meltable layer to provide for localized control of the energy and melting, and (2) controlling the pressure and dwell time to fuse the meltable layers together. As described below, Applicant's custom device comprising a Leister laser, Autometix table, and Sono-Tek absorbent application system provide the required precision. The system further includes an IR transparent wheel through which the laser illuminates the target FCL stack and compresses the stack against the elastomeric backing to apply a pressure. Accordingly, these systems, coupled with the methods described below, provide for joining (welding) together two or more ultra-thin FCL materials, a previously unattainable result in the field.

In aspects, the wavelength for laser illumination and heating is selected to avoid absorption by the FCL fibers and matrix. This configuration avoids improper heating, melting, and subsequent weakening of the FCL material. Further, by avoiding absorbance by the FCL material, heating is limited to the meltable layer. Among the benefits is the ability to simultaneously weld materials together in a stack of FCLs, for example as illustrated in FIGS. 7A and 7B. As shown in FIG. 7A, two colinear welds can be prepared simultaneously in a single pass thereby reducing manufacturing complexity. In addition to selecting illumination wavelengths that avoid absorption by the FCL material, the illumination wavelength can be selected that is absorbed by the meltable polymer layer. While convenient, the wavelengths are necessarily limited by the availability of FCLs having suitable meltable polymers. In aspects, the FCLs include a suitable absorption modifier (163) in the meltable polymer layer to absorb the laser light at the selected wavelength. In other aspects, the absorption modifier (163) is applied to the surface of the meltable layer during the welding process. As provided below, the specification provides a custom apparatus for welding seams that includes a syringe pump and ultrasonic nozzle to apply an absorption modifier during the welding process. In other aspects, the absorption modifier can be applied during the assembly of the FCL stack. The application of a separate absorption modifier the surface of the meltable layer allows greater flexibility in the selection of the wavelength for laser illumination, control of the extinction coefficient and thereby the amount of heating. Even further, by applying differing amounts of absorption modifier to the meltable layer surface, stacked welding as shown in FIG. 7A can be readily achieved. In the layers closest to the laser source, lower percentages of absorption of the more intense laser light are sufficient to melt the polymer coating. As shown in FIG. 7B, 81% of the power reaches the first absorption modifier after some absorption by the FCL layer. The second modifier receives a lower intensity (58% of the initial power) and the absorption is increased in accommodation (e.g., 31%). In the final layer as shown, only 36% of the original laser light reaches the absorption modifier which absorbs 58% of the light. Thus, each layer can be provided with the appropriate amount of energy to melt and yet remain below the melting points of the fibers and matrix of the FCL. This approach greatly simplifies the preparation of reinforced seams as discussed below, but also simplifies the preparation of single seams as the amount of absorption modifier is easily varied independently of the meltable layer.

A quantitative understanding of the inherent absorptivities of the materials to be welded is helpful to effectively weld together FCLs without damaging the internal fibers, resulting in a weakened area. In the absence of quantitative absorptivities, identifying the appropriate wavelengths, intensities, and dwell times can be determined empirically and through trial and error; however such effort would be better spent on independently determining inherent absorptivities prior to welding. While some FCLs have little or no innate absorptivity, others have intermediate levels of absorptivity, while yet other are nearly opaque to applied laser energy. Combining FCL layers and meltable layers with differing levels of inherent absorption allows for the strategic welding of specific areas and depths within a multi-layered seam, for example as illustrated in Example 6. This fine-tuning of absorptivity may be augmented by the application of laser-absorptive adjuncts, herein identified as absorption modifiers (163) at specific areas and depths. In practice, a particularly useful absorption modifier (163) is one that undergoes a color change when exposure to a specific threshold level of laser energy (e.g., ClearWeld™). This provides for a further visible confirmation of the welding process.

One of skill in the art will appreciate that the specific choice of FCL will be dependent upon the application at hand. In addition to choices of fiber and matrix, FCLs are selected based on the number of stacked monolayers. Similarly, the meltable layer can vary depending on the need for air-permeability. For example, while thermoplastic polyurethane (TPU) is an exemplary meltable layer for inflatables, other, thermoplastics may be sufficient for less demanding applications, such as parachute and backpacking tents. In general, an FCL gets stronger and heavier by adding more fibers, as well as more cross-plied layers of fibers. While a strength/weight of Dyneema® classified as CT5 (i.e., standard family Dyneema® with a non-linear strength scale of 5) is suitable for the formation of emergency life preservers, a higher strength/weight of Dyneema®, such as CT9 (i.e., standard family Dyneema® with a non-linear strength scale of 9), is better suited for the formation of inflatable rafts.

Dyneema® itself is composed of multiple stacked layers of unidirectional Ultra-High Molecular Weight Polyethylene (UHMWPE) fibers embedded in a plastic matrix and coated with a thermoplastic polymer layer that strongly adheres to the fiber-matrix core. One or both sides of the Dyneema® material may be coated with the polymer coating, and two different coatings may be present on the two faces of the FCL. Thus, the "welding" process for Dyneema®, or any other FCL, is more akin to "soldering", in that the coating material(s) bonded to each of the matrix-embedded fiber layers joins together the two base materials.

Commonly, FCLs such as Dyneema® are coated on one or both sides with a thermal polyurethane (TPU) coating. As a result of the inherent thinness of Dyneema® and related oriented fiber laminate materials, it is critical that the entire "sandwich" of Dyneema® core material and TPU coatings be well consolidated during the welding process so that the whole of the seamed structure maintains its integrity. In the methods of the present disclosure, the consolidation is provided by applying a pressure between a IR transparent wheel and the elastomeric backing layer. Other thermoplastic coatings such as polyester terephthalate, polyester napthalate, and nylon are also suitable for FCL welding purposes according to the present disclosure. These thermoplastic coatings, along with TPU, are particularly well-suited for use in inflatables as they are colorable, abrasion resistant, and capable of creating airtight seams. Not to be limited by theory, it is thought that the strong bond between the meltable layer and the FCL is due to integration and infiltration of the polymer into the FCL matrix. Thus, the welding process for two FCLs involves fusion of the outer coating materials bonded to each of the base materials to one another.

The present disclosure provides for, and includes, prior to the welding of two FCL materials together, quantifying the intrinsic absorptivities of each FCL and meltable layer by use of an absorption meter or similar method. Further, when the two FCL materials are stacked together to form a pre-weld "sandwich", the absorption of each successive layer of the stack can be, and preferably is, measured. The absorption data so acquired can then be used to determine a favorable balance of applied power, applied force, weld depth, and weld time to be used to generate a strong weld. As will be understood by persons of skill in the art, once parameters are determined, they can be applied throughout the manufacture of the product as the disclosed methods are highly reproducible. As shown below in Table 4, variability between the tensile strength of seams according to the present disclosure vary less than 15% among samples. In aspects, the variability is less than 5% as shown in Table 4 when the adjacent cross-plied monolayers are parallel to each other and parallel to the seam.

As some FCL materials are inherently transparent, or have varying degrees of inherent absorption, the addition of an absorption modifier (163), placed in/under the weld line, can be used to achieve the desired welding conditions. Indeed, polymers and other materials (e.g., pigments) in UHMWPE textiles absorb energy differently, depending in the molecular nature of the constituents. Thus, absent the use of a defined absorption modifier, determining the optimal welding conditions can require significant, but routine, trial and error testing. Once the parameters are determined however, the methods can be repeatedly applied due to the precision of the welding techniques disclosed herein with variabilities reduced below 10% or even 5%. In view of the wide range of absorbent materials known, different materials can be used to absorb different features of the electromagnetic spectrum. In the current application, the absorbent materials that have found use in photographic films are applied to textile welding, but an array of known laser absorbents are available to one of skill in the art. See e.g., P. A. Hilton et al., "Laser Welding of Fabrics Using Infrared Absorbing Dyes," presented at the International Conference on Joining of Advanced and Specialty Materials III, ASM 2000, Oct. 9-12, 2000, St. Louis, MO.

In general, liquid absorbents are used for the welding of textiles and are often most convenient, but absorption modifiers may also be in the form of a film, a paste, a gel, a suspension, a spray, a powder, or a solution. The formulations and concentrations of absorption modifier solutions or suspensions may be varied to regulate the overall amount of absorption. The amount of absorption varies in conjunction with varying the wavelength of applied energy, the length of time of illumination (e.g., dwell time), the concentration of absorption modifier, and the extinction coefficient of the absorption modifier, the overall absorption profile is adjusted to produce a strong weld. Generally speaking, excessive absorption will lead to overheating, which can lead to burning of the fibers and melting of the matrix.

The goal of welding the high strength, light weight FCL materials, is to obtain a weld that is as strong (or stronger) than the base materials. As is evident to persons of ordinary skill (and logically), an unreinforced laminate weld may only be as strong as the base materials which are fused together. Assessment of the general quality of a weld may be accomplished by simple visual inspection while pulling apart the two fused layers of the welded FCL. More rigorous methods for assessment of weld quality include the examination of the weld area under a scanning electron microscope and quantification of damage per unit area, performing a pull-test on a welded coupon in a calibrated tensile test machine, performing a burst pressure test on the seamed inflatable structure, and quantifying the amount of melt recrystallization that has occurred in the UHMWPE fiber layers of the weld by differential scanning calorimetry (DSC). (See e.g., US Patent Publication No. 2017/0082406). In a manufacturing environment, the use of a continuous infrared temperature measurement system coupled with statistical sampling and testing of specific form factors can be included to provide an overall quality control/quality assurance assessment for the seamed products. As will be evident to a person of skill in the art, once the materials, the absorption modifiers, laser wavelength, intensity, dwell time (proportional to the speed of the laser), and pressure are determined, the process can be consistently applied to long seams, including curves with low levels of variation. In particular, the use of laser illumination provides both for control of the melting to avoid damage to the underlying FCL and reproducibility for fabrication of products.

The present disclosure provides for, and includes, absorption modifiers (163) that are infrared light-absorbing polymers. A light absorbing polymer is a polymeric material capable of efficiently absorbing light of a specific, predetermined wavelength or wavelength range. In an aspect, a light absorbing polymer can comprise a meltable polymer that intrinsically absorbs light. In other aspects, the meltable layer can include a light absorbing polymer. In other aspects, the meltable layer can include an amount of an absorption modifier (163), generally comprising less than 0.005% of the total mass of the meltable layer of the FCL. A meltable layer of the present disclosure may comprise a light-absorbing polymer, or a light-absorbing polymer may be added to a meltable layer of the present disclosure.

The present disclosure provides for, and includes, welds formed between base FCLs each having a meltable layer that in includes an absorption modifier (163) that is a light-absorbing polymer that absorbs light between 700 nm and 1400 nm. In an aspect, the absorption modifier (163) absorbs light between 900 and 1100 nm. In certain aspects, the meltable polymer itself comprises a light-absorbing polymer and accordingly, comprises an absorption modifier (163). More flexibly, a light-absorbing polymer can be included as a fraction of the meltable polymer to provide the capability to be heated using the laser methods disclosed herein, while maintaining the preferred properties of the meltable polymer (e.g., abrasion resistance, impermeability etc.). In aspects, a meltable layer of the present disclosure comprises between 0.1% to 5% by mass of a light-absorbing polymer. In an aspect, a meltable layer of the present disclosure comprises about 0.5% by mass of a light-absorbing polymer. In an aspect, a meltable layer of the present disclosure comprises about 1.00% by mass of a light-absorbing polymer. In an aspect, a meltable layer of the present disclosure comprises about 1.5% by mass of a light-absorbing polymer. In an aspect, a meltable layer of the present disclosure comprises about 2.0% by mass of a light-absorbing polymer. In an aspect, a meltable layer of the present disclosure comprises about 5.0% by mass of a light-absorbing polymer. In an aspect, a meltable layer of the present disclosure comprises less than 0.5% by mass of a light-absorbing polymer. In an aspect, a meltable layer of the present disclosure comprises less than 1.0% by mass of a light-absorbing polymer. In an aspect, a meltable layer of the present disclosure comprises less than 1.5% by mass of a light-absorbing polymer. In an aspect, a meltable layer of the present disclosure comprises less than 2.0% by mass of a light-absorbing polymer. In an aspect, a meltable layer of the present disclosure comprises less than 5.0% by mass of a light-absorbing polymer. In an aspect, a meltable layer of the present disclosure comprises between 0.5% and 1.0% by mass of a light-absorbing polymer. In an aspect, a meltable layer of the present disclosure comprises between 1.0% and 1.5% by mass of a light-absorbing polymer. In an aspect, a meltable layer of the present disclosure comprises between 1.0% and 2.0% by mass of a light-absorbing polymer. In an aspect, a meltable layer of the present disclosure comprises between 0.5% and 2.0% by mass of a light-absorbing polymer. In an aspect, a meltable layer of the present disclosure comprises between 2.0% and 5.0% by mass of a light-absorbing polymer. In an aspect, a meltable layer of the present disclosure comprises between 0.5% and 5.0% by mass of a light-absorbing polymer. In certain other aspects, the meltable layer is largely transparent to light between 700 nm and 1400 nm. In further aspects, the meltable layer is largely transparent to light between 900 nm and 1100 nm. Such laser transparent meltable layers provide for greater flexibility in the choice of materials as the absorption modifier (163) can be adjusted suitably to provide for multi-stack welding.

As used herein, the "absorption maximum" of a material refers to the wavelength of light at which that light absorption by the material is highest.

As used herein, the term "extinction coefficient" refers to a measurement of how strongly a material attenuates light at a given wavelength. The molar extinction coefficient (e) of a material an inherent property having the units $M^{-1}cm^{-1}$ that relates the absorbance (A) of the material by the Beer-Lambert law, $A=\varepsilon cl$, where c is the molar concentration of the material, and t is the pathlength in centimeters.

In an aspect, the absorption modifier (163) is a light-absorbing polymer that absorbs light having an absorption maximum that is between 700 nm and 1400 nm. In an aspect, the light-absorbing polymer absorbs light having an absorption maximum that is between 800 nm and 1200 nm. In an aspect, a light-absorbing polymer absorbs light having an absorption maximum that is between 900 nm and 1100 nm. In an aspect, a light-absorbing polymer absorbs light having an absorption maximum that is between 900 nm and 1000 nm. In an aspect, a light-absorbing polymer absorbs light having an absorption maximum that is between 950 nm and 1050 nm. In an aspect, a light-absorbing polymer absorbs light having an absorption maximum that is between about 986 nm and about 990 nm. In an aspect, a light-absorbing polymer absorbs light having an absorption maximum that is about 980 nm. In an aspect, a light-absorbing polymer absorbs light having an absorption maximum that is about 988 nm.

In an aspect, a meltable layer of the present disclosure further including an absorption modifier (163) that is a light-absorbing compound having an absorption maximum that is between 700 nm and 1400 nm. In an aspect, a meltable layer of the present disclosure further includes a light-absorbing compound having an absorption maximum that is between 800 nm and 1200 nm. In another aspect, a meltable layer of the present disclosure further includes an absorption modifier (163) that is a light-absorbing compound having an absorption maximum that is between 900 nm and 1100 nm. In yet a further aspect, a meltable layer of the present disclosure further includes a light-absorbing compound having an absorption maximum that is between 900 nm and 1000 nm. In another aspect, a meltable layer of the present disclosure further includes a light-absorbing compound having an absorption maximum that is between 950 nm and 1050 nm. In an aspect, a light-absorbing polymer absorbs light having an absorption maximum that is between about 986 nm and about 990 nm. In an aspect, a meltable layer of the present disclosure further includes an absorption modifier (163) that is a light-absorbing compound having an absorption maximum that is about 980 nm. In an aspect, a light-absorbing polymer absorbs light having an absorption maximum that is about 988 nm.

As used herein, the term "absorption modifier" refers to a substance that may be present in or added to the polymer coating of a coated FCL in order to change the absorptivity of the polymer coating during welding. Absorptive adjuncts can be varied in concentration to increase or decrease absorption at a specific wavelength of applied energy. One common absorption modifier commonly used in the art is Clearweld™, made by the Crysta-Lyn Chemical company. The choice and concentration of a specific absorption modifier enables the magnitude of weld energy to be controlled at specific depths and locations.

The present disclosure provides for, and includes, a weld formed between a first FCL and second FCL comprising a homogeneous fused monolayer formed from meltable layers on each FCL where the homogeneous fused monolayer further comprises an absorption modifier (163). In aspects, the absorption modifier is applied to the surface of the first FCL, the second FCL, or both, prior to welding. In other aspects, the absorption modifier is incorporated into the meltable layer (104), the meltable layer (105), or both. In yet a further aspect, an absorption modifier (163) comprises both an applied absorption modifier and incorporated absorption modifier on the meltable layer (104), the meltable layer (105), or both. More specifically, in aspects the absorption modifier (163) is selected and configured to minimize the amount of absorption modifier (163) in the homogeneous fused monolayer (106) to maintain the desired properties of the meltable layers. In an aspect, a meltable layer further comprises an absorption modifier. In an aspect, an absorption modifier may be added to a polymer coating by spraying. In an aspect, a fused monolayer further comprises an absorption modifier. In some aspects, the absorption modifier is evenly distributed in a fused monolayer. In other aspects, the absorption modifier is unevenly distributed in a fused monolayer, with higher concentrations at the midline where the interface between the meltable layers was prior to melting and fusion. In an aspect, an absorption modifier may include Clearweld™ LD940A, Clearweld™ LD940B, Clearweld™ LD940C, Clearweld™ LD940E, and Clearweld™ LD940F, and carbon black.

The present disclosure provides for, and includes, meltable layers having a melting temperature that is lower than the melting temperature of the components of the FCL. In an aspect, the melting temperature of the meltable layers are between 115 to 125° C.

In an aspect, a light-absorbing polymer of the present disclosure is selected from the group consisting of thermoplastic polyurethane (TPU), thermoplastic polyvinyl chloride (PVC), polyester (PE), polypropylene (PP), polyethylene, ABS, nylon, and Mylar®.

The present disclosure provides for, and includes, reinforced seams comprising two or more welds as described above between three or more FCL materials (e.g., the primary first and second FCL and one or more reinforcing FCL materials). As used herein, the term "reinforced seam" refers to a seam where the seam has been further strengthened by co-fusion of the seam to one or more additional FCLs so that the reinforced seam is more resistant to cracking and other stress-induced failure relative to the non-reinforced seam. Reinforced seams are required in applications for inflatables (e.g., rafts, life preservers, aviation escape chutes) that are subject to high stresses.

A. REINFORCEMENT TABS

In accordance with the present disclosure, three classes of reinforcement FCLs for reinforcing seams are disclosed. Each of the three classes of reinforcement FCLs are discussed in turn.

The present disclosure provides for, and includes, a reinforced seam joining two flexible composite laminates (FCLs) comprising a first base FCL (760) having a meltable layer (704) on its inner face and second base FCL (770) having a meltable layer (705) on its inner face. See FIGS. 9A-9D and FIGS. 12A-12D. The FCLs (760, 770, 860, 870) are equivalent to the base FCLs (110) and (120) described above. Similarly, the meltable layers (704, 705, 804, and 805) of the reinforced seam correspond to the meltable layers (104) and (105) above. In aspects, like the meltable layers described above, the meltable layers are selected to have a melting temperature that is at least 5° C. below the melting temperature of the fibers in the cross-plied monolayers and the embedding plastic matrix. In other aspects, the meltable layers are selected to have a melting temperature that is less than 95% of the melting temperature of the fibers in the cross-plied monolayers and the embedding plastic matrix.

Tensor Tabs

Figure 8A:
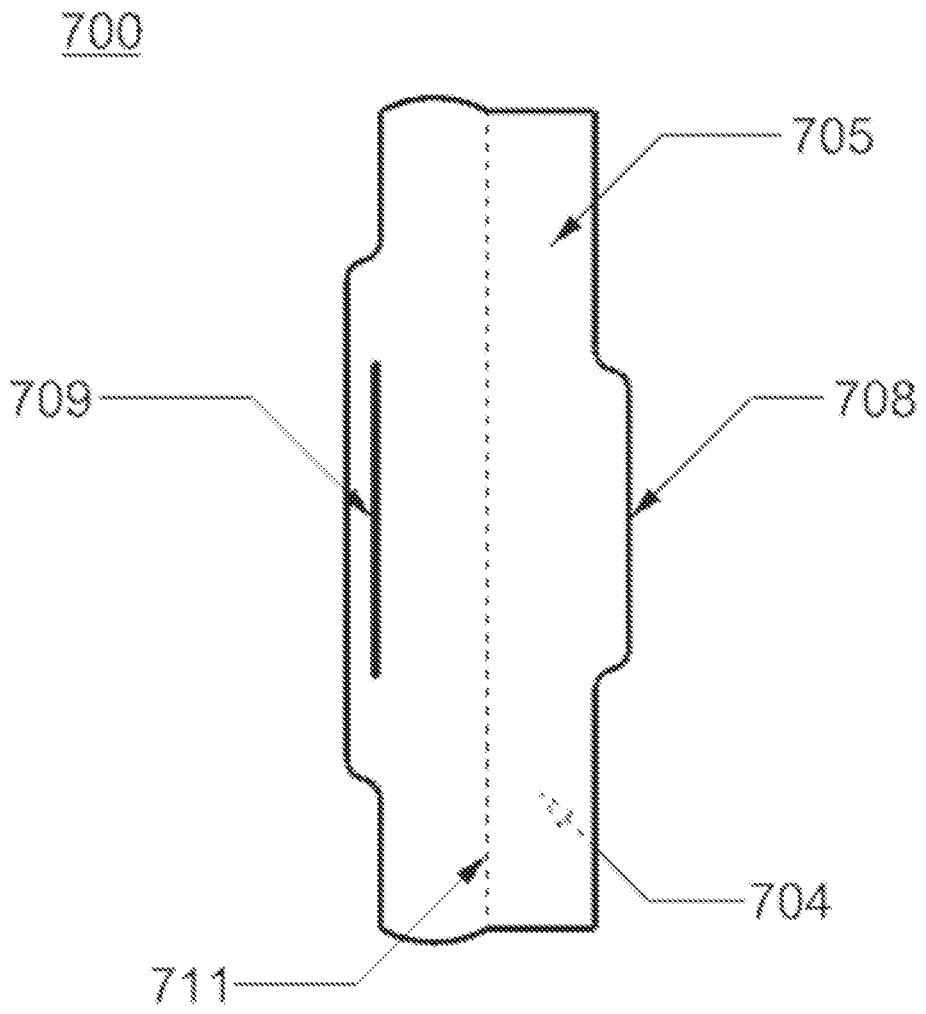
FIGS. 8A, 8B, and 8C present an illustration of the preparation of linear reinforcement tab (Tensor tab) and welding of a reinforced linear seam according to an aspect of the present disclosure.
Figure 8B:
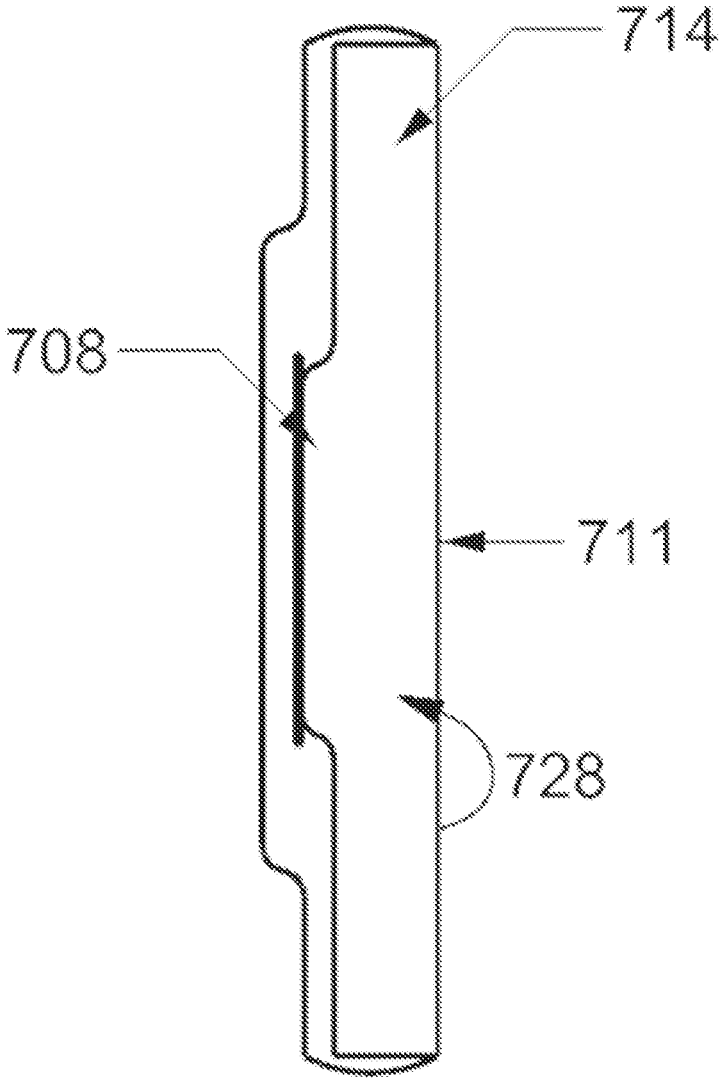
Figure 8C:
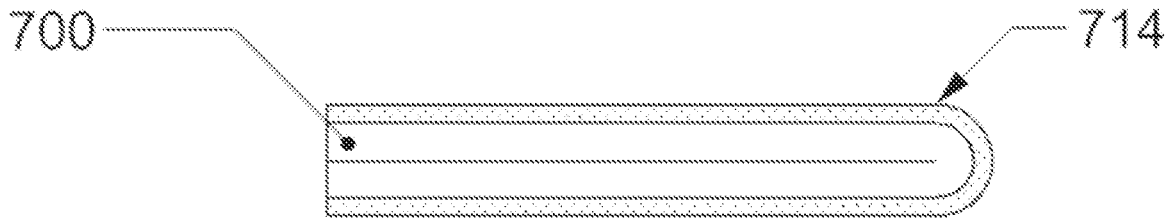

Reinforced seams differ from the seams above by including additional welded reinforcing structures identified herein as reinforcement FCLs. As will be discussed, reinforcement FCLs can comprise a single FCL reinforcement welded to both base FCLs (760) and (770) called a "Tensor" tab (FIG. 8A to 8C). The assembly and welding of Tensor tabs to base FCLs is presented in FIGS. 9A-9D. Tensor tabs are designed for reinforcing linear seams. As shown in FIG. 8A to 8C, a tensor tab comprises a single piece of FCL folded at the midline. In aspects, Tensor tabs may include a tab (708) that is designed to insert into cut (709) when folded and aids in assembly. In some aspects, the Tensor tab includes an absorbance modifier either as part of the meltable polymer as shown in FIG. 8C or applied on the FCL surface. Tensor Tabs may also include a polymer coating (705) on its interior surface after folding, but the interior surface is not intended to be welded together. Accordingly, IR absorbance at interior surface is avoided in many aspects.

Figure 9A:
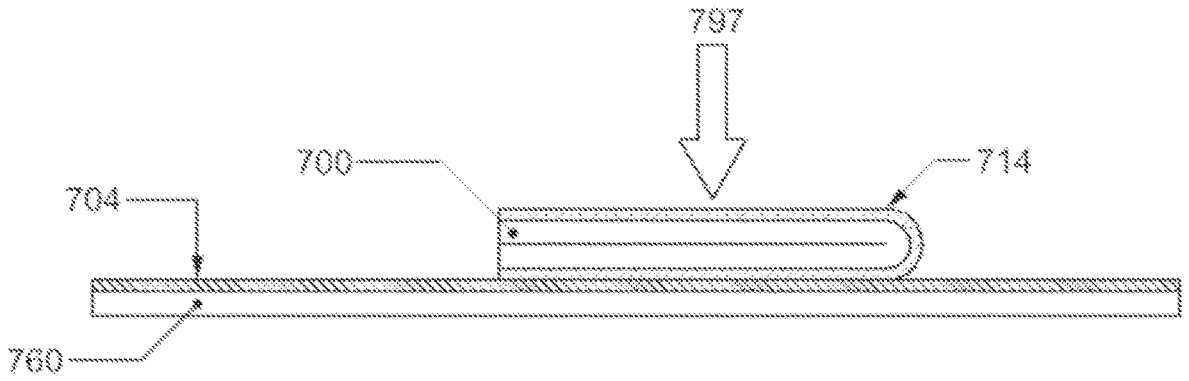
FIGS. 9A, 9B, 9C, and 9D present an illustration of the process of using a linear reinforcement tab to prepare a reinforced seam according to an aspect of the present disclosure.
Figure 9B:
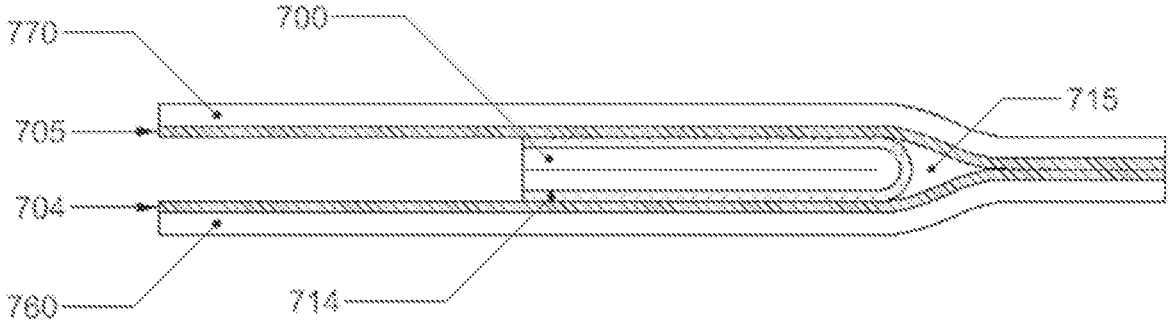
Figure 9C:
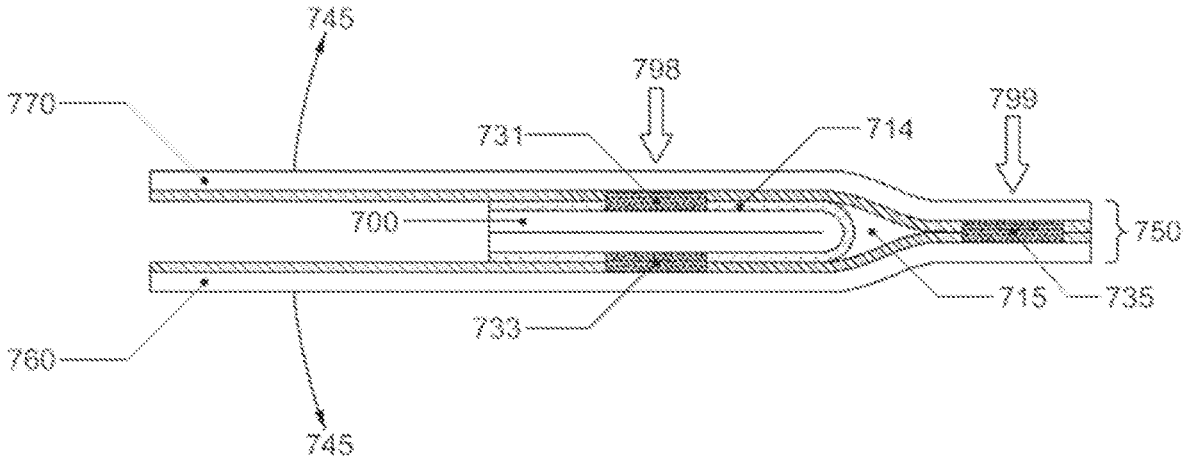
Figure 9D:
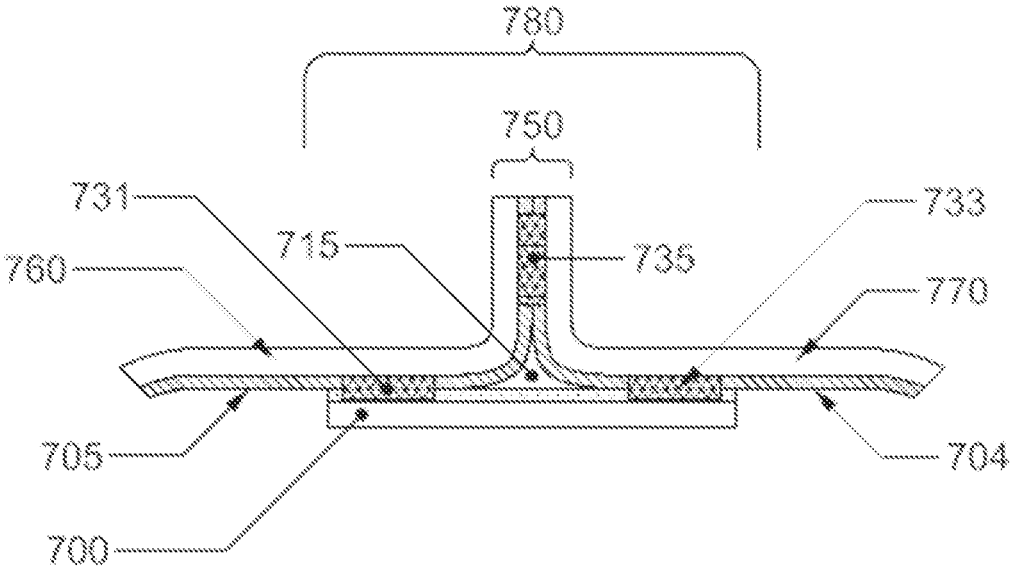

Turning to FIGS. 9A-9D, the assembly and welding of a Tensor tab reinforced seam is illustrated. To assemble a reinforced seam comprising a Tensor tab, the folded Tensor tab as shown in FIG. 8C is arranged on a first base FCL (760). In some aspects, the Tensor tab can be welded to the first base FCL using the disclose methods. In alternative aspects, the Tensor tab can be held in place by an adhesive or heat tacking as shown in FIG. 9A. This allows for the complete assembly of the 'stack' and a single welding step. When heat tacking, care must be taken to avoid damaging the underlying fibers and matrix. The second base FCL (770) is then place on top of the growing stack (FIG. 9B) with the edges aligned. The assembled stack is then laser welded as illustrated in FIG. 7A to prepare seams (731) and (733) (FIG. 9C). In aspects seam (735) is welded separately. In other aspects, seam (735) is folded back as shown in FIG. 9D. This allows for all three welds to be completed in a single pass of the laser welding apparatus. During assembly, an intra-seam space (715) is retained. This is an important element of the assembly as it allows the seam to assume an open configuration without resistance.

Flexus Tabs

For curved seams, a reinforcement FCL comprises a two separate shaped and folded FCLs (810) and (820) which are heat-fused along all contacting surfaces, with the exception of (806) and (808) to prepare a reinforcement FCL (840) called a "Flexus" tab. Flexus tabs are designed for reinforcing curved seams and come in two forms.

Figure 10A:
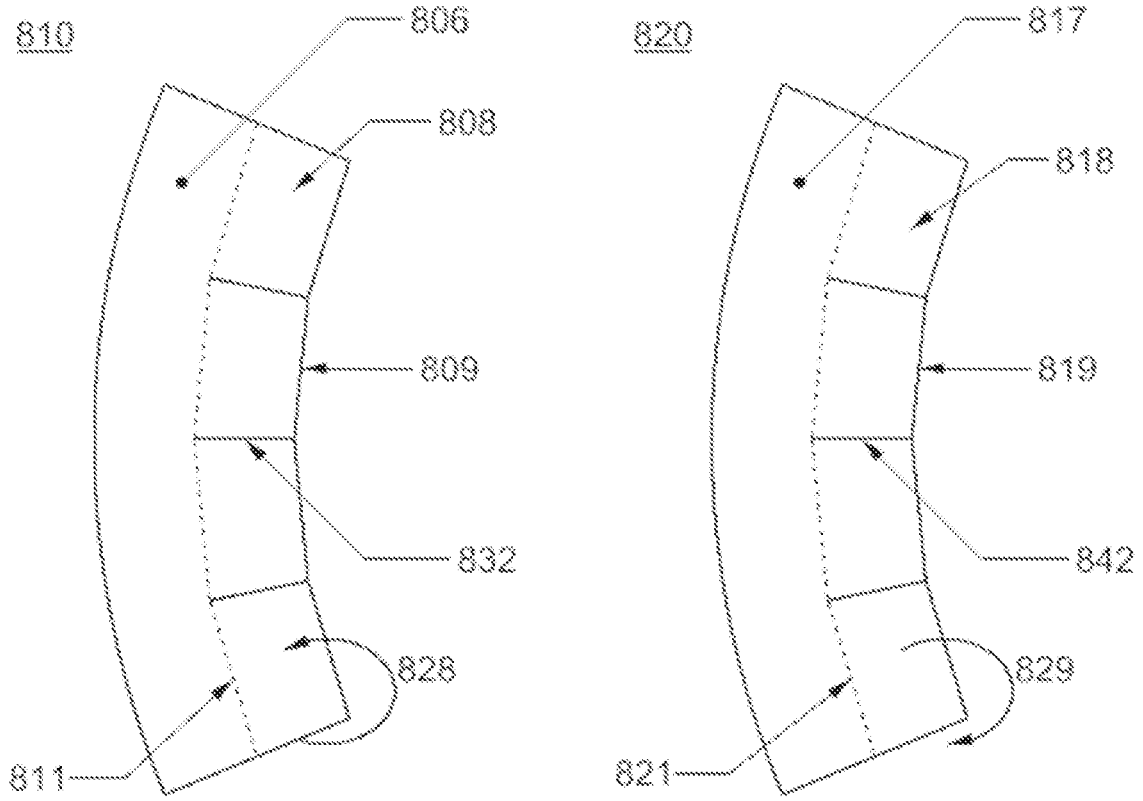
FIGS. 10A, 10B, 10C, 10D, and 10E present an illustration of the preparation and assembly of a reinforcement tab for a convex curve (Flexus-x).
Figure 10B:
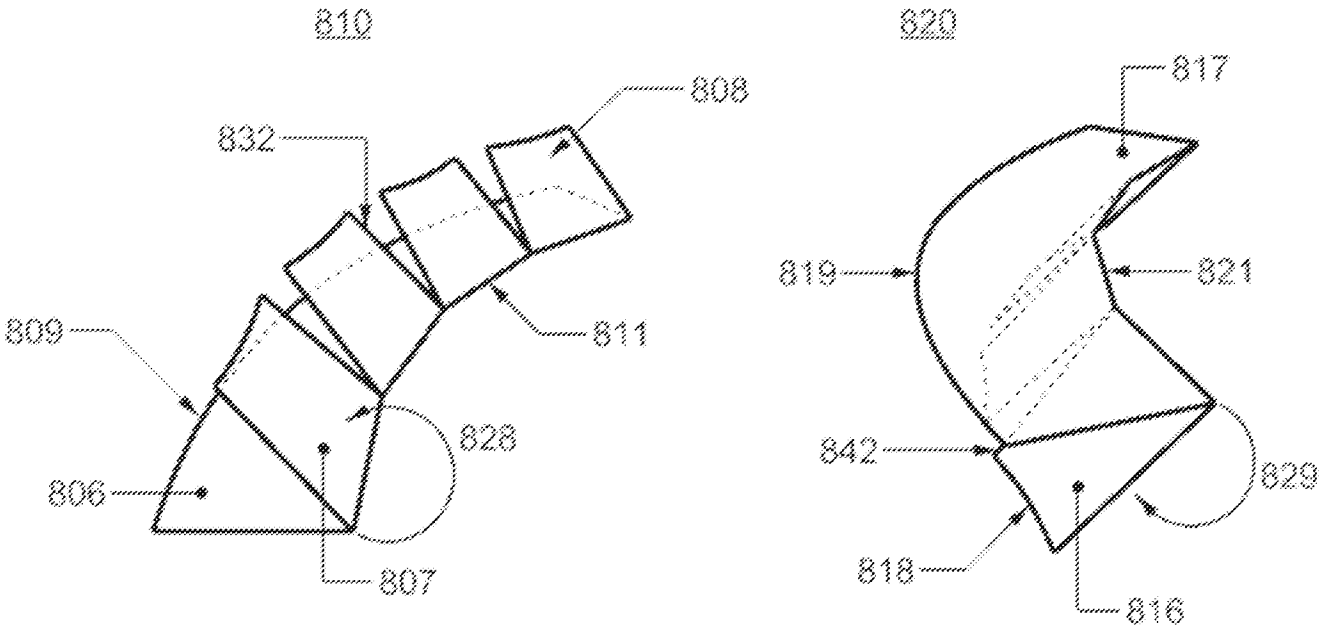
Figure 10C:
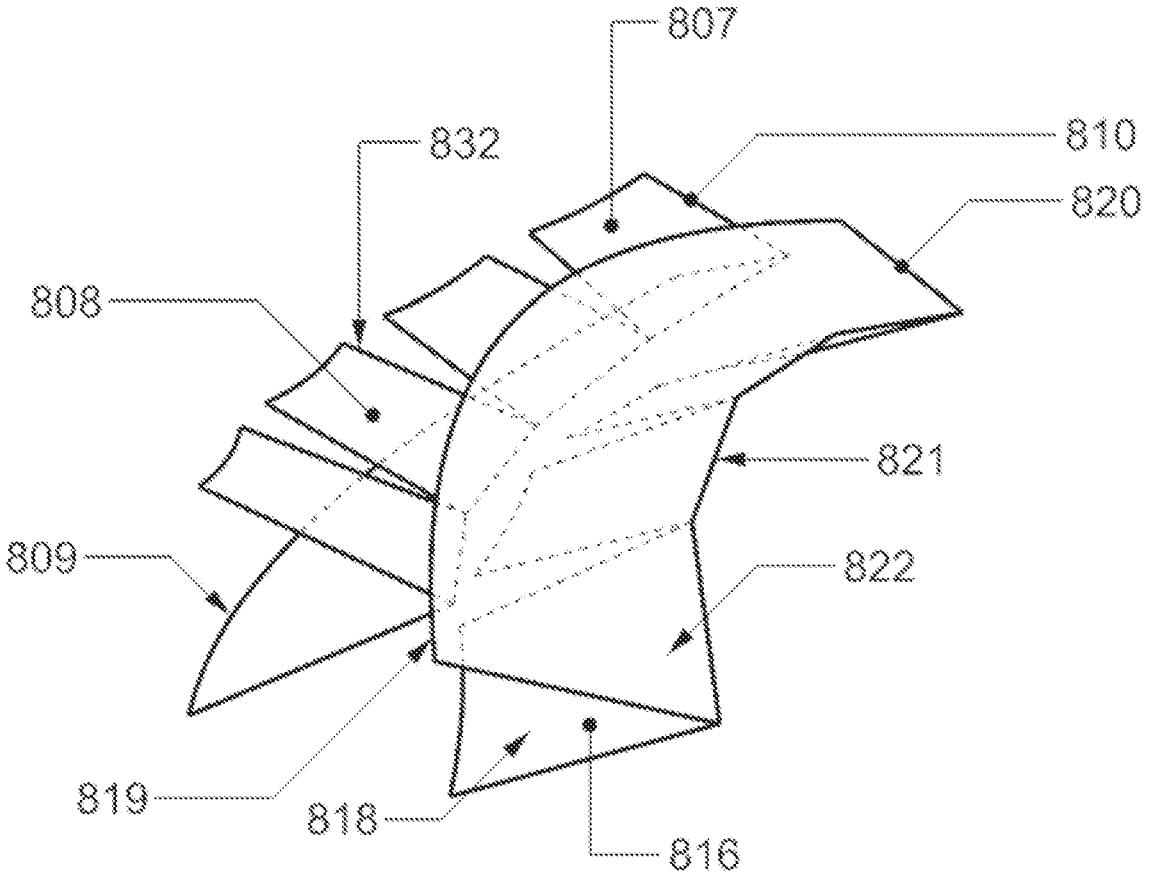
Figure 10D:
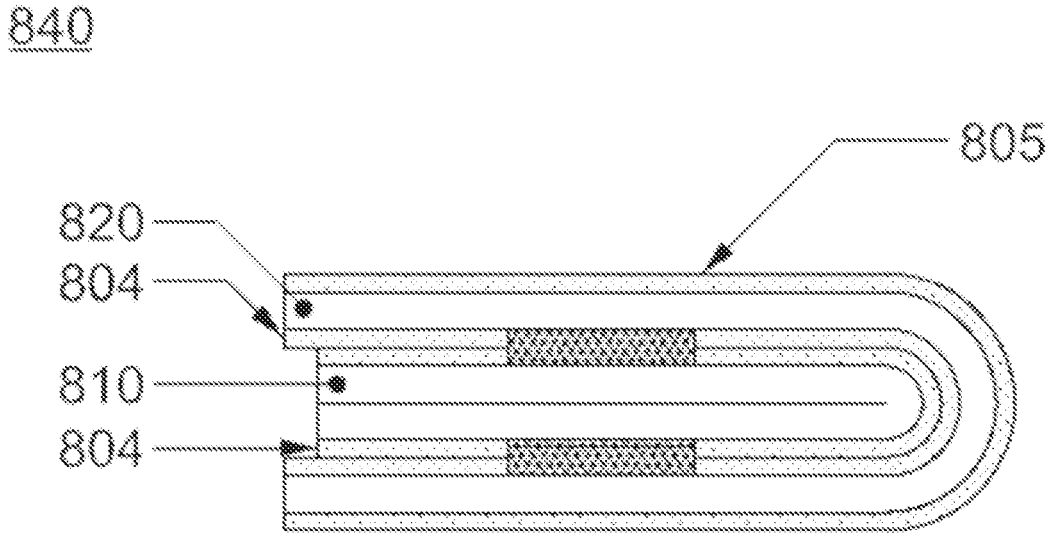
Figure 10E:
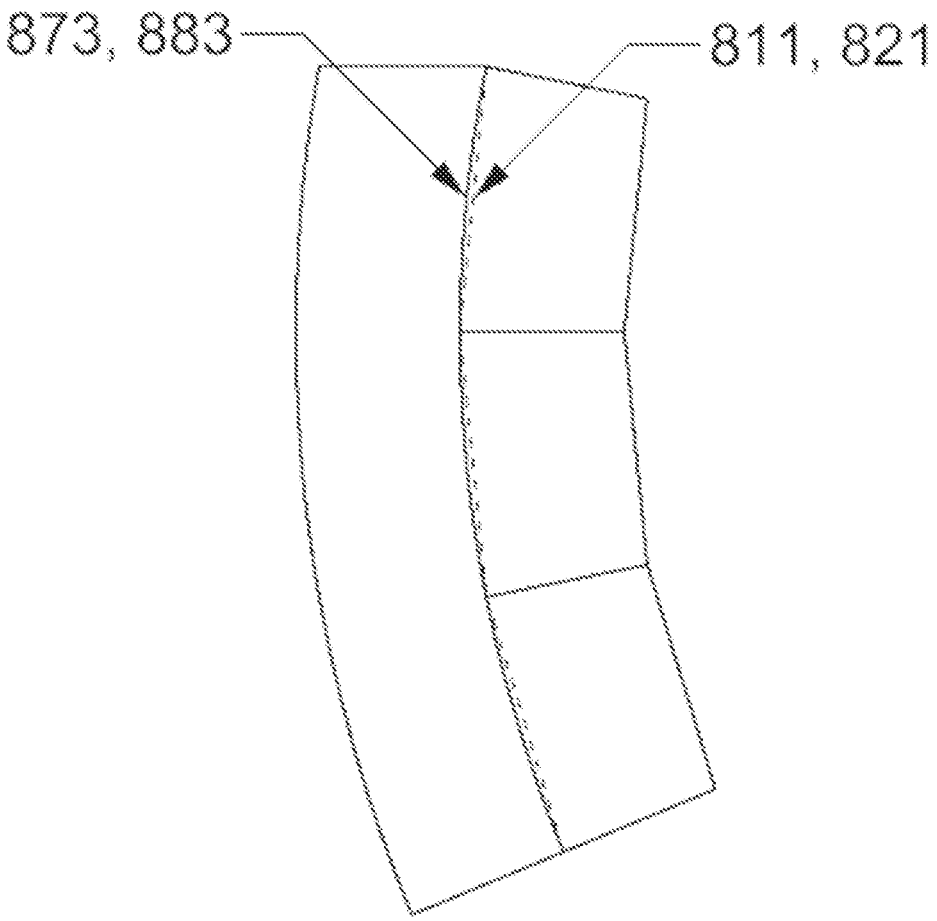
Figure 11A:
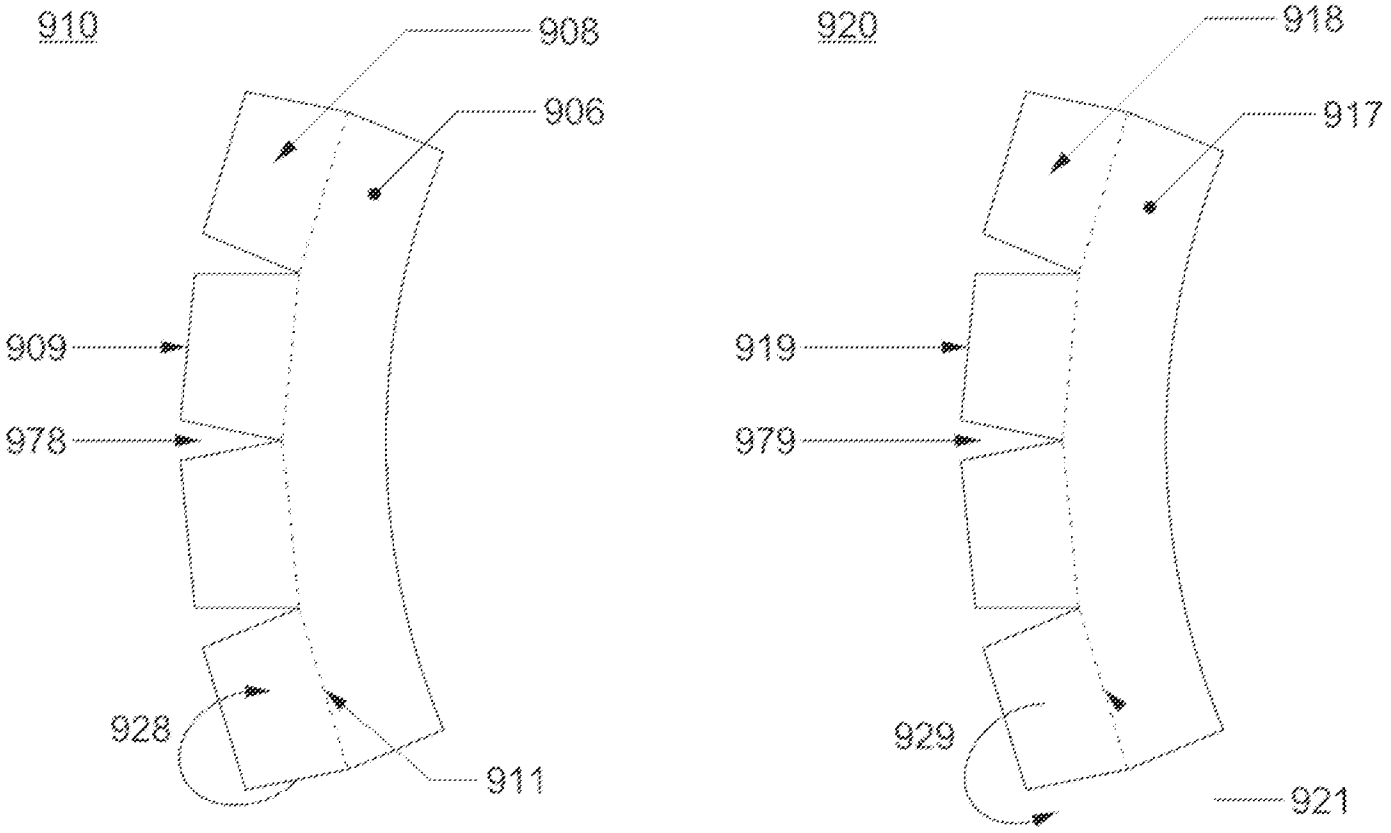
FIGS. 11A, 11B, 11C, 11D, and 11E present an illustration of the preparation and assembly of a reinforcement tab for a concave curve (Flexus-k).
Figure 11B:
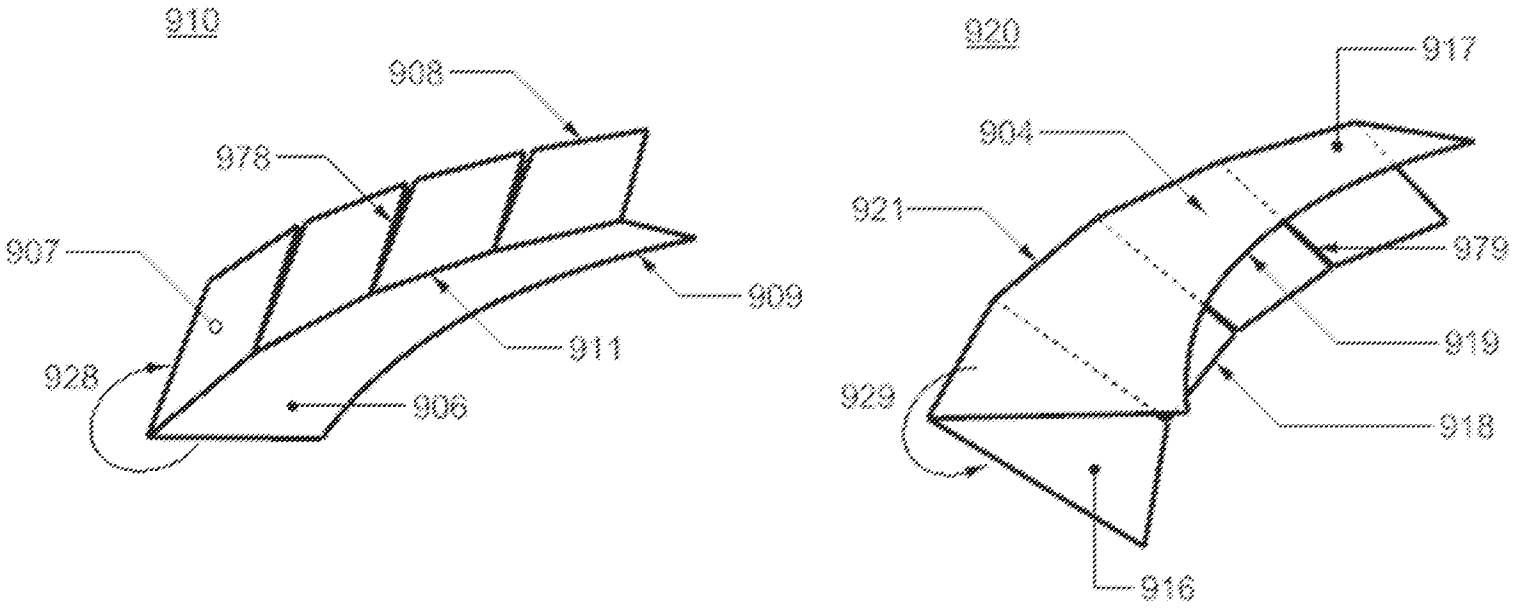
Figure 11C:
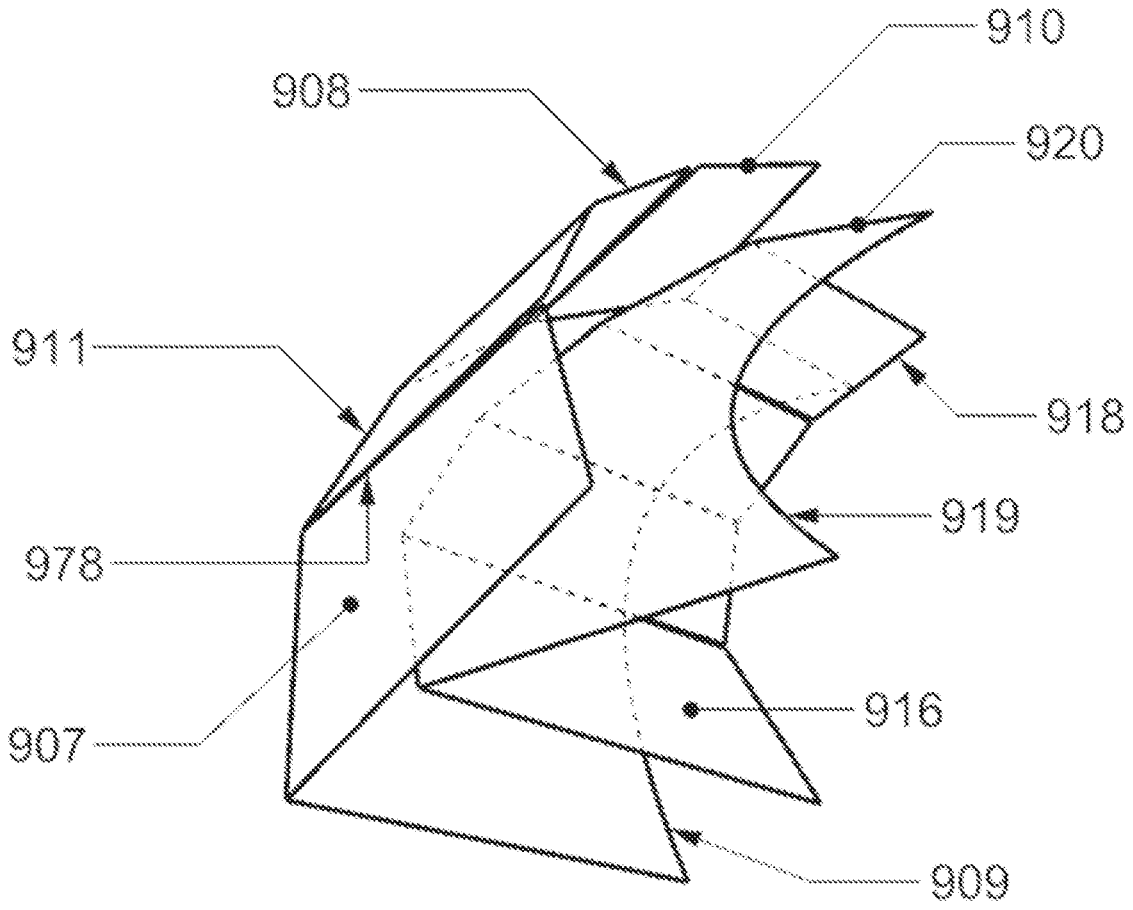
Figure 11D:
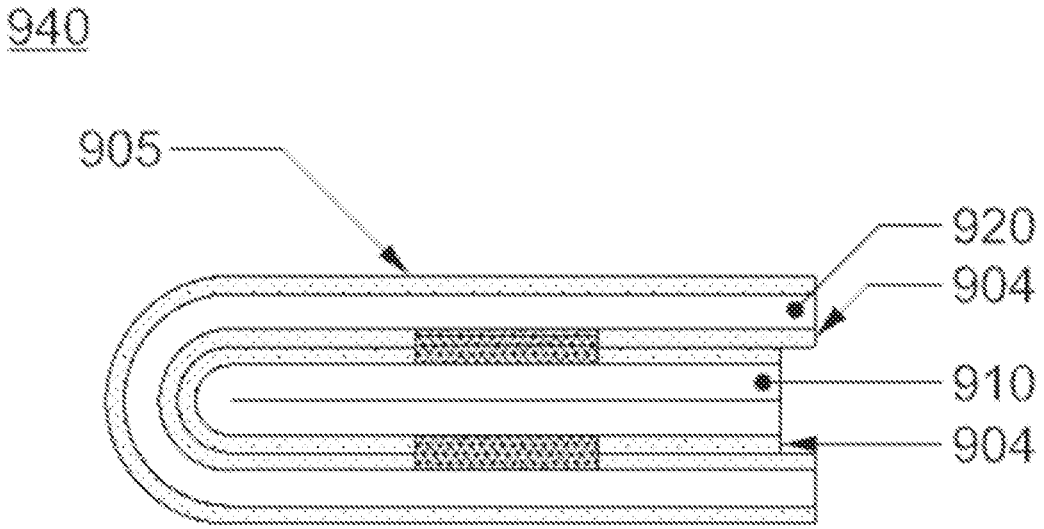
Figure 11E:
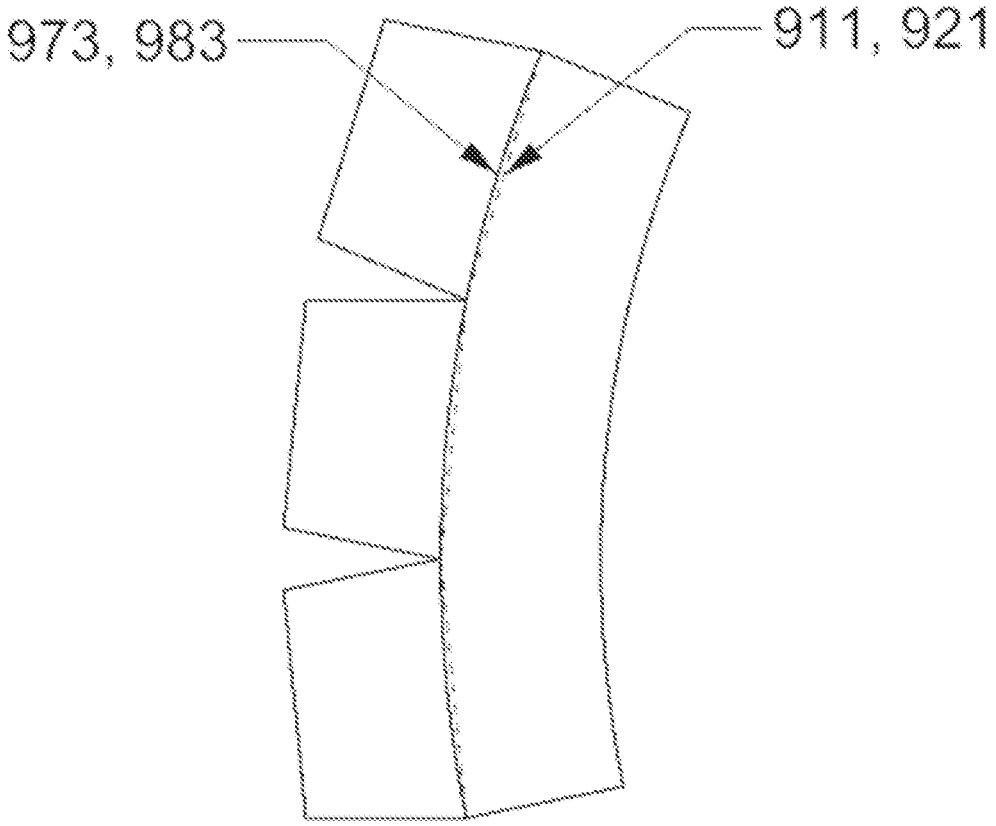

A first Flexus tab, illustrated in FIGS. 10A-10E, is designed to reinforce a convex curve (Flexus-x) and involves introducing cuts (832) and (842) and folds to produce folded tabs (809) and (819) into two arc shaped FCLs (811 and 821) that are assembled together as shown in FIG. 10C and heat fused together. The resulting Flexus tab is then assembled into a stacked configuration as illustrated in FIGS. 12A-12D and welded as illustrated in FIG. 7A, to base FCLs (870 and 860) to prepare a seam as described above.

A second Flexus tab (940), illustrated in FIGS. 11A-11E, is designed to reinforce a concave curve (Flexus-k) and involves introducing notched gaps (978) and (979) and folds to produce folded tabs (908) into two arc shaped FCLs (910 and 920). The folded FCLs are then heat fused together to prepare reinforcement FCL (940). The reinforcement FCL (940) is then welded to each of two base FCLs (870 and 860) to prepare a reinforced seam as illustrated in FIGS. 12A-12D.

For each reinforced seam (linear, convex curved, concave curved) there are three welds. A first weld is between the base FCLs to be joined (e.g., FCL 870 is welded to FCL 860 along an aligned edge) to form a fin seam. A second weld joins the reinforcement FCL to base FCL (870) and a third weld joins the reinforcement FCL to base FCL (860). Notably, the assembly is prepared and included intra-seam space (815). In some aspects, each of the first, second, and third, welds are prepared in separate steps. In other aspects, the two welds of the reinforcement FCLs to the base FCLs to be joined are completed in a single step, for example as illustrated in FIG. 7A. The ability of the present methods to prepare multiple welds at different depths in a stack of FCLs significantly reduces the time and effort to prepare seamed products of the present disclosure. Moreover, simultaneously creating the welds ensures that the welds (831 and 833) are equidistant from the fin seam at weld (835) joining the two base FCLs. See FIG. 12C. The intra-seam space (815) allows for the reinforced seam to be opened, for example upon inflation, as illustrated in FIG. 9D and FIG. 12D. The inclusion of the intra-seam space reduces the stress on the seam and increases the overall tensile strength and burst strength.

The present disclosure provides for, and includes, reinforced seams comprising a reinforcement FCL (700) ("Tensor tab") that joins and reinforces a first base FCL (760) and a second base FCL (770). Reinforcement FCL (700) comprises a third FCL that is cut and folded along a foldable midline (711) and having a meltable polymer layer (714) on its outer surface. In an aspect, the inner surface include a meltable polymer layer that does not include any IR absorbable material or absorption modifier. The reinforced seam is prepared by introducing two continuous welds between the reinforcement FCL (700) and the two base FCLs. The first weld (731) between the outer face of said reinforcement FCL (700) and said first base FCL (760) that comprises a homogeneous, fused monolayer (706) formed from said meltable layers (714) and (704). The second weld (733) between the outer face of the reinforcement FCL (700) and the second base FCL (770) and also comprises a homogeneous, fused monolayer (707) formed from the meltable layers (714) and (705). In an aspect, the first and second welds (731, 733) are arranged equidistant or nearly equidistant from a continuous third weld (735) between the first base FCL (760) and second base FCL (770). Like the other welds, the continuous third weld (735) comprising a homogeneous, fused monolayer (706) formed from said meltable layers (704) and (705). In aspects of the present disclosure, the Tensor tab (i.e., reinforcement FCL (700)) can be rectangular shaped. In another aspect, the tensor tab is square shaped.

Figure 14:
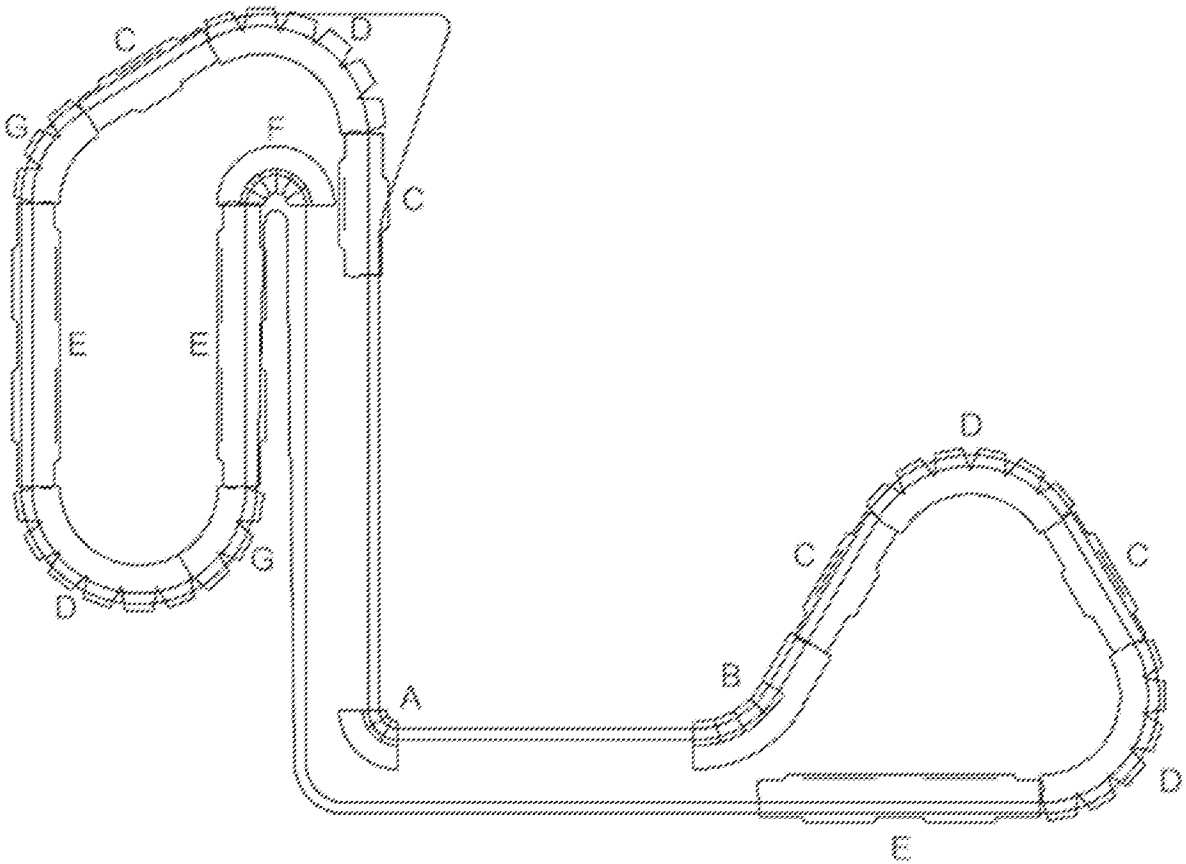
FIG. 14 presents an illustration of an inflatable device having a variety of reinforcement tables according to aspects of the present disclosure.
Figure 15A:
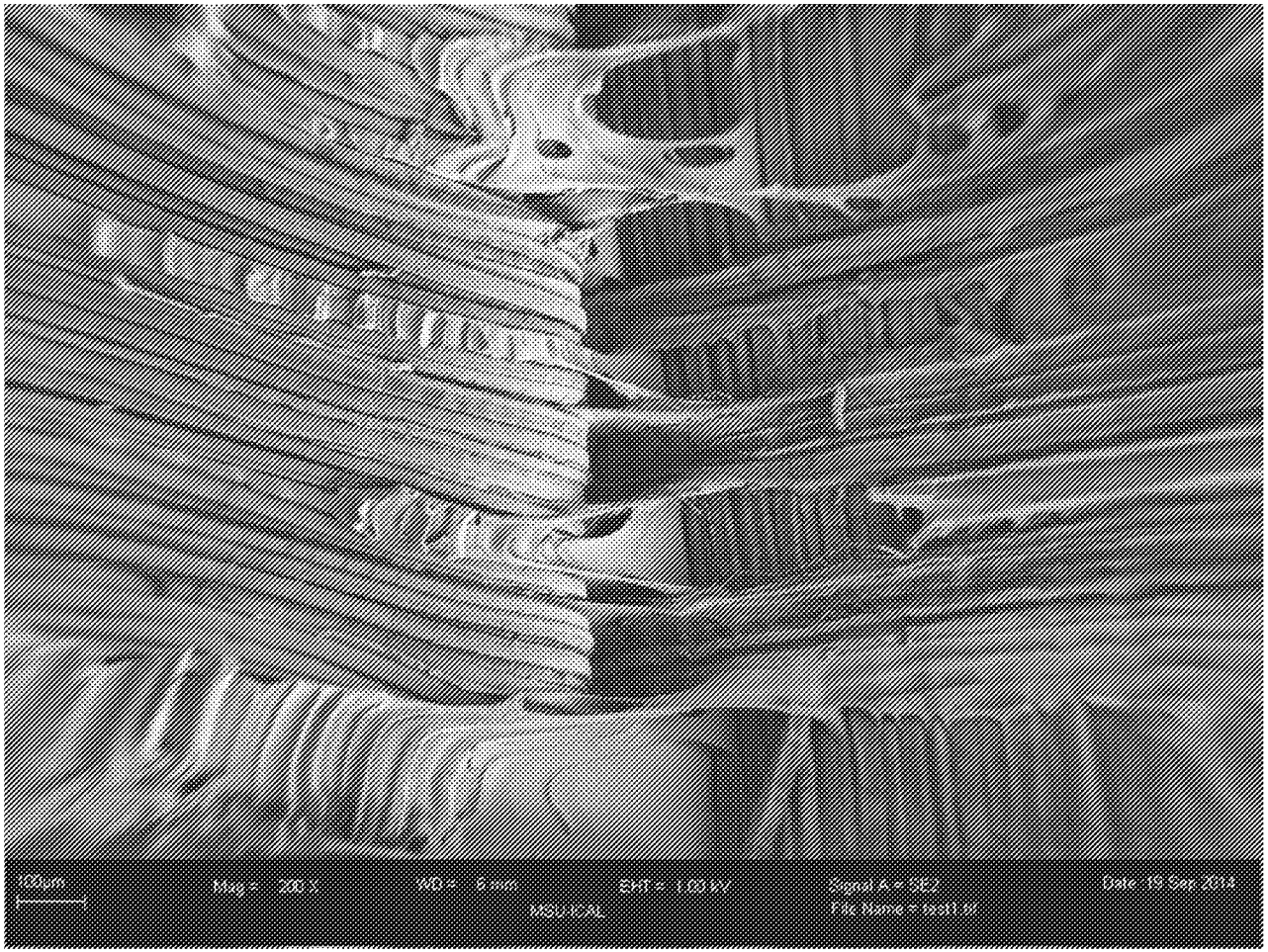
FIGS. 15A, 15B, 15C, 15D, 15E, 15F, 15G, 15H, 15I, 15J, and 15K present exemplary scanning electron microscope images of fiber layers.
Figure 15B:
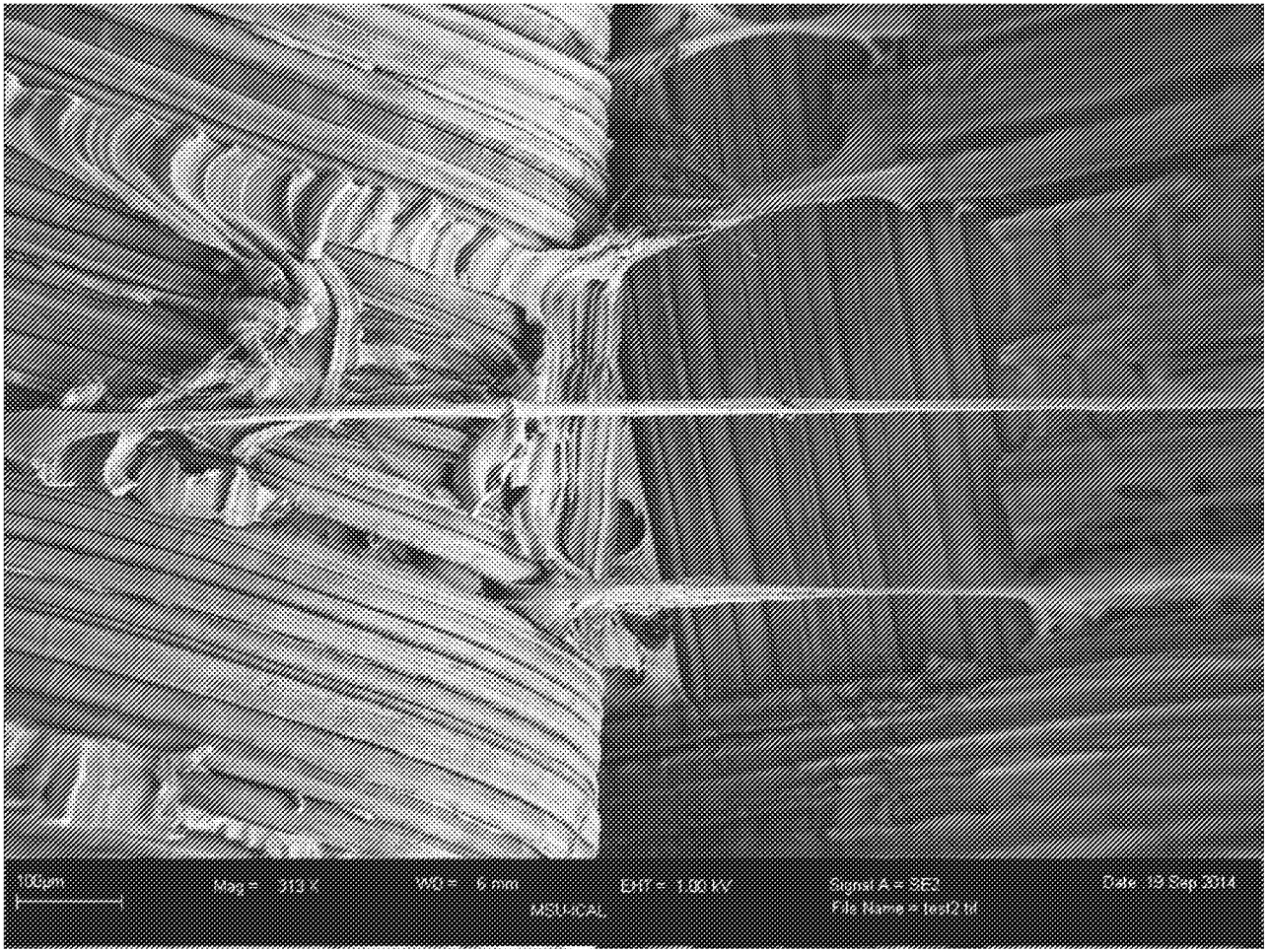
Figure 15C:
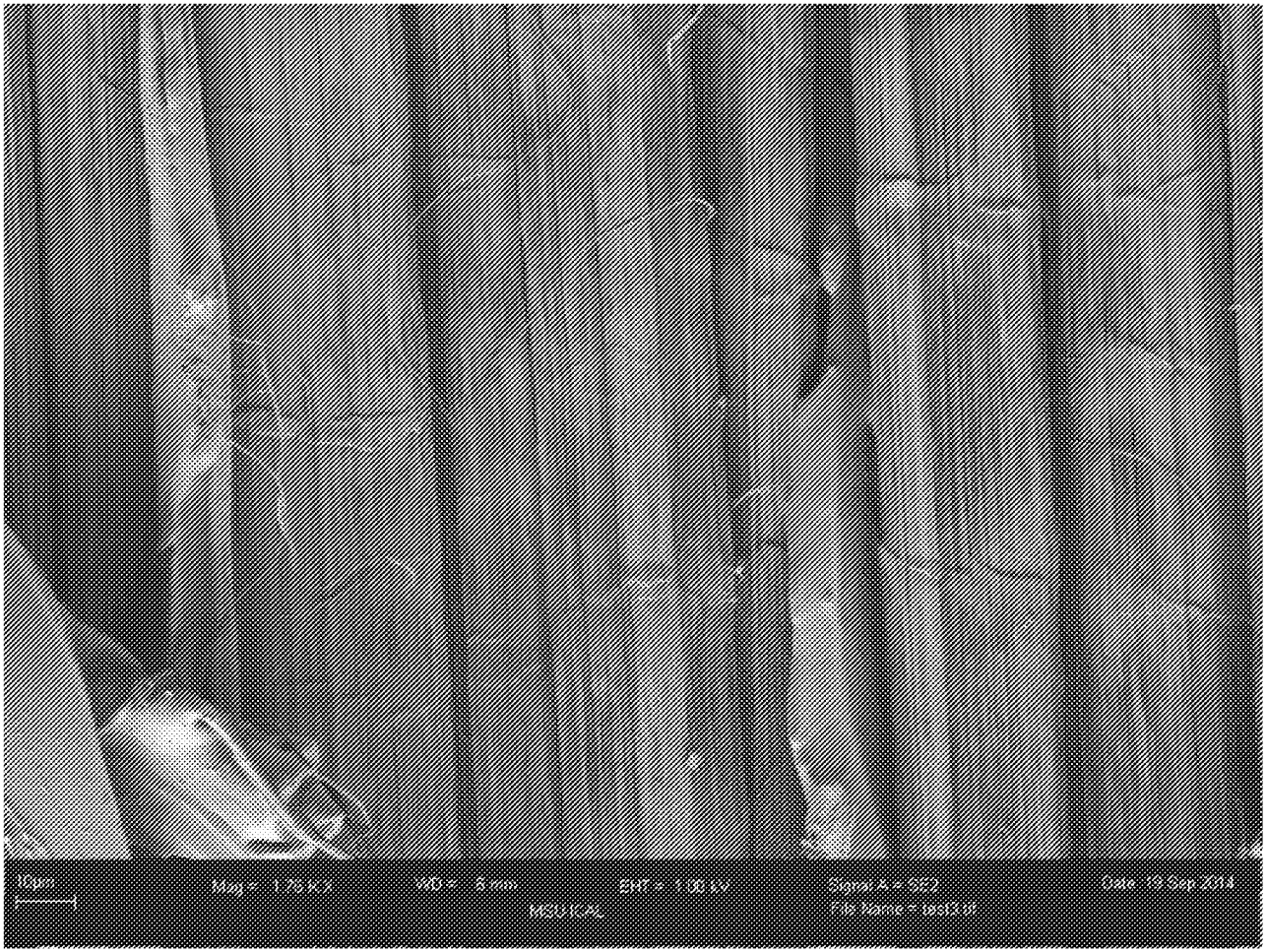
Figure 15D:
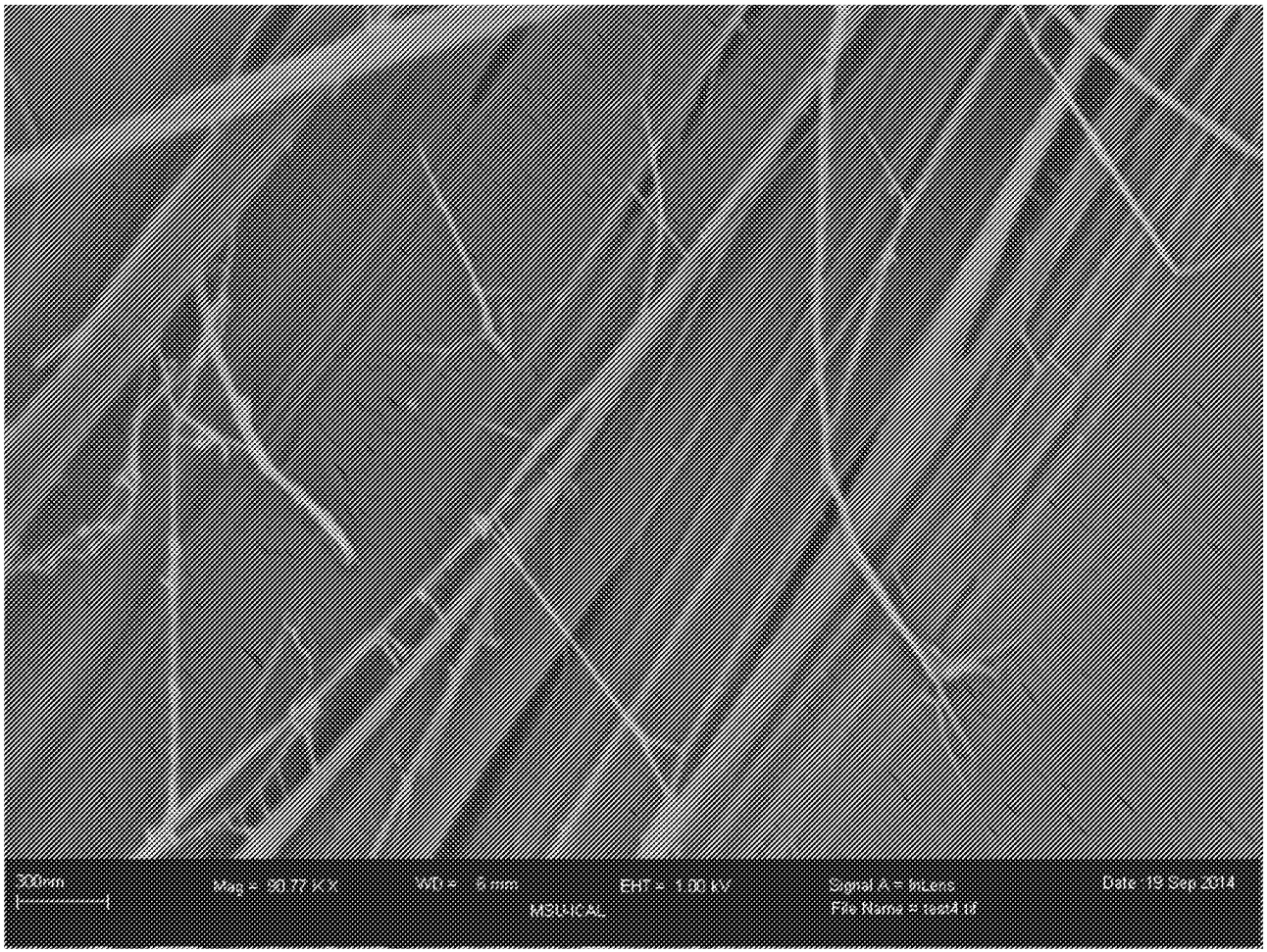
Figure 15E:
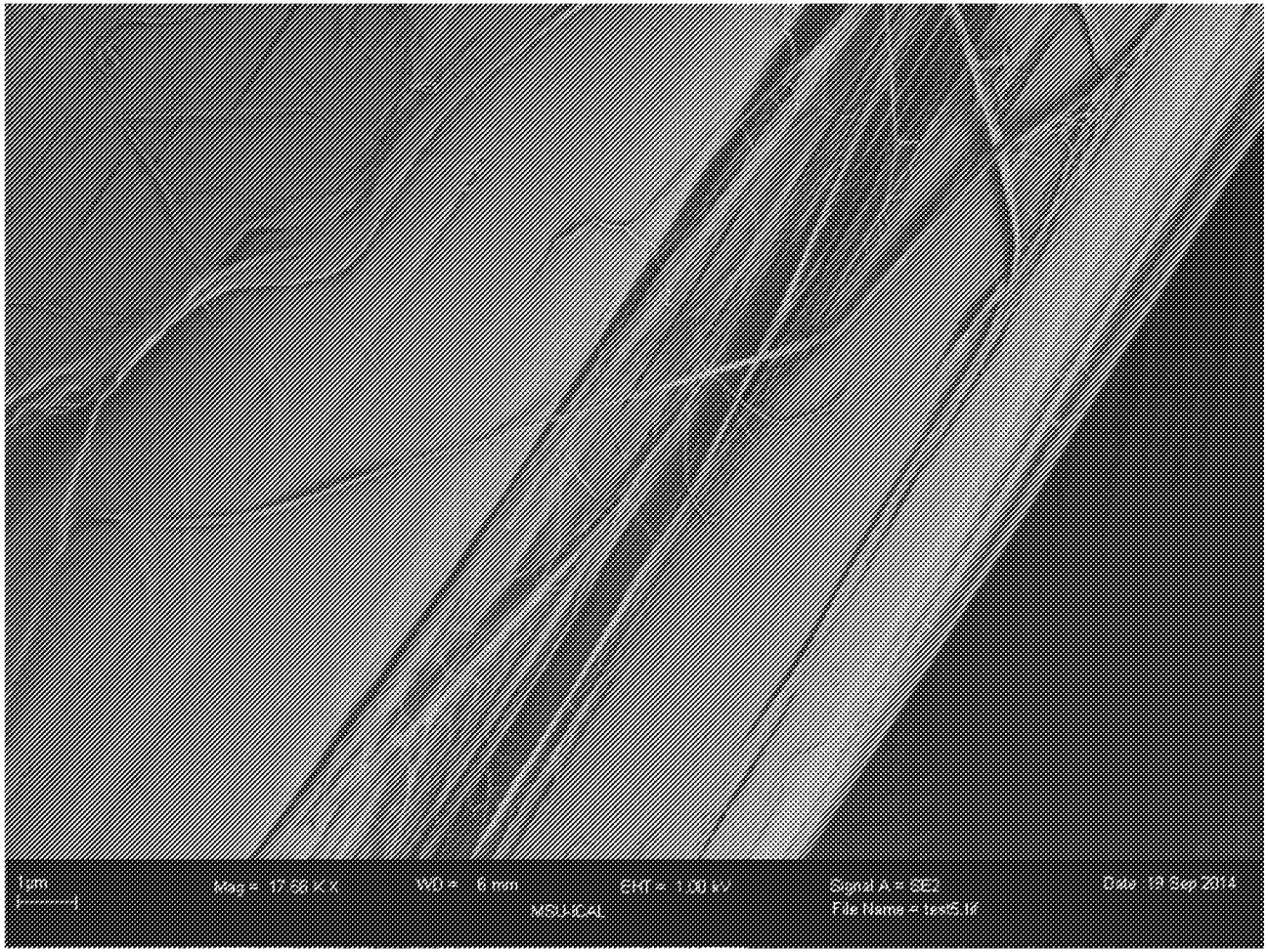
Figure 15F:
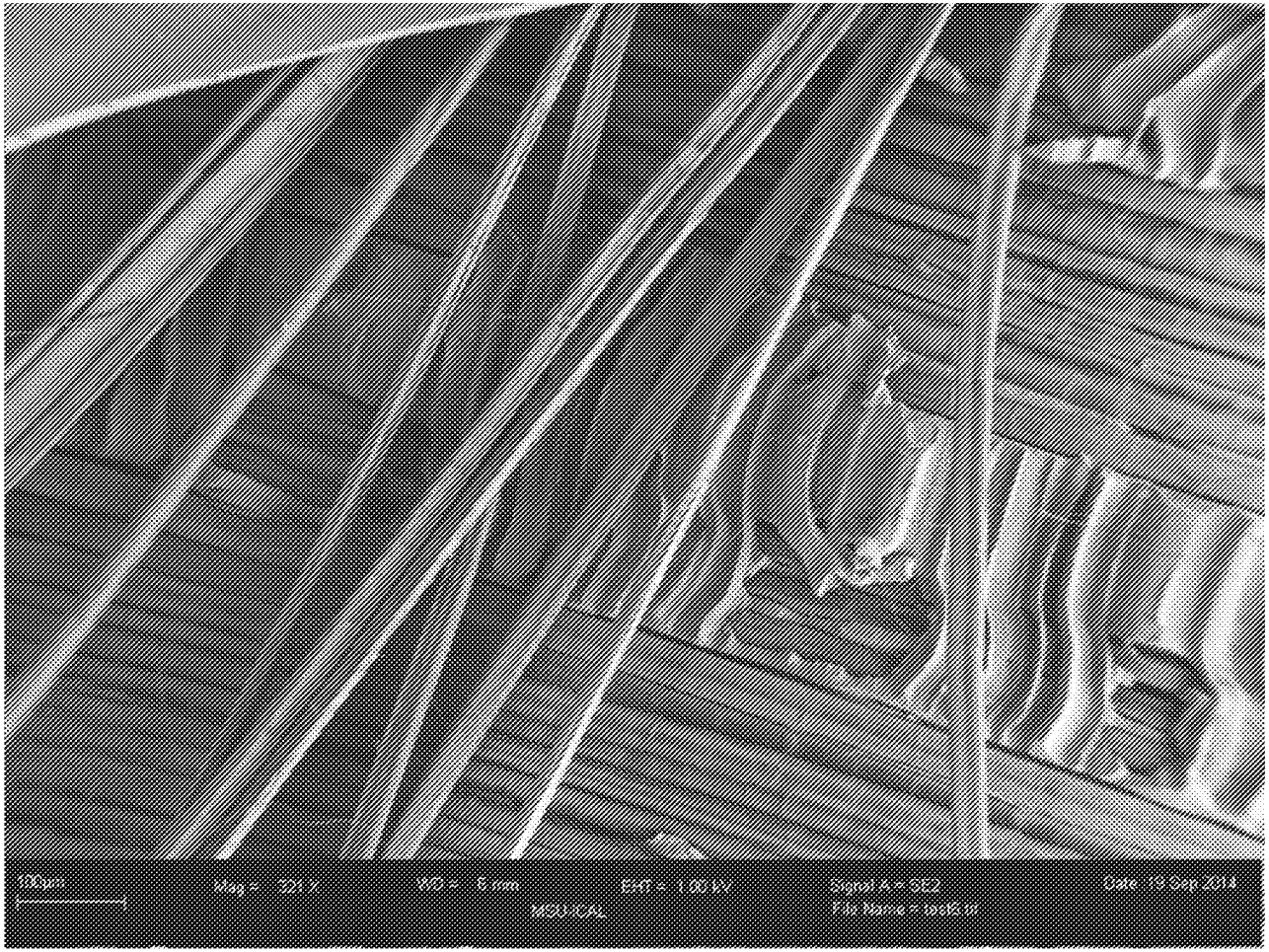
Figure 15G:
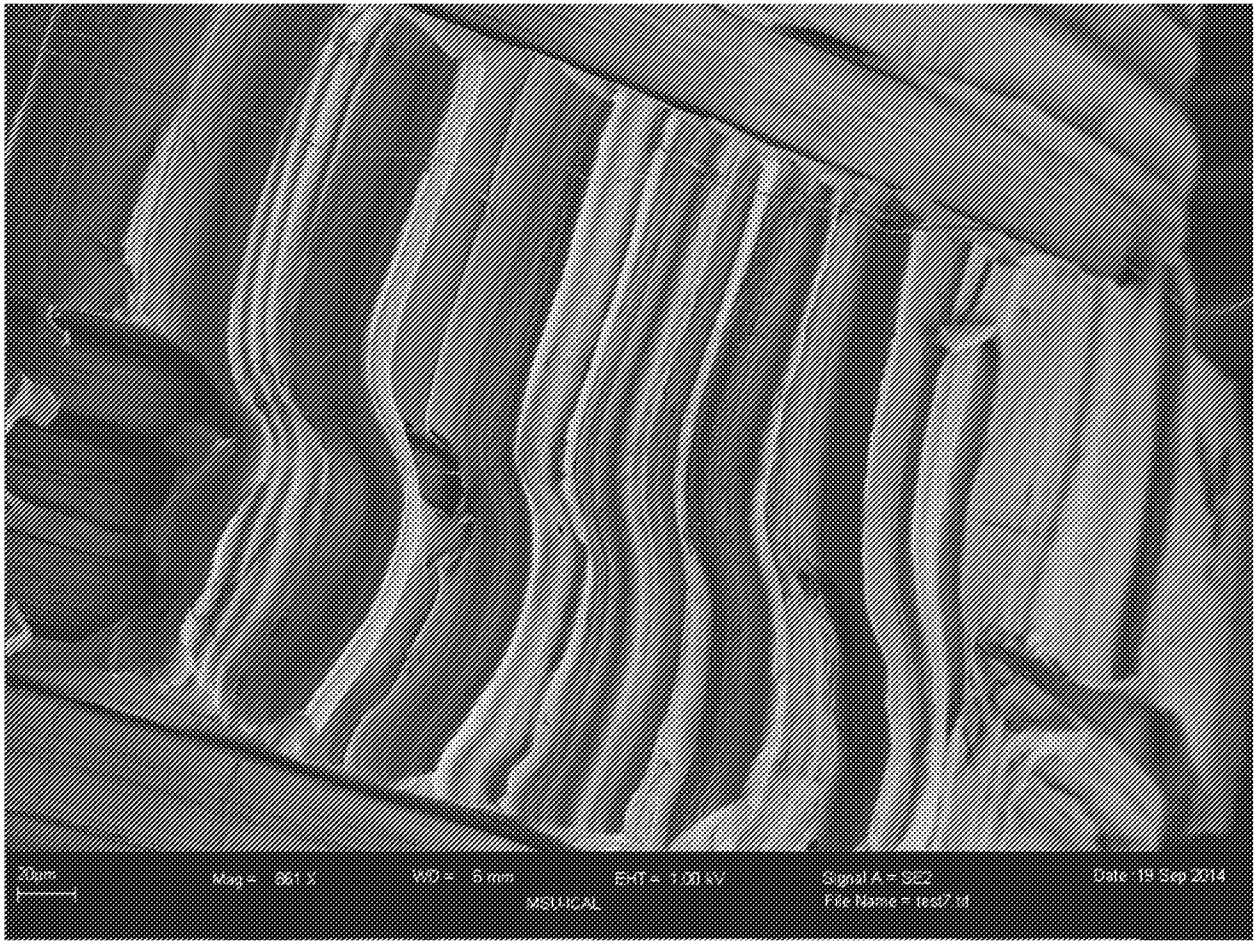
Figure 15H:
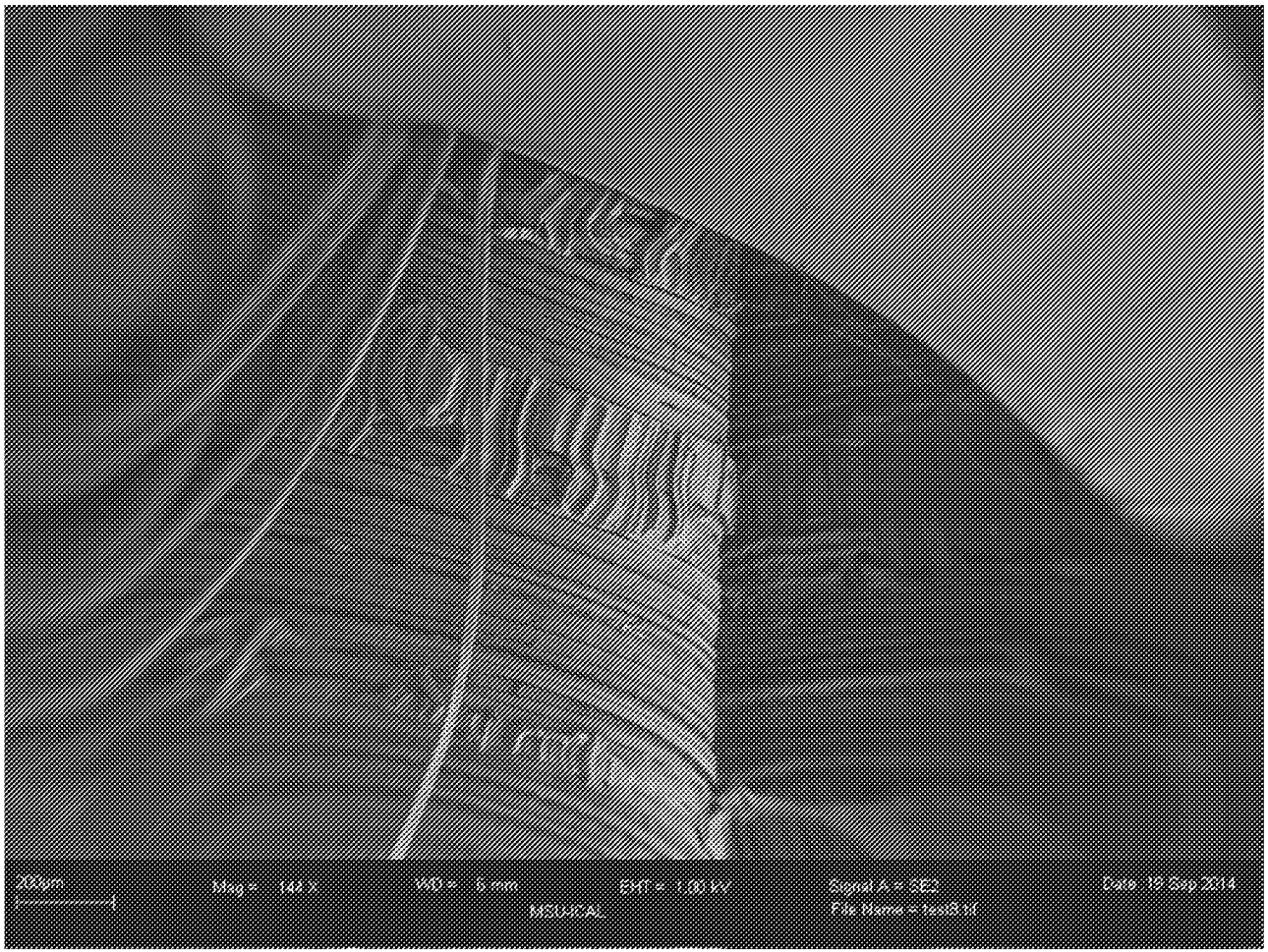
Figure 15I:
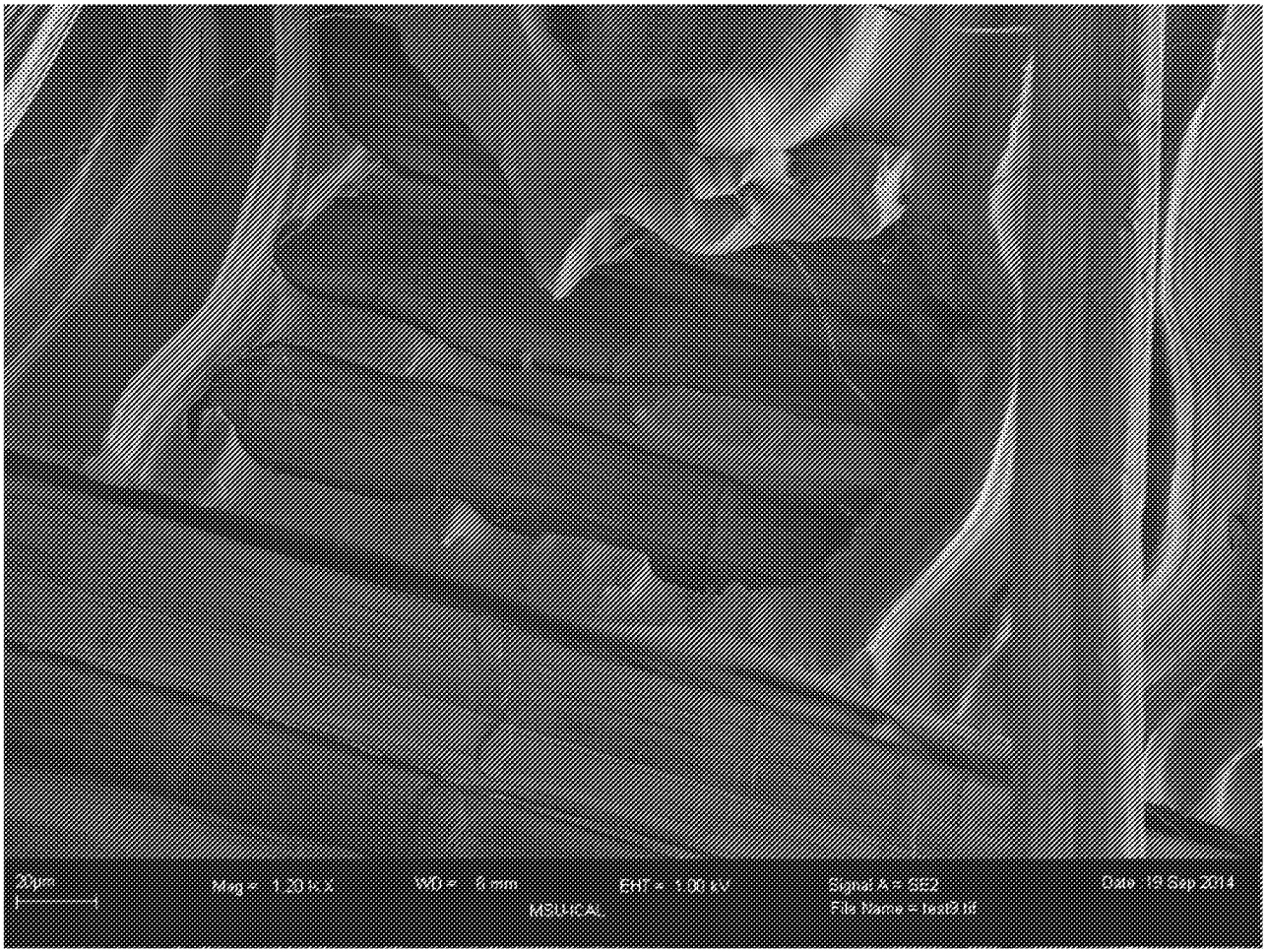
Figure 15J:
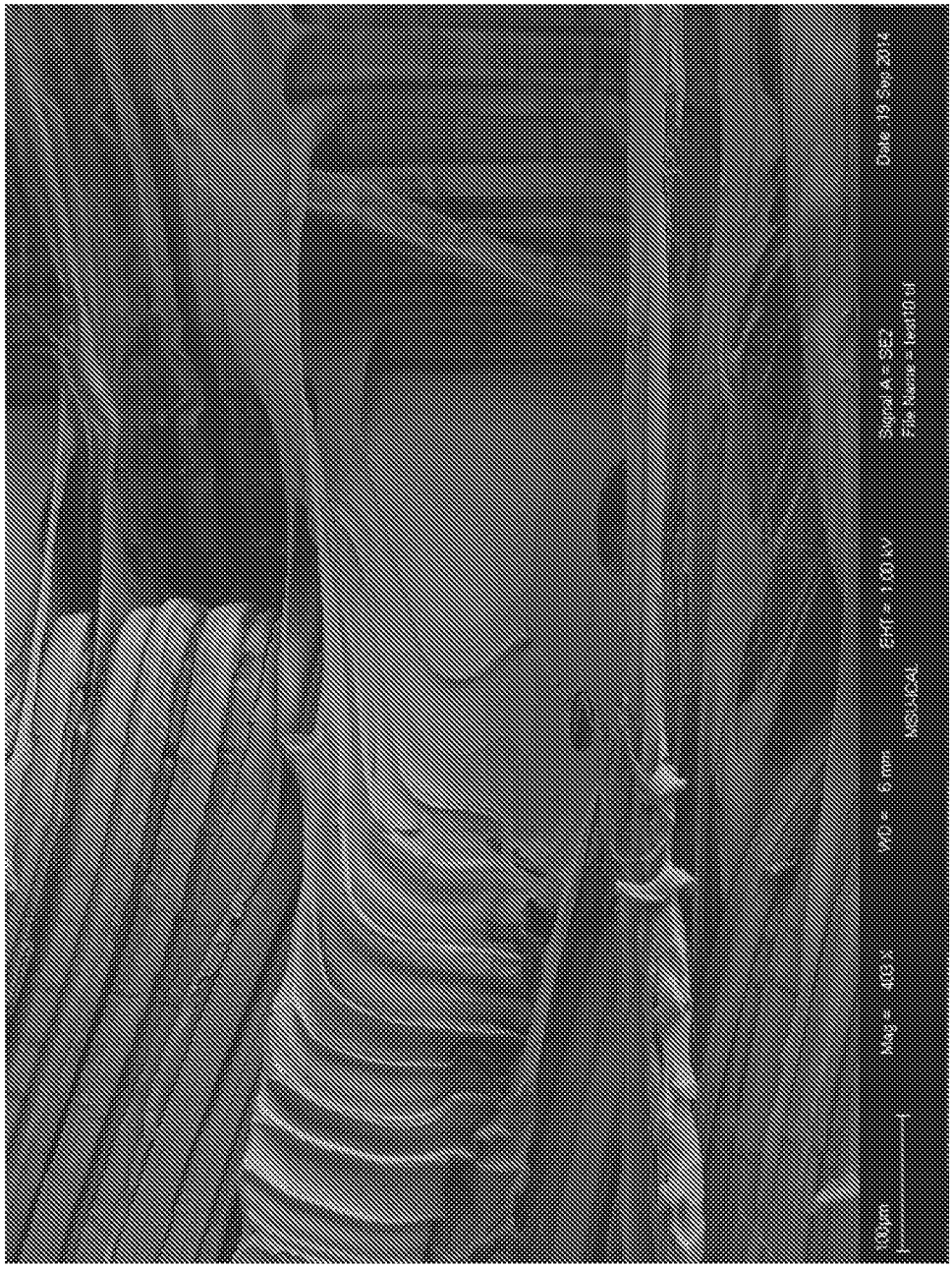
Figure 15K:
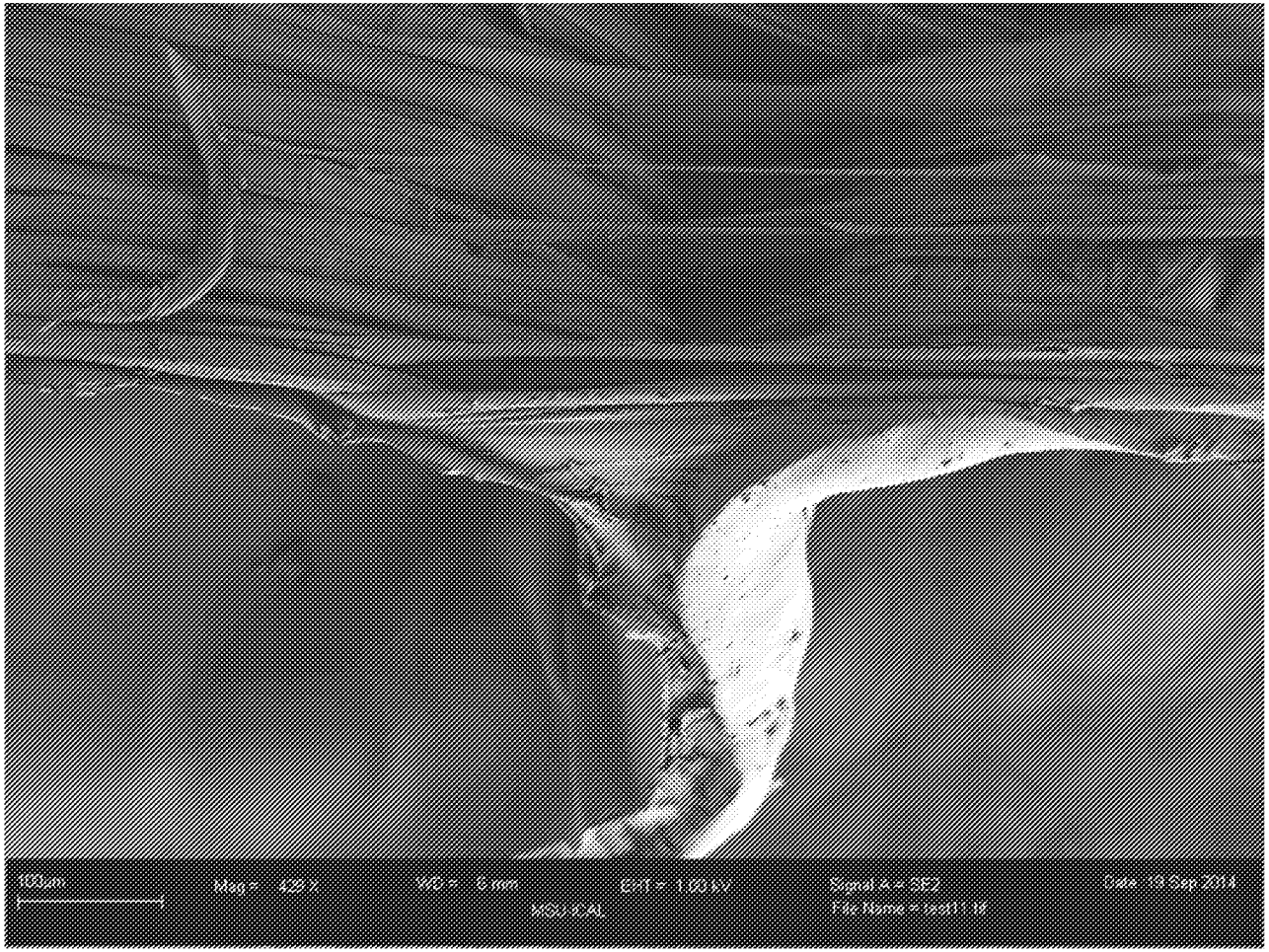

The dimensions of the reinforced seams of the present disclosure are characterized relative to the original, non-reinforced seam. In an aspect, a reinforced seam runs the entire length of the seam. In another aspect, a reinforced seam covers only part of the seam, often the region wherein stresses are concentrated. In another aspect, a reinforced seam is prepared by providing one or more reinforcement FCLs. Examples of such seams are provided in FIG. 14 showing a combination of 16 reinforcement FCLs (A to P) including seven Tensor tabs (C, E, G, I, L, N, and P), six Flexus-x tabs (D, F, J, K, M, and O) and two Flexus-k tabs (A, and H). As shown, the number of cuts/notches in the Flexus tabs ranges from three to six though tabs with up to 10 cuts/notches are common. Notably, by incorporating multiple flexus tabs, the orientation of the fibers in adjacent cross-plied monolayers can be controlled. Accordingly, in many aspects, a curved reinforced seam comprises two or more reinforcement FCLs. Also as show in FIG. 14, linear reinforcement tabs (e.g., Tensor tabs) can be of various lengths (compare tabs C, E, N, and P to tabs G, I, and L). In an aspect, a reinforced seam spans the entire length of the seam. In another aspect, a reinforced seam spans only part of the length of the seam, particularly where hoop stresses are expected or demonstrated by testing. In aspects of the present disclosure, the number of reinforcement seams is limited to locations of high stress in inflatables to reduce weight.

Reinforced Seams

The present disclosure provides for, and includes, reinforced seams comprising a reinforcement FCL. As used herein, the term "reinforcement FCL" refers to one or more additional FCLs that are joined to an otherwise non-reinforced seam so that the resulting reinforced seam exhibits increased resistance to cracking, tearing, and other stress-induced failures. As used herein, reinforcement FCLs are limited to the seam areas, generally (but not exclusively) to those areas that are subject to hoop type stresses in inflatable applications. In an aspect, a reinforcement FCL spans the entire length of a seam. In another aspect, a reinforcement FCL spans one continuous section of a seam. In an aspect, a reinforcement FCL may be linear, curved, or a combination thereof. In an aspect, a reinforcement FCL may be rectangular-shaped or square-shaped. In one aspect, a curved reinforcement FCL reinforces an outward-curving seam (e.g., FIGS. 11A-11E "Flexus-k"). In another aspect, a curved reinforcement FCL reinforces an inward-curving seam (e.g., FIGS. 10A-10E, "Flexus-x").

As discussed above, to maximize the strength of the reinforced seams, the orientation of the fibers in adjacent cross-plied monolayers at each weld and seam should be considered. The present disclosure provides for, and includes, linear reinforced seams having a Tensor tab having the fibers of adjacent cross-plied monolayers oriented between 75 and 90 degrees to each other. In another aspect the fibers of adjacent cross-plied monolayers oriented perpendicular to each other. In yet another aspect, the fibers of adjacent cross-plied monolayers oriented between zero (0) (e.g., parallel) and 15 degrees to each other. In a further aspect, the fibers of adjacent cross-plied monolayers oriented parallel to each other and parallel to the direction of the seam.

The reinforced linear seams of the present disclosure have high average tensile strengths when tested. To test the tensile strength, a 2.54 cm by 12.7 cm coupon is prepared from to two base FCLs joined in the middle by a reinforced seam. Each of the welds (e.g., 731, 733, and 735) are approximately 1 cm wide. The samples are then tested as described below in Example 8. In aspects, the Tensor tab reinforced welds of the present disclosure have an average tensile strength of greater than 800 Newtons/$5\times10^{-3}$ meters (N/5 cm). In an aspect, a Tensor tab reinforced weld has average tensile strength of greater than 1,000 N/5 cm. In another aspect, a Tensor tab reinforce weld has an average tensile strength of about 1,120 N/5 cm. Also included, and provided for, by the present specification are reinforced seams that have an average tensile strength that is at least 80% of the strength of the base FCL materials. In an aspect, the Tensor reinforce seams have an average tensile strength that is at least 83% of the strength of the base FCL materials. In some aspects, the first and second base FCL comprise the same material and the same meltable layer. In aspects, the average tensile strength is selected from the group consisting of average shear tensile strength and average peel tensile strength.

In aspects of the present disclosure, reinforced linear seams have at least an average peel tensile strength that is between 50% and 100% of the base tensile strength of the weaker of two coated FCLs comprising the seam when tested on a coupon with a 1 cm width. In aspects, the reinforced linear seams have at least 50/a of the base tensile strength of the weaker of two coated FCLs. In an aspect, the reinforced linear seams have at least 60% of the base tensile strength of the weaker of two coated FCLs. In further aspects, the reinforced linear seams have a peel tensile strength that is at least 70% of the base tensile strength of the weaker of two coated FCLs. The methods and welds further provide reinforced linear seams having at least 80% of the base tensile strength of the weaker of two coated base FCLs comprising the seam. In aspects, reinforced linear seams of the present disclosure have an average peel tensile strength of between 70% and 100% of the base tensile strength of the weaker of two coated base FCLs comprising the seam. Also provided for, and included, are reinforced linear seams that are between 70% and 90% of the base tensile strength of the weaker of two coated base FCLs comprising the seam. In aspects, a reinforced linear seam has an average peel tensile strength that is between 70% and 75%, between 75% and 80%, between 80% and 85%, between 85% and 90%, between 90% and 95%, between 70% and 80%, between 75% and 85%, between 80% and 90%, or between 70% and 95% the base tensile strength of the weaker of two FCLs comprising the seam.

The present disclosure provides for, and includes, Tensor tab reinforced welds between base FCLs that have high tensile strengths. Accordingly, includes Tensor reinforced seams that have an average tensile strength that is at least 80% of the strength of the base FCL of the weakest FCL material. In an aspect, the Tensor reinforce seams have an average tensile strength that is at least 83% strength of the base FCL of the weakest FCL material. In some aspects, the first and second base FCL comprise the same material and same meltable layer. In aspects, the average tensile strength is selected from the group consisting of average shear tensile strength and average peel tensile strength.

B. FLEXUS TABS

Certain applications require high strength seams. In particular, the preparation of inflatable products places high demands on seams as the shapes concentrate stresses along curves. These stresses are often referred to as hoop stresses. Hoop stresses act circumferential and perpendicular to the axis and the radius of a cylinder wall and using design software can often be calculated using equation (1): $\sigma h = p\, d/(2\, t)$, where ah=hoop stress (MPa), p=equals the internal pressure (Mpa), d is the internal diameter (mm), and t is the tube or cylinder wall thickness (mm). More generally, stresses in an inflatable are concentrated at curves and require reinforcement to avoid catastrophic failure.

The present disclosure provides for, and includes, reinforced curved seams joining two flexible composite laminates (FCLs) using reinforcing FCLs that are cut, folded, joined and then welded to the base FCLs to create a seam. These reinforcing FCLs are briefly described above and are referred to as Flexus tabs. Two different types of Flexus tabs are needed to reinforce concave (Flexus-k) and convex (Flexus-x) curved seams.

In a first aspect of a curved reinforced seam, a reinforced curved seam is a convex curved seam that joins two flexible composite laminates (FCLs), a first base FCL (860) and a second base FCL (870) having curved edges (861) and (871) respectively. Each FCL comprises a plurality of stacked, unidirectionally oriented fibers arranged in cross-plied monolayers (201) and embedded in a plastic matrix (103), the first base FCL (860) having a meltable layer (804) on its inner face and the second base FCL (870) having a meltable layer (805) on its inner face. The reinforced curved seam further includes a reinforcement FCL (840) (e.g., a Flexus tab) that comprises a folded third FCL (810) having a meltable layer (813) applied to one side, a curved edge (809) that is align-able with curved edge (871), and three or more folded tabs (808) formed from two or more cuts (832) oriented perpendicular to the curved edge (809) and extending to the midline (811). See FIG. 10. The tabs (808) are folded along the midline to provide an exposed face (817) having the meltable layer (813). The folded fourth FCL (820) has meltable layers (813, 814) applied to both sides, a curved edge (819) that is align-able with curved edge (871), and three or more folded tabs (818) formed from two or more cuts (842) oriented perpendicular to the curved edge (819) and extending to the midline (821). The tabs (818) are folded along the midline to provide an exposed face (827) having meltable layer (814), and an inner face (826) having meltable layer (813). The folded third FCL (810) is inserted into the folded fourth FCL (820), aligning the curved edges (819) and (829), and heat-fused to prepare reinforcement FCL (840). The first base FCL (860), the second base FCL (870), and the reinforcement FCL (840) are assembled by aligning and juxtaposing all curved edges (861, 871, 809, 819) and welded as provided above to prepare a continuous first weld (831) comprising a homogeneous, fused monolayer (806) formed from the meltable layer (804) of the first base FCL (860) and the meltable layer (814) of the reinforcement FCL (840), a continuous second weld (833) comprising a homogeneous, fused monolayer (806) formed from the meltable layer (805) of the second FCL (870) and meltable layers (813) and (814) of the reinforcement FCL (840), a continuous third weld (835) comprising a homogeneous, fused monolayer (806) formed from meltable layer (804) of the first base FCL (860) and meltable layer (805) of the second base FCL (870), where the number of cuts (832) and (842) is configured so that each inner edge of folded tabs (818) and (808) is oriented within 88 and 90 degrees relative to said curved edges (861) and (871). The number of tabs is determined so as to maintain a maximum distance of 6 mm between the mid-point of the fold line (811, 821) and the arc representing the true curvature (873, 883). See FIG. 10E. Accordingly, a sharp curve requires more tabs while gentle curves require fewer. At the extreme, a curve that is a straight line does not require any cuts or tabs.

In aspects of the present disclosure, the orientation of the fibers in the adjacent cross-plied monolayers are arranged to be between 90 and 75 degrees of each other. This ensures that the maximal tensile strength is obtained throughout the curve. In an aspect, the fibers of the adjacent cross-plied monolayers are maintained perpendicular. In certain other aspects, the orientation of the fibers in the adjacent cross-plied monolayers are arranged to be between 0 and 15 degrees of each other. In an aspect, the fibers of the adjacent cross-plied monolayers are maintained in a parallel orientation (e.g., 0 degrees) throughout the curve.

The Flexus tabs are prepared from curved FCLs that are cut to the midline and folded. As used herein, the term "cut" refers to a linear slit in a curved FCL that is oriented perpendicular to the inner edge (and the parallel outer edge) of the FCL and extends to the midline so that the FCL remains physically intact. The number of cuts varies with the degree of the curve with sharp curves requiring more cuts. In aspects of the present disclosure the number of cuts varies between 2 and 20 cuts (see FIGS. 13A-13G). In certain aspects, the number of cuts can be less than 20. In certain aspects, the number of cuts can be greater than 20. In certain aspects, the number of cuts is between 20 and 50. In an aspect, a curved FCL comprises two cuts. In an aspect, a curved FCL comprises three cuts. In yet another aspect, a curved FCL comprises four cuts. In an aspect, a curved FCL comprises five cuts. In an additional aspect, a curved FCL comprises six cuts. In yet another aspect, a curved FCL comprises seven cuts. In an aspect, a curved FCL comprises eight cuts. In a further aspect of the present disclosure, a curved FCL comprises nine cuts. In an aspect, a Flexus tab includes a curved FCL comprising 10 cuts. In an aspect, a curved FCL of a Flexus tab comprises 11 cuts. In an aspect, a curved FCL comprises 12 cuts. In an aspect, a Flexus tab includes a curved FCL comprising 13 cuts. In an aspect, a curved FCL comprises 14 cuts. In aspects, the reinforcement FCL comprises unidirectionally oriented fibers are polyethylene fibers selected from the group consisting of UHMWPE, High Density Polyethylene (HDPE) fibers, Medium-Density Polyethylene (MDPE) fibers, Low-Density Polyethylene (LDPE) fibers, Very Low-Density Polyethylene (VLDPE) fibers, and Cross-Linked Polyethylene (PEX) fibers. In some aspects, the unidirectionally oriented fibers are Ultra-High Molecular Weight Polyethylene (UHMWPE) fibers.

In further aspects, the reinforced curved seam includes controlling the distance between the welds to ensure symmetry. In an aspect, the distance between said first weld (831) said third weld (835) is at least 90% of the distance between said second weld (833) and said third weld (835). In another aspect, the first weld (831) and said second weld (833) are arranged equidistant from said third weld (835). Using the stacked welding methods of the present disclosure, the welds (831) and (833) can be prepared simultaneously ensuring the optimal alignment.

The present disclosure provides for, and includes, curved reinforcement FCLs for use in concave curves (e.g., Flexus-k). In contrast to convex curves, the tabs are prepared by introducing notches into an arced FCL (see FIGS. 11A-11E). As used herein, the term "notched gap" refers to an area of a curved FCL where a triangular-shaped section of material has been removed to the midline of the curved FCL. In an aspect, a notched gap has the shape of an equilateral triangle, where all sides are congruent. In an aspect, a notched gap has the shape of an isosceles triangle, where two sides are congruent. In an aspect, a reinforced curved seam joins two flexible composite laminates (FCLs), a first base FCL (960) and a second base FCL (970) having curved edges (961) and (971) respectively. Each FCL comprises a plurality of stacked, unidirectionally oriented fibers arranged in cross-plied monolayers (201) and embedded in a plastic matrix (103), the first base FCL (960) having a meltable layer (904) on its inner face and the second base FCL (970) having a meltable layer (905) on its inner face. The reinforced curved seam further includes a reinforcement FCL (940) (e.g., a Flexus tab) that comprises a folded third FCL (910) having a meltable layer (913) applied to one side, a curved edge (909) that is align-able with curved edge (971), and two or more notched gaps (978) oriented perpendicular to curved edge (909) and to the midline (911) to form three or more tabs (908). The tabs (908) are folded along the midline to provide an exposed face (917) having the meltable layer (913). The folded fourth FCL (920) has meltable layers (913, 914) applied to both sides, a curved edge (919) that is align-able with curved edge (971), and two or more notched gaps (979) oriented perpendicular to curved edge (919) and to the midline (921) to form three or more tabs (918). The tabs (918) are folded along the midline to provide an exposed face (927) having meltable layer (914), and an inner face (926) having meltable layer (913). The folded third FCL (910) is inserted into the folded fourth FCL (920), aligning the curved edges (919) and (929), and heat-fused to prepare heat fused reinforcement (940). The first base FCL (960), the second base FCL (970), and the reinforcement (940) are assembled by aligning and juxtaposing all curved edges (961, 971, 909, 919) and welded as provided above to prepare a continuous first weld (931) comprising a homogeneous, fused monolayer (906) formed from the meltable layer (904) of the first base FCL (960) and the meltable layer (914) of the reinforcement FCL (940), a continuous second weld (933) comprising a homogeneous, fused monolayer (906) formed from the meltable layer (905) of the second FCL (970) and meltable layers (913) and (914) of the reinforcement FCL (940), a continuous third weld (935) comprising a homogeneous, fused monolayer (906) formed from meltable layer (904) of the first base FCL (960) and meltable layer (905) of the second base FCL (970), where the number of notched gaps (978) and (979) is configured so that each inner edge of folded tabs (908) and (918) is oriented within 88 and 90 degrees relative to said curved edges (961) and (971). The number of tabs is determined so as to maintain a maximum distance of 6 mm between the mid-point of the fold line (911, 921) and the arc representing the true curvature (973, 983). See FIG. 11E. As provided above, a sharp curve requires more tabs while a more gradual curve requires fewer tabs. In aspects, the reinforcement FCL comprises unidirectionally oriented fibers are polyethylene fibers selected from the group consisting of UHMWPE, High Density Polyethylene (HDPE) fibers, Medium-Density Polyethylene (MDPE) fibers, Low-Density Polyethylene (LDPE) fibers, Very Low-Density Polyethylene (VLDPE) fibers, and Cross-Linked Polyethylene (PEX) fibers. In some aspects, the unidirectionally oriented fibers are Ultra-High Molecular Weight Polyethylene (UHMWPE) fibers.

In aspects of the present disclosure, the orientation of the fibers in the adjacent cross-plied monolayers are arranged to be between 90 and 75 degrees of each other. This ensures that the maximal tensile strength is obtained throughout the curve. In an aspect, the fibers of the adjacent cross-plied monolayers are maintained perpendicular. In certain other aspects, the orientation of the fibers in the adjacent cross-plied monolayers are arranged to be between 0 and 15 degrees of each other. In an aspect, the fibers of the adjacent cross-plied monolayers are maintained in a parallel orientation (e.g., 0 degrees) throughout the curve.

As noted above, the second type of Flexus tabs are prepared from curved FCLs that are notched to the midline and folded. As used herein, the term "notch" refers to a removal of a wedge-shaped gap from a curved FCL, referred to herein as a "notched gap," where the notched gap is oriented perpendicular to the inner edge (and the parallel outer edge) of the FCL and extends to the midline so that the FCL remains physically intact. The number of notched gaps varies with the degree of the curve with sharp curves requiring more notched gaps. In aspects of the present disclosure the number of notched gaps varies between 2 and 20 notched gaps. In certain aspects, the number of notched gaps can be less than 20. In certain aspects, the number of notched gaps can be greater than 20. In certain aspects, the number of notched gaps is between 20 and 50. In an aspect, a curved FCL comprises two notched gaps. In an aspect, a curved FCL comprises three notched gaps. In yet another aspect, a curved FCL comprises four notched gaps. In an aspect, a curved FCL comprises five notched gaps. In an additional aspect, a curved FCL comprises six notched gaps. In yet another aspect, a curved FCL comprises seven notched gaps. In an aspect, a curved FCL comprises eight notched gaps. In a further aspect of the present disclosure, a curved FCL comprises nine notched gaps. In an aspect, a Flexus tab includes a curved FCL comprising 10 notched gaps. In an aspect, a curved FCL of a Flexus tab comprises 11 notched gaps. In an aspect, a curved FCL comprises 12 notched gaps. In an aspect, a Flexus tab includes a curved FCL comprising 13 notched gaps. In an aspect, a curved FCL comprises 14 notched gaps. In an aspect, a curved FCL of a Flexus tab comprises 15 notched gaps. In a further aspect, a curved FCL comprises 20 notched gaps.

In further aspects, the reinforced curved seam includes controlling the distance between the welds to ensure symmetry. In an aspect, the distance between said first weld (931) said third weld (935) is at least 90% of the distance between said second weld (933) and said third weld (935). In another aspect, the first weld (931) and said second weld (933) are arranged equidistant from said third weld (935). Using the stacked welding methods of the present disclosure, the welds (931) and (933) can be prepared simultaneously so as to ensure the optimal alignment.

A reinforcement FCL is formed by heat means applied to a surface. In an aspect, heat means is selected from the group consisting of a heat press, a hot iron, or a combination thereof. In an aspect, heat means is provided at a constant temperature and a constant pressure. In another aspect, heat means is provided at a variable temperature and a constant pressure. In yet another aspect, heat means is provided at a constant temperature and a variable pressure. In yet another aspect, heat means is provided at a variable temperature and a variable pressure. In yet another aspect, heat is applied at a constant temperature that is less than 95% of the melting temperature of said UHMWPE fibers arranged in cross-plied monolayers. In an aspect, the heat applied to a surface has a temperature between 100° C. and 130° C. In another aspect, the heat applied to a surface has a temperature between 110° C. and 120° C. In yet another aspect, the heat applied to a surface has a temperature of about 115° C. In an aspect, the heat is applied to a surface for a period of less than 10 seconds. In another aspect, the heat is applied to a surface for a period of less than 5 seconds. In yet another aspect, the heat is applied to a surface for a period of about 3 seconds. In an aspect, the heat is applied to a surface with a pressure between 5 and 20 psi. In another aspect, the heat is applied to a surface with a pressure between 5 and 10 psi. In yet another aspect, the heat is applied to a surface with a pressure between 10 and 15 psi. In yet another aspect, the heat is applied to a surface with a pressure that is about 10 psi.

As used herein, the term "tab" refers to a foldable section of a curved FCL formed by two congruent slits, both of which are oriented perpendicular to the inner edge of the curved FCL Tabs can be prepared by either notching or cutting an arced FCL and folding at the midline. In an aspect, a curved FCL comprises three tabs. In another aspect, a curved FCL comprises four tabs. In a further aspect, a curved FCL comprises five tabs. In aspects, a curved FCL comprises six tabs. In an aspect, a curved FCL comprises seven tabs. In yet another aspect, a curved FCL comprises eight tabs. In an aspect, a curved FCL comprises nine tabs. In aspects, a curved FCL comprises 10 tabs. A curved FCL comprises 11 tabs in some aspects. In other aspects, a curved FCL comprises 12 tabs. In some aspects, a curved FCL comprises 13 tabs. In a further aspect, a curved FCL comprises 14 tabs. In an aspect, a curved FCL comprises 15 tabs. In an aspect, a curved FCL comprises 20 tabs.

As used herein, the term "oblique angle" refers to an angle that is not a right angle. As used herein, the term "perpendicular" refers to a right angle of 90 degrees. As used herein, the term "parallel" refers to an angle of zero degrees.

As used herein, the linear edges of two or more objects are "aligned" the linear edges are arranged in a relative parallel orientation. As used herein, the curved edges of two or more objects are "aligned" if the curved edges are arranged in a symmetrical relative orientation.

As used herein, the term "segment" refers to parts of a whole, such as discrete sections of an FCL, an FCL, or a weld.

As used herein, the term "gas impermeable" refers to a material through which a gas cannot penetrate. In an aspect, the impermeable gas is oxygen. In an aspect, a seam of the present disclosure is gas impermeable. In an aspect, a weld of the present disclosure is gas impermeable.

A reinforced curved seam provides for seams having a high tensile strength. High tensile strength is critical in inflatable products particularly in the curves where forces accumulate. Each of the seams in a reinforced curved seam (e.g., seams of welds 831, 833, and 835) are high tensile strength seams as described above and as tested on a 2.54 cm×12.7 cm coupon bisected by a reinforced seam comprising a weld having a width of about 1 cm. In aspects of the present disclosure, reinforced curved seams have at least an average peel tensile strength that is between 50% and 100% of the base tensile strength of the weaker of two coated FCLs comprising the seam when tested on a coupon with a 1 cm width. In aspects, the reinforced curved seams have at least 50% of the base tensile strength of the weaker of two coated FCLs. In an aspect, the reinforced curved seams have at least 60% of the base tensile strength of the weaker of two coated FCLs. In further aspects, the reinforced curved seams have a peel tensile strength that is at least 70% of the base tensile strength of the weaker of two coated FCLs. The methods and welds further provide reinforced curved seams having at least 80% of the base tensile strength of the weaker of two coated base FCLs comprising the seam. In aspects, reinforced curved seams of the present disclosure have an average peel tensile strength of between 70% and 100% of the base tensile strength of the weaker of two coated base FCLs comprising the seam. Also provided for, and included, are reinforced curved seams that are between 70% and 90% of the base tensile strength of the weaker of two coated base FCLs comprising the seam. In aspects, a reinforced curved seam has an average peel tensile strength that is between 70% and 75%, between 75% and 80%, between 80% and 85%, between 85% and 90%, between 90% and 95%, between 70% and 80%, between 75% and 85%, between 80% and 90%, or between 70% and 95% the base tensile strength of the weaker of two FCLs comprising the seam.

As used herein, the term "inflatable body" refers to a closed body that may be filled with air or another gas such as hydrogen, helium, nitrogen, and argon, resulting in the body having an internal density that is different from the density of its surrounding environment. An inflatable body may be a high-pressure inflatable or a low-pressure inflatable. In an aspect, an inflatable body is a high-pressure inflatable. In an aspect, an inflatable body may be selected from the group consisting of a life preserver, a life raft, an inflatable emergency slide, a sculpture, and a balloon. Any inflatable body can be produced using the methods of the present application.

As used herein, the term "burst pressure" refers to the pressure at which an inflated body ruptures. Units for expressing burst pressure include kilopascals (kPa), atmospheres (atm), millimeters of mercury (mmHg), or pounds per square inch (psi). As used herein, the term "average burst pressure" refers to a mean burst pressure value calculated from a plurality of burst pressure measurements.

As used herein, the term "test bladder" refers to an inflatable body comprising one or more seams, one or more reinforced seams, or a combination thereof, which may undergo burst pressure testing to determine one or more locations of weakness in the inflatable body and the burst pressures associated with these one or more locations.

A test bladder of the present disclosure may be of a variety of sizes and shapes. In an aspect, a test bladder has a rounded shape. In an aspect, a test bladder has a kidney shape and overall dimensions of 40.9 cm×89.1 cm and further comprises reinforced seams. In further aspects, the test bladder has reinforced seams that provide for an average burst pressure of greater than 50 kilopascals (kPa), greater than 55 kPa, greater than 60 kPa, greater than 65 kPa, greater than 70 kPa, greater than 75 kPa, greater than 80 kPa, greater than 85 kPa, greater than 90 kPa, greater than 95 kPa, greater than 100 kPa, greater than 105 kPa, or greater than 110 kPa. In other further aspects, the reinforced seam has an average burst pressure of about 50 kPa, about 51 kPa, about 60 kPa, about 65 kPa, about 70 kPa about 75 kPa, about 80 kPa, about 85 kPa, about 90 kPa, about 95 kPa, about 100 kPa, about 105 kPa, or about 110 kPa. In other further aspects, the reinforced seam has an average burst pressure that is between 50 kPa and 60 kPa, between 60 kPa and 70 kPa, between 70 kPa and 80 kPa, between 80 kPa and 90 kPa, between 90 kPa and 100 kPa, between 100 kPa and 110 kPa, between 75 kPa and 90 kPa, between 70 kPa and 90 kPa, between 80 kPa and 100 kPa, between 90 kPa and 110 kPa, or between 50 kPa and 110 kPa.

For convenience and clarity, while defined throughout the present disclosure, components shown in the Figures are listed in Table 1.

TABLE 1

Listing of reference numbers

| Reference number | Element name |
|---|---|
| 50 | two FCLs joined with fin seam |
| 51, 52, 61, 62 | seamed FCL |
| 53 | fin seam |

TABLE 1-continued

Listing of reference numbers

| Reference number | Element name |
|---|---|
| 55, 65 | direction of applied stress |
| 60 | two FCLs joined with overlap seam |
| 63 | overlap seam |
| 100, 200 | unwelded stacked configuration |
| 101, 102, 201, 202 | cross-plied monolayer of unidirectionally oriented UHMWPE fibers |
| 103 | plastic matrix |
| 104, 105, 404, 405, 704, 705, 714, 804, 805, 813, 814, 904, 905, 913, 914 | meltable layer |
| 106, 706, 806, 906 | homogeneous, fused monolayer |
| 110, 120, 210, 410, 420 | FCL |
| 163 | absorption modifier |
| 185 | transparent wheel with weld bit |
| 186 | weld bit opening |
| 187, 501 | weld backing |
| 300, 400 | welded stacked configuration |
| 351, 352, 353, 354 | seam direction |
| 450, 850, 950 | seam |
| 490 | inflatable structure having fin seam in a non-inflated state |
| 495 | inflatable structure having fin seam in an inflated state |
| 499, 797, 798, 799, 987, 898, 899, 997, 998, 999 | approximate weld location |
| 700 | reinforcement FCL, unfolded |
| 708 | interlocking fold tab |
| 709 | interlocking fold groove |
| 710 | reinforcement FCL, folded |
| 711, 811, 821, 911, 921 | foldable midline |
| 715, 815, 915 | intraseam space |
| 731, 733, 735, 831, 833, 835, 931, 933, 935 | weld |
| 745, 845, 945 | direction of inflation |
| 760, 770, 860, 870, 960, 970 | flexible composite laminate (FCL) |
| 763, 863, 963 | attachment region |
| 780, 880, 980 | reinforced seam |
| 790, 890, 990 | inflatable structure having a reinforced fin seam in a non-inflated state |
| 795, 895, 995 | inflatable structure having a reinforced fin seam in an inflated state |
| 797, 897, 997 | approximate heat tacking location |
| 806, 816, 906, 916 | inner face |
| 807, 817, 907, 917 | exposed (outer) face |
| 808, 818, 908, 918 | tab |
| 809, 819, 909, 919 | curved edge |
| 810, 820, 910, 920 | curved FCL segment |
| 728, 828, 829, 928, 929 | fold direction |
| 832, 842 | cut |
| 840, 940 | reinforcement FCL |
| 861, 871, 961, 971 | FCL curved edge |
| 873, 883, 973, 983 | true curvature of tab foldable midline |
| 978, 979 | notched gap |

The present disclosure provides for, and includes, reinforced seams wherein the overlap welds are approximately equidistant from the fin seam welds. Not to be limited by theory, it is thought by providing symmetric reinforcement, the overall strength of the reinforced seams is increased. As noted herein, the overlap welds of the present disclosure can conveniently be prepared by simultaneously welding the stacked FCLs of the seam to be reinforced in a single pass. In an aspect, the distance between weld (831) and weld (835) is at least 90% of the distance between weld (833) and weld (835). In another aspect, the distance between weld (831) and weld (835) is at least 95% of the distance between weld (833) and weld (835). In an aspect, the distance between weld (833) and weld (835) is at least 90% of the distance between weld (831) and weld (835). In an aspect, the distance between weld (833) and weld (835) is at least 95% of the distance between weld (831) and weld (835). In an aspect, both welds (831) and (833) are located equidistant from weld (835).

The present disclosure provides for, and includes, inflatable devices having one or more reinforced seams selected from the groups of a linear reinforced seam, a concave curve reinforced seam, and a convex curve reinforced seam. In aspects according to the present disclosure, an inflatable device prepared using the methods disclosed herein can have 1 to 20 areas in need of reinforcement. In an aspect, an inflatable body comprises at least two seam areas in need of reinforcement. In another aspect, an inflatable body comprises at least three seam areas in need of reinforcement. In other aspects, an inflatable body comprises at least four seam areas in need of reinforcement. In an aspect, an inflatable body comprises at least five seam areas in need of reinforcement. In a further aspect, an inflatable body comprises at least six seam areas in need of reinforcement. In an aspect, an inflatable body comprises at least seven seam areas in need of reinforcement. In yet another aspect, an inflatable body comprises at least eight seam areas in need of reinforcement. In other aspects, an inflatable body comprises at least nine seam areas in need of reinforcement. In a further aspect, an inflatable body comprises ten seam areas in need of reinforcement. In an aspect, an inflatable body comprises between one and five seam areas in need of reinforcement. In an aspect, an inflatable body comprises between five and ten seam areas in need of reinforcement. In an aspect, an inflatable body comprises between one and ten seam areas in need of reinforcement.

The present disclosure provides for, and includes, combinations of reinforcement FCLs of the present invention incorporated into an inflatable body. Any combination of the three classes of reinforcement FCLs may be welded to an inflatable body to strengthen seam areas in need of reinforcement. In an aspect, one reinforcement FCL (700) is welded to a linear seam area of an inflatable body in need of reinforcement. In an aspect, at least one reinforcement FCL (700) is welded to at least one linear seam area of an inflatable body in need of reinforcement. In an aspect, two reinforcement FCLs (700) are welded to two linear seam areas of an inflatable body in need of reinforcement. In an aspect, three reinforcement FCLs (700) are welded to three linear seam areas of an inflatable body in need of reinforcement. In an aspect, a plurality of reinforcement FCLs (700) are welded to a plurality of linear seam areas in need of reinforcement.

In an aspect, one reinforcement FCL (840) is welded to one concave curved seam area of inflatable body in need of reinforcement. In an aspect, at least one reinforcement FCL (840) is welded to at least one concave curved seam area of an inflatable body in need of reinforcement. In an aspect, two reinforcement FCLs (840) are welded to two concave curved seam areas of an inflatable body in need of reinforcement. In an aspect, three reinforcement FCLs (840) are welded to three concave curved seam areas of an inflatable body in need of reinforcement. In an aspect, a plurality of reinforcement FCLs (840) are welded to a plurality of concave curved seam areas in need of reinforcement.

In further aspects, the inflatable bodies prepared using the disclosed methods and structures include one reinforcement FCL (940) welded to one convex curved seam area of the inflatable body. In an aspect, at least one reinforcement FCL (940) is welded to at least one convex curved seam area of an inflatable body in need of reinforcement. In an aspect, two reinforcement FCLs (940) are welded to two convex curved seam areas of an inflatable body in need of reinforcement. In an aspect, three heat-fused reinforcement FCLs (940) are welded to three convex curved seam areas of an inflatable body in need of reinforcement. In an aspect, a plurality of reinforcement FCLs (940) are welded to a plurality of convex curved seam areas in need of reinforcement.

In further aspects, the inflatable bodies prepared using the disclosed methods and structures include one reinforcement FCL (700) and one heat-fused reinforcement FCL (840) are welded to a linear seam area and a concave curved seam area of an inflatable body. In an aspect, at least one reinforcement FCL (700) and at least one reinforcement FCL (840) are welded to at least one linear seam areas and at least one concave curved seam area of an inflatable body. In an aspect, two reinforcement FCLs (700) and one reinforcement FCL (840) are welded to two linear seam areas and one concave curved seam area of an inflatable body. In an aspect, one reinforcement FCL (700) and two reinforcement FCLs (840) are welded to one linear seam area and two concave curved seam areas of an inflatable body. In an aspect, two reinforcement FCLs (700) and two reinforcement FCLs (840) are welded to two linear seam areas and two concave curved seam areas of an inflatable body. In an aspect, a plurality of reinforcement FCLs (700) and a plurality of reinforcement FCLs (840) are welded to a plurality of linear seam areas and a plurality of concave curved seam areas of an inflatable body.

In further aspects, the inflatable bodies prepared using the disclosed methods and structures include at least one reinforcement FCL (700) and at least one reinforcement FCL (940) welded to a linear seam area and a convex curved seam area of an inflatable body. In an aspect, at least two reinforcement FCLs (700) and at least one reinforcement FCL (940) are welded to two linear seam areas and one convex curved seam area of an inflatable body. In an aspect, a plurality of reinforcement FCLs (700) and a plurality of reinforcement FCLs (940) are welded to a plurality of linear seam areas and a plurality of convex curved seam areas of an inflatable body.

In further aspects, the inflatable bodies prepared using the disclosed methods and structures include at least one reinforcement FCL (840) and at least one reinforcement FCL (940) welded to a concave curved seam area and a convex curved seam area of an inflatable body. In an aspect, at least two reinforcement FCLs (840) and at least one reinforcement FCL (940) are welded to two concave curved areas and one convex curved seam area of an inflatable body. In an aspect, a plurality of reinforcement FCLs (840) and a plurality of reinforcement FCLs (940) are welded to a plurality of concave curved seam areas and a plurality of convex curved seam areas of an inflatable body.

In further aspects, the inflatable bodies prepared using the disclosed methods and structures include at least one reinforcement FCL (700), at least one reinforcement FCL (840), and at least one reinforcement FCL (940) welded to a linear seam area, a concave curved seam area, and a convex curved seam area of an inflatable body. In an aspect, a plurality of reinforcement FCLs (700), a plurality of reinforcement FCLs (840), and a plurality of reinforcement FCLs (940) are welded to a plurality of linear seam areas, a plurality of concave curved seam areas, and a plurality of convex curved seam areas of an inflatable body.

C. METHODS

The present disclosure provides for, and includes, methods to directly form seams between coated FCLs that have high tensile strengths. In general, the method includes finishing a first coated fabric (110) having a meltable layer (104) on at least one surface and a second coated fabric (120) comprising a meltable layer (105) on at least one surface where the first and second coated fabrics (110) and (120) are configured to have matching edges, overlaying said first and second coated fabrics (110) and (120) so that said meltable layers (104) and (105) are juxtaposed, and laser welding the meltable layers to produce a homogeneous, fused monolayer (106) and moving the laser along the edges to be welded to create a seam.

The laser welding methods of the present discloser provide for and include, directing a laser beam having wavelength between 900 nm and 1100 nm at the weld location at a power of between 20 and 40 watts per 15 $mm^2$ with a beam width of about 7 mm, and simultaneously applying a pressure of between 100 and 1,000 kilopascals (kPa) where the weld location comprises an absorption modifier (163) either as part of the meltable layers or applied as a separate component.

The laser welding can be performed on a flat surface (table) using the apparatus described below or an equivalent that includes a laser capable of generating a laser light having a wavelength between 900 nm and 1100 nm. In aspects, the laser is a tunable laser capable of providing a selectable wavelength in the IR range between 700 nm and 1400 nm. Suitable lasers further provide the capability to provide at least 10 watts per 15 $mm^2$ up to 50 watts per 15 $mm^2$. In an aspect, a suitable laser is a laser providing between 20 and 40 watts per 15 $mm^2$. Even further, suitable lasers are capable of providing a laser beam having a width of about 7 mm, or a width of about 3 mm.

The laser welding apparatus further includes an IR transparent wheel for the application of pressure during the welding process against a backing layer of silicone rubber (501) that is applied to the surface of the table. During the welding process, the transparent wheel (185) applies a pressure of between 100 and 1,000 kilopascals (kPa) on the stacked FCLs against a backing layer of silicone rubber (501) while the laser illuminates and heats the absorption modifier present in the meltable layer or as applied to the surface of the meltable layer.

The laser beam applied through the IR transparent wheel (185) and is moved along the matched edges at a speed of between 0.65 and 7.5 centimeters/second (cm/sec) for a dwell time of between 5 and 180 seconds per centimeter while the IR transparent wheel (185) rolls and maintains the pressure. The laser energy is absorbed by the absorption modifier which heats and melts said meltable layers (104) and (105) which fuse under pressure to produce a homogeneous melt that forms a fused monolayer (106) upon cooling to create a seam. In aspects of the seam forming method, an absorption modifier is applied during the process before laser illumination. In other aspects, the absorption modifier (163) is comprised within any of said meltable layers (104) and (105), applied in a layer on the surface of any of said meltable layers (104) and (105), or a combination thereof. Suitable absorption modifiers are described in detail above.

For the laser welding of fabrics coated with a meltable polymer having a high melting point, e.g., K18 (mylar), the melting temperature of the polymer coating will be closer to the melting temperature of the fabric. This results in a narrowed temperature window in which to form a seam without damaging the base fabric materials; altered laser welding conditions are therefore required. For such welds, use of a laser providing between 85 and 95 watts per 15 $mm^2$ at a speed of between 35 and 45 centimeters/second (cm/sec)

is necessary. It is noted that variation of pressure and dwell time has less of an impact on the laser welding of fabrics having meltable layers, and pressure of between 100 and 1,000 kPa and a dwell time of between 5 and 180 seconds per centimeter should be used.

For the laser welding of one fabric coated with a meltable polymer having a high melting point, e.g., K18 (mylar) to a second fabric coated with a meltable layers having a low melting point, e.g., TPU, a laser providing between 18 and 25 watts per 15 $mm^2$ at a speed of about 1.5 centimeters/second (cm/sec) is used. Variation of pressure and dwell time has less of an impact on the laser welding of such fabric combinations.

In aspects of the laser seaming method of the present disclosure, the first and second fabrics comprise a plurality of stacked, unidirectionally oriented fibers in cross-plied monolayers (101) and (102) embedded in a plastic matrix (103). In an aspect, the method further comprises overlaying and aligning the fibers from the cross-plied monolayers (101) and (102) adjacent the fused monolayer (106) of each of the coated fabrics (110) and (120) into a relative orientation of between 75 and 90 degrees. In another aspect, the method further comprises overlaying and aligning the fibers from the cross-plied monolayers (101) and (102) adjacent to the fused monolayer (106) of each of the coated fabrics (110) and (120) into a relative orientation of between 0 and 15 degrees.

In aspects according to the seaming method, the laser wavelength, intensity, and dwell time are selected to be absorbed by said absorption modifier and heat the meltable layers (104) and (105) to a temperature that is between 80° C. and 140° C. As provided herein, measurement of the absorption of each of the components can serve as a guide to the selection of the appropriate power and time and once determined for a given FCL pair, provides reproducible melting, fusing, and welds with less than 10% variation. In another aspect, the laser wavelength, intensity, and dwell time is selected to be absorbed by the absorption modifier (163) to heat said meltable layers (104) and (105) to a temperature that is at least 5° C. below the melting point of the cross-plied monolayers (101) and (102).

The methods for forming a seam include forming welds along a straight or curved line along matching edges of the base FCL layers.

The methods for forming a seam, include and provide, cooling the melted polymer coatings (104) and (105) to form a solidified homogeneous, fused monolayer (106). In an aspect, the cooling is passive air cooling at ambient temperature. In another aspect, the cooling is accomplished by providing cool air or further including a cooling element to the apparatus until solidification has occurred.

Also included and provided for in the methods for forming a seam is clamping the overlaid said first and second coated fabrics (110) and (120) in place prior to directing a laser beam.

In aspects of the methods for forming a seam, the resulting seam has an average tensile strength of between 200 Newtons/$5\times10^3$ m (N/5 cm) and 400 N/cm. In other aspects, less than 10% of said seam in a length of at least 1 cm comprises discontinuous weld segments as revealed by scanning-electron microscopy (SEM). The methods for forming a seam can be applied to any length of finished fabrics of a length of at least one inch. In aspects, the seams are at least 10 cm long. In additional aspects, the seams are at least 20 cm long. Seams may be straight, curved, or a combination of each.

The present disclosure provides for, and includes, methods for forming reinforced linear seams between seams between flexible composite laminates (FCL). An exemplary illustration of the preparation of reinforcement tabs is presented in FIG. 8 and the assembly and welding of exemplary reinforced linear seams are presented in FIG. 8 and FIG. 9. In aspects, the method of forming a linear reinforced seam between two FCLs comprises providing a first flexible composite laminate (FCL) having a meltable layer (704) and a second FCL having a meltable layer (705) on its inner face that are configured to have similar or matching edges, providing a third FCL folded along its midline and having a meltable layer (714) on its exposed face, inserting the folded FCL between the first and second FCL so that the meltable layer (714) is juxtaposed with both of the meltable layers (704) and (705), directing a laser beam at weld locations (797), (798) to prepare an overlap seam, and at location (799) to prepare a fin seam, the laser having a wavelength between 700 nm and 1400 nm, a power of between 10 and 50 watts per 15 $mm^2$, and a beam width of about 7 mm, and simultaneously applying a pressure of between 100 and 1,000 kilopascals (kPa), where the weld locations comprise an absorption modifier (163), moving the laser beam along the aligned edges at a speed of between 0.65 and 7.5 centimeters/second (cm/sec) and providing a dwell time of between 5 and 180 seconds, melting the meltable layers (704), (705), and (714) at each of the weld locations (797), (798), and (799), and cooling the melted coating to form a reinforced seam comprising continuous welds (731), (733), and (735) at weld locations (797), (798), and (799), where each of the meltable layers are fused. In aspects, each weld is formed separately. In an aspect, the overlap welds are formed simultaneously in a stacked welding configuration. In another aspect, all three welds are formed simultaneously in a stacked welding configuration.

The method of preparing a reinforced linear seam further comprises varying the wavelength, power, pressure, dwell time, and beam width to avoid damage to the underlying unidirectionally oriented fibers in cross-plied monolayers and plastic matrix of the FCLs. In aspects, the laser has a wavelength of between 800 and 1200 nm. In other aspects, the laser has a wavelength of between 900 and 1100 nm. In further aspects the laser has a wavelength between 950 and 1050 nm. In an aspect, the laser has a wavelength of 980 nm. The power of the laser in aspects can be between 20 and 40 watts per 15 $mm^2$. In other aspects, the laser power is between 25 and 35 watts per 15 $mm^2$. In other aspects, the laser power can be greater than 50 watts per 15 $mm^2$, greater than 75 watts per 15 $mm^2$, greater than 85 watts per 15 $mm^2$, or greater than 95 watts per 15 $mm^2$. Aspects of the method further include applying a pressure during laser illumination of between 250 and 750 kPa. In further aspects, the pressure is applied at between 400 and 600 kPa. In yet further aspects, the pressure is applied at between 500 and 600 kPa. In aspects, the laser is moved along the path of the intended seam at a speed between 0.65 and 7.5 cm/second. In aspects the speed of the laser moving along the path of the intended seams is between 1 and 4 cm/sec. In other aspects, the speed of the moving laser is between 2 and 3 cm/sec, or between 35 and 45 cm/sec. The dwell time of the laser during the melting of the meltable layers is between 5 and 180 seconds. In aspects, the laser beam width is about 7 mm. In other aspects, the laser beam width is about 3 mm.

The present disclosure provides for, and includes, methods for forming reinforced curved seams between seams between flexible composite laminates (FCL). An exemplary illustration of the preparation of reinforcement tabs is presented in FIG. 10 and the assembly and welding of exemplary reinforced linear seams are presented in FIG. 12. In aspects, the method of forming a linear reinforce seam between two FCLs comprises providing a first flexible composite laminate (FCL) having a meltable layer (804) and a second FCL having a meltable layer (805) on its inner face that are configured to have similar or matching edges, providing a folded third FCL (810) having a meltable layer (813) on one side, a curved edge (809), and three or more folded tabs (808), said folded tabs (808) being formed from two or more cuts (832) oriented perpendicular to said curved edge (809) and extending to the midline (811), the tabs (808) being folded along said midline (811) to provide an exposed face (817) having meltable layer (813), further providing a folded fourth FCL (820) having a meltable layer (813, 814) on both sides, a curved edge (819), and three or more folded tabs (818), the folded tabs (818) being formed from two or more cuts (842) oriented perpendicular to the curved edge (819) and extending to the midline (821), the tabs (818) being folded along said midline (821) to provide an exposed face (827) having meltable layer (814), and an inner face (826) having meltable layer (813), inserting the folded third FCL (810) into the folded fourth FCL (820), so that the meltable layer (813) of the folded third FCL (810) is juxtaposed with the meltable layer (813) of the folded fourth FCL (820), joining the folded third FCL (810) to the folded fourth FCL (820) by applying a heat means to a surface, thereby forming a reinforcement FCL (840), aligning the first FCL (860) relative to the second FCL (870) along curved edges (861) and (871), inserting the reinforcement FCL (840) between the aligned first FCL (860) and second FCL (870) so as to align and juxtapose all of the curved edges (861), (871), (809), and (819), juxtapose the meltable layer (814) with each of the meltable layers (804) and (805), and juxtapose meltable layer (813) with meltable layer (805), directing a laser beam at weld locations (897), (898), and (899), the laser having an wavelength between 900 nm and 1100 nm, a power of between 20 and 40 watts per 15 $mm^2$, and a beam width of about 7 mm, and simultaneously applying a pressure of between 100 and 1,000 kilopascals (kPa), where the weld locations comprise an absorption modifier (163), moving the laser beam along the aligned curved edges at a speed of between 0.65 and 7.5 centimeters/second (cm/sec), and for a time of between 5 and 180 seconds, melting the meltable layers (804), (805), (813), and (814) at locations (897), (898), and (899), cooling to form a reinforced curved seam comprising welds (831), (833), and (835) at weld locations (897), (898), and (899), where the continuous weld (831) fuses meltable layers (804) and (814), the continuous weld (833) fuses meltable layers (805), (813), and (814), and the continuous weld (835) fuses meltable layers (804) and (805). In aspects, each weld is formed separately. In an aspect, the overlap welds are formed simultaneously in a stacked welding configuration. In another aspect, all three welds are formed simultaneously in a stacked welding configuration.

In various aspects, the method of preparing a reinforced curved seam further comprises varying the wavelength, power, pressure, dwell time, and beam width to avoid damage to the underlying unidirectionally oriented fibers in cross-plied monolayers and plastic matrix of the FCLs. In aspects, the laser has a wavelength of between 800 and 1200 nm. In other aspects, the laser has a wavelength of between 900 and 1100 nm. In further aspects the laser has a wavelength between 950 and 1050 nm. In an aspect, the laser has a wavelength of 980 nm. The power of the laser in aspects can be between 20 and 40 watts per 15 $mm^2$. In other aspects, the laser power is between 25 and 35 watts per 15 $mm^2$. In other aspects, the laser power can be greater than 50 watts per 15 $mm^2$, greater than 75 watts per 15 $mm^2$, greater than 85 watts per 15 $mm^2$, or greater than 95 watts per 15 $mm^2$. Aspects of the method further include applying a pressure during laser illumination of between 250 and 750 kPa. In further aspects, the pressure is applied at between 400 and 600 kPa. In yet further aspects, the pressure is applied at between 500 and 600 kPa. In aspects, the laser is moved along the path of the intended seam at a speed between 0.65 and 7.55 cm/second. In aspects the speed of the laser moving along the path of the intended seams is between 1 and 4 cm/sec. In other aspects, the speed of the moving laser is between 2 and 3 cm/sec, or between 35 and 45 cm/sec. The dwell time of the laser during the melting of the meltable layers is between 5 and 180 seconds. In aspects, the laser beam width is about 7 mm. In other aspects, the laser beam width is about 3 mm.

In aspects of the method to prepare curved reinforced seams between FCLs, the overlap seams are arranged equidistant from the fin seam between the base FCL fabrics. In some aspects, the overlap seams are arranged within 10% of being equidistant from the fin seam between the base FCL fabrics. In aspects of the method to prepare a curved reinforced seams between FCLs, the reinforcement tabs are cut and prepared so that each inner edge of said folded tabs (808) and (818) is oriented within 88 and 90 degrees relative to said curved edges (861) and (871) so as to maintain a maximum distance of 6 mm between the mid-point of the fold line (811) and (821) and the arc representing the true curvature (873) and (883). See FIG. 10E.

The present disclosure provides for, and includes, methods for forming reinforced curved seams between seams between flexible composite laminates (FCL). An exemplary illustration of the preparation of reinforcement tabs is presented in FIG. 11 and the assembly and welding of exemplary reinforced linear seams are presented in FIG. 12. In aspects, the method of forming a linear reinforce seam between two FCLs comprises providing a first flexible composite laminate (FCL) having a meltable layer (904) and a second FCL having a meltable layer (905) on its inner face that are configured to have similar or matching edges, providing a folded third FCL (910) having a meltable layer (913) on one side, a curved edge (909), and two or more notched gaps (978) oriented perpendicular to the curved edge (909) and extending from the curved edge (909) to the midline (911) to form three or more tabs (908), the third FCL (910) being folded along midline (911) to provide an exposed face (917) having the meltable layer (913), further providing a folded fourth FCL (920) having meltable a polymer coating (913, 914) on both sides, a curved edge (919), and two or more notched gaps (979) oriented perpendicular to the curved edge (919) and extending from the curved edge (919) to the midline (921) to form three or more tabs (918), the fourth FCL (920) being folded along midline (921) to provide an exposed face (927) having meltable layer (914), and an inner face (926) having meltable layer (913), inserting the folded third FCL (910) into the folded fourth FCL (920), so that the meltable layer (913) of the folded third FCL (910) is juxtaposed with the meltable layer (913) of the folded fourth FCL (920), joining the folded third FCL (910) to the folded fourth FCL (920) by applying a heat means to a surface, thereby forming a reinforcement FCL (940), aligning the first FCL (960) relative to the second FCL (970) along the curved edges (961) and (971), inserting the reinforcement FCL (940) between the aligned first FCL (960) and second FCL (970) so as to align and juxtapose all of the curved edges (961), (971), (909), and (919), juxtapose the meltable layer (914) with each of the meltable layers (904) and (905), and juxtapose the meltable layer (913) with the meltable layer (905), directing a laser beam at weld locations (997), (998), and (999), the laser having a wavelength between 900 nm and 1100 nm, a power of between 20 and 40 watts per 15 $mm^2$, and a beam width of about 7 mm, and simultaneously applying a pressure of between 100 and 1,000 kilopascals (kPa), where the weld locations comprise an absorption modifier (163), moving the laser beam along the aligned curved edges at a speed of between 0.65 and 7.5 centimeters/second (cm/sec), and for a time of between 5 and 180 seconds, melting the meltable layers (904), (905), (913), and (914) at locations (997), (998), and (999), cooling to form a reinforced curved seam comprising welds (931), (933), and (935) at weld locations (997), (998), and (999), where the continuous weld (931) fuses meltable layers (904) and (914), the continuous weld (933) fuses meltable layers (905), (913), and (914), and the continuous weld (935) fuses meltable layers (904) and (905). In aspects, each weld is formed separately. In an aspect, the overlap welds are formed simultaneously in a stacked welding configuration. In another aspect, all three welds are formed simultaneously in a stacked welding configuration.

The method of preparing a reinforced curved seam further comprises varying the wavelength, power, pressure, dwell time, and beam width to avoid damage to the underlying unidirectionally oriented fibers in cross-plied monolayers and plastic matrix of the FCLs. In aspects, the laser has a wavelength of between 800 and 1200 nm. In other aspects, the laser has a wavelength of between 900 and 1100 nm. In further aspects the laser has a wavelength between 950 and 1050 nm. In an aspect, the laser has a wavelength of 980 nm. The power of the laser in aspects can be between 20 and 40 watts per 15 $mm^2$. In other aspects, the laser power is between 25 and 35 watts per 15 $mm^2$. In other aspects, the laser power can be greater than 50 watts per 15 $mm^2$, greater than 75 watts per 15 $mm^2$, greater than 85 watts per 15 $mm^2$, or greater than 95 watts per 15 $mm^2$. Aspects of the method further include applying a pressure during laser illumination of between 250 and 750 kPa. In further aspects, the pressure is applied at between 400 and 600 kPa. In yet further aspects, the pressure is applied at between 500 and 600 kPa. In aspects, the laser is moved along the path of the intended seam at a speed between 0.65 and 7.55 cm/second. In aspects the speed of the laser moving along the path of the intended seams is between 1 and 4 cm/sec. In other aspects, the speed of the moving laser is between 2 and 3 cm/sec, or between 35 and 45 cm/sec. The dwell time of the laser during the melting of the meltable layers is between 5 and 180 seconds. In aspects, the laser beam width is about 7 mm. In other aspects, the laser beam width is about 3 mm.

In aspects of the method to prepare curved reinforced seams between FCLs, the overlap seams are arranged equidistant from the fin seam between the base FCL fabrics. In some aspects, the overlap seams are arranged within 10% of being equidistant from the fin seam between the base FCL fabrics. In aspects of the method to prepare a curved reinforced seams between FCLs, the reinforcement tabs are cut and prepared so that the number of notched gaps (978) and (979) are configured so that each inner edge of said folded tabs (908) and (918) is oriented within 88 and 90 degrees relative to said curved edges (961) and (971) so as to maintain a maximum distance of 6 mm between the mid-point of the fold line (911) and (921) and the arc representing the true curvature (973) and (983). See FIG. 11E.

The present disclosure provides for, and includes, methods for preparing reinforcement FCLs (840) of use in the preparation of reinforced curved seams between flexible composite laminates (FCLs). An exemplary illustration of the preparation of reinforcement tabs is presented in FIGS. 10A-10E. The method comprises the steps of providing a first FCL (810) having a curved edge (809) and a meltable layer (813) on one face (807), a second FCL (820) having curved edge (819), a meltable layer (813) on one face (816), and a meltable layer (814) on the other face (817), cutting two or more cuts (832) in the first FCL (810) perpendicular to the curved edge (809) and extending to the midline (811) to form three or more tabs (808), cutting two or more cuts (842) in the second FCL (820) perpendicular to the curved edge (819) to form three or more tabs (818), folding each of the tabs (808) along midline (811) to form a folded first FCL (810), folding each of the tabs (818) along midline (821) to form a folded second FCL (820), inserting the folded first FCL (810) into the folded second FCL (820) so that curved edges (809) and (819) are aligned and juxtaposed and providing an intra-seam space (815), heat-fusing the meltable layer (813) of said the folded FCL (810) to the meltable layer (813) of the second folded FCL (820) by applying a heat means to a surface. In aspects, heat fusing comprises applying a hot surface having a temperature of between 90 and 150° C. to the stacked folded, juxtaposed, and aligned first and second FCLs for between 2 and 6 seconds with a force of between 5 and 8.5 $N/cm^2$. In an aspect, the temperature is between 90 and 121° C. and applied for between 3 and 5 seconds with a force of between 6 and 8 $N/cm^2$. In another aspect, the heat fusing comprises applying the hot surface at a temperature of 110 to 127° C. and applied for between 3 and 5 seconds with a force of between 6 and 8 $N/cm^2$. In an aspect the elements are heat fused using the hot surface at a temperature of 115° C., for three seconds at about 6.9 $N/cm^2$.

The present disclosure provides for, and includes, methods for preparing reinforcement FCLs (940) of use in the preparation of reinforced curved seams between flexible composite laminates (FCLs). An exemplary illustration of the preparation of reinforcement tabs is presented in FIGS. 11A-11E. The method comprises the steps of providing a first FCL (910) having curved edge (909) and a meltable layer (913) on one face (907), a second FCL (920) having curved edge (919), a meltable layer (913) on its inner face (916), and a meltable layer (914) on the other face (917), notching the first FCL (910) perpendicular to the curved edge (909) and extending from the curved edge (909) to midline (911) to prepare two or more notched gaps (978) and three or more tabs (908), notching the second FCL (920) perpendicular to the curved edge (919) and extending from the curved edge (919) to midline (921) to prepare two or more notched gaps (979) and three or more tabs (918), folding the tabs (908) of the notched first FCL (910) along midline (911) to form a notched and folded first FCL (910), folding the tabs (918) of the notched second FCL (920) along midline (921) to form a notched and folded second FCL (920), inserting the notched and folded first FCL (910) into the notched and folded second FCL (920) so that curved edges (909) and (919) are aligned, and heat-fusing the meltable layer (913) of the notched and folded first FCL (910) to the meltable layer (913) of the notched and folded second FCL (920) by applying a heat means to a surface. In aspects, heat fusing comprises applying a hot surface having a temperature of between 90 and 150° C. to the stacked folded, juxtaposed, and aligned first and second FCLs for between 2 and 6 seconds with a force of between 5 and 8.5

N/cm$^2$. In an aspect, the temperature is between 90 and 121° C. and applied for between 3 and 5 seconds with a force of between 6 and 8 N/cm$^2$. In another aspect, the heat fusing comprises applying the hot surface at a temperature of 110 to 127° C. and applied for between 3 and 5 seconds with a force of between 6 and 8 N/cm$^2$. In an aspect the elements are heat fused using the hot surface at a temperature of 115° C., for three seconds at about 6.9 N/cm$^2$.

The present disclosure provides for, and includes, methods to prepare a reinforced seam for an inflatable body along a concave curved seam using reinforcement FCLs as described above and as shown in FIGS. 10A-10E and FIGS. 11A-11E. Heat fused reinforcement FCLs (840) and (940) can be prepared in advanced and used for the assembly of stacked FCLs for laser welding a described herein. Inflatable bodies can assume many shapes and forms. In general, inflatable bodies will often comprise one or more concave curves. An example of such an inflatable body is presented in FIG. 16 comprising two concave curves as well as convex curves. A simple circular inflatable device would comprise a continuous concave curve and would be reinforced with a series of reinforcement FCLs. FIG. 14 presents a more complex inflatable having linear reinforcement FCLs, concave reinforcement FCLs and convex reinforcement FCLS. In general, computer aided design (CAD) software can calculate stress points that may need reinforcement but often, assembly and testing is required. Additional reinforcement FCLs can then be introduced.

Methods of the present disclosure for preparing reinforced seams formed from two FCLs (860, 870) of an inflatable body, or part thereof, wherein the FCLs having at least one concave curved edge comprise providing two parts of an inflatable body in need of a seam along a concave curve, aligning one or more reinforcement FCLs (840) along the concave curve, and laser welding the one or more reinforcement FCLs (840) to the concave curve to form a reinforced concave curved seam having two overlap seams between the reinforcement FCLs and a fin seam between the inflatable body member FCLs. In aspects, said welding comprises directing a laser beam having a wavelength 900 nm and 1100 nm, a power of between 20 and 40 watts per 15 mm$^2$, and a beam width of about 7 mm at a weld location, and simultaneously applying a pressure of between 100 and 1,000 kilopascals (kPa). In aspects, the reinforcement seam comprises an absorption modifier as described above on the other surface. In other aspects, the absorption modifier may be present on the surfaces of the FCLs in contact with the reinforcement FCL. In aspects, the laser has a wavelength of between 800 and 1200 nm. In other aspects, the laser has a wavelength of between 900 and 1100 nm. In further aspects the laser has a wavelength between 950 and 1050 nm. In an aspect, the laser has a wavelength of 980 nm. The power of the laser in aspects can be between 20 and 40 watts per 15 mm$^2$. In other aspects, the laser power is between 25 and 35 watts per 15 mm$^2$. In other aspects, the laser power can be greater than 50 watts per 15 mm$^2$, greater than 75 watts per 15 mm$^2$, greater than 85 watts per 15 mm$^2$, or greater than 95 watts per 15 mm$^2$. Aspects of the method further include applying a pressure during laser illumination of between 250 and 750 kPa. In further aspects, the pressure is applied at between 400 and 600 kPa. In yet further aspects, the pressure is applied at between 500 and 600 kPa. In aspects, the laser is moved along the path of the intended seam at a speed between 0.65 and 7.5 cm/second. In aspects the speed of the laser moving along the path of the intended seams is between 1 and 4 cm/sec. In other aspects, the speed of the moving laser is between 2 and 3 cm/sec, or between 35 and 45 cm/sec. The dwell time of the laser during the melting of the meltable layers is between 5 and 180 seconds. In aspects, the laser beam width is about 7 mm. In other aspects, the laser beam width is about 3 mm.

The present disclosure provides for, and includes, methods for preparing reinforced seams formed from two FCLs (960, 970) of an inflatable body, or part thereof, wherein the FCLs having at least one convex curved edge comprise providing two parts of an inflatable body in need of a seam along a convex curve, aligning one or more reinforcement FCLs (840) along the convex curve, and laser welding the one or more reinforcement FCLs (840) to the convex curve to form a reinforced convex curved seam having two overlap seams between the reinforcement FCLs and a fin seam between the inflatable body member FCLs. In aspects, said welding comprises directing a laser beam having a wavelength between 900 nm and 1100 nm, a power of between 20 and 40 watts per 15 mm$^2$, and a beam width of about 7 mm at a weld location, and simultaneously applying a pressure of between 100 and 1,000 kilopascals (kPa) and moving the laser beam along the path of the intended seam. In aspects, the reinforcement seam comprises an absorption modifier as described above on the other surface. In other aspects, the absorption modifier may be present on the surfaces of the FCLs in contact with the reinforcement FCL. In aspects, the laser has a wavelength of between 800 and 1200 nm. In other aspects, the laser has a wavelength of between 900 and 1100 nm. In further aspects the laser has a wavelength between 950 and 1050 nm. In an aspect, the laser has a wavelength of 980 nm. The power of the laser in aspects can be between 20 and 40 watts per 15 mm$^2$. In other aspects, the laser power is between 25 and 35 watts per 15 mm$^2$. In other aspects, the laser power can be greater than 50 watts per 15 mm$^2$, greater than 75 watts per 15 mm$^2$, greater than 85 watts per 15 mm$^2$, or greater than 95 watts per 15 mm$^2$. Aspects of the method further include applying a pressure during laser illumination of between 250 and 750 kPa. In further aspects, the pressure is applied at between 400 and 600 kPa. In yet further aspects, the pressure is applied at between 500 and 600 kPa. In aspects, the laser is moved along the path of the intended seam at a speed between 0.65 and 7.5 cm/second. In aspects the speed of the laser moving along the path of the intended seams is between 1 and 4 cm/sec. In other aspects, the speed of the moving laser is between 2 and 3 cm/sec, or between 35 and 45 cm/sec. The dwell time of the laser during the melting of the meltable layers is between 5 and 180 seconds. In aspects, the laser beam width is about 7 mm. In other aspects, the laser beam width is about 3 mm.

The present disclosure provides for, and includes, methods to prepare reinforced seams for inflatable bodies comprising two or more FCLs (760, 770, 860, 870, 960, 970). The combination of linear, concave, and convex reinforcement allows for the preparation of lightweight, high strength inflatables of any desired shape. The methods of preparing a reinforced seam for an inflatable body comprising the steps of providing an inflatable body in need of a seam along one or more areas, selected from the group consisting of a linear area, a concave curved area, and a convex curved area; laser-welding one or more reinforcement FCLs (700) along said one or more linear areas, laser-welding one or more reinforcement FCLs (840) along said one or more concave curved areas, and laser-welding one or more reinforcement FCLs (940) along said one or more convex curved areas. In aspects, said welding comprises directing a laser beam having a wavelength between 900 nm and 1100 nm, a power of between 20 and 40 watts per 15 mm$^2$, and a beam width of about 7 mm at a weld location, simultaneously applying a pressure of between 100 and 1,000 kilopascals (kPa), and moving the laser beam along the path of the intended seam. In aspects, the reinforcement seam comprises an absorption modifier as described above on the other surface. In other aspects, the absorption modifier may be present on the surfaces of the FCLs in contact with the reinforcement FCL. In aspects, the laser has a wavelength of between 800 and 1200 nm. In other aspects, the laser has a wavelength of between 900 and 1100 nm. In further aspects the laser has a wavelength between 950 and 1050 nm. In an aspect, the laser has a wavelength of 980 nm. The power of the laser in aspects can be between 20 and 40 watts per 15 $mm^2$. In other aspects, the laser power is between 25 and 35 watts per 15 $mm^2$. In other aspects, the laser power can be greater than 50 watts per 15 $mm^2$, greater than 75 watts per 15 $mm^2$, greater than 85 watts per 15 $mm^2$, or greater than 95 watts per 15 $mm^2$. In aspects, the laser beam has a width of about 7 mm. In other aspects, the laser beam has a width that is between 1 mm to 15 mm. Aspects of the method further include applying a pressure during laser illumination of between 250 and 750 kPa. In further aspects, the pressure is applied at between 400 and 600 kPa. In yet further aspects, the pressure is applied at between 500 and 600 kPa. In aspects, the laser is moved along the path of the intended seam at a speed between 0.65 and 7.5 cm/second. In aspects the speed of the laser moving along the path of the intended seams is between 1 and 4 cm/sec. In other aspects, the speed of the moving laser is between 2 and 3 cm/sec. The dwell time of the laser during the melting of the meltable layers is between 5 and 180 seconds. In aspects, the laser beam width is about 7 mm. In other aspects, the laser beam width is about 3 mm.

Unless defined otherwise herein, terms are to be understood according to conventional usage by those of ordinary skill in the relevant art. Where a term is provided in the singular, the inventors also contemplate aspects of the disclosure described by the plural of that term. Where there are discrepancies in terms and definitions used in references that are incorporated by reference, the terms used in this application shall have the definitions given herein. Other technical terms used have their ordinary meaning in the art in which they are used, as exemplified by various art-specific dictionaries, for example, "The American Heritage® Science Dictionary" (Editors of the American Heritage Dictionaries, 2011, Houghton Mifflin Harcourt, Boston and New York), or the "McGraw-Hill Dictionary of Scientific and Technical Terms" (6th edition, 2002, McGraw-Hill, New York).

All publications, patents, and patent applications mentioned in this disclosure are herein incorporated by reference to the same extent as if each individual publication, patent, or patent application was specifically and individually indicated to be incorporated by reference.

D. DEFINITIONS

The term "and/or" when used in a list of two or more items, means that any one of the listed items can be employed by itself or in combination with any one or more of the listed items. For example, the expression "A and/or B" is intended to mean either or both of A and B, i.e., A alone, B alone, or A and B in combination. The expression "A, B and/or C" is intended to mean A alone, B alone, C alone, A and B in combination, A and C in combination, B and C in combination, or A, B, and C in combination.

As used herein, terms in the singular and the singular forms "a," "an," and "the," for example, include plural referents unless the content clearly dictates otherwise.

As used herein, the term "laser-welding" refers to a material fusion process using a laser beam as an energy source to melt any two or more materials being joined together.

As used herein, the term "finishing" refers to seaming the edge of an FCL.

As used herein, the term "notching" refers to cutting and removing triangular-shaped notched gaps from an FCL.

As used herein, the term "cooling" may refer to transfer of heat into the surrounding air at ambient temperature, or cooling by other heat transfer mechanism (e.g., refrigeration).

As used herein, two edges that are "similar" have comparable shapes and lengths, while two edges that are "matching" have identical or near-identical shapes and lengths.

Where a range of values is provided, it is understood that each intervening value, between the upper and lower limit of that range and any other stated or intervening value in that stated range is encompassed within the disclosure. The upper and lower limits of these smaller ranges may independently be included in the smaller ranges, and are also encompassed within the disclosure, subject to any specifically excluded limit in the stated range. Where the stated range includes one or both of the limits, ranges excluding either both of those included limits are also included in the disclosure. Whenever the phrase "comprising" is used, variations such as "consisting essentially of" and "consisting of" are also contemplated.

E. EMBODIMENTS

Embodiment 1. A seam having a length of at least one inch comprising: a weld formed between a first base flexible composite laminate (FCL) (110) and a second base FCL (120), each base FCL comprising a plurality of stacked, unidirectionally oriented fibers in cross-plied monolayers (101) and (102) embedded in a plastic matrix (103), wherein each base FCL is coated on at least one face with a meltable layer (104) or (105); said weld comprising a homogeneous, fused monolayer (106) formed from said meltable layers (104) and (105) from each of said first and second base FCLs (110) and (120).

Embodiment 2. The seam of embodiment 1, wherein the meltable layer is no more than 55 microns thick, and no more than 90% of the thickness of the base FCL.

Embodiment 3. The seam of embodiment 1 or 2, wherein said unidirectionally oriented fibers are polyethylene fibers selected from the group consisting of UHMWPE, High Density Polyethylene (HDPE) fibers, Medium-Density Polyethylene (MDPE) fibers, Low-Density Polyethylene (LDPE) fibers, Very Low-Density Polyethylene (VLDPE) fibers, and Cross-Linked Polyethylene (PEX) fibers.

Embodiment 4. The seam of any one of embodiments 1 to 3, wherein said unidirectionally oriented fibers are Ultra-High Molecular Weight Polyethylene (UHMWPE) fibers.

Embodiment 5. The seam of any one of embodiments 1 to 4, wherein the density of the base FCL is selected from the group consisting of between 0.40 $g/m^3$ and 3.0 $g/m^3$.

Embodiment 6. The seam of any one of embodiments 1 to 5, wherein the base FCL has a weight of between 35 $g/m^2$ and 140 $g/m^2$.

Embodiment 7. The seam of any one of embodiments 1 to 6, wherein the relative orientation of said plurality of unidirectionally oriented fibers in said cross-plied monolayers (101) and (102) adjacent to said fused monolayer (106) is perpendicular or having an oblique angle of no less than 75 degrees.

Embodiment 8. The seam of embodiment 7, wherein said oblique angle is no less than 85 degrees.

Embodiment 9. The seam of any one of embodiments 1 to 8, wherein the relative orientation of said plurality of unidirectionally oriented fibers in said cross-plied monolayers (101) and (102) adjacent to said fused monolayer (106) is perpendicular.

Embodiment 10. The seam of any one of embodiments 1 to 6, wherein the relative orientation of said plurality of unidirectionally oriented fibers in said cross-plied monolayers (101) and (102) adjacent to said fused monolayer (106) is parallel or having an oblique angle of no more than 15 degrees.

Embodiment 11. The seam of embodiment 10, wherein said oblique angle is no more than 5 degrees.

Embodiment 12. The seam of any one of embodiments 1 to 6, 10, and 11, wherein the relative orientation of said plurality of unidirectionally oriented fibers in said cross-plied monolayers (101) and (102) adjacent to said fused monolayer (106) is parallel.

Embodiment 13. The seam of embodiment 12, wherein the direction of said seam is the same as said unidirectionally oriented fibers in said cross-plied monolayers (101) and (102) adjacent to said fused monolayer (106).

Embodiment 14. The seam of embodiment 12, wherein the direction of said seam is orthogonal to said fiber directions of said unidirectionally oriented fibers in said cross-plied monolayers (101) and (102) adjacent to said fused monolayer (106).

Embodiment 15. The seam of any one of embodiments 1 to 14, wherein said unidirectionally oriented fibers of said first and second base FCLs (110) and (120) of said seam in an area of at least 0.05 $cm^2$ show less than 10% damage from overheating as revealed by scanning-electron microscopy (SEM).

Embodiment 16. The seam of any one of embodiments 1 to 15, wherein said unidirectionally oriented fibers in an area of at least 0.05 $cm^2$ shows no damage from overheating as revealed by SEM.

Embodiment 17. The seam of any one of embodiments 1 to 16, wherein at least 90% of said seam in a sampled length of at least 20 $cm^2$ is free of discoloration, rippling, bubbling, deformation, and tearing.

Embodiment 18. The seam of any one of embodiments 1 to 17, wherein at least 95% of said seam in a sampled length of at least 20 $cm^2$ is free of discoloration, rippling, bubbling, deformation, and tearing.

Embodiment 19. The seam of any one of embodiments 1 to 18, wherein at least 99% of said seam in a sampled length of at least 20 $cm^2$ is free of discoloration, rippling, bubbling, deformation, and tearing.

Embodiment 20. The seam of any one of embodiments 1 to 19, wherein said seam in a sampled length of at least 20 $cm^2$ is free of discoloration, rippling, bubbling, deformation, and tearing.

Embodiment 21. The seam of any one of embodiments 17 to 20, wherein said discoloration, rippling, bubbling, deformation, and tearing results from overheating.

Embodiment 22. The seam of any one of embodiments 1 to 21, wherein said seam shows no visible discontinuous weld lines oriented perpendicular to the direction of the seam when sampled along a length of at least 10 cm.

Embodiment 23. The seam of embodiment 22, wherein said sample length is at least 20 cm.

Embodiment 24. The seam of embodiment 22 or 23, wherein said discontinuous weld segments are indicative of weld discontinuity.

Embodiment 25. The seam of any one of embodiments 1 to 24, wherein less than 5% by weight of the fibers of said first and second base FCLs (110, 120) of said seam are melt recrystallized as determined by differential scanning calorimetry (DSC; 10° C./min).

Embodiment 26. The seam of any one of embodiments 1 to 25, wherein less than 1% by weight of said fibers are melt recrystallized as determined by DSC (10° C./min).

Embodiment 27. The seam of any one of embodiments 1 to 26, wherein melt recrystallized fibers are not detectable by DSC (10° C./min).

Embodiment 28. The seam of any one of embodiments 1 to 27, wherein said seam has an average tensile strength that is at least 15% of the base tensile strength of the weaker of said first and second coated fabrics (110) and (120).

Embodiment 29. The seam of any one of embodiments 1 to 28, wherein said seam has an average tensile strength that is at least 19% of the base tensile strength of the weaker of said first and second coated fabrics (110) and (120).

Embodiment 30. The seam of any one of embodiments 1 to 29, wherein said average tensile strength is selected from the group consisting of average shear tensile strength and average peel tensile strength.

Embodiment 31. The seam of any one of embodiments 1 to 30, wherein each of said plurality of stacked, unidirectionally oriented UHMWPE cross-plied monolayers (101) and (102) has a thickness that is between 30 μM (microns) and 120 μM.

Embodiment 32. The seam of any one of embodiments 1 to 30, wherein each of said plurality of stacked, unidirectionally oriented UHMWPE cross-plied monolayers (101) and (102) has a thickness that is less than 30 μM (microns).

Embodiment 33. The seam of any one of embodiments 1 to 32, wherein said plastic matrix (103) comprises a thermoset, a thermoplastic, or a combination thereof.

Embodiment 34. The seam of any one of embodiments 1 to 33, wherein said plastic matrix (103) is an epoxy matrix.

Embodiment 35. The seam of any one of embodiments 1 to 33, wherein said plastic matrix (103) is an elastomer.

Embodiment 36. The seam of embodiment 35, wherein said elastomer has a tensile modulus that is less than 41 MPa (Megapascals) at 25° C.

Embodiment 37. The seam of any one of embodiments 1 to 36, wherein said homogeneous, fused monolayer (106) further comprises an absorption modifier (163).

Embodiment 38. The seam of embodiment 37, wherein said absorption modifier (163) is evenly distributed in said fused monolayer (106).

Embodiment 39. The seam of embodiment 37, wherein said absorption modifier (163) is unevenly distributed in said fused monolayer (106).

Embodiment 40. The seam of any one of embodiments 1 to 39, wherein any of said meltable layers (104) and (105) further comprises an absorption modifier (163).

Embodiment 41. The seam of any one of embodiments 37 to 40, wherein said absorption modifier (163) is selected from the group consisting of Clearweld™ LD940A, Clearweld™ LD940B, Clearweld™ LD940C, Clearweld™ LD940E, and Clearweld™ LD940F.

Embodiment 42. The seam of any one of embodiments 1 to 41, wherein said meltable layer (104) or (105) further comprises a light-absorbing polymer that absorbs light having a wavelength that is between 700 nm and 1400 nm.

Embodiment 43. The seam of any one of embodiments 1 to 42, wherein said meltable layer (104) or (105) further comprises less than 0.005% by mass of a light-absorbing polymer that absorbs light having a wavelength that is between 700 nm and 1400 nm.

Embodiment 44. The seam of embodiment 42 or 43, wherein said wavelength is between 900 nm and 1100 nm.

Embodiment 45. The seam of any one of embodiments 42 to 44, wherein said wavelength is about 980 nm.

Embodiment 46. The seam of any one of embodiments 42 to 45, wherein said light-absorbing polymer is selected from the group consisting of thermoplastic polyurethane (TPU), thermoplastic polyvinyl chloride (PVC), polyester (PE), polypropylene (PP), polyethylene, ABS, and Mylar®.

Embodiment 47. The seam of any one of embodiments 1 to 46, wherein any of said meltable layers (104) and (105) has a melting temperature of 140° C. or less.

Embodiment 48. The seam of any one of embodiments 1 to 47, wherein said seam comprises gas impermeable first and second base FCLs (110) and (120), and said weld is gas impermeable.

Embodiment 49. The seam of any one of embodiments 1 to 48, wherein said UHMWPE is selected from the group consisting of Dyneema®, Spectra®, and Dynex®.

Embodiment 50. A reinforced seam joining two flexible composite laminates (FCLs) comprising: three welds between a first FCL (760), a second FCL (770), a reinforcement FCL (700), and arranged to form intraseam space (715) comprising (i) a continuous first weld (731) comprising a homogeneous, fused monolayer (706) formed from a meltable layer (714) of FCL (700) and a meltable layer (704) of FCL (760), (ii) a continuous second weld (733) comprising a homogeneous, fused monolayer (707) formed from the meltable layer (714) and a meltable layer (705) of FCL (770), and (iii) a continuous third weld (735) arranged equidistant or nearly equidistant from the first and second welds (731) and (733) comprising a homogeneous, fused monolayer (706) formed from said meltable layers (704) and (705), said welds (731), (733), and (735) and FCLs (760), (770), and (700) arranged to form intraseam space (715), wherein said meltable layer (704) is located on the inner face of said first FCL (760); said meltable layer (705) is located on the inner face of said second FCL (770); said meltable layer (714) is located on the outer face of said reinforcement FCL (700), said reinforcement FCL (700) being folded along a midline (711); and each of said FCLs (700), (760), and (770) comprises a plurality of stacked, unidirectionally oriented Ultra-High Molecular Weight Polyethylene (UHMWPE) fibers arranged in cross-plied monolayers (201) and (202) and embedded in a plastic matrix (103).

Embodiment 51. The reinforced seam of embodiment 50, wherein said reinforcement FCL (700) is rectangular-shaped.

Embodiment 52. The reinforced seam of embodiment 50, wherein said reinforcement FCL (700) is square-shaped.

Embodiment 53. The reinforced seam of any one of embodiments 50 to 52, wherein the relative orientation of each pair of said plurality of unidirectionally oriented fibers in said cross-plied monolayers (201) and (202) that are located adjacent to each of said fused monolayers (706) and (707) are perpendicular or having an oblique angle of no less than 75 degrees.

Embodiment 54. The reinforced seam of any one of embodiments 50 to 53, wherein the relative orientation of each pair of said plurality of unidirectionally oriented fibers in said cross-plied monolayers (201) and (202) that are located adjacent to each of said fused monolayers (706) and (707) are perpendicular.

Embodiment 55. The reinforced seam of any one of embodiments 50 to 52, wherein the relative orientation of each pair of said plurality of unidirectionally oriented fibers in said cross-plied monolayers (201) and (202) that are located adjacent to each of said fused monolayers (706) and (707) are parallel or having an oblique angle of no more than 15 degrees.

Embodiment 56. The reinforced seam of any one of embodiments 50 to 52, and 55, wherein the relative orientation of each pair of said plurality of unidirectionally oriented fibers in said cross-plied monolayers (201) and (202) that are located adjacent to each of said fused monolayers (706) and (707) are parallel.

Embodiment 57. The reinforced seam of any one of embodiments 50 to 56, wherein said unidirectionally oriented fibers are polyethylene fibers selected from the group consisting of UHMWPE, High Density Polyethylene (HDPE) fibers, Medium-Density Polyethylene (MDPE) fibers, Low-Density Polyethylene (LDPE) fibers, Very Low-Density Polyethylene (VLDPE) fibers, and Cross-Linked Polyethylene (PEX) fibers.

Embodiment 58. The reinforced seam of any one of embodiments 50 to 57, wherein said unidirectionally oriented fibers are Ultra-High Molecular Weight Polyethylene (UHMWPE) fibers.

Embodiment 59. The reinforced seam of any one of embodiments 50 to 58, wherein said reinforced seam has an average tensile strength that is at least 80% of the base tensile strength of the weaker of said first FCL (760) or said second FCL (770).

Embodiment 60. The reinforced seam of any one of embodiments 50 to 59, wherein said reinforced seam has an average tensile strength that is about 83% of the base tensile strength of the weaker of said first FCL (760) or said second FCL (770).

Embodiment 61. The reinforced seam of any one of embodiments 50 to 60, wherein said first FCL (760) and said second FCL (770) are identical.

Embodiment 62. The reinforced seam of any one of embodiments 50 to 61, wherein said reinforced seam has an average tensile test strength that is at least 80% of the base tensile strength of one or both of said first FCL (760) and said second FCL (770).

Embodiment 63. The reinforced seam of any one of embodiments 50 to 62, wherein said reinforced seam has an average tensile test strength that is about 83% of the base tensile strength of one or both of said first FCL (760) and said second FCL (770).

Embodiment 64. The reinforced seam of embodiment 62 or 63, wherein said average tensile strength is selected from the group consisting of average shear tensile strength and average peel tensile strength.

Embodiment 65. The reinforced seam of any one of embodiments 50 to 64, wherein said reinforced seam has an average burst pressure of greater than 75 kilopascals (kPa) as measured using a test bladder (500) having a kidney shape with overall dimensions of 40.9 cm×89.1 cm and comprising said reinforced seam.

Embodiment 66. The reinforced seam of any one of embodiments 50 to 64, wherein said reinforced seam has an average burst pressure that is between 75 kPa and 90 kPa as measured using a test bladder (500) having a kidney shape with overall dimensions of 40.9 cm×89.1 cm and comprising said reinforced seam.

Embodiment 67. The reinforced seam of any one of embodiments 50 to 66, wherein each of said first and second FCLs (760) and (770) comprises High-Density Polyethylene (HDPE) fibers, Medium-Density Polyethylene (MDPE) fibers, or Low-Density Polyethylene (LDPE) fibers.

Embodiment 68. The reinforced seam of any one of embodiments 50 to 67, wherein the distance between said first weld (731) and said third weld (735) is at least 90% of the distance between said second weld (733) and third weld (735).

Embodiment 69. A reinforced curved seam joining two flexible composite laminates (FCLs) comprising: three welds between a first FCL (860), a second FCL (870), a reinforcement FCL (840), and arranged to form intraseam space (815) comprising (i) a continuous first weld (831) comprising a homogeneous, fused monolayer (806) formed from a meltable layer (814) of FCL (840) and a meltable layer (804) of FCL (860), (ii) a continuous second weld (833) comprising a homogeneous, fused monolayer (807) formed from said meltable layer (814) of FCL (840), a meltable layer (813) of FCL (840), and a meltable layer (805) of FCL (870), and (iii) a continuous third weld (835) arranged equidistant or nearly equidistant from said first and second welds (831) and (833) comprising a homogeneous, fused monolayer (806) formed from said meltable layers (804) and (805), said welds (831), (833), and (835) and FCLs (860), (870), and (840) arranged to form intraseam space (815), wherein said first FCL (860) has a curved edge (861) and said meltable layer (804) on its inner face; said second FCL (870) has a curved edge (871) and said meltable layer (805) on its inner face; said reinforcement FCL (840) comprises (a) a folded third FCL (810) comprising a curved edge (809) and three or more folded tabs (808), said folded tabs (808) being formed from two or more cuts (832) oriented perpendicular to said curved edge (809) and extending to a midline (811), said tabs being (808) folded along said midline (811) to provide an exposed face (817) having said meltable layer (813), and (b) a folded fourth FCL (820) comprising a curved edge (819) and three or more folded tabs (818), said folded tabs (818) being formed from two or more cuts (842) oriented perpendicular to said curved edge (819) and extending to a midline (821) to provide an exposed face (827) having said meltable layer (814), and an inner face (826) having said meltable layer (813), wherein said meltable layer (813) of said third FCL (810) is joined to said meltable layer (813) of said fourth FCL (820) by providing a heat means to a surface; each of said FCLs (810), (820), (860), and (870) comprises a plurality of stacked, unidirectionally oriented Ultra-High Molecular Weight Polyethylene (UHMWPE) fibers arranged in cross-plied monolayers (201) and (202) and embedded in a plastic matrix (103); said curved edges (861), (871), (809), and (819) are aligned and juxtaposed; and the number of cuts (832) and (842) are configured so that each inner edge of folded tabs (808) and (818) is oriented within 88 and 90 degrees relative to said curved edges (861) and (871) so as to maintain no more than a 6 millimeter (mm) distance between the mid-point of the section of said midline (811, 821) comprising the fold of each of said folded tabs (808, 818) and the corresponding arc representing the true curvature (873, 883) of said midline (811, 821).

Embodiment 70. The reinforced curved seam of embodiment 69, wherein the relative orientation of each pair of said plurality of unidirectionally oriented fibers in said cross-plied monolayers (201) and (202) that are located adjacent to each of said welds (831), (833), and (835) are perpendicular or having an oblique angle of no less than 75 degrees.

Embodiment 71. The reinforced curved seam of embodiment 69 or 70, wherein the relative orientation of each pair of said plurality of unidirectionally oriented fibers in said cross-plied monolayers (201) and (202) that are located adjacent to each of said welds (831), (833), and (835) are perpendicular.

Embodiment 72. The reinforced curved seam of embodiment 69, wherein the relative orientation of each pair of said plurality of unidirectionally oriented fibers in said cross-plied monolayers (201) and (202) that are located adjacent to each of said welds (831), (833), and (835) are parallel or having an oblique angle of no more than 15 degrees.

Embodiment 73. The reinforced curved seam of embodiments 69 or 72, wherein the relative orientation of each pair of said plurality of unidirectionally oriented fibers in said cross-plied monolayers (201) and (202) that are located adjacent to each of said welds (831), (833), and (835) are parallel.

Embodiment 74. The reinforced curved seam of any one of embodiments 69 to 73, wherein the distance between said first weld (831) said third weld (835) is at least 90% of the distance between said second weld (833) and said third weld (835).

Embodiment 75. The reinforced curved seam of any one of embodiments 69 to 74, wherein each of said first weld (831) and said second weld (833) are arranged equidistant from said third weld (835).

Embodiment 76. The reinforced curved seam of any one of embodiments 69 to 75, wherein said unidirectionally oriented fibers are polyethylene fibers selected from the group consisting of UHMWPE, High Density Polyethylene (HDPE) fibers, Medium-Density Polyethylene (MDPE) fibers, Low-Density Polyethylene (LDPE) fibers, Very Low-Density Polyethylene (VLDPE) fibers, and Cross-Linked Polyethylene (PEX) fibers.

Embodiment 77. The reinforced curved seam of any one of embodiments 69 to 76, wherein said unidirectionally oriented fibers are Ultra-High Molecular Weight Polyethylene (UHMWPE) fibers.

Embodiment 78. The reinforced curved seam of any one of embodiments 69 to 77, wherein the melting temperature of each of said meltable layers (804), (805), (813), and (814) is less than 95% of the melting temperature of said UHMWPE fibers arranged in cross-plied monolayers (201) and (202).

Embodiment 79. The reinforced curved seam of any one of embodiments 69 to 78, wherein said reinforced seam has an average tensile strength that is at least 80% of the base tensile strength of the weaker of said first and second FCLs (860) and (870).

Embodiment 80. The reinforced curved seam of any one of embodiments 69 to 79, wherein said reinforced weld has an average tensile strength that is about 85% of the base tensile strength of the weaker of said first and second FCLs (860) and (870).

Embodiment 81. The reinforced curved seam of any one of embodiments 69 to 80, wherein said reinforced seam has an average burst pressure of greater than 75 kilopascals (kPa) as measured using a test bladder (500) having a kidney shape with overall dimensions of 40.9 cm×89.1 cm and comprising said reinforced seam.

Embodiment 82. The reinforced curved seam of any one of embodiments 69 to 80, wherein said reinforced seam has an average burst pressure that is between 75 kPa and 90 kPa as measured using a test bladder (500) having a kidney shape with overall dimensions of 40.9 cm×89.1 cm and comprising said reinforced seam.

Embodiment 83. A reinforced curved seam joining two flexible composite laminates (FCLs) comprising: three welds between a first FCL (960), a second FCL (970), a reinforcement FCL (940), and arranged to form intraseam space (915) comprising (i) a continuous first weld (931) comprising a homogeneous, fused monolayer (906) formed from a meltable layer (914) of FCL (940) and a meltable layer (904) of FCL (960), (ii) a continuous second weld (933) comprising a homogeneous, fused monolayer (907) formed from said meltable layer (914) of FCL (940), a meltable layer (913) of FCL (940), and a meltable layer (905) of FCL (970), and, (iii) a continuous third weld (935) arranged equidistant or nearly equidistant from said first and second welds (931) and (933) comprising a homogeneous, fused monolayer (906) formed from said meltable layers (904) and (905), said welds (931), (933), and (935) and FCLs (960), (970), and (940) arranged to form intraseam space (915), wherein said first FCL (960) has a curved edge (961) and said meltable layer (904) on its inner face; said second FCL (970) has a curved edge (971) and said meltable layer (905) on its inner face; said reinforcement FCL (940) comprises (a) a folded third FCL (910) comprising two or more notched gaps (978) oriented perpendicular to a curved edge (909) and extending from said curved edge (909) to a midline (911) to form three or more tabs (908), said third FCL (910) being folded along midline (911) to provide an exposed face (917) having said meltable layer (913), and (b) a folded fourth FCL (920) comprising two or more notched gaps (979) oriented perpendicular to a curved edge (919) and extending from said curved edge (919) to a midline (921) to form three or more tabs (918), said fourth FCL (920) being folded along midline (921) to provide an exposed face (927) having said meltable layer (914), and an inner face (926) having said meltable layer (913), wherein said meltable layer (913) of said third FCL (910) is joined to said meltable layer (913) of said fourth FCL (920) by providing a heat means to a surface; each of said FCLs (910), (920), (960), and (970) comprises a plurality of stacked, unidirectionally oriented Ultra-High Molecular Weight Polyethylene (UHMWPE) fibers arranged in cross-plied monolayers (201) and (202) and embedded in a plastic matrix (103); said curved edges (961), (971), (909), and (919) are aligned and juxtaposed; and said notched gaps (978) and (979) are configured so that each inner edge of said folded tabs (908) and (918) is oriented within 88 and 90 degrees relative to said curved edges (961) and (971) so as to maintain no more than a 6 millimeter (mm) distance between the mid-point of the section of said midline (911, 921) comprising the fold of each of said folded tabs (908, 918) and the corresponding arc representing the true curvature (973, 983) of said midline (911, 921).

Embodiment 84. The reinforced curved seam of embodiment 83, wherein the relative orientation of each pair of said plurality of unidirectionally oriented fibers in said cross-plied monolayers (201) and (202) that are located adjacent to each of said welds (931), (933), and (935) are perpendicular or having an oblique angle of no less than 75 degrees.

Embodiment 85. The reinforced curved seam of embodiment 83 or 84, wherein the relative orientation of each pair of said plurality of unidirectionally oriented fibers in said cross-plied monolayers (201) and (202) that are located adjacent to each of said welds (931), (933), and (935) are perpendicular.

Embodiment 86. The reinforced curved seam of embodiment 83, wherein the relative orientation of each pair of said plurality of unidirectionally oriented fibers in said cross-plied monolayers (201) and (202) that are located adjacent to each of said welds (931), (933), and (935) are parallel or having an oblique angle of no more than 15 degrees.

Embodiment 87. The reinforced curved seam of embodiment 83 or 86, wherein the relative orientation of each pair of said plurality of unidirectionally oriented fibers in said cross-plied monolayers (201) and (202) that are located adjacent to each of said welds (931), (933), and (935) are parallel.

Embodiment 88. The reinforced curved seam of any one of embodiments 83 to 87, wherein said unidirectionally oriented fibers are polyethylene fibers selected from the group consisting of UHMWPE, High Density Polyethylene (HDPE) fibers, Medium-Density Polyethylene (MDPE) fibers, Low-Density Polyethylene (LDPE) fibers, Very Low-Density Polyethylene (VLDPE) fibers, and Cross-Linked Polyethylene (PEX) fibers.

Embodiment 89. The reinforced curved seam of any one of embodiments 83 to 88, wherein said unidirectionally oriented fibers are Ultra-High Molecular Weight Polyethylene (UHMWPE) fibers.

Embodiment 90. The reinforced curved seam of any one of embodiments 83 to 89, wherein the distance between said first weld (931) and said third weld (935) is at least 90% of the distance between said second weld (933) and said third weld (935).

Embodiment 91. The reinforced curved seam of any one of embodiments 83 to 90, wherein each of said first weld (931) and said second weld (933) is arranged equidistant from said third weld (935).

Embodiment 92. The reinforced curved seam of any one of embodiments 83 to 91, wherein the melting temperature of each of said meltable layers (904), (905), (913), and (914) is less than 95% of the melting temperature of said UHMWPE fibers arranged in cross-plied monolayers (201) and (202).

Embodiment 93. The reinforced curved seam of any one of embodiments 83 to 92, wherein said reinforced seam has an average tensile strength that is at least 80% of the base tensile strength of the weaker of said first and second FCLs (960) and (970).

Embodiment 94. The reinforced curved seam of any one of embodiments 83 to 93, wherein said reinforced weld has an average tensile strength that is about 85% of the base tensile strength of the weaker of said first and second FCLs (960) and (970).

Embodiment 95. The reinforced curved seam of any one of embodiments 83 to 94, wherein said reinforced seam has an average burst pressure of greater than 75 kilopascals (kPa) as measured using a test bladder (500) having a kidney shape with overall dimensions of 40.9 cm×89.1 cm and comprising said reinforced seam.

Embodiment 96. The reinforced curved seam of any one of embodiments 83 to 94, wherein said reinforced seam has an average burst pressure that is between 75 kPa and 90 kPa as measured using a test bladder (500) having a kidney shape with overall dimensions of 40.9 cm×89.1 cm and comprising said reinforced seam.

Embodiment 97. A seamed, inflatable body comprising two or more base FCLs (760, 770) and having one or more linear-shaped seam areas in need of reinforcement, wherein said one or more linear-shaped seam areas in need of reinforcement are laser-welded to one or more reinforcement FCLs (700).

Embodiment 98. A seamed, inflatable body comprising two or more base FCLs (860, 870) and having one or more concave seam areas in need of reinforcement, wherein said one or more concave seam areas in need of reinforcement are laser-welded to one or more reinforcement FCLs (840).

Embodiment 99. A seamed, inflatable body comprising two or more base FCLs (960, 970) and having one or more convex seam areas in need of reinforcement, wherein said one or more convex seam areas in need of reinforcement are laser-welded to one or more reinforcement FCLs (940).

Embodiment 100. A seamed, inflatable body comprising two or more base FCLs (760, 770, 860, 870, 960, 970) and having one or more seam areas in need of reinforcement, wherein the shape of said one or more seam areas in need of reinforcement is selected from the group consisting of a linear area, a concave area, and a convex area, wherein: any one or more linear areas in need of reinforcement is laser-welded to one or more reinforcement FCLs (700), any one or more concave areas in need of reinforcement is laser-welded to one or more reinforcement FCLs (840), and any one or more convex areas in need of reinforcement is laser-welded to one or more reinforcement FCLs (940).

Embodiment 101. The seamed, inflatable body of claim 100, wherein an end of a first seam area in need of reinforcement is linked to an end of a second seam area in need of reinforcement, thereby forming a continuous reinforced seam area.

Embodiment 102. A method of forming a seam, the method comprising the steps of: providing a first flexible composite laminate (FCL) (110) comprising a meltable layer (104) on at least one face and a second FCL (120) comprising a meltable layer (105) on at least one face, said first and second FCLs (110) and (120) configured to have similar or matching edges; overlaying said first and second FCLs (110) and (120) so that said meltable layers (104) and (105) are juxtaposed, and so that said similar or matching edges are aligned; directing a laser beam having a wavelength between 900 nm and 1100 nm, a power of between 20 and 40 watts per 15 square millimeters, and a beam width of about 7 mm at a weld location, and simultaneously applying a pressure of between 100 and 1,000 kilopascals (kPa) at said weld location, wherein said weld location comprises an absorption modifier (163); moving said laser beam along the aligned edges at a speed of between 0.65 and 7.5 centimeters/second (cm/sec) and a dwell time of between 5 and 180 seconds while maintaining said pressure; and melting said meltable layers (104) and (105) to produce a homogeneous, fused monolayer (106).

Embodiment 103. The method of embodiment 102, wherein said absorption modifier (163) is comprised within any of said meltable layers (104) and (105), applied in a layer on the surface of any of said meltable layers (104) and (105), or a combination thereof.

Embodiment 104. The method of embodiments 102 or 103, wherein said absorption modifier (163) has a wavelength of between 900 nm and 1100 nm.

Embodiment 105. The method of any one of embodiments 102 to 104, wherein said first and second FCLs (110) and (120) comprise a plurality of stacked, unidirectionally oriented Ultra-High Molecular Weight Polyethylene (UHMWPE) fibers in cross-plied monolayers (101) and (102) embedded in a plastic matrix (103).

Embodiment 106. The method of embodiment 105, further comprising aligning the fibers from said cross-plied monolayers (101) and (102) adjacent to said fused monolayer (106) of each of said first and second FCLs (110) and (120) into a relative orientation of between 75 and 90 degrees.

Embodiment 107. The method of embodiment 105, further comprising aligning the fibers from said cross-plied monolayers (101) and (102) adjacent to said fused monolayer (106) of each of said first and second FCLs (110) and (120) into a relative orientation of between 0 and 15 degrees.

Embodiment 108. The method of any one of embodiments 102 to 107, wherein said laser beam is absorbed by said absorption modifier (163) to heat said meltable layers (104) and (105) to a temperature that is between 80° C. and 140° C.

Embodiment 109. The method of any one of embodiments 105 to 108, wherein said laser beam is absorbed by said absorption modifier (163) to heat said meltable layers (104) and (105) to a temperature that is at least 5° C. below the melting point of said cross-plied monolayers (101) and (102).

Embodiment 110. The method of any one of embodiments 102 to 109, wherein said moving follows a straight line, thereby forming a linear seam.

Embodiment 111. The method of any one of embodiments 102 to 109, wherein said moving follows a curved line, thereby forming a curved seam.

Embodiment 112. The method of any one of embodiments 102 to 111, further comprising cooling of said homogeneous, fused monolayer (106) at ambient temperature until solidification has occurred.

Embodiment 113. The method of any one of embodiments 102 to 112, further comprising clamping the overlaid said first and second FCLs (110) and (120) in place prior to said directing a laser beam.

Embodiment 114. The method of any one of embodiments 102 to 113, wherein less than 10% of said seam in a length of at least 1 cm comprises discontinuous weld segments as revealed by scanning-electron microscopy (SEM).

Embodiment 115. The method of any one of embodiments 102 to 114, wherein said seam has a length of at least one inch.

Embodiment 116. A method of forming a reinforced seam between two flexible composite laminates (FCLs), the method comprising the steps of: providing (i) a first FCL (760) having a meltable layer (704) on its inner face, (ii) a second FCL (770) having a meltable layer (705) on its inner face, and (iii) a reinforcement FCL (700) folded along a midline (711) and having a meltable layer (714) on its exposed face, wherein said first and second FCLs (760) and (770) are configured to have similar or matching edges; inserting said reinforcement FCL (700) between said first FCL (760) and said second FCL (770), so that said meltable layer (714) is juxtaposed with both of said meltable layers (704) and (705), and so that said similar or matching edges are aligned; directing a laser beam at weld locations (797), (798), and (799), said laser having a wavelength between 900 nm and 1100 nm, a power of between 20 and 40 watts per 15 square millimeters, and a beam width of about 7 mm, and simultaneously applying a pressure of between 100 and 1,000 kilopascals (kPa), wherein said weld locations comprise an absorption modifier (163); moving said laser beam along the aligned edges at a speed of between 0.65 and 7.5 centimeters/second (cm/sec) and a dwell time of between 5 and 180 seconds, melting said meltable layers (704), (705), and (714) at each of said weld locations (797), (798), and (799); and cooling to form a reinforced seam comprising continuous welds (731), (733), and (735) at weld locations (797), (798), and (799), wherein said weld (731) fuses meltable layers (704) and (714), wherein said weld (733) fuses meltable layers (705) and (714), wherein said weld (735) fuses meltable layers (704) and (705), and wherein said welds (731) and (733) are arranged equidistant or nearly equidistant from said weld (735).

Embodiment 117. The method of embodiment 116, wherein said directing a laser beam at weld locations (797) and (798) is performed simultaneously.

Embodiment 118. The method of embodiment 116 or 117, wherein said absorption modifier (163) is comprised within any of said meltable layers (704), (705), and (714), applied in a layer on the surface of any of said meltable layers (704), (705), and (714), or a combination thereof.

Embodiment 119. The method of any one of embodiments 116 to 118, wherein each of said first FCL (760), said second FCL (770), and said reinforcement FCL (700) comprises a plurality of stacked, unidirectionally oriented Ultra-High Molecular Weight Polyethylene (UHMWPE) fibers in cross-plied monolayers (101) and (102) embedded in a plastic matrix (103).

Embodiment 120. The method of embodiment 119, further comprising aligning the fibers from said cross-plied monolayers (101) and (102) located adjacent to any of said continuous welds (731), (733), and (735) into a relative orientation of between 75 and 90 degrees.

Embodiment 121. The method of embodiment 119, further comprising aligning the fibers from said cross-plied monolayers (101) and (102) located adjacent to any of said continuous welds (731), (733), and (735) into a relative orientation of between 0 and 15 degrees.

Embodiment 122. The method of any one of embodiments 116 to 121, wherein said laser beam is absorbed by said absorption modifier (163) to heat any of said meltable layers (704), (705), and (714) to a temperature that is between 80° C. and 140° C.

Embodiment 123. The method of any one of embodiments 119 to 122, wherein said laser beam is absorbed by said absorption modifier (163) to heat any of said meltable layers (704), (705), and (714) to a temperature that is at least 5° C. below the melting point of said cross-plied monolayers (101) and (102).

Embodiment 124. The method of any one of embodiments 116 to 123, wherein said directing a laser beam is performed at each of said weld locations (797) and (798) simultaneously.

Embodiment 125. The method of any one of embodiments 116 to 124, wherein said reinforced seam has a linear shape.

Embodiment 126. The method of any one of embodiments 116 to 125, further comprising clamping any two of said first FCL (760), said second FCL (770), and said reinforcement FCL (700) in place prior to said applying a laser.

Embodiment 127. The method of any one of embodiments 116 to 126, wherein said reinforced seam has an average tensile strength that is at least 80% of the base tensile strength of the weaker of said first FCL (760) or said second FCL (770).

Embodiment 128. The method of any one of embodiments 116 to 127, wherein said reinforced seam has an average burst pressure of greater than 75 kPa as measured using a test bladder (500) having a kidney shape with overall dimensions of 40.9 cm×89.1 cm and comprising said reinforced seam.

Embodiment 129. A method of forming a reinforced curved seam joining two flexible composite laminates (FCLs), the method comprising the steps of: providing (i) a first FCL (860) having a curved edge (861) and a meltable layer (804) on its inner face, (ii) a second FCL (870) having a curved edge (871) and a meltable layer (805) on its inner face, (iii) a folded third FCL (810) having a curved edge (809) and three or more folded tabs (808), said folded tabs (808) being formed from two or more cuts (832) oriented perpendicular to said curved edge (809) and extending to a midline (811), said tabs (808) being folded along said midline (811) to provide an exposed face (817) having a meltable layer (813), and (iv) a folded fourth FCL (820) having a curved edge (819) and three or more folded tabs (818), said folded tabs (818) being formed from two or more cuts (842) oriented perpendicular to said curved edge (819) and extending to a midline (821), said tabs (818) being folded along said midline (821) to provide an exposed face (827) having a meltable layer (814), and an inner face (826) having said meltable layer (813); inserting said folded third FCL (810) into said folded fourth FCL (820), so that said meltable layer (813) of said folded third FCL (810) is juxtaposed with said meltable layer (813) of said folded fourth FCL (820); joining said folded third FCL (810) to said folded fourth FCL (820) by applying a heat means to a surface, thereby forming a reinforcement FCL (840); aligning said first base FCL (860) relative to said second base FCL (870) along said curved edges (861) and (871); inserting said reinforcement FCL (840) between the aligned said first and second FCLs (860) and (870) so as to align and juxtapose all of said curved edges (861), (871), (809), and (819), juxtapose said meltable layer (814) with each of said meltable layers (804) and (805), and juxtapose said meltable layer (813) with said meltable layer (805), providing an intraseam space (815); directing a laser beam at weld locations (897), (898), and (899), said laser having a wavelength between 900 nm and 1100 nm, a power of between 20 and 40 watts per 15 square millimeters, and a beam width of about 7 mm, and simultaneously applying a pressure of between 100 and 1,000 kilopascals (kPa), wherein said weld locations comprise an absorption modifier (163); moving said laser beam along the aligned curved edges at a speed of between 0.65 and 7.5 centimeters/second (cm/sec), and for a time of between 5 and 180 seconds; melting said meltable layers (804), (805), (813), and (814) at locations (897), (898), and (899); and cooling to form a reinforced curved seam comprising continuous welds (831), (833), and (835) at weld locations (897), (898), and (899), wherein the number of cuts (832) and (842) are configured so that each inner edge of said folded tabs (808) and (818) is oriented within 88 and 90 degrees relative to said curved edges (861) and (871) so as to maintain no more than a 6 millimeter (mm) distance between the mid-point of the section of said midline (811, 821) comprising the fold of each of said folded tabs (808, 818) and the corresponding arc representing the true curvature (873, 883) of said midline (811, 821), wherein said weld (831) fuses meltable layers (804) and (814), wherein said weld (833) fuses meltable layers (805), (813), and (814), wherein said weld (835) fuses meltable layers (804) and (805), and wherein said welds (831) and (833) are arranged equidistant or nearly equidistant from said weld (835).

Embodiment 130. The method of embodiment 129, wherein said absorption modifier (163) is comprised within any of said meltable layers (804), (805), (813), and (814), applied in a layer on the surface of any of said meltable layers (804), (805), (813), and (814), or a combination thereof.

Embodiment 131. The method of embodiment 129 or 130, wherein each of said first FCL (860), said second FCL (870), said third FCL (810), and said fourth FCL (820) comprises a plurality of stacked, unidirectionally oriented Ultra-High Molecular Weight Polyethylene (UHMWPE) fibers in cross-plied monolayers (101) and (102) embedded in a plastic matrix (103).

Embodiment 132. The method of embodiment 131, further comprising aligning the fibers from said cross-plied monolayers (101) and (102) adjacent to any of said continuous welds (831), (833), and (835) into a relative orientation of between 75 and 90 degrees.

Embodiment 133. The method of embodiment 131, further comprising aligning the fibers from said cross-plied monolayers (101) and (102) adjacent to any of said continuous welds (831), (833), and (835) into a relative orientation of between 0 and 15 degrees.

Embodiment 134. The method of any one of embodiments 129 to 133, wherein said laser beam is absorbed by said absorption modifier (163) to heat any of said meltable layers (804), (805), (813), and (814) to a temperature that is between 80° C. and 140° C.

Embodiment 135. The method of any one of embodiments 131 to 134, wherein said laser beam is absorbed by said absorption modifier (163) to heat any of said meltable layers (804), (805), (813), and (814) to a temperature that is at least 5° C. below the melting point of said cross-plied monolayers (101) and (102).

Embodiment 136. The method of any one of embodiments 129 to 135, wherein said directing a laser beam is performed at each of weld locations (897) and (898) simultaneously.

Embodiment 137. The method of any one of embodiments 129 to 136, further comprising clamping any two of said first FCL (860), said second FCL (870), and said reinforcement FCL (840) in place prior to said directing a laser beam.

Embodiment 138. The method of any one of embodiments 129 to 137, wherein said reinforced seam has an average tensile strength that is at least 80% of the base tensile strength of the weaker of said first FCL (860) or said second FCL (870).

Embodiment 139. The method of any one of embodiments 129 to 138, wherein said reinforced seam has an average burst pressure of greater than 75 kPa as measured using a test bladder (500) having a kidney shape with overall dimensions of 40.9 cm×89.1 cm and comprising said reinforced seam.

Embodiment 140. The method of any one of embodiments 129 to 139, wherein said heat means is a heat press, a hot iron, or a combination thereof.

Embodiment 141. The method of embodiment 140, wherein said heat means provides a constant temperature and pressure.

Embodiment 142. The method of embodiment 141, wherein said constant temperature is between 120° C. and 130° C.

Embodiment 143. A method of forming a reinforced curved seam between two flexible composite laminates (FCLs), the method comprising the steps of: providing (i) a first FCL (960) having curved edge (961) and a meltable layer (904) on its inner face, (ii) a second FCL (970) having curved edge (971) and a meltable layer (905) on its inner face, (iii) a folded third FCL (910) having a curved edge (909) and two or more notched gaps (978) oriented perpendicular to said curved edge (909) and extending from said curved edge (909) to a midline (911) to form three or more tabs (908), said third FCL (910) being folded along midline (911) to provide an exposed face (917) having a meltable layer (913), and (iv) a folded fourth FCL (920) having a curved edge (919) and two or more notched gaps (979) oriented perpendicular to said curved edge (919) and extending from said curved edge (919) to a midline (921) to form three or more tabs (918), said fourth FCL (920) being folded along midline (921) to provide an exposed face (927) having a meltable layer (914), and an inner face (926) having said meltable layer (913); inserting said folded third FCL (910) into said folded fourth FCL (920), so that said meltable layer (913) of said folded third FCL (910) is juxtaposed with said meltable layer (913) of said folded fourth FCL (920); joining said folded third FCL (910) to said folded fourth FCL (920) by applying a heat means to a surface, thereby forming a reinforcement FCL (940); aligning said first and second FCLs (960) and (970) along said curved edges (961) and (971); inserting said reinforcement FCL (940) between the aligned said first and second FCLs (960) and (970) so as to align and juxtapose all of said curved edges (961), (971), (909), and (919), juxtapose said meltable layer (914) with each of said meltable layers (904) and (905), and juxtapose said meltable layer (913) with said meltable layer (905), providing an intraseam space (915); directing a laser beam at weld locations (997), (998), and (999), said laser having a wavelength between 900 nm and 1100 nm, a power of between 20 and 40 watts per 15 square millimeters, and a beam width of about 7 mm, and simultaneously applying a pressure of between 100 and 1,000 kilopascals (kPa), wherein said weld locations comprise an absorption modifier (163); moving said laser beam along the aligned curved edges at a speed of between 0.65 and 7.5 centimeters/second (cm/sec), and for a time of between 5 and 180 seconds; melting said meltable layers (904), (905), (913), and (914) at locations (997), (998), and (999); and cooling to form a reinforced curved seam comprising continuous welds (931), (933), and (935) at weld locations (997), (998), and (999), wherein the number of notched gaps (978) and (979) are configured so that each inner edge of said folded tabs (908) and (918) is oriented within 88 and 90 degrees relative to said curved edges (961) and (971) so as to maintain no more than a 6 millimeter (mm) distance between the mid-point of the section of said midline (911, 921) comprising the fold of each of said folded tabs (908, 918) and the corresponding arc representing the true curvature (973, 983) of said midline (911, 921), wherein said weld (931) fuses meltable layers (904) and (914), wherein said weld (933) fuses meltable layers (905), (913), and (914), wherein said weld (935) fuses meltable layers (904) and (905), and wherein said welds (931) and (933) are arranged equidistant or nearly equidistant from said weld (935).

Embodiment 144. The method of embodiment 143, wherein said absorption modifier (163) is comprised within any of said meltable layers (904), (905), (913), and (914), applied in a layer on the surface of any of said meltable layers (904), (905), (913), and (914), or a combination thereof.

Embodiment 145. The method of embodiment 143 or 144, wherein each of said first FCL (960), said second FCL (970), said third FCL (910), and said fourth FCL (920) comprises a plurality of stacked, unidirectionally oriented Ultra-High Molecular Weight Polyethylene (UHMWPE) fibers in cross-plied monolayers (101) and (102) embedded in a plastic matrix (103).

Embodiment 146. The method of embodiment 145, further comprising aligning the fibers from said cross-plied monolayers (101) and (102) adjacent to any of said continuous welds (931), (933), and (935) into a relative orientation of between 75 and 90 degrees.

Embodiment 147. The method of embodiment 145, further comprising aligning the fibers from said cross-plied monolayers (101) and (102) adjacent to any of said continuous welds (931), (933), and (935) into a relative orientation of between 0 and 15 degrees.

Embodiment 148. The method of any one of embodiments 143 to 147, wherein said laser beam is absorbed by said absorption modifier (163) to heat any of said meltable layers (904), (905), (913), and (914) to a temperature that is between 80° C. and 140° C.

Embodiment 149. The method of any one of embodiments 145 to 148, wherein said laser beam is absorbed by said absorption modifier (163) to heat any of said meltable layers (904), (905), (913), and (914) to a temperature that is at least 5° C. below the melting point of said cross-plied monolayers (101) and (102).

Embodiment 150. The method of any one of embodiments 143 to 149, wherein said directing a laser beam is performed at each of weld locations (997) and (998) simultaneously.

Embodiment 151. The method of any one of embodiments 143 to 150, further comprising clamping any two of said first FCL (960), said second FCL (970), and said reinforcement FCL (940) in place prior to said directing a laser beam.

Embodiment 152. The method of any one of embodiments 143 to 151, wherein said reinforced seam has an average tensile strength that is at least 80% of the base tensile strength of the weaker of said first FCL (960) or said second FCL (970).

Embodiment 153. The method of any one of embodiments 143 to 152, wherein said reinforced seam has an average burst pressure of greater than 75 kPa as measured using a test bladder (500) having a kidney shape with overall dimensions of 40.9 cm×89.1 cm and comprising said reinforced seam.

Embodiment 154. The method of any one of embodiments 143 to 153, wherein said heat means is a heat press, a hot iron, or a combination thereof.

Embodiment 155. The method of embodiment 154, wherein said heat means provides a constant temperature and pressure.

Embodiment 156. The method of embodiment 155, wherein said constant temperature is between 120° C. and 130° C.

Embodiment 157. A method of making a reinforcement FCL (840), the method comprising the steps of: providing (i) a first FCL (810) having a curved edge (809) and a meltable layer (813) on one face (807), and (ii) a second FCL (820) having curved edge (819), said meltable layer (813) on one face (816), and a meltable layer (814) on the other face (817); cutting two or more cuts (832) in said first FCL (810) perpendicular to said curved edge (809) and extending to a midline (811) to form three or more tabs (808); cutting two or more cuts (842) in said second FCL (820) perpendicular to said curved edge (819) and extending to a midline (821) to form three or more tabs (818); folding said each of said tabs (808) along said midline (811) to form a folded first FCL (810); folding said each of said tabs (818) along said midline (821) to form a folded second FCL (820); inserting said folded first FCL (810) into said folded second FCL (820) so that curved edges (809) and (819) are aligned and juxtaposed and providing an intraseam space (815); and heat-fusing said meltable layer (813) of said first folded FCL (810) to said meltable layer (813) of said second folded FCL (820) by applying a heat means to a surface.

Embodiment 158. A method of making a reinforcement FCL (940), the method comprising the steps of; providing (i) a first FCL (910) having curved edge (909) and a meltable layer (913) on one face (907), and (ii) a second FCL (920) having curved edge (919), said meltable layer (913) on its inner face (916), and a meltable layer (914) on the other face (917); notching said first FCL (910) perpendicular to said curved edge (909) and extending from said curved edge (909) to a midline (911) to prepare two or more notched gaps (978) and three or more tabs (908); notching said second FCL (920) perpendicular to said curved edge (919) and extending from said curved edge (919) to a midline (921) to prepare two or more notched gaps (979) and three or more tabs (918); folding said tabs (908) of the notched first FCL (910) along said midline (911) to form a notched and folded first FCL (910); folding said tabs (918) of the notched second FCL (920) along said midline (921) to form a notched and folded second FCL (920); inserting said notched and folded first FCL (910) into said notched and folded second FCL (920) so that curved edges (909) and (919) are aligned; and heat-fusing said meltable layer (913) of said notched and folded first FCL (910) to said meltable layer (913) of said notched and folded second FCL (920) by applying a heat means to a surface.

Embodiment 159. The method of embodiment 157 or 158, wherein said heat means is a heat press, a hot iron, or a combination thereof.

Embodiment 160. The method of embodiment 159, wherein said heat means provides a constant temperature and pressure.

Embodiment 161. The method of embodiment 160, wherein said constant temperature is between 120° C. and 130° C.

Embodiment 162. A method of preparing a reinforced seam for an inflatable body along a linear seam formed from two or more base FCLs (760, 770), the method comprising the steps of: providing an inflatable body in need of a linear seam; and laser-welding one or more reinforcement FCLs (700) along said linear seam to form a reinforced linear seam.

Embodiment 163. A method of preparing a reinforced seam for an inflatable body along a concave curved seam formed from two base FCLs (860, 870) of an inflatable body, or part thereof, said FCLs having at least one concave curved edge, the method comprising the steps of: providing an inflatable body in need of a seam along a concave curve of said FCLs; aligning one or more reinforcement FCLs (840) along said concave curve; and laser-welding said one or more reinforcement FCLs (840) to said concave curve to form a reinforced concave curved seam.

Embodiment 164. A method of preparing a reinforced seamed for an inflatable body along a convex curved seam formed from two base FCLs (960, 970) of an inflatable body, or part thereof, said FCLs having at least one convex curved edge, the method comprising the steps of: providing an inflatable body in need of a seam along a convex curve of said FCLs; aligning one or more reinforcement FCLs (940) along said convex curve; and laser-welding said one or more reinforcement FCLs (940) to said convex curve to form a reinforced convex curved seam.

Embodiment 165. A method of preparing a reinforced seam for an inflatable body comprising two or more base FCLs (760, 770, 860, 870, 960, 970), the method comprising the steps of: providing an inflatable body in need of a seam along one or more areas, said one or more areas selected from the group consisting of a linear area, a concave curved area, and a convex curved area; laser-welding one or more reinforcement FCLs (700) along said one or more linear areas; laser-welding one or more reinforcement FCLs (840) along said one or more concave curved areas; and laser-welding one or more reinforcement FCLs (940) along said one or more convex curved areas.

Embodiment 166. The method of any one of embodiments 162 to 165, wherein said laser-welding is accomplished with a laser having a wavelength between 900 nm and 1100 nm at a power of between 20 and 40 watts per 15 square millimeters with a beam width of about 7 mm, at a pressure between 100 and 1,000 kilopascals (kPa), at a speed of between 0.65 and 7.5 centimeters/second (cm/sec), and for a dwell time of between 5 and 180 seconds.

Embodiment 167. The method of any one of embodiments 162 to 165, wherein said laser-welding is accomplished with a laser having a wavelength between 900 nm and 1100 nm at a power of between 85 and 95 watts per 15 square millimeters with a beam width of about 3 mm, at a pressure between 100 and 1,000 kilopascals (kPa), at a speed of between 35 and 45 centimeters/second (cm/sec), and for a dwell time of between 5 and 180 seconds.

Embodiment 168. The method of any one of embodiments 162 to 167, wherein said inflatable body is selected from the group consisting of an inflatable life preserver and an inflatable raft.

Embodiment 169. A method of forming a seam, the method comprising the steps of: providing a first flexible composite laminate (FCL) (110) comprising a meltable layer (104) on at least on face and a second FCL (120) comprising a meltable layer (105) on at least one face, said first and second FCLs (110) and (120) configured to have similar or matching edges; overlaying said first and second FCLs (110) and (120) so that said meltable layers (104) and (105) are juxtaposed, and so that said similar or matching edges are aligned; directing a laser beam having a wavelength between 900 nm and 1100 nm, a power of between 85 and 95 watts per 15 square millimeters, and a beam width of about 3 mm at a weld location, and simultaneously applying a pressure of between 100 and 1,000 kilopascals (kPa) at said weld location, wherein said weld location comprises an absorption modifier (163); moving said laser beam along the aligned edges at a speed of between 35 and 45 centimeters/second (cm/sec) and a dwell time of between 5 and 180 seconds while maintaining said pressure; and melting said meltable layers (104) and (105) to produce a homogeneous, fused monolayer (106).

Embodiment 170. The method of embodiment 169, wherein said absorption modifier (163) is comprised within any of said meltable layers (104) and (105), applied in a layer on the surface of any of said meltable layers (104) and (105), or a combination thereof.

Embodiment 171. The method of embodiments 169 or 170, wherein said absorption modifier (163) has a wavelength of between 900 nm and 1100 nm.

Embodiment 172. The method of any one of embodiments 169 to 171, wherein said first and second FCLs (110) and (120) comprise a plurality of stacked, unidirectionally oriented Ultra-High Molecular Weight Polyethylene (UHMWPE) fibers in cross-plied monolayers (101) and (102) embedded in a plastic matrix (103).

Embodiment 173. The method of embodiment 172, further comprising aligning the fibers from said cross-plied monolayers (101) and (102) adjacent to said fused monolayer (106) of each of said first and second FCLs (110) and (120) into a relative orientation of between 75 and 90 degrees.

Embodiment 174. The method of embodiment 172, further comprising aligning the fibers from said cross-plied monolayers (101) and (102) adjacent to said fused monolayer (106) of each of said first and second FCLs (110) and (120) into a relative orientation of between 0 and 15 degrees.

Embodiment 175. The method of any one of embodiments 169 to 174, wherein said laser beam is absorbed by said absorption modifier (163) to heat said meltable layers (104) and (105) to a temperature that is between 110° C. and 143° C.

Embodiment 176. The method of any one of embodiments 172 to 175, wherein said laser beam is absorbed by said absorption modifier (163) to heat said meltable layers (104) and (105) to a temperature that is at least 1° C. below the melting point of said cross-plied monolayers (101) and (102).

Embodiment 177. The method of any one of embodiments 169 to 176, wherein said moving follows a straight line, thereby forming a linear seam.

Embodiment 178. The method of any one of embodiments 169 to 176, wherein said moving follows a curved line, thereby forming a curved seam.

Embodiment 179. The method of any one of embodiments 169 to 178, further comprising cooling of said homogeneous, fused monolayer (106) at ambient temperature until solidification has occurred.

Embodiment 180. The method of any one of embodiments 169 to 179, further comprising clamping the overlaid said first and second FCLs (110) and (120) in place prior to said directing a laser beam.

Embodiment 181. The method of any one of embodiments 169 to 180, wherein less than 10% of said seam in a length of at least 1 cm comprises discontinuous weld segments as revealed by scanning-electron microscopy (SEM).

Embodiment 182. The method of any one of embodiments 169 to 181, wherein said seam has a length of at least one inch.

Embodiment 183. A method of forming a reinforced seam between two flexible composite laminates (FCLs), the method comprising the steps of: providing (i) a first FCL (760) having a meltable layer (704) on its inner face, (ii) a second FCL (770) having a meltable layer (705) on its inner face, and (iii) a reinforcement FCL (700) folded along a midline (711) and having a meltable layer (714) on its exposed face, wherein said first and second FCLs (760) and (770) are configured to have similar or matching edges; inserting said reinforcement FCL (700) between said first FCL (760) and said second FCL (770), so that said meltable layer (714) is juxtaposed with both of said meltable layers (704) and (705), and so that said similar or matching edges are aligned; directing a laser beam at weld locations (797), (798), and (799), said laser having a wavelength between 900 nm and 1100 nm, a power of between 85 and 95 watts per 15 square millimeters, and a beam width of about 3 mm, and simultaneously applying a pressure of between 100 and 1,000 kilopascals (kPa), wherein said weld locations comprise an absorption modifier (163); moving said laser beam along the aligned edges at a speed of between 35 and 45 centimeters/second (cm/sec) and a dwell time of between 5 and 180 seconds; melting said meltable layers (704), (705), and (714) at each of said weld locations (797), (798), and (799); and cooling to form a reinforced seam comprising continuous welds (731), (733), and (735) at weld locations (797), (798), and (799), wherein said weld (731) fuses meltable layers (704) and (714), wherein said weld (733) fuses meltable layers (705) and (714), wherein said weld (735) fuses meltable layers (704) and (705), and wherein said welds (731) and (733) are arranged equidistant or nearly equidistant from said continuous weld (735).

Embodiment 184. The method of embodiment 183, wherein said directing a laser beam at weld locations (797) and (798) is performed simultaneously.

Embodiment 185. The method of embodiment 183 or 184, wherein said absorption modifier (163) is comprised within any of said meltable layers (704), (705), and (714), applied in a layer on the surface of any of said meltable layers (704), (705), and (714), or a combination thereof.

Embodiment 186. The method of any one of embodiments 183 to 185, wherein each of said first FCL (760), said second FCL (770), and said reinforcement FCL (700) comprises a plurality of stacked, unidirectionally oriented Ultra-High Molecular Weight Polyethylene (UHMWPE) fibers in cross-plied monolayers (101) and (102) embedded in a plastic matrix (103).

Embodiment 187. The method of embodiment 186, further comprising aligning the fibers from said cross-plied monolayers (101) and (102) located adjacent to any of said continuous welds (731), (733), and (735) into a relative orientation of between 75 and 90 degrees.

Embodiment 188. The method of embodiment 186, further comprising aligning the fibers from said cross-plied monolayers (101) and (102) located adjacent to any of said continuous welds (731), (733), and (735) into a relative orientation of between 0 and 15 degrees.

Embodiment 189. The method of any one of embodiments 183 to 188, wherein said laser beam is absorbed by said absorption modifier (163) to heat any of said meltable layers (704), (705), and (714) to a temperature that is between 110° C. and 143° C.

Embodiment 190. The method of any one of embodiments 186 to 189, wherein said laser beam is absorbed by said absorption modifier (163) to heat any of said meltable layers (704), (705), and (714) to a temperature that is at least 1° C. below the melting point of said cross-plied monolayers (101) and (102).

Embodiment 191. The method of any one of embodiments 183 to 190, wherein said directing a laser beam is performed at each of said weld locations (797) and (798) simultaneously.

Embodiment 192. The method of any one of embodiments 183 to 191, wherein said reinforced seam has a linear shape.

Embodiment 193. The method of any one of embodiments 183 to 192, further comprising clamping any two of said first FCL (760), said second FCL (770), and said reinforcement FCL (700) in place prior to said applying a laser.

Embodiment 194. The method of any one of embodiments 183 to 193, wherein said reinforced seam has an average tensile strength that is at least 60% of the base tensile strength of the weaker of said first base FCL (760) or said second base FCL (770).

Embodiment 195. A method of forming a reinforced curved seam joining two flexible composite laminates (FCLs), the method comprising the steps of: providing (i) a first FCL (860) having a curved edge (861) and a meltable layer (804) on its inner face, (ii) a second FCL (870) having a curved edge (871) and a meltable layer (805) on its inner face, (iii) a folded third FCL (810) having a curved edge (809) and three or more folded tabs (808), said folded tabs (808) being formed from two or more cuts (832) oriented perpendicular to said curved edge (809) and extending to a midline (811), said tabs (808) being folded along said midline (811) to provide an exposed face (817) having said meltable layer (813), and (iv) a folded fourth FCL (820) having a curved edge (819) and three or more folded tabs (818), said folded tabs (818) being formed from two or more cuts (842) oriented perpendicular to said curved edge (819) and extending to a midline (821), said tabs (818) being folded along said midline (821) to provide an exposed face (827) having a meltable layer (814), and an inner face (826) having said meltable layer (813); inserting said folded third FCL (810) into said folded fourth FCL (820), so that said meltable layer (813) of said folded third FCL (810) is juxtaposed with said meltable layer (813) of said folded fourth FCL (820); joining said folded third FCL (810) to said folded fourth FCL (820) by applying a heat means to a surface, thereby forming a reinforcement FCL (840); aligning said first and second FCLs (860) and (870) along said curved edges (861) and (871); inserting said reinforcement FCL (840) between the aligned said first and second FCLs (860) and (870) so as to align and juxtapose all of said curved edges (861), (871), (809), and (819), juxtapose said meltable layer (814) with each of said meltable layers (804) and (805), and juxtapose said meltable layer (813) with said meltable layer (805), providing an intraseam space (815); directing a laser beam at weld locations (897), (898), and (899), said laser having a wavelength between 900 nm and 1100 nm, a power of between 85 and 95 watts per 15 square millimeters, and a beam width of about 3 mm, and simultaneously applying a pressure of between 100 and 1,000 kilopascals (kPa), wherein said weld locations comprise an absorption modifier (163); moving said laser beam along the aligned curved edges at a speed of between 35 and 45 centimeters/second (cm/sec), and for a time of between 5 and 180 seconds; melting said meltable layers (804), (805), (813), and (814) at locations (897), (898), and (899); and cooling to form a reinforced curved seam comprising continuous welds (831), (833), and (835) at weld locations (897), (898), and (899), wherein the number of cuts (832) and (842) are configured so that each inner edge of said folded tabs (808) and (818) is oriented within 88 and 90 degrees relative to said curved edges (861) and (871) so as to maintain no more than a 6 millimeter (mm) distance between the mid-point of the section of said midline (811, 821) comprising the fold of each of said folded tabs (808, 818) and the corresponding arc representing the true curvature (873, 883) of said midline (811, 821), wherein said weld (831) fuses meltable layers (804) and (814), wherein said weld (833) fuses meltable layers (805), (813), and (814), wherein said weld (835) fuses meltable layers (804) and (805), and wherein said welds (831) and (833) are arranged equidistant or nearly equidistant from said continuous weld (835).

Embodiment 196. The method of embodiment 195, wherein said absorption modifier (163) is comprised within any of said meltable layers (804), (805), (813), and (814), applied in a layer on the surface of any of said meltable layers (804), (805), (813), and (814), or a combination thereof.

Embodiment 197. The method of embodiment 195 or 196, wherein each of said first FCL (860), said second FCL (870), said third FCL (810), and said fourth FCL (820) comprises a plurality of stacked, unidirectionally oriented Ultra-High Molecular Weight Polyethylene (UHMWPE) fibers in cross-plied monolayers (101) and (102) embedded in a plastic matrix (103).

Embodiment 198. The method of embodiment 197, further comprising aligning the fibers from said cross-plied monolayers (101) and (102) adjacent to any of said continuous welds (831), (833), and (835) into a relative orientation of between 75 and 90 degrees.

Embodiment 199. The method of embodiment 197, further comprising aligning the fibers from said cross-plied monolayers (101) and (102) adjacent to any of said continuous welds (831), (833), and (835) into a relative orientation of between 0 and 15 degrees.

Embodiment 200. The method of any one of embodiments 195 to 199, wherein said laser beam is absorbed by said absorption modifier (163) to heat any of said meltable layers (804), (805), (813), and (814) to a temperature that is between 110° C. and 143° C.

Embodiment 201. The method of any one of embodiments 197 to 200, wherein said laser beam is absorbed by said absorption modifier (163) to heat any of said meltable layers (804), (805), (813), and (814) to a temperature that is at least 1° C. below the melting point of said cross-plied monolayers (101) and (102).

Embodiment 202. The method of any one of embodiments 195 to 201, wherein said directing a laser beam is performed at each of weld locations (897) and (898) simultaneously.

Embodiment 203. The method of any one of embodiments 195 to 202, further comprising clamping any two of said first FCL (860), said second FCL (870), and said reinforcement FCL (840) in place prior to said directing a laser beam.

Embodiment 204. The method of any one of embodiments 195 to 203, wherein said reinforced seam has an average tensile strength that is at least 60% of the base tensile strength of the weaker of said first FCL (860) or said second FCL (870).

Embodiment 205. The method of any one of embodiments 195 to 204, wherein said heat means is a heat press, a hot iron, or a combination thereof.

Embodiment 206. The method of embodiment 205, wherein said heat means provides a constant temperature and pressure.

Embodiment 207. The method of embodiment 206, wherein said constant temperature is between 120° C. and 130° C.

Embodiment 208. A method of forming a reinforced curved seam between two flexible composite laminates (FCLs), the method comprising the steps of: providing (i) a first FCL (960) having curved edge (961) and a meltable layer (904) on its inner face, (ii) a second FCL (970) having curved edge (971) and a meltable layer (905) on its inner face, (iii) a folded third FCL (910) having a curved edge (909) and two or more notched gaps (978) oriented perpendicular to said curved edge (909) and extending from said curved edge (909) to a midline (911) to form three or more tabs (908), said third FCL (910) being folded along midline (911) to provide an exposed face (917) having said meltable layer (913), and (iv) a folded fourth FCL (920) having a curved edge (919) and two or more notched gaps (979) oriented perpendicular to said curved edge (919) and extending from said curved edge (919) to a midline (921) to form three or more tabs (918), said fourth FCL (920) being folded along midline (921) to provide an exposed face (927) having a meltable layer (914), and an inner face (926) having said meltable layer (913); inserting said folded third FCL (910) into said folded fourth FCL (920), so that said meltable layer (913) of said folded third FCL (910) is juxtaposed with said meltable layer (913) of said folded fourth FCL (920); joining said folded third FCL (910) to said folded fourth FCL (920) by applying a heat means to a surface, thereby forming a reinforcement FCL (940); aligning said first and second FCLs (960) and (970) along said curved edges (961) and (971); inserting said reinforcement FCL (940) between the aligned said first and second FCLs (960) and (970) so as to align and juxtapose all of said curved edges (961), (971), (909), and (919), juxtapose said meltable layer (914) with each of said meltable layers (904) and (905), and juxtapose said meltable layer (913) with said meltable layer (905), providing an intraseam space (915); directing a laser beam at weld locations (997), (998), and (999), said laser having a wavelength between 900 nm and 1100 nm, a power of between 85 and 95 watts per 15 square millimeters, and a beam width of about 3 mm, and simultaneously applying a pressure of between 100 and 1,000 kilopascals (kPa), wherein said weld locations comprise an absorption modifier (163); moving said laser beam along the aligned curved edges at a speed of between 35 and 45 centimeters/second (cm/sec), and for a time of between 5 and 180 seconds; melting said meltable layers (904), (905), (913), and (914) at locations (997), (998), and (999); and cooling to form a reinforced curved seam comprising continuous welds (931), (933), and (935) at weld locations (997), (998), and (999), wherein the number of notched gaps (978) and (979) are configured so that each inner edge of said folded tabs (908) and (918) is oriented within 88 and 90 degrees relative to said curved edges (961) and (971) so as to maintain no more than a 6 millimeter (mm) distance between the mid-point of the section of said midline (911, 921) comprising the fold of each of said folded tabs (908, 918) and the corresponding arc representing the true curvature (973, 983) of said midline (911, 921), —wherein said weld (931) fuses meltable layers (904) and (914), wherein said weld (933) fuses meltable layers (905), (913), and (914), wherein said weld (935) fuses meltable layers (904) and (905), and wherein said welds (931) and (933) are arranged equidistant or nearly equidistant from said weld (935).

Embodiment 209. The method of embodiment 208, wherein said absorption modifier (163) is comprised within any of said meltable layers (904), (905), (913), and (914), applied in a layer on the surface of any of said meltable layers (904), (905), (913), and (914), or a combination thereof.

Embodiment 210. The method of embodiment 208 or 209, wherein each of said first FCL (960), said second FCL (970), said third FCL (910), and said fourth FCL (920) comprises a plurality of stacked, unidirectionally oriented Ultra-High Molecular Weight Polyethylene (UHMWPE) fibers in cross-plied monolayers (101) and (102) embedded in a plastic matrix (103).

Embodiment 211. The method of embodiment 210, further comprising aligning the fibers from said cross-plied monolayers (101) and (102) adjacent to any of said continuous welds (931), (933), and (935) into a relative orientation of between 75 and 90 degrees.

Embodiment 212. The method of embodiment 211, further comprising aligning the fibers from said cross-plied monolayers (101) and (102) adjacent to any of said continuous welds (931), (933), and (935) into a relative orientation of between 0 and 15 degrees.

Embodiment 213. The method of any one of embodiments 208 to 212, wherein said laser beam is absorbed by said absorption modifier (163) to heat any of said meltable layers (904), (905), (913), and (914) to a temperature that is between 110° C. and 143° C.

Embodiment 214. The method of any one of embodiments 210 to 213, wherein said laser beam is absorbed by said absorption modifier (163) to heat any of said meltable layers (904), (905), (913), and (914) to a temperature that is at least 1° C. below the melting point of said cross-plied monolayers (101) and (102).

Embodiment 215. The method of any one of embodiments 208 to 214, wherein said directing a laser beam is performed at each of weld locations (997) and (998) simultaneously.

Embodiment 216. The method of any one of embodiments 208 to 215, further comprising clamping any two of said first FCL (960), said second FCL (970), and said reinforcement FCL (940) in place prior to said directing a laser beam.

Embodiment 217. The method of any one of embodiments 208 to 216, wherein said reinforced seam has an average tensile strength that is at least 60% of the base tensile strength of the weaker of said first FCL (960) or said second FCL (970).

Embodiment 218. The method of any one of embodiments 208 to 217, wherein said heat means is a heat press, a hot iron, or a combination thereof.

Embodiment 219. The method of embodiment 218, wherein said heat means provides a constant temperature and pressure.

Embodiment 220. The method of embodiment 219, wherein said constant temperature is between 120° C. and 130° C.

EXAMPLES

Example 1: Apparatus for Welding Seams

A custom designed infrared welding apparatus is prepared using a Leister Spot Optic AT with the addition of the Leister Roller Optic. This system is integrated onto the tool tray of an Autometrix Radium CNC cutting table using custom aluminum brackets. Also mounted to the tool tray is a Sono-Tek ALIGN platform, with a Syringe Pump TI liquid delivery system, and an AccuMist ultrasonic nozzle. As such, the welding apparatus comprises an infrared laser light source, a laser transparent down-pressure tool, and a conformable light absorbing backing to distribute weld pressure.

The welding apparatus provides for the precise control of laser energy, weld speed, pressure, and an ability to vary these parameters through a seam path without deleterious differential heating. The welding apparatus also enables precision starting and stopping, acceleration, and velocity mapping to allow for consistent welding through starts, stops, curves and straights, all of which affect dwell. An infrared camera is included, following the weld head in order to monitor and record weld temperature. Further, an IR transparent wheel turns with a weld curve, producing a uniform weld pattern across a weld radius while the elastomeric backing equalizes the pressure.

The standard bed of the CNC table is replaced with a ⅛" thick layer of 60A durometer silicone rubber. The silicone rubber is orange in color and the color of the silicone rubber directly effects the mechanical strength of the weld. Welding is performed on a white sheet of silicone rubber, and the resulting weld is approximately 25% weaker than the orange silicone rubber. Alternatively, a black silicone rubber sheet could be used, but the laser power, temperature and dwell parameters are more difficult to optimize. Darker colored silicone materials tend to absorb too much energy into the silicone itself and therefore have a very short useful life.

The welding apparatus allowed welds to be formed for tensile strength testing and burst testing using a variety of FCL materials and absorption modifiers, and a range of weld formation parameters. The dwell time is affected by the speed of a pressure roller that travels along the seam line. Accordingly, the "weld setting" corresponds to power (wattage) per area, pressure (KPa) and roller speed (cm/sec).

Optimal welding conditions for a new combination of materials begins with a measurement of the inherent laser absorption of the pre-weld layup using an absorption meter that is tuned to the wavelength of the laser source. The inherent absorptivities of the each of the materials for welding are determined and the amount of energy delivered to a seam or other attachment is determined. In practice, additional optimization of the laser energy, weld speed, and pressure is needed.

Example 2: Tensile Strength Tests for Fin Seams

Using the apparatus of Example 2, fin seam welds are prepared by laser welding as shown in FIG. 5A-B. The welded seams are first visually inspected to provide a general assessment of the quality of the weld. For seams exhibiting good weld quality, subsequent tensile testing is performed in order to optimize the wattage and dwell time, leading to increased tensile strengths. Tensile testing is performed on 1-inch by 5-inch rectangular coupon samples having a seam bisecting the longer sides of the sample by using a 100 Series Single Column Electromechanical Universal Test Machine with a 4.4 kN max force. Peel strength is measured according to *ASTM D*3039—*Standard Test Method for Tensile Properties of Polymer Matrix Composite Materials*, ASTM International, West Conshohocken, PA (2017) where the angle of separation is 180 degrees and separation rate is 6 in/min. The free ends of the samples are wrapped around a ⅛" steel rod and then gripped directly above the rod using a Standard Mechanical Vice Action Grip so as to prevent the material from slipping through the grips. Two types of seam testing are performed: 1) shear testing, and 2) peel testing.

The nominal tensile strength of the CT5-HW23-O material is 1350 N/5 cm (154 lb/in) in the warp and 1170 N/5 cm (134 lb/in) in the weft. The tensile strength of seam coupons are compared to un-seamed coupons of material obtained from the same lot of coated FCLs. It is noted that tensile test results that are significantly lower than the base material can result from either excess or inefficient energy delivery to the weld zone. If too little energy is delivered to the weld zone (e.g., as in the case of low power or insufficient dwell time), the thermoplastic polymers do not sufficiently melt and do not completely bond. On the other hand, if too much energy is delivered to the weld zone (e.g., as in the case of high power or prolonged dwell time), the UHMWPE fibers can become damaged and/or the matrix can become embrittled, resulting in lower tested tensile strengths.

When welding two layers of material together, the relative fiber direction and the weld direction have dramatic impacts on the tensile strength of the seam. Three different orientations are tested. The first orientation (FIG. 3A) has the inner fibers (102) aligned parallel with respect to one another and the seam direction (351) is in the same direction as the fibers. The second orientation (FIG. 3A) has the inner fibers (102) aligned parallel with respect to one another and the seam direction (352) is orthogonal to the direction of the fibers. The third orientation (FIG. 3B) has the inner fibers (201) and (102) oriented perpendicular to each other. Five samples for each orientation are assembled and tested at two different weld speeds (2.54 cm/s and 3.81 cm/s) using the optimal CT5HW23-CT5HW23 welding conditions identified in Table 2, where welding is performed employing a laser power of 27 watts and a cylinder pressure of 552 KPa (80 psig). The peel tensile test results for these five samples are provided in Table 2.

TABLE 2

Effect of adjacent cross-plied monolayer fiber orientation and relative seam orientation (FCL CT5HW23)

| Speed (cm/sec) | | Tensile Test Results (N/5 cm) Test 1 | Test 2 | Test 3 | Test 4 | Test 5 | average | std dev | average % |
|---|---|---|---|---|---|---|---|---|---|
| 2.5 | Orientation 1 | 322.2 | 234.7 | 223.3 | 316.1 | 276.7 | 274.6 | 45.3 | 17% |
| | Orientation 2 | 352 | 316.1 | 340.6 | 352.9 | 338 | 339.92 | 14.9 | 4% |
| | Orientation 3 | 369.5 | 306.5 | 265.3 | 260.1 | 293.3 | 298.94 | 43.9 | 15% |
| 3.8 | Orientation 1 | 258.3 | 338 | 303 | 289.8 | 261.8 | 290.18 | 32.7 | 11% |
| | Orientation 2 | 340.6 | 360.7 | 348.5 | 339.7 | 317 | 341.3 | 16.0 | 5% |
| | Orientation 3 | 289.8 | 283.7 | 324.8 | 341.5 | 313.5 | 310.66 | 24.1 | 8% |

The orientation does not have a dependency on weld direction due to the symmetry, so either seam direction (353) or (354) produces the same result. For each of the two different weld speeds tested, welds of Orientation 2 have the highest average strength, with maximum load values 300-350 N/5 cm.

Example 3: Weldable Composite Fabrics

FCLS are welded using the methods of Example 1 and the welds tested for peel tensile strength or shear tensile strength according to Example 2.

Figure 19:
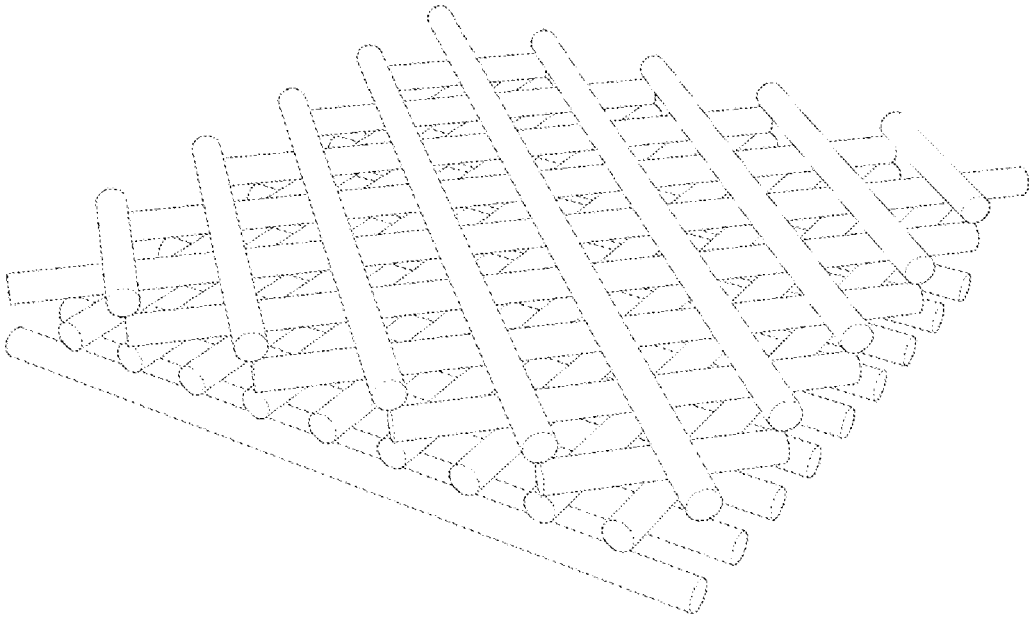
FIG. 19 depicts one possible orientation of fibers in a high bias (HB) FCL, where some fiber layers are offset by 45° relative to the usual 0°-90° fiber layer orientation.

For the FCLs listed in the tables below, "CT5" refers to standard family Dyneema® with a non-linear strength scale of 5, "CT2" refers to standard family Dyneema® with a non-linear strength scale of 2, "CT1" refers to standard family Dyneema® with a non-linear strength scale of 1, "HW23" refers to a weldable Thermoplastic Polyurethane (TPU) coating, "HB" refers to a high bias FCL having fibers offset 45° from the 0°-90° fibers normally present in an FCL (FIG. 19), "K18" refers to mylar, or biaxially-oriented polyester (PET), coating, and "HW37" refers to a weldable Thermoplastic Polyurethane (TPU) coating having an added UV inhibitor.

In Table 3 below, the peel tensile strengths of non-reinforced seams formed from the laser welding of two CT5HW23 fabrics at various laser powers, pressures, and speeds are provided. In all entries, the absorption modifier Clearweld™ formulation B (CW-B) is used, and a standard laser optic having an applied laser beam width of approximately 7 mm is used.

TABLE 3

Welding conditions and peel tensile strength testing results for CT5HW23-CT5HW23 non-reinforced seams

| Entry Number | Laser Power (W) | Pressure (psi) | Speed (in/sec) | Peel Tensile Strength (lbf) |
|---|---|---|---|---|
| 1 | 40 | 17 | 0.5 | 20.4 |
| 2 | 40 | 17 | 1.0 | 20.6 |
| 3 | 35 | 17 | 1.0 | 28.0 |
| 4 | 35 | 17 | 1.5 | 28.3 |
| 5 | 35 | 17 | 2.0 | 23.3 |
| 6 | 40 | 18 | 0.5 | 25.1 |
| 7 | 40 | 18 | 1.0 | 22.8 |
| 8 | 35 | 18 | 1.0 | 20.2 |
| 9 | 35 | 18 | 1.5 | 19.4 |
| 10 | 35 | 18 | 0.5 | 22.3 |
| 11 | 40 | 19 | 0.5 | 25.4 |
| 12 | 40 | 19 | 1.0 | 21.4 |
| 13 | 35 | 19 | 0.5 | 12.9 |
| 14 | 35 | 19 | 1.0 | 22.9 |

TABLE 3-continued

Welding conditions and peel tensile strength testing results for CT5HW23-CT5HW23 non-reinforced seams

| Entry Number | Laser Power (W) | Pressure (psi) | Speed (in/sec) | Peel Tensile Strength (lbf) |
|---|---|---|---|---|
| 15 | 35 | 19 | 1.5 | 25.4 |
| 16 | 40 | 20 | 0.5 | 27.7 |
| 17 | 40 | 20 | 1.0 | 24.2 |
| 18 | 35 | 20 | 1.0 | 25.0 |
| 19 | 35 | 20 | 1.5 | 21.1 |
| 20 | 35 | 20 | 2.0 | 13.9 |
| 21 | 35 | 21 | 1.0 | 30.0 |
| 22 | 35 | 21 | 1.5 | 24.2 |
| 23 | 40 | 22 | 0.5 | 28.9 |
| 24 | 40 | 22 | 1.0 | 20.3 |
| 25 | 35 | 22 | 1.0 | 29.0 |
| 26 | 35 | 22 | 1.5 | 29.5 |
| 27 | 35 | 23 | 1.0 | 33.7 |
| 28 | 35 | 23 | 1.5 | 27.1 |
| 29 | 40 | 24 | 0.5 | 23.4 |
| 30 | 40 | 24 | 1.0 | 17.3 |
| 31 | 35 | 24 | 1.0 | 33.2 |
| 32 | 35 | 24 | 1.5 | 34.3 |
| 33 | 35 | 25 | 1.0 | 32.5 |
| 34 | 35 | 25 | 1.5 | 33.3 |
| 35 | 40 | 26 | 0.5 | 18.0 |
| 36 | 40 | 26 | 1.0 | 23.6 |
| 37 | 35 | 26 | 1.0 | 32.7 |
| 38 | 35 | 26 | 1.5 | 30.5 |
| 39 | 35 | 27 | 1.0 | 35.6 |
| 40 | 35 | 27 | 1.5 | 31.2 |
| 41 | 40 | 28 | 0.5 | 16.2 |
| 42 | 40 | 28 | 1.0 | 18.1 |
| 43 | 35 | 28 | 1.0 | 30.3 |
| 44 | 35 | 28 | 1.5 | 31.1 |
| 45 | 37 | 28 | 1.5 | 26.3 |
| 46 | 37 | 29 | 1.5 | 38.9 |
| 47 | 35 | 29 | 1.0 | 34.2 |
| 48 | 35 | 29 | 1.5 | 36.6 |
| 49 | 40 | 30 | 0.5 | 11.4 |
| 50 | 37 | 30 | 1.5 | 38.1 |
| 51 | 35 | 30 | 1.0 | 29.8 |
| 52 | 35 | 30 | 1.5 | 34.5 |
| 53 | 37 | 31 | 1.5 | 30.8 |
| 54 | 35 | 31 | 1.5 | 24.0 |
| 55 | 35 | 32 | 1.5 | 29.2 |
| 56 | 35 | 33 | 1.5 | 32.2 |
| 57 | 35 | 34 | 1.0 | 29.8 |
| 58 | 35 | 34 | 1.5 | 30.6 |
| 59 | 35 | 35 | 1.5 | 29.3 |
| 60 | 35 | 35 | 2.0 | 30.8 |
| 61 | 35 | 36 | 1.5 | 24.1 |
| 62 | 35 | 37 | 1.5 | 29.7 |
| 63 | 47 | 38 | 1.5 | 29.7 |
| 64 | 35 | 38 | 1.5 | 27.8 |
| 65 | 35 | 38 | 2.0 | 20.9 |
| 66 | 47 | 39 | 1.5 | 32.8 |
| 67 | 40 | 39 | 1.5 | 33.4 |

TABLE 3-continued

Welding conditions and peel tensile strength testing results for CT5HW23-CT5HW23 non-reinforced seams

| Entry Number | Laser Power (W) | Pressure (psi) | Speed (in/sec) | Peel Tensile Strength (lbf) |
|---|---|---|---|---|
| 68 | 35 | 40 | 1.5 | 28.5 |
| 69 | 40 | 41 | 1.5 | 33.0 |
| 70 | 35 | 41 | 1.5 | 24.4 |
| 71 | 35 | 42 | 1.5 | 28.1 |
| 72 | 35 | 45 | 1.5 | 31.6 |
| 73 | 35 | 46 | 1.5 | 23.0 |
| 74 | 35 | 49 | 1.5 | 25.0 |
| 75 | 35 | 60 | 1.5 | 26.4 |
| 76 | 35 | 70 | 1.5 | 27.4 |

In Table 4 below, the peel tensile strengths of non-reinforced seams formed from the laser welding of two CTJ HW23 fabrics at various laser powers, at a pressure of 40 psi, and at a speed of 1.5 inches/second are provided. In all entries, the absorption modifier CW-B is used, and a standard laser optic having an applied laser beam width of approximately 7 mm is used.

TABLE 4

Welding conditions and peel tensile strength testing results for CT1HW23-CT1HW23 non-reinforced seams

| Entry Number | Laser Power (W) | Pressure (psi) | Speed (in/sec) | Peel Tensile Strength (lbf) |
|---|---|---|---|---|
| 1 | 25 | 40 | 1.5 | 11.4 |
| 2 | 26 | 40 | 1.5 | 12.3 |
| 3 | 27 | 40 | 1.5 | 16.3 |
| 4 | 28 | 40 | 1.5 | 15.6 |
| 5 | 29 | 40 | 1.5 | 16.9 |
| 6 | 30 | 40 | 1.5 | 13.1 |
| 7 | 31 | 40 | 1.5 | 14.4 |

In Table 5 below, the peel tensile strengths of non-reinforced seams formed from the laser welding of one CT1HW23 fabric and one CT1HB fabric at various laser powers, at a pressure of 40 psi, and at a speed of 1.5 inches/second, are provided. In all entries, the absorption modifier CW-B is used, and a standard laser optic having an applied laser beam width of approximately 7 mm is used.

TABLE 5

Welding conditions and peel tensile strength testing results for CT1HW23-CT1HB non-reinforced seams

| Entry Number | Laser Power (W) | Pressure (psi) | Speed (in/sec) | Peel Tensile Strength (lbf) |
|---|---|---|---|---|
| 1 | 28 | 40 | 1.5 | 11.4 |
| 2 | 29 | 40 | 1.5 | 17.0 |
| 3 | 30 | 40 | 1.5 | 14.9 |

In Table 6 below, the peel tensile strengths of non-reinforced seams formed from the laser welding of two CT1HB fabrics at various laser powers, at a pressure of 40 psi, and at a speed of 1.5 inches/second, are provided. In all entries, the absorption modifier CW-B is used, and a standard laser optic having an applied laser beam width of approximately 7 mm is used.

TABLE 6

Welding conditions and peel tensile strength testing results for CT1HB-CT1HB non-reinforced seams

| Entry Number | Laser Power (W) | Pressure (psi) | Speed (in/sec) | Peel Tensile Strength (lbf) |
|---|---|---|---|---|
| 1 | 29 | 40 | 1.5 | 16.7 |
| 2 | 30 | 40 | 1.5 | 17.5 |
| 3 | 31 | 40 | 1.5 | 18.4 |

In Table 7 below, the shear tensile strengths of non-reinforced seams formed from two CT1HW23 fabrics at various laser powers, at a pressure of 40 psi, and at a speed of 1.5 inches/second, are provided. In all entries, the absorption modifier CW-B is used, and a standard laser optic having an applied laser beam width of approximately 7 mm is used.

TABLE 7

Welding conditions and shear tensile strength testing results for CT1HW23-CT1HW23 non-reinforced seams

| Entry Number | Laser Power (W) | Pressure (psi) | Speed (in/sec) | Shear Tensile Strength, Max Load (lbf) |
|---|---|---|---|---|
| 1 | 15 | 40 | 1.5 | 39.8 |
| 2 | 20 | 40 | 1.5 | 52.5 |
| 3 | 25 | 40 | 1.5 | 46.2 |
| 4 | 30 | 40 | 1.5 | 50.3 |
| 5 | 35 | 40 | 1.5 | 49.2 |

In Table 8 below, the shear tensile strengths of non-reinforced seams formed from one CT1HW23 fabric and one CTH1B fabric at various laser powers, at a pressure of 40 psi, and at a speed of 4 inches/second, are provided. In all entries, the absorption modifier CW-B is used, and a standard laser optic having an applied laser beam width of approximately 7 mm is used.

TABLE 8

Welding conditions and shear tensile strength testing results for CT1HW23-CT1HB non-reinforced seams

| Entry Number | Laser Power (W) | Pressure (psi) | Speed (in/sec) | Shear Tensile Strength, Max Load (lbf) |
|---|---|---|---|---|
| 1 | 17 | 40 | 4 | 30.0 |
| 2 | 18 | 40 | 4 | 31.2 |
| 3 | 19 | 40 | 4 | 37.6 |
| 4 | 20 | 40 | 4 | 36.2 |
| 5 | 21 | 40 | 4 | 45.6 |
| 6 | 22 | 40 | 4 | 48.3 |
| 7 | 23 | 40 | 4 | 39.3 |
| 8 | 24 | 40 | 4 | 38.4 |

In Table 9 below, the shear tensile strengths of non-reinforced seams formed from two CTH1B fabrics at various laser powers, at a pressure of 40 psi, and at a speed of 4 inches/second, are provided. In all entries, the absorption modifier CW-B is used, and a standard laser optic having an applied laser beam width of approximately 7 mm is used.

TABLE 9

Welding conditions and shear tensile strength testing results for CT1HB -CT1HB non-reinforced seams

| Entry Number | Laser Power (W) | Pressure (psi) | Speed (in/sec) | Shear Tensile Strength, Max Load (lbf) |
|---|---|---|---|---|
| 1 | 18 | 40 | 4 | 37.9 |
| 2 | 19 | 40 | 4 | 34.0 |
| 3 | 20 | 40 | 4 | 30.5 |
| 4 | 21 | 40 | 4 | 41.8 |
| 5 | 22 | 40 | 4 | 41.6 |
| 6 | 23 | 40 | 4 | 39.8 |
| 7 | 24 | 40 | 4 | 35.6 |
| 8 | 25 | 40 | 4 | 45.8 |
| 9 | 26 | 40 | 4 | 38.6 |
| 10 | 27 | 40 | 4 | 37.7 |
| 11 | 28 | 40 | 4 | 36.3 |

In Table 10 below, the shear tensile strengths of non-reinforced seams formed from one CT5HW37 fabric and one CTtK18 fabc at various laser powers, at a pressure of 40 psi, and at a speed of 1.5 inches/second, are provided. In all entries, the absorption modifier CW-B is used, and a standard laser optic having an applied laser beam width of approximately 7 mm is used.

TABLE 10

Welding conditions and shear tensile strength testing results for CT5HW37 -CT5K18 non-reinforced seams

| Entry Number | Laser Power (W) | Pressure (psi) | Speed (in/sec) | Shear Tensile Strength, Max Load (lbf) |
|---|---|---|---|---|
| 1 | 12 | 40 | 1.5 | 57.1 |
| 2 | 14 | 40 | 1.5 | 59.5 |
| 3 | 16 | 40 | 1.5 | 76.8 |
| 4 | 17 | 40 | 1.5 | 80.4 |
| 5 | 18 | 40 | 1.5 | 78.6 |
| 6 | 19 | 40 | 1.5 | 75.5 |
| 7 | 20 | 40 | 1.5 | 78.5 |
| 8 | 22 | 40 | 1.5 | 72.8 |
| 9 | 24 | 40 | 1.5 | 71.0 |
| 10 | 26 | 40 | 1.5 | 66.5 |
| 11 | 28 | 40 | 1.5 | 66.8 |
| 12 | 30 | 40 | 1.5 | 51.7 |
| 13 | 32 | 40 | 1.5 | 37.5 |
| 14 | 34 | 40 | 1.5 | 67.6 |
| 15 | 36 | 40 | 1.5 | 56.3 |
| 16 | 38 | 40 | 1.5 | 55.9 |
| 17 | 40 | 40 | 1.5 | 35.7 |
| 18 | 42 | 40 | 1.5 | 60.3 |
| 19 | 44 | 40 | 1.5 | 46.1 |
| 20 | 46 | 40 | 1.5 | 29.5 |
| 21 | 48 | 40 | 1.5 | 51.8 |
| 22 | 50 | 40 | 1.5 | 44.0 |

In Table 11 below, the shear tensile strengths of non-reinforced seams formed from two CTK18 fabrics at various laser powers and speeds, and at a pressure of 40 psi, are provided. In all entries, the absorption modifier CW-B is used, and a modified laser optic having an applied laser beam width of approximately 3 mm is used.

TABLE 11

Welding conditions and shear tensile strength testing results for CT2K18 -CT2K18 non-reinforced seams

| Entry Number | Laser Power (W) | Pressure (psi) | Speed (in/sec) | Shear Tensile Strength, Max Load (lbf) |
|---|---|---|---|---|
| 1 | 86 | 40 | 17 | 30.6 |
| 2 | 87 | 40 | 13 | 24.7 |
| 3 | 88 | 40 | 17 | 40.5 |
| 4 | 89 | 40 | 17 | 33.6 |
| 5 | 90 | 40 | 10 | 19.2 |
| 6 | 90 | 40 | 11 | 24.1 |
| 7 | 90 | 40 | 12 | 31.5 |
| 8 | 90 | 40 | 13 | 30.5 |
| 9 | 90 | 40 | 14 | 29.0 |
| 10 | 90 | 40 | 15 | 34.0 |
| 11 | 90 | 40 | 16 | 41.7 |
| 12 | 90 | 40 | 17 | 33.0 |
| 13 | 90 | 40 | 18 | 37.9 |
| 14 | 90 | 40 | 19 | 26.6 |
| 15 | 90 | 40 | 20 | 33.5 |
| 16 | 92 | 40 | 15 | 43.5 |

Example 4: IR Temperature Monitoring During Welding

During welding, the temperature of the weld zone is monitored by a FLIR C3 IR camera providing an estimation of the temperature at and near to the weld zone. The IR camera allows the temperature of a weld zone to be monitored by thermal imaging. In combination with visual and tactile monitoring, thermal imaging aids in making appropriate welding parameter choices. The thermal imaging of two example FCL materials is tested. The observed weld temperature range for each of the tested FCL materials is provided in Table 12.

TABLE 12

Observed welding melt temperatures

| FCL Type | Melt Temperature | FCL Description |
|---|---|---|
| CT5-HW23-O to CT5-HW23-O | 125° C.-127° C. | Thermoplastic Urethane (TPU) on both sides of the FCL; Orange |
| CT5 K.18/W23 to CT5-HW23-O | 125° C.-127° C. | TPU on one side of the FCL; polyester on the other side of the FCL; Grey |

Example 5: Characterization of Welds

Throughout the welding optimization process, welds are visually inspected. In general, if too little energy is delivered to a weld area, insufficient heat will be present to melt the weldable layers of the FCLs. Conversely, if too much energy is delivered, the core UHMWPE fibers become damaged and the resulting structure has decreased performance.

For all laser-welded seams, a weak, ineffective weld is identified by five key visual indicators. First, if the measured thickness of the weld width is less than 90% of the width of the weld roller by visual analysis, the weld is inefficient and likely resulted from insufficient energy delivery. Second, if the absorbent path is not continuous by visual analysis, the resulting weld is severely weakened at the point of discontinuity. Thus, a visually observed discontinuity anywhere on a weld path anywhere is indicative of a weak weld. Third, a visually observed visible or tactile ripple at any location on the weld path is indicative of a weak weld. Fourth, a visually observed rippled look and narrowing of the weld path is indicative of a weak weld, likely arising from an excess of delivered energy. Fifth, the visual observation of any bubbling, discoloration, and/or material separation is indicative of a weak weld and likely arose from overheating.

Table 13 shows how these negative weld characteristics affect the burst pressure of an inflatable body.

TABLE 13

Visible weld non-conformances and their relative impact to burst pressure

| Negative Weld Characteristic | Percentage of Original Strength |
|---|---|
| <90% width of weld roller | 80-90% |
| Discontinuous weld path | 0-15% |
| Visible/Tactile ripple on weld path | 30-50% |
| Overheating (Bubbled, Brittle, Discolored, etc) | 40-50% |

These types of severe damage can be visible by the naked eye or by utilizing microscopy. Scanning electron microscopy (SEM) is used to reveal fine scale indicators of damage. Example images of fiber layers as viewed by SEM are depicted in FIG. 15.

Example 6: Preparation of High Strength, Depth-Specific Welds

Multiple layers of coated FCLs are welded together in a single step by controlling the infrared absorption of each meltable layer and matrix comprising the weld. In this example, the meltable polymer thermoplastic polyurethane (TPU) is used, which is IR transparent and does not contribute to the absorption and heating. Absorption and heating are further controlled by absorption modifier Clearweld™ formulation B which, along with the pigment in the matrix, provides localized heating effects of between 125-127° C. at pre-selected depths in the stacked configuration of coated FCLs. The quantity of the absorption modifier used, the inherent absorption of a base textile material arising from any absorbing pigmentation, the selected wattage, the selected dwell time, and weld backing material used, together allow full control of the weld temperature between multiple TPU layers so as to avoid damage to the UHMWPE fibers and matrix. Welded seams comprising up to 8 layers of the textile materials are prepared using this method.

Below are specific examples of how stacked layups of FCLs can be prepared and welded in a single step. While all of the following examples employ a weld speed of 2.54 cm/sec and 552 KPa (80 psig) cylinder pressure, it is noted that both are adjustable parameters.

In FIG. 6A, two FCL layers (110 and 120) with inherent absorptions of 10%, sandwich a layer of absorption modifier (106) with a prescribed absorption of 10%. Incoming power of 100 watts absorbs 10% through each successive layer, such that 27 watts are absorbed through the layup, with 73 watts exiting into and absorbed by the silicon backing. This power and layup combination damages the silicon backing, which also damages the FCL layup. In FIG. 6B, two FCL layers (110 and 120) with inherent absorptions of 10% each, sandwich a layer of absorption modifier (106) having a pre-selected absorption of 80%. Incoming power of 100 watts absorbs 100% through each FCL layer, and 80% through the absorbent layer, such that 84 watts are absorbed through the layup, with 16 watts exiting into and absorbed by the silicon backing. This power and layup combination damages the FCL layup, but not the silicon backing. In FIG. 6C, two FCL layers (110 and 120) with inherent absorptions of 10%, sandwich a layer of absorption modifier (106) with a pre-selected absorption of 80%. Incoming power of 30 watts absorbs 10% through each FCL layer, and 80% through the absorbent layer, such that 25.1 watts are absorbed through the layup, with 4.9 watts exiting into and absorbed by the silicon backing. This absorbed power level creates a localized heating effect with a weld temperature of 125-127° C. at the interface, thus providing a satisfactory weld. In FIG. 6D, two FCL layers (110 and 120) with inherent absorptions of 10%, sandwich a layer of absorption modifier (106) with a pre-selected absorption of 30%. Incoming power of 30 watts absorbs 10% through each FCL layer, and 30% through the absorbent layer, such that 13 watts are absorbed through the layup, with 17 watts exiting into and absorbed by the silicon backing. This amount of absorbed power creates insufficient localized heating, thus providing an unsatisfactory weld. In FIG. 6E, two FCL layers (110 and 120) with inherent absorptions of 10%, sandwich a layer of absorption modifier (106) with a pre-selected absorption of 40%. Incoming power of 50 watts absorbs 10% through each FCL layer, and 40% through the absorbent layer, such that 26 watts are absorbed through the layup, with 24 watts exiting into and absorbed by the silicon backing. This absorbed power level creates a localized heating effect with a weld temperature of 125-127° C., thus providing a satisfactory weld. In FIG. 7A, four FCL layers (110 and 120), each with inherent absorptions of 10%, sandwich two layers of an absorption modifier (106), the upper absorption modifier (106) having a pre-selected absorption of 20%, and the upper absorption modifier (106) having a pre-selected absorption of 31%. No absorption modifier is included between the top half and bottom half of the layup. Incoming power of 80 watts absorbs 10% through each FCL layer, 20% through the upper absorbent layer, and 31% through the lower absorbent layer, such that 28 watts are absorbed through the top half of the layup, and 23 watts are absorbed through the bottom half of the layup, with 29 watts exiting into and absorbed by the silicon backing. These absorbed power levels create localized heating effects with weld temperatures of 125-127° C. in both of the top and bottom halves of the layup, thus providing satisfactory welds in two desired layers, with no weld occurring between the top half and bottom half of the layup. In FIG. 7A four FCL layers (110 and 120) with inherent absorptions of 10%, sandwich three layers of an absorption modifier (106), the upper absorption modifier (106) having a pre-selected absorption of 20%, the middle absorption modifier (106) having a pre-selected of 31%, and the lower absorption modifier (106) having a pre-selected absorption of 58%. Incoming power of 90 watts absorbs 10% through each FCL layer, 20% through the upper absorbent layer, 31% through the middle absorbent layer, and 58% through the lower absorbent layer such that 25 watts are absorbed through the top portion of the layup, 25 watts are absorbed through the middle section, and 26 watts are absorbed through the bottom half of the layup, with 14 watts exiting into and absorbed by the silicon backing. These absorbed power levels create localized heating effects with weld temperatures of 125-127° C. in all of the upper, middle, and lower sections of the layup, thus providing three satisfactory welds throughout the entire depth of the layup. One skilled in the art will recognize that many different combinations of textile materials, absorption modifiers, incoming power, applied pressure, dwell, and backing material can provide satisfactory welds throughout the entire depth of a layup, including one or more interfaces within a layup which lacks a weld. The quantity of the absorption modifier used, in combination with the selected wattage, dwell time, and backing allows full control of the temperature between TPU layers and avoids damage to the UHMWPE fibers and matrix. Welded seams comprising of up to 8 layers of the textile materials have been prepared using this method. However, this method is applicable to seams comprising any number of layers.

Example 7: Preparation of Reinforced Seams

Reinforcement FCLs (700) are used to reinforce linear seams of composite FCL structures having a meltable layer on a single side. For each example, a reinforcement FCL (700) is placed on a first FCL (760) comprising an absorption modifier (163) at the section of attachment as shown in FIG. 9A. The reinforcement FCL (700) is heat-tacked to the first FCL (760) by heating with a hot iron at 240 degrees Fahrenheit for 3 seconds with 10 pounds of force. A second layer of absorption modifier (163) is applied to a different section of FCL (760), as also shown in FIG. 9B. A second FCL (770) is stacked on top of the side of the first FCL (760) comprising the reinforcement FCL (700). Subsequently, the two FCLs are laser-welded together at locations (798) and (799), thereby forming a fin seam (750) comprising a weld (735) as well as two reinforcement welds (731) and (733) on either side of the fin seam (750) as shown in FIG. 9C. A small intra-seam space (715) allows the seam reinforcement to actuate into its deployed position as shown in FIG. 9D.

Curved reinforcement FCLs (840) are used to reinforce curved seams of composite FCL structures having a meltable layer on a single side. For each example, a curved reinforcement FCL (840) is formed from an outer layer of CT5-HW23-0 and an inner layer of CT5 K.18/W23. The two component pieces are cut, folded, and then heat-bonded together in the orientation shown in FIG. 10D and FIG. 11D. Heat-bonding is accomplished by using a swing arm heat press at 129° C. and a pressure of 70 kPa for one minute and 45 seconds. The curved reinforcement FCL (840) is then placed on a first FCL (760) comprising an absorption modifier (63) at the section of attachment, and a second layer of absorption modifier (163) is applied to a different section of FCL (860). The curved reinforcement FCL (840) is heat-fused to a first FCL (860) by heating with a hot iron at 240 degrees Fahrenheit for 3 seconds with 10 pounds of force. A second FCL (870) is then stacked on top of the side of the first FCL (860) comprising the reinforcement FCL (840) as shown in FIG. 12B, and then laser-welded at locations (898) and (899), thereby forming a fin seam (850) comprising a weld (835) as well as two reinforcement welds (831) and (833) on either side of the fin seam (850) as shown in FIG. 12C.

Tensile test results for reinforced linear fin seams of Example 4 are provided below in Table 14, and tensile test results for reinforced curved seams of Example 4 are provided below in Table 15. For all results provided in Tables 14 and 15, a pressure of 35 psi is employed during laser welding.

TABLE 14

Welding conditions and shear tensile strength testing results for linear reinforced seams

| Entry Number | FCL 1 | FCL2 | Laser Power (W) | Speed (in/sec) | Upper Weld (731), Absorbant | Upper Weld (731), max load (lbf) | Lower Weld (733), Absorbant | Lower Weld (733), max load (lbf) |
|---|---|---|---|---|---|---|---|---|
| 1 | CT5HW23 | CT5HK18 | 20 | 1 | CW-C | 93.8 | CW-C | 80.9 |
| 2 | CT5HW23 | CT5HK18 | 20.5 | 1 | CW-C | 102.4 | CW-C | 88.0 |
| 3 | CT5HW23 | CT5HK18 | 21 | 1 | CW-C | 82.9 | CW-C | 98.2 |
| 4 | CT5HW23 | CT5HK18 | 21 | 1 | CW-B | 118.2 | CW-B | 108.2 |
| 5 | CT5HW23 | CT5HK18 | 21 | 1 | CW-F | 116.7 | CW-F | 88.9 |
| 6 | CT5HW23 | CT5HK18 | 22 | 1 | CW-B | 96.9 | CW-B | 94.0 |
| 7 | CT5HW23 | CT5HK18 | 22.5 | 1 | CW-B | 111.4 | CW-B | 104.2 |
| 8 | CT5HW23 | CT5HK18 | 22.8 | 2 | CW-B | 88.9 | CW-B | 106.5 |
| 9 | CT5HW23 | CT5HK18 | 23 | 1 | CW-B | 97.5 | CW-B | 96.7 |
| 10 | CT5HW23 | CT5HK18 | 23 | 1 | CW-F | 104.1 | CW-F | 113.8 |
| 11 | CT5HW23 | CT5HK18 | 24 | 1 | CW-B | 91.3 | CW-C | 84.7 |
| 12 | CT5HW23 | CT5HK18 | 24 | 1 | CW-F | 77.1 | CW-C | 83.0 |
| 13 | CT5HW23 | CT5HK18 | 24 | 1 | CW-B | 75.3 | CW-F | 88.3 |
| 14 | CT5HW23 | CT5HK18 | 24 | 1 | CW-C | 64.7 | CW-C | 68.1 |
| 15 | CT5HW23 | CT5HK18 | 24 | 1 | CW-B | 113.1 | CW-B | 96.2 |
| 16 | CT5HW23 | CT5HK18 | 24 | 1 | CW-F | 98.5 | CW-F | 102.6 |
| 17 | CT5HW23 | CT5HK18 | 27 | 1.5 | CW-B | 114.6 | CW-B | 95.2 |
| 18 | CT5HW23 | CT5HK18 | 29 | 1.5 | CW-B | 122.2 | CW-B | 89.3 |
| 19 | CT5HW23 | CT5HK18 | 32 | 1.5 | CW-B | 127.9 | CW-B | 107.8 |
| 20 | CT5HW23 | CT5HK18 | 33 | 1.5 | CW-B | 82.2 | CW-B | 104.0 |
| 21 | CT5HW23 | CT5HK18 | 34 | 1.5 | CW-B | 93.0 | CW-B | 99.9 |

TABLE 15

Welding conditions and shear tensile strength testing results for curved reinforced seams

| Entry Number | FCL 1 | FCL2 | Laser Power (W) | Speed (in/sec) | Upper Weld (831), Absorbant | Upper Weld (831), max load (lbf) | Lower Weld (833), Absorbant | Lower Weld (833), max load (lbf) |
|---|---|---|---|---|---|---|---|---|
| 1 | CT5HW23 | CT5HW23 | 24 | 1 | CW-B | 113.1 | CW-C | 118.7 |
| 2 | CT5HW23 | CT5HW23 | 30 | 1 | CW-B | 124.9 | CW-C | 120.5 |
| 3 | CT5HW23 | CT5HW23 | 30 | 1 | CW-A | 84.7 | CW-F | 98.1 |

TABLE 15-continued

Welding conditions and shear tensile strength testing results for curved reinforced seams

| Entry Number | FCL 1 | FCL2 | Laser Power (W) | Speed (in/sec) | Upper Weld (831), Absorbant | Upper Weld (831), max load (lbf) | Lower Weld (833), Absorbant | Lower Weld (833), max load (lbf) |
|---|---|---|---|---|---|---|---|---|
| 4 | CT5HW23 | CT5HW23 | 30 | 1 | CW-B | 121.7 | CW-F | 114.7 |
| 5 | CT5HW23 | CT5HW23 | 30 | 1 | CW-B | 105.9 | CW-C | 131.2 |
| 6 | CT5HW23 | CT5HW23 | 31 | 1 | CW-B | 148.5 | CW-F | 149.2 |
| 7 | CT5HW23 | CT5HW23 | 32 | 1 | CW-B | 117.7 | CW-F | 137.9 |
| 8 | CT5HW23 | CT5HW23 | 32 | 1 | CW-B | 109.0 | CW-C | 103.0 |
| 9 | CT5HW23 | CT5HW23 | 33 | 1 | CW-B | 134.3 | CW-C | 123.4 |
| 10 | CT5HW23 | CT5HW23 | 35 | 1 | CW-B | 121.3 | CW-C | 114.1 |

Example 8: Tensile Strength Tests of Reinforced Seams

Average tensile test results for fin seams, linear reinforced seams, and curved reinforced seams formed using welding conditions optimized for each seam type are provided in Tables 2-10, 14, and 15. The average observed tensile strengths for each seam type are also expressed as a percentage of the strength of the parent FCLs comprising the seam in Table 16, demonstrating the increased tensile strength provided to both linear and curved seams by fusion to a reinforcement FCL (700) or a curved reinforcement FCL (840), respectively.

TABLE 16

Seam strength compared to nominal strength base material

| Seam Type | Avg. Tensile Strength (Optimized Settings) | % of Nominal Strength |
|---|---|---|
| Simple fin seam | 256.8 N/5 cm (29.3 lb/in) | 19% |
| Linear reinforced seam | 1,120 N/5 cm (127.9 lb/in) | 83% |
| Curved reinforced seam | 1,147.3 N/5 cm (130.9 lb/in) | 85% |

Example 9: Burst Strength Testing of Reinforced Inflatables

While tensile strength measurements assess the strength of a welded seam along a single axis, inflatables often experience stresses in three dimensions along all three axes. To evaluate the three-dimensional stress of a seamed, inflatable body, burst testing is performed. Burst testing reveals weak seamed areas, which may then be reinforced in an iterative manner using one or more reinforcement FCLs until the test bladder exhibits a "catastrophic failure", where failure occurs in a broad area of the body, and not along a seam or a specific location. As is understood in the art, catastrophic failure will typically show failure in several modes.

Figure 16:
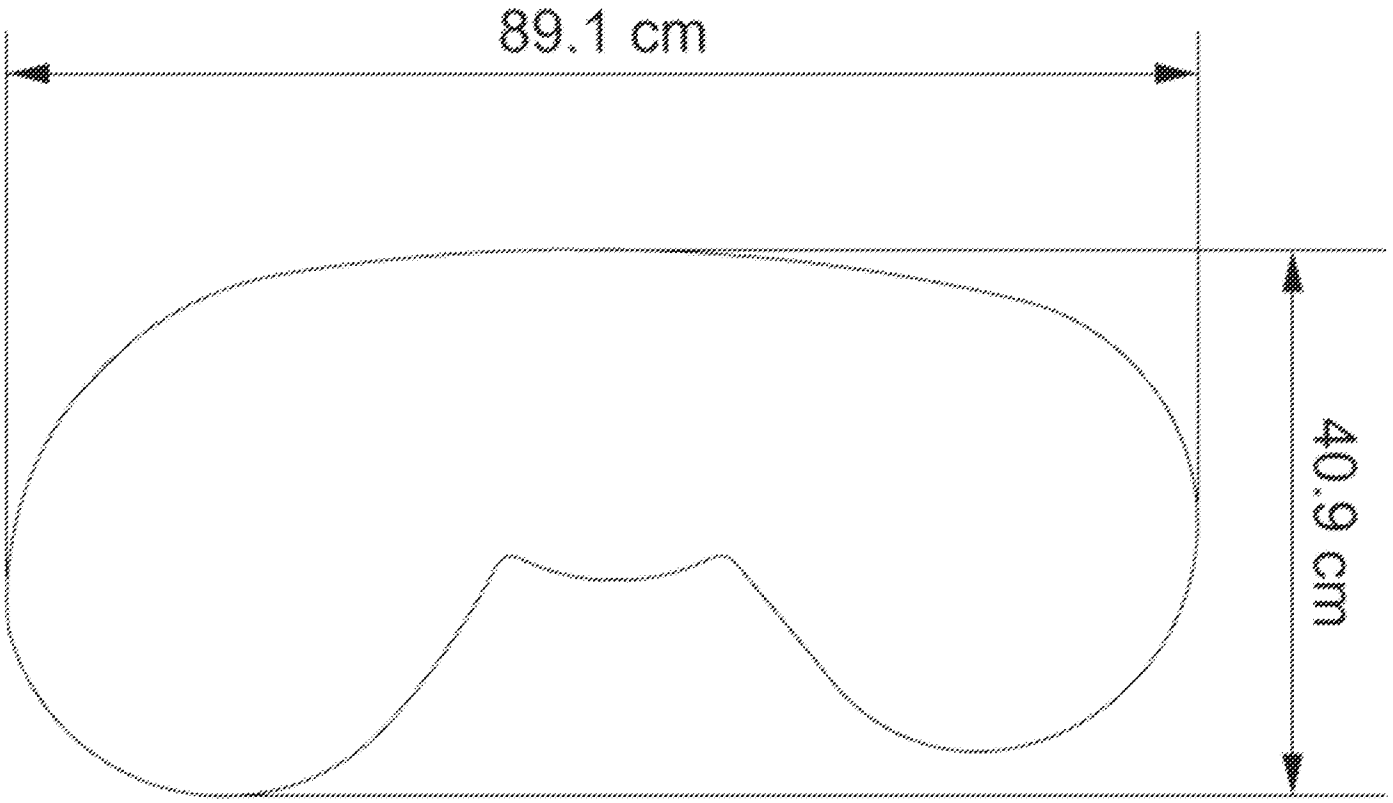
FIG. 16 depicts the shape and dimensions of an example test bladder for use in burst strength testing, in accordance with the present disclosure.

Burst testing is performed on a test bladder having the standard shape and dimensions shown in FIG. 16. The standard shape represents some of the common features and curvatures that are known to be problematic in inflatable life preserver applications. Optimized welding parameters provided in Examples 4 and 7 are used to prepare the seamed areas of the test body. Visual inspection methods as provided in Example 5 are used to determine the origins underlying any seam failure observed during burst testing of the test bladders.

Figure 17:
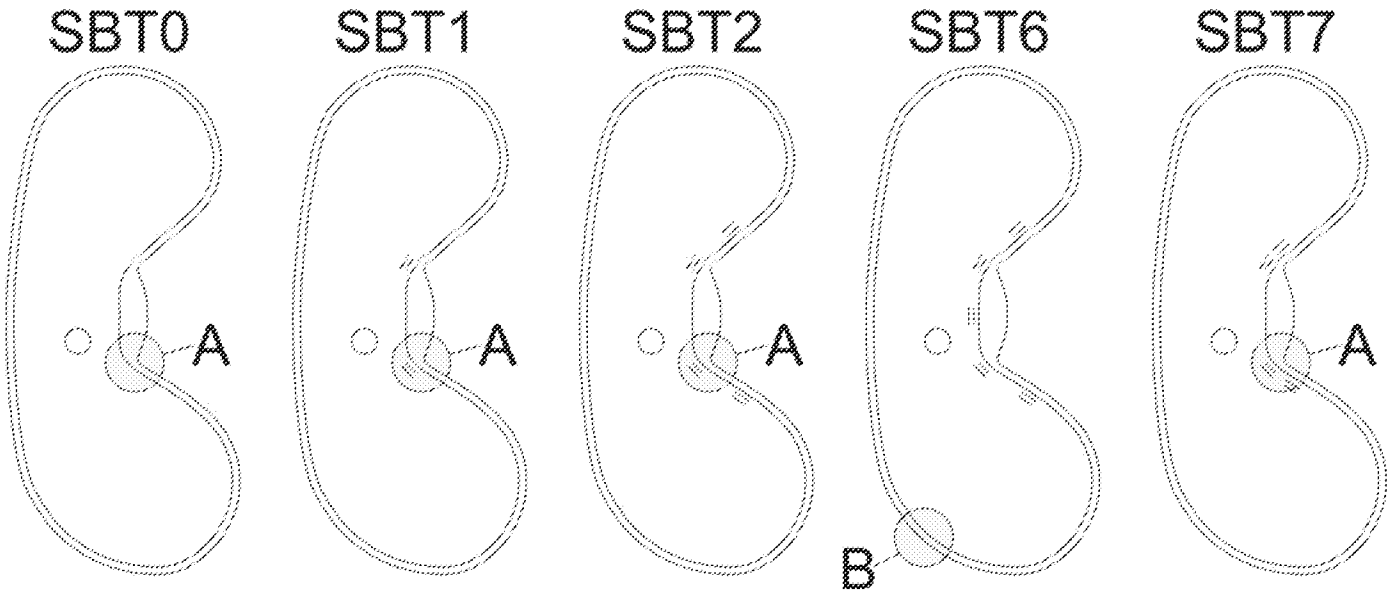
FIG. 17 depicts five non-reinforced ("SBT0") or reinforced ("SBT1" to "SBT7") test bladders, each having the shape and dimensions of the test bladder of FIG. 16, in accordance with the present disclosure. A single reinforcement tab is depicted as one set of double lines. A burst location observed during the burst testing of the test bladders is depicted as a shaded circle marked "A" or "B."

Standard test bladders are inflated at a constant intake rate of 17.2 kPa/min (2.5 psig/min), and the resulting internal pressure is continuously monitored. The pressure at burst is recorded for each inflated test bladder. Additionally, the location(s) and type(s) of failure are recorded. These results are provided in Table 17 and depicted visually in FIG. 17. In FIG. 17, a single reinforcement tab is depicted as one set of double lines, and a burst location is depicted as a shaded circle marked "A" or "B."

TABLE 17

Standard test bladder burst pressure and locations

| Test ID | Number of Tabs | Burst (psi) | Burst Location |
|---|---|---|---|
| SBT0 | 0 | 6 | A |
| SBT1 | 2 | 8.75 | A |
| SBT2 | 4 | 9 | A |
| SBT6 | 5 | 7 | B |
| SBT7 | 4 | 7 | A |

Figure 18:
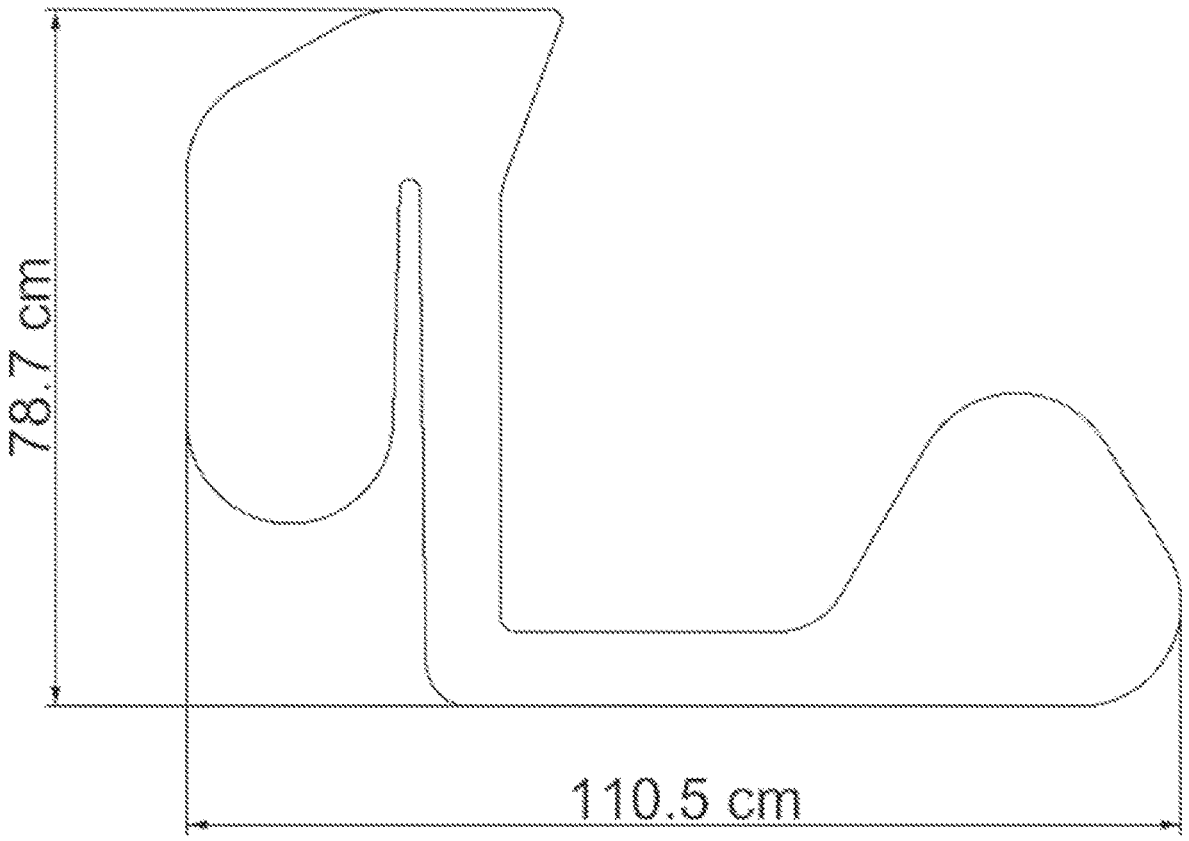
FIG. 18 depicts the shape and dimensions of an example LPU-21 test bladder for use in burst strength testing, in accordance with the present disclosure.

Further testing of seam strength is performed on inflatable bladders for the LPU-21 test system. The general geometry and dimensions of the LPU-21 test system is shown in FIG. 18. Testing is conducted on 6 LPU-21 bladders having no reinforcements as well as 6 LPU-21 bladders that are fully reinforced. A fully reinforced LPU-21 bladder is depicted in FIG. 14, and results for the burst tests are provided in Table 18. As shown in Table 18, LPU-21 bladders lacking any reinforcement have an average burst pressure that is 50% lower than the average burst pressure of the reinforced version. Also, a larger variance in absolute burst pressure is observed for non-reinforced LPU-21 bladders relative to their reinforced counterparts.

TABLE 18

LPU-21 unreinforced vs reinforced burst pressures

| Description | Burst Pressure (Average) | Burst Pressure (Range) |
|---|---|---|
| LPU-21 (no reinforcements) | 41.4 kPa (6 psig) | 25.6-48.3 kPa (4-7 psig) |
| LPU-2.1 (with reinforcements) | 82.7 kPa (12 psig) | 75.8-89.6 kPa (11-13 psig) |

While the present disclosure has been described with reference to particular embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the scope of the present disclosure.

Therefore, it is intended that the present disclosure not be limited to the particular embodiments disclosed as the best mode contemplated for carrying out the present disclosure, but that the present disclosure will include all embodiments falling within the scope and spirit of the appended claims.

We claim:

1. A laser-welded reinforced seam joining two flexible composite laminates (FCLs) comprising:

three continuous welds between a first FCL (760), a second FCL (770), and a reinforcement FCL (700), and arranged to form an intraseam space (715) comprising a continuous first weld (731) comprising a homogeneous, fused monolayer (706) formed from a meltable layer (714) of reinforcement FCL (700) and a meltable layer (704) of the first FCL (760), a continuous second weld (733) comprising a homogeneous, fused monolayer (707) formed from the meltable layer (714) and a meltable layer (705) of the second FCL (770), and a continuous third weld (735) arranged equidistant or nearly equidistant from the continuous first weld (731) and the continuous second weld (733) comprising a homogeneous, fused monolayer (706) formed from the meltable layers (704 and 705), the continuous first weld (731), the continuous second weld (733), the continuous third weld (735), the first FCL (760), the second FCL (770), and the reinforcement FCL (700) arranged to form the intraseam space (715), wherein the meltable layer (704) is located on the inner face of the first FCL (760);

the meltable layer (705) is located on the inner face of the second FCL (770);

the meltable layer (714) is located on the outer face of the reinforcement FCL (700), the reinforcement FCL (700) being folded along a midline (711); and each of the reinforcement FCL (700), the first FCL (760), and the second FCL (770) comprises a plurality of stacked, unidirectionally oriented medium or high density polyethylene fibers arranged in cross-plied monolayers (201 and 202) and embedded in a plastic matrix (103), wherein the relative orientation of each pair of the plurality of unidirectionally oriented medium or high density polyethylene fibers within the cross-plied monolayers (201 and 202) that are located adjacent to each of the fused monolayers (706 and 707) is parallel or has an oblique angle of no more than 15 degrees.

2. The laser-welded reinforced seam of claim 1, wherein the unidirectionally oriented medium or high density polyethylene fibers are selected from the group consisting of Ultra-High Molecular Weight Polyethylene (UHMWPE), High Density Polyethylene (HDPE) fibers, Medium-Density Polyethylene (MDPE) fibers, and Cross-Linked Polyethylene (PEX) fibers.

3. The laser-welded reinforced seam of claim 1, wherein the laser-welded reinforced seam has an average tensile strength that is at least 80% of a base tensile strength of the weaker of the first FCL (760) or the second FCL (770).

4. The laser-welded reinforced seam of claim 3, wherein the average tensile strength is selected from the group consisting of an average shear tensile strength and an average peel tensile strength.

5. The laser-welded reinforced seam of claim 3, wherein the laser-welded reinforced seam has an average burst pressure of greater than 75 kilopascals (kPa) as measured using a test bladder (500) having a kidney shape with overall dimensions of 40.9 cm×89.1 centimeters (cm).

6. A reinforced curved seam joining two flexible composite laminates (FCLs) comprising:

three continuous welds between a first FCL (860), a second FCL (870), and a reinforcement FCL (840), and arranged to form an intraseam space (815) comprising a continuous first weld (831) comprising a homogeneous, fused monolayer (806) formed from a meltable layer (814) of the reinforcement FCL (840) and a meltable layer (804) of the first FCL (860), a continuous second weld (833) comprising a homogeneous, fused monolayer (807) formed from the meltable layer (814) of the reinforcement FCL (840), a meltable layer (813) of the reinforcement FCL (840), and a meltable layer (805) of the second FCL (870), and a continuous third weld (835) arranged equidistant or nearly equidistant from the continuous first weld (831) and the continuous second weld (833) comprising a homogeneous, fused monolayer (806) formed from the meltable layers (804 and 805), the continuous first weld (831), the continuous second weld (833), the continuous third weld (835), the first FCL (860), the second FCL (870), and the reinforcement FCL (840) arranged to form the intraseam space (815), wherein the first FCL (860) has a curved edge (861) and the meltable layer (804) on its inner face;

the second FCL (870) has a curved edge (871) and the meltable layer (805) on its inner face;

the reinforcement FCL (840) comprises a folded third FCL (810) comprising a curved edge (809) and three or more folded tabs (808), the folded tabs (808) being formed from two or more cuts (832) oriented perpendicular to the curved edge (809) and extending to a midline (811), the tabs (808) being folded along the midline (811) to provide an exposed face (817) having the meltable layer (813), and a folded fourth FCL (820) comprising a curved edge (819) and three or more folded tabs (818), the folded tabs (818) being formed from two or more cuts (842) oriented perpendicular to the curved edge (819) and extending to a midline (821) to provide an exposed face (827) having the meltable layer (814), and an inner face (826) having the meltable layer (813), wherein the meltable layer (813) of the folded third FCL (810) is joined to the meltable layer (813) of the folded fourth FCL (820) by providing a heat means to a surface;

each of the third folded FCL (810), the fourth folded FCL (820), the first FCL (860), and the second FCL (870) comprises a plurality of stacked, unidirectionally oriented medium or high density polyethylene fibers arranged in cross-plied monolayers (201 and 202) and embedded in a plastic matrix (103);

the curved edges (861, 871, 809, and 819) are aligned and juxtaposed; and the number of cuts (832 and 842) are configured so that each inner edge of the folded tabs (808 and 818) is oriented within 88 and 90 degrees relative to the curved edges (861 and 871) so as to maintain no more than a 6 millimeter (mm) distance between the mid-point of the section of the midline (811 and 821) comprising the fold of each of the folded tabs (808 and 818) and a corresponding arc representing a true curvature (873 and 883) of the midline (811 and 821).

7. The reinforced curved seam of claim 6, wherein the relative orientation of each pair of the plurality of unidirectionally oriented medium or high density polyethylene fibers in the cross-plied monolayers (201 and 202) that are located adjacent to each of the continuous first weld (831), the continuous second weld (833), and the continuous third weld (835) is perpendicular or has an oblique angle of no less than 75 degrees.

8. The reinforced curved seam of claim 6, wherein the relative orientation of each pair of the plurality of unidirectionally oriented medium or high density polyethylene fibers in the cross-plied monolayers (201 and 202) that are located adjacent to each of the continuous first weld (831), the continuous second weld (833), and the continuous third weld (835) is parallel or has an oblique angle of no more than 15 degrees.

9. The reinforced curved seam of claim 6, wherein a distance between the continuous first weld (831) and the continuous third weld (835) is at least 90% of a distance between the continuous second weld (833) and the continuous third weld (835).

10. The reinforced curved seam of claim 6, wherein the unidirectionally oriented medium or high density polyethylene fibers are selected from the group consisting of Ultra-High Molecular Weight Polyethylene (UHMWPE), High Density Polyethylene (HDPE) fibers, Medium-Density Polyethylene (MDPE) fibers, and Cross-Linked Polyethylene (PEX) fibers.

11. The reinforced curved seam of claim 6, wherein a melting temperature of each of the meltable layers (804, 805, 813, and 814) is less than 95% of a melting temperature of the unidirectionally oriented medium or high density polyethylene fibers arranged in cross-plied monolayers (201 and 202).

12. The reinforced curved seam of claim 6, wherein the reinforced seam has an average tensile strength that is at least 80% of a base tensile strength of the weaker of the first FCL (860) and the second FCL 870).

13. A reinforced curved seam joining two flexible composite laminates (FCLs) comprising:

three continuous welds between a first FCL (960), a second FCL (970), and a reinforcement FCL (940), and arranged to form an intraseam space (915) comprising a continuous first weld (931) comprising a homogeneous, fused monolayer (906) formed from a meltable layer (914) of the reinforcement FCL (940) and a meltable layer (904) of the first FCL (960), a continuous second weld (933) comprising a homogeneous, fused monolayer (907) formed from the meltable layer (914) of the reinforcement FCL (940), a meltable layer (913) of the reinforcement FCL (940), and a meltable layer (905) of the second FCL (970), and a continuous third weld (935) arranged equidistant or nearly equidistant from the continuous first weld (931) and the continuous second weld (933) comprising a homogeneous, fused monolayer (906) formed from the meltable layers (904 and 905), the continuous first weld (931), the continuous second weld (933), the continuous third weld (935), the first FCL (960), the second FCL (970), and the reinforcement FCL (940) arranged to form the intraseam space (915), wherein the first FCL (960) has a curved edge (961) and the meltable layer (904) on its inner face;

the second FCL (970) has a curved edge (971) and the meltable layer (905) on its inner face;

the reinforcement FCL (940) comprises a folded third FCL (910) comprising two or more notched gaps (978) oriented perpendicular to a curved edge (909) and extending from the curved edge (909) to a midline (911) to form three or more tabs (908), the folded third FCL (910) being folded along the midline (911) to provide an exposed face (917) having the meltable layer (913), and a folded fourth FCL (920) comprising two or more notched gaps (979) oriented perpendicular to a curved edge (919) and extending from the curved edge (919) to a midline (921) to form three or more tabs (918), the folded fourth FCL (920) being folded along the midline (921) to provide an exposed face (927) having the meltable layer (914), and an inner face (926) having the meltable layer (913), wherein the meltable layer (913) of the folded third FCL (910) is joined to the meltable layer (913) of the folded fourth FCL (920) by providing a heat means to a surface;

each of the folded third FCL (910), the folded fourth FCL (920), the first FCL (960), and the second FCL (970) comprises a plurality of stacked, unidirectionally oriented medium or high density polyethylene fibers arranged in cross-plied monolayers (201 and 202) and embedded in a plastic matrix (103);

the curved edges (961, 971, 909, and 919) are aligned and juxtaposed; and the notched gaps (978 and 979) are configured so that each inner edge of the folded tabs (908 and 918) is oriented within 88 and 90 degrees relative to the curved edges (961 and 971) so as to maintain no more than a 6 millimeter (mm) distance between the mid-point of the section of the midline (911 and 921) comprising the fold of each of the folded tabs (908 and 918) and a corresponding arc representing a true curvature (973 and 983) of the midline (911 and 921).

14. The reinforced curved seam of claim 13, wherein the relative orientation of each pair of the plurality of unidirectionally oriented medium or high density polyethylene fibers in the cross-plied monolayers (201 and 202) that are located adjacent to each of the continuous first weld (931), the continuous second weld (933), and the continuous third weld (935) is perpendicular or has an oblique angle of no less than 75 degrees.

15. The reinforced curved seam of claim 13, wherein the relative orientation of each pair of the plurality of unidirectionally oriented medium or high density polyethylene fibers in the cross-plied monolayers (201 and 202) that are located adjacent to each of the continuous first weld (931), the continuous second weld (933), and the continuous third weld (935) is parallel or has an oblique angle of no more than 15 degrees.

16. The reinforced curved seam of claim 13, wherein the unidirectionally oriented medium or high density polyethylene fibers are selected from the group consisting of Ultra-High Molecular Weight Polyethylene (UHMWPE), High Density Polyethylene (HDPE) fibers, Medium-Density Polyethylene (MDPE) fibers, and Cross-Linked Polyethylene (PEX) fibers.

17. The reinforced curved seam of claim 13, wherein a distance between the continuous first weld (931) and the continuous third weld (935) is at least 90% of a distance between the continuous second weld (933) and the continuous third weld (935).

18. The reinforced curved seam of claim 13, wherein a melting temperature of each of the meltable layers (904, 905, 913, and 914) is less than 95% of a melting temperature of the unidirectionally oriented medium or high density polyethylene fibers arranged in cross-plied monolayers (201 and 202).

19. The reinforced curved seam of claim 13, wherein the reinforced seam has an average tensile strength that is at least 80% of a base tensile strength of the weaker of the first FCL (960) and the second FCL (970).

* * * * *